US007004517B2

(12) United States Patent
Vitry et al.

(10) Patent No.: US 7,004,517 B2
(45) Date of Patent: Feb. 28, 2006

(54) LATCHING DEVICE

(75) Inventors: Fabrice Vitry, Worcester (GB); Ana Pinto, Droitwich (GB); Ivica Sekulovic, Worcester (GB)

(73) Assignee: Southco, Inc., Concordville, PA (US)

( * ) Notice: Subject to any disclaimer, the term of this patent is extended or adjusted under 35 U.S.C. 154(b) by 24 days.

(21) Appl. No.: 10/001,479

(22) Filed: Nov. 1, 2001

(65) Prior Publication Data

US 2003/0025339 A1 Feb. 6, 2003

Related U.S. Application Data

(60) Provisional application No. 60/245,089, filed on Nov. 1, 2000, provisional application No. 60/254,605, filed on Dec. 10, 2000, provisional application No. 60/273,944, filed on Mar. 7, 2001, provisional application No. 60/318,839, filed on Sep. 13, 2001, provisional application No. 60/312,677, filed on Aug. 15, 2001.

(51) Int. Cl.
*E05C 3/02* (2006.01)

(52) U.S. Cl. ..... 292/213; 292/144; 292/201; 292/216; 292/224; 292/341.16; 70/275; 296/37.12

(58) Field of Classification Search ..... 292/201, 292/213, 216, DIG. 11, 341.16; 296/37.1, 296/56, 146.1, 37.12, 37.8; 70/275, 277
See application file for complete search history.

(56) References Cited

U.S. PATENT DOCUMENTS 2,898,138 A * 8/1959 Van Noord ..... 292/122
3,504,511 A * 4/1970 Allen ..... 70/241
3,620,560 A * 11/1971 Peters ..... 292/201
3,664,698 A * 5/1972 Stropkay ..... 292/201
3,713,472 A * 1/1973 Dozois ..... 160/189
3,942,828 A * 3/1976 Bourrie et al. ..... 292/201
4,030,322 A * 6/1977 Pettit ..... 70/159
4,268,076 A * 5/1981 Itoi ..... 292/216
4,518,179 A * 5/1985 Fenner ..... 292/166
4,540,206 A 9/1985 Frame et al.
4,684,167 A * 8/1987 Newmayer ..... 296/202
4,691,948 A * 9/1987 Austin et al. ..... 292/171
4,804,215 A 2/1989 Bisbing
4,815,775 A * 3/1989 Mertin et al. ..... 292/201
4,828,298 A 5/1989 Bisbing
4,830,413 A 5/1989 Bisbing
5,002,322 A * 3/1991 Fukumoto ..... 292/341.16
5,062,559 A * 11/1991 Falcoff ..... 224/311
5,076,622 A 12/1991 Detweiler
5,076,625 A 12/1991 Oxley
5,098,141 A * 3/1992 Bull ..... 292/252
5,213,381 A 5/1993 Anderson
5,234,238 A 8/1993 Takimoto
5,271,649 A 12/1993 Gromotka
5,280,974 A 1/1994 Weintroub
5,429,400 A * 7/1995 Kawaguchi et al. ..... 292/201

(Continued)

*Primary Examiner*—Brian E. Glessner
*Assistant Examiner*—Carlos Lugo
(74) *Attorney, Agent, or Firm*—Paul and Paul

(57) ABSTRACT

The present invention relates to a latching device for securing two panels together such as those of storage structures in which an enclosure is secured by means of a door or panel which will remain in a closed position until released. The present latching system is usually used in connection with automobile glove boxes or other compartments which are to be secured for storage of items therein. The latching device has a housing, actuation means and a pawl in communication with a movable retention means. The latching device can be electrically or manually operated.

21 Claims, 149 Drawing Sheets

U.S. PATENT DOCUMENTS 5,445,422 A 8/1995 Weinerman et al.
5,478,125 A 12/1995 Gromotka
5,498,040 A * 3/1996 Silye ..... 292/201
5,595,407 A * 1/1997 ter Horst et al. ..... 292/5
5,603,535 A 2/1997 Antonucci et al.
5,607,195 A 3/1997 Antonucci
5,626,373 A 5/1997 Chambers et al.
5,630,630 A * 5/1997 Price et al. ..... 292/128
5,667,261 A 9/1997 Weinerman et al.
5,676,003 A * 10/1997 Ursel et al. ..... 70/472
5,742,990 A 4/1998 Antonucci
5,799,517 A * 9/1998 Hattori et al. ..... 70/247
5,823,017 A * 10/1998 Hapke et al. ..... 60/12.26
5,887,466 A * 3/1999 Yoshizawa ..... 70/257
5,904,389 A 5/1999 Vaishnav et al.
5,927,772 A * 7/1999 Antonucci et al. ..... 292/336.3
6,027,148 A * 2/2000 Shoemaker ..... 292/216
6,036,241 A 3/2000 Ostdiek et al.
6,048,006 A 4/2000 Antonucci et al.
6,050,117 A * 4/2000 Weyerstall ..... 70/277
6,059,327 A * 5/2000 Yoshikuwa ..... 292/216
6,076,865 A 6/2000 Sokurenko et al.
6,139,073 A 10/2000 Heffner et al.
6,179,350 B1 1/2001 Ely et al.
6,257,631 B1 7/2001 Sokurenko et al.
6,302,455 B1 10/2001 Huang
6,505,867 B1 * 1/2003 Szablewski et al. ..... 292/201
6,634,684 B1 * 10/2003 Spiessl ..... 292/341.16

* cited by examiner

LATCHING DEVICE

CROSS REFERENCE TO RELATED APPLICATIONS

This application claims priority to U.S. Provisional Application No. 60/245,089, filed Nov. 1, 2000, and U.S. Provisional Application No. 60/254,605 filed Dec. 10, 2000, and U.S. Provisional Application No. 60/273,944, filed Mar. 7, 2001, and U.S. Provisional Application No. 60/318,839, filed Sep. 13, 2001, and U.S. Provisional Application No. 60/312,677 filed Aug. 15, 2001.

BACKGROUND OF THE INVENTION

1. Field of Invention

The present invention relates to the field of latch assemblies.

2. Brief Description of the Related Art

Latch assemblies are relied on in many applications for securing items, such as panels, doors, and doorframes together. For example, containers, cabinets, closets, compartments and the like may be secured with a latch. An important use for latches is in the automotive field, where there is a desire and need to access automotive compartments, such as, for example, the trunk or passenger compartments of vehicles, as well as interior compartments such as a glove box. Various latches for panel closures have been employed where one of the panels such as a swinging door or the like is to be fastened or secured to a stationary panel, doorframe, or compartment body. Although many latch assemblies are known in the prior art, none are seen to teach or suggest the unique features of the present invention or to achieve the advantages of the present invention.

SUMMARY OF THE INVENTION

The present invention relates to a latching system for securing two panels together such as those of storage structures in which an enclosure is secured by means of a door or panel which will remain in a closed position until released. An example of a use of the present latching system is in connection with automobile glove boxes or other compartments which are to be secured for storage of items therein.

DESCRIPTION OF THE DRAWINGS

FIG. 118B is a close-up view of the latch pawl shown in FIG. 118A.

FIG. 119 is a rear perspective view of the fully-assembled glove box door.

FIG. 120 is a left side view of the outer shell of a glove compartment lid or door.

FIG. 121 is a left side view of the outer shell of a glove compartment lid or door showing the latch assembly according to the present invention installed to the outer shell of the door with the latch pawls shown in the closed position.

FIG. 122 is a left side view of the fully-assembled door of a glove compartment having the latch assembly according to the present invention installed thereto, with the latch pawls shown in the closed position.

FIG. 123 is a front perspective view of the outer shell of a glove compartment lid or door.

FIG. 124 is a bottom perspective view of the front of the outer shell of a glove compartment door having the latch assembly according to the present invention installed thereto, with the latch pawls shown in the closed position.

FIG. 125 is a bottom perspective view of the front of the outer shell of a glove compartment door having the latch assembly according to the present invention installed thereto, with the latch pawls shown in the open position.

FIG. 126 is a close-up view of the latch assembly according to the present invention, showing the solenoid assembly and the latch pawl closest to the solenoid in the closed position.

FIG. 127 is a close-up view of the latch assembly according to the present invention, showing the solenoid assembly and the latch pawl closest to the solenoid in the open position.

FIG. 128 is a close-up view of the latch assembly according to the present invention, showing the latch pawl farthest from the solenoid in the open position.

FIG. 129 is a close-up view of the latch assembly according to the present invention, showing the latch pawl farthest from the solenoid in the closed position.

Figure 130:
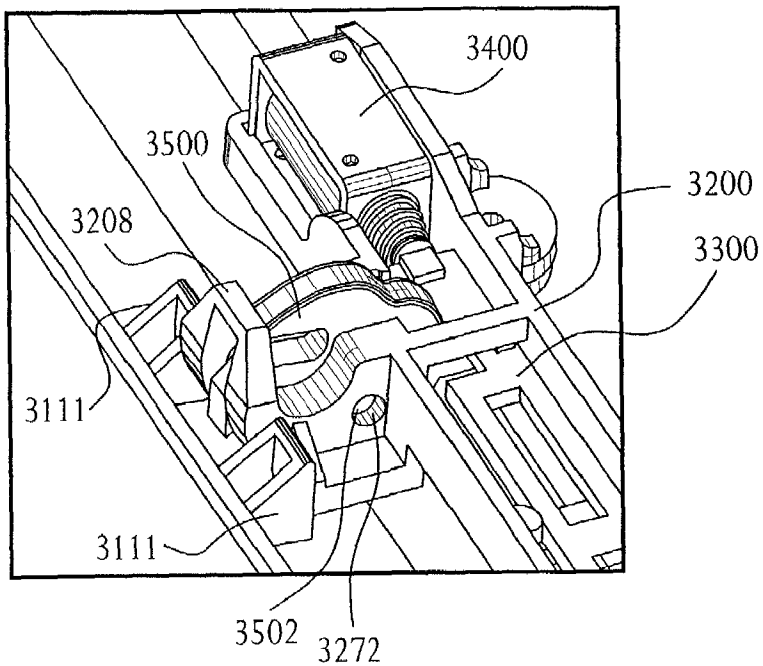

FIG. 130 is a close-up view of the outer shell of a glove box door having the latch assembly according to the present invention installed thereto, showing the solenoid assembly and the latch pawl closest to the solenoid in the closed position.

Figure 131:
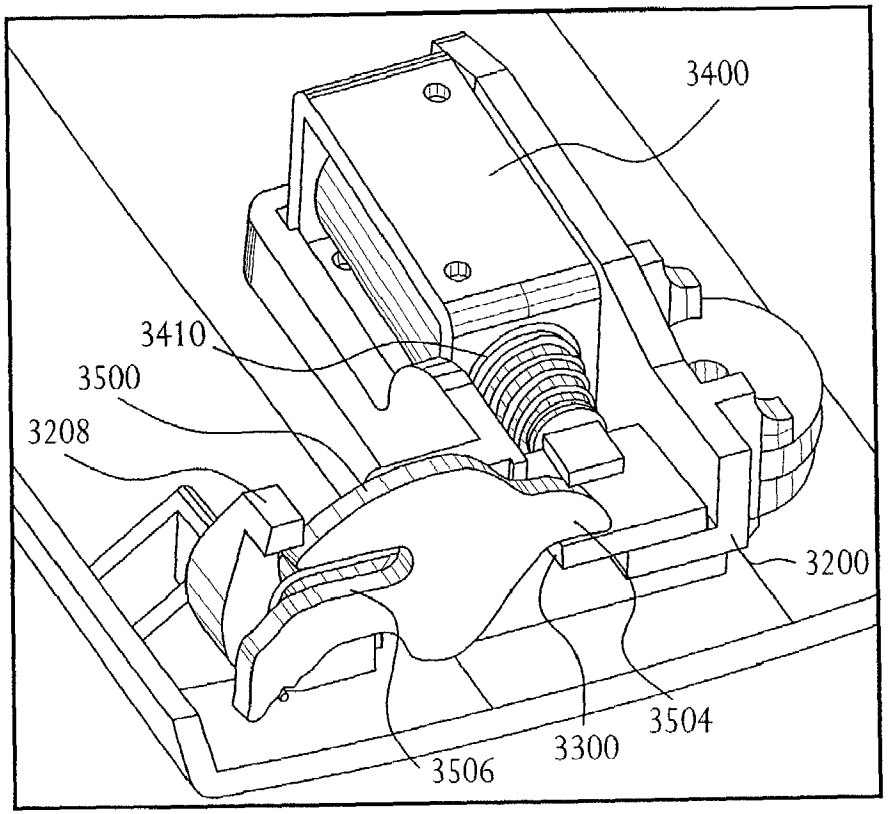

FIG. 131 is a view of the latch assembly of the present invention as shown in FIG. 130 with the housing broken away to reveal details of the latch pawl.

Figure 132:
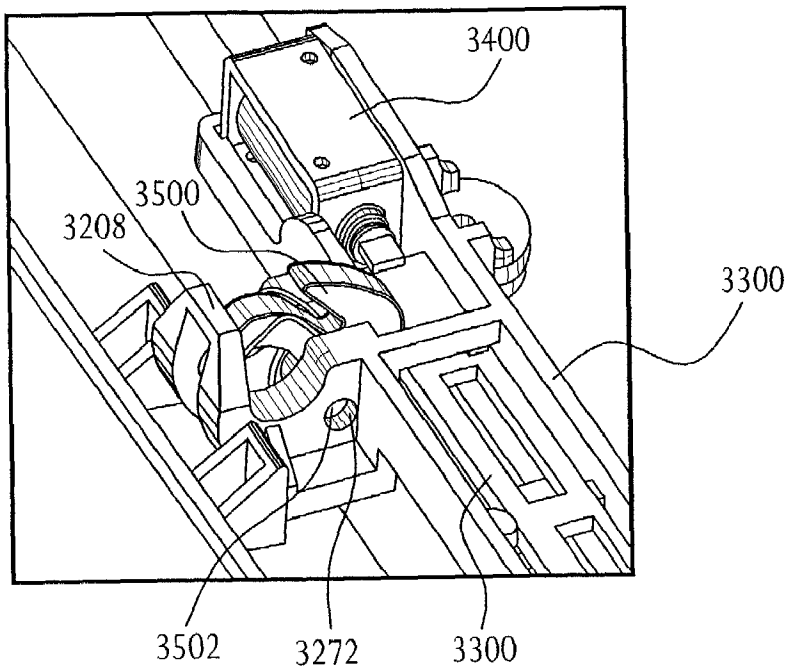

FIG. 132 is a close-up view of the outer shell of a glove box door having the latch assembly according to the present invention installed thereto, showing the solenoid assembly and the latch pawl closest to the solenoid in the open position.

Figure 133:
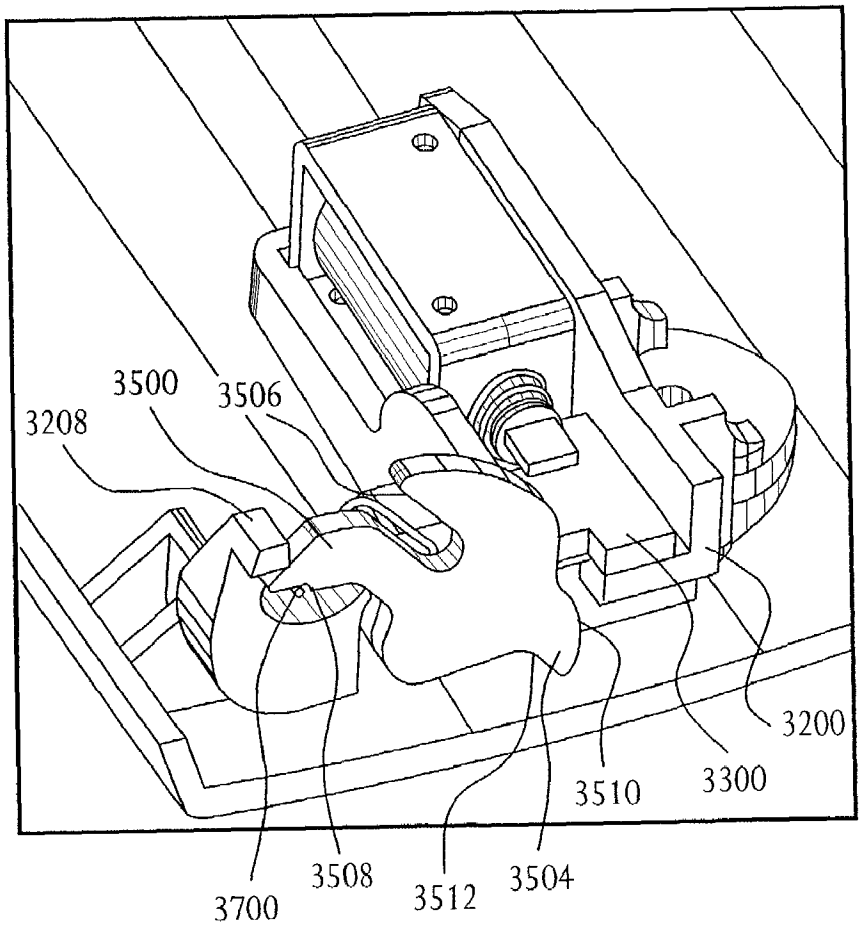

FIG. 133 is a view of the latch assembly of the present invention as shown in FIG. 132 with the housing broken away to reveal details of the latch pawl.

Figure 134:
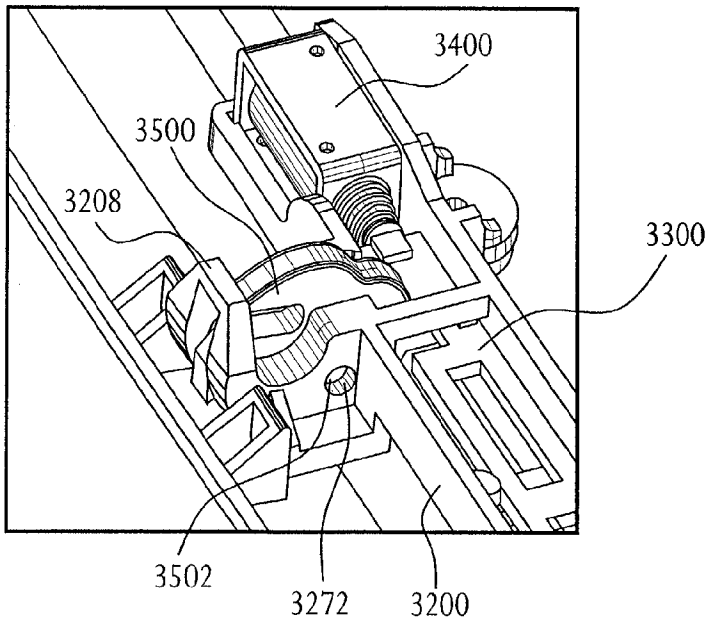

FIG. 134 is a close-up view of the outer shell of a glove box door having the latch assembly according to the present invention installed thereto, showing the solenoid assembly and the latch pawl closest to the solenoid in the closed position.

Figure 135:
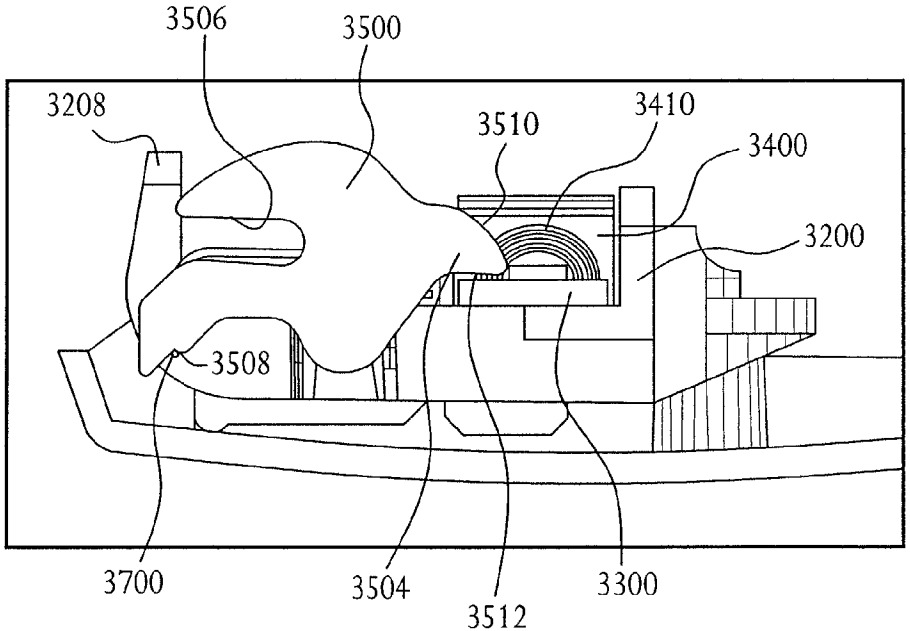

FIG. 135 is a right side view of the outer shell of a glove box door having the latch assembly according to the present invention installed thereto with the housing broken away to reveal details of the latch pawl in the closed position.

Figure 136:
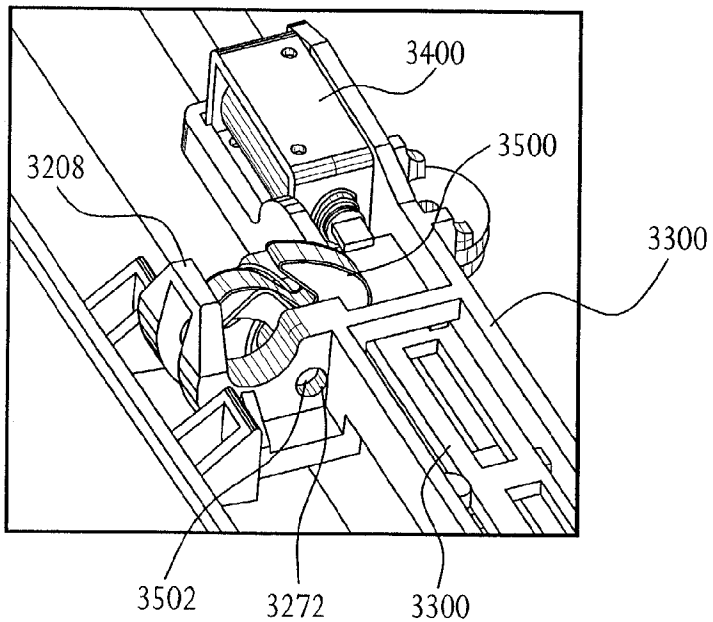

FIG. 136 is a close-up view of the outer shell of a glove box door having the latch assembly according to the present invention installed thereto, showing the solenoid assembly and the latch pawl closest to the solenoid in the open position.

Figure 137:
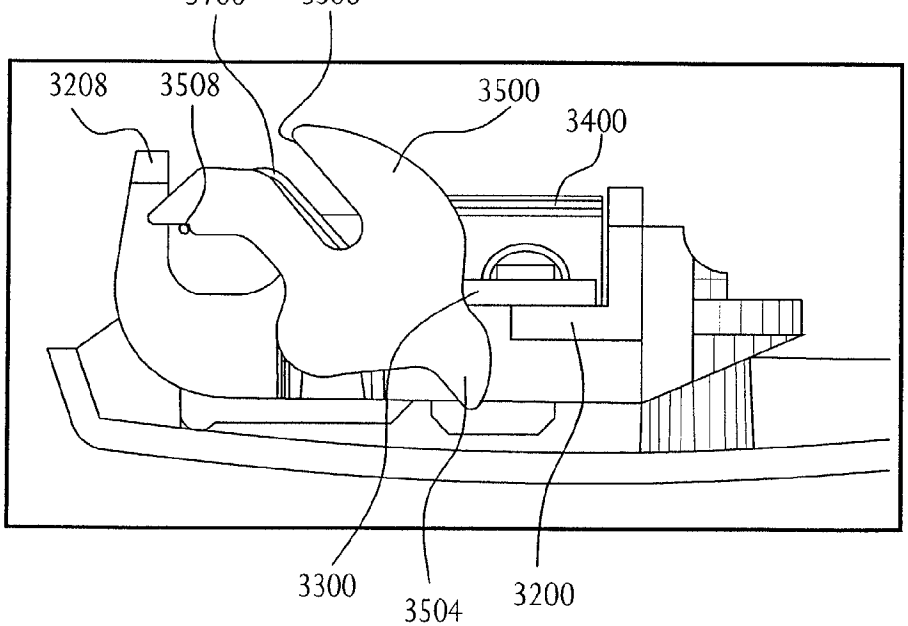

FIG. 137 is a right side view of the outer shell of a glove box door having the latch assembly according to the present invention installed thereto with the housing broken away to reveal details of the latch pawl in the open position.

Figure 138:
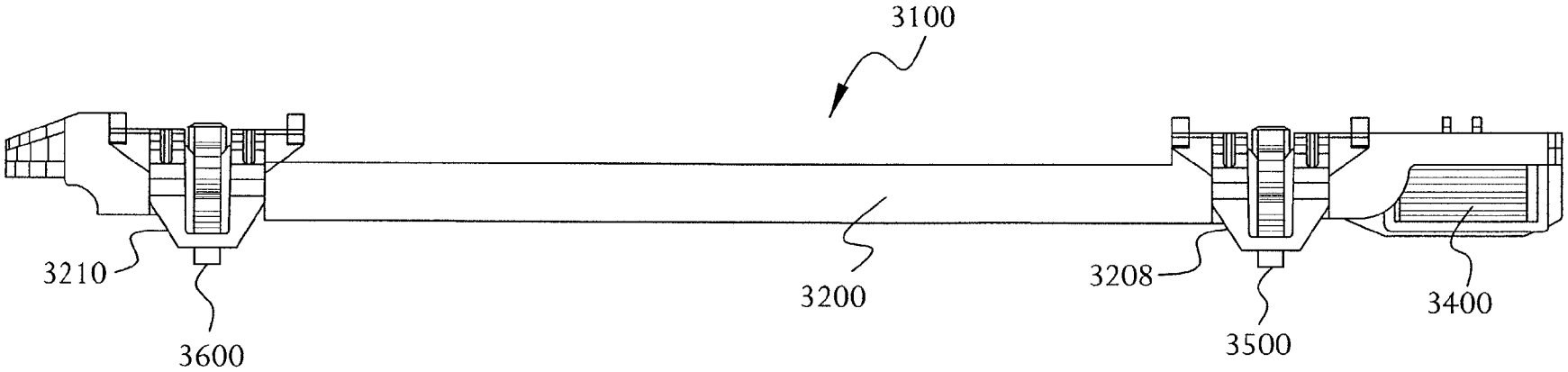

FIG. 138 is a top view of the latch assembly according to the present invention with the latch pawls in the open position.

Figure 139:
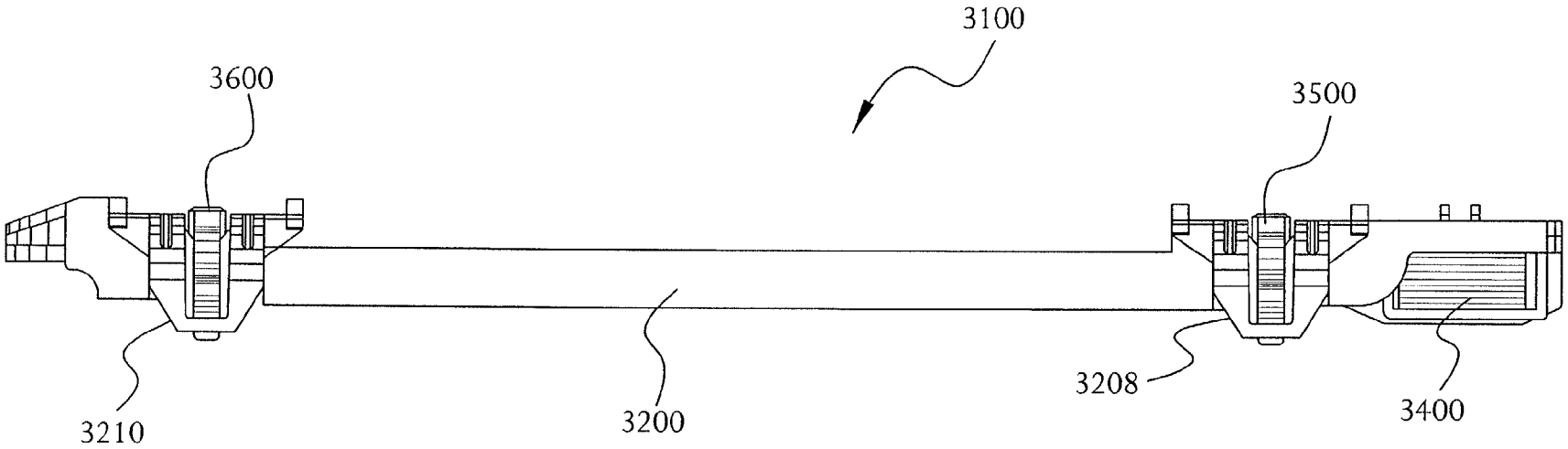

FIG. 139 is a top view of the latch assembly according to the present invention with the latch pawls in the closed position.

Figure 140:
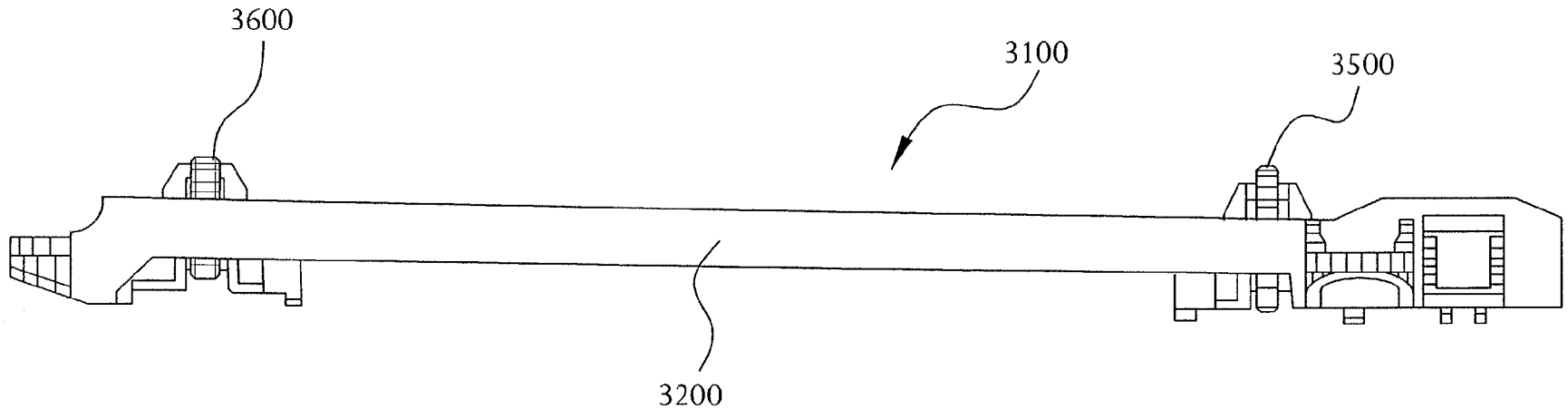

FIG. 140 is a bottom view of the latch assembly according to the present invention with the latch pawls in the closed position.

Figure 141:
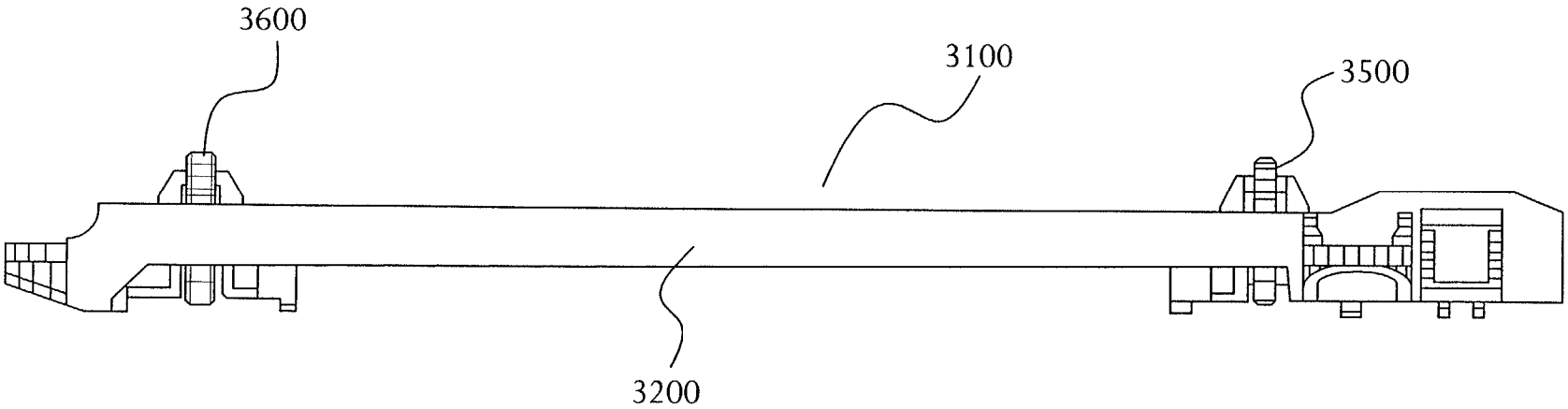

FIG. 141 is a bottom view of the latch assembly according to the present invention with the latch pawls in the open position.

Figure 142:
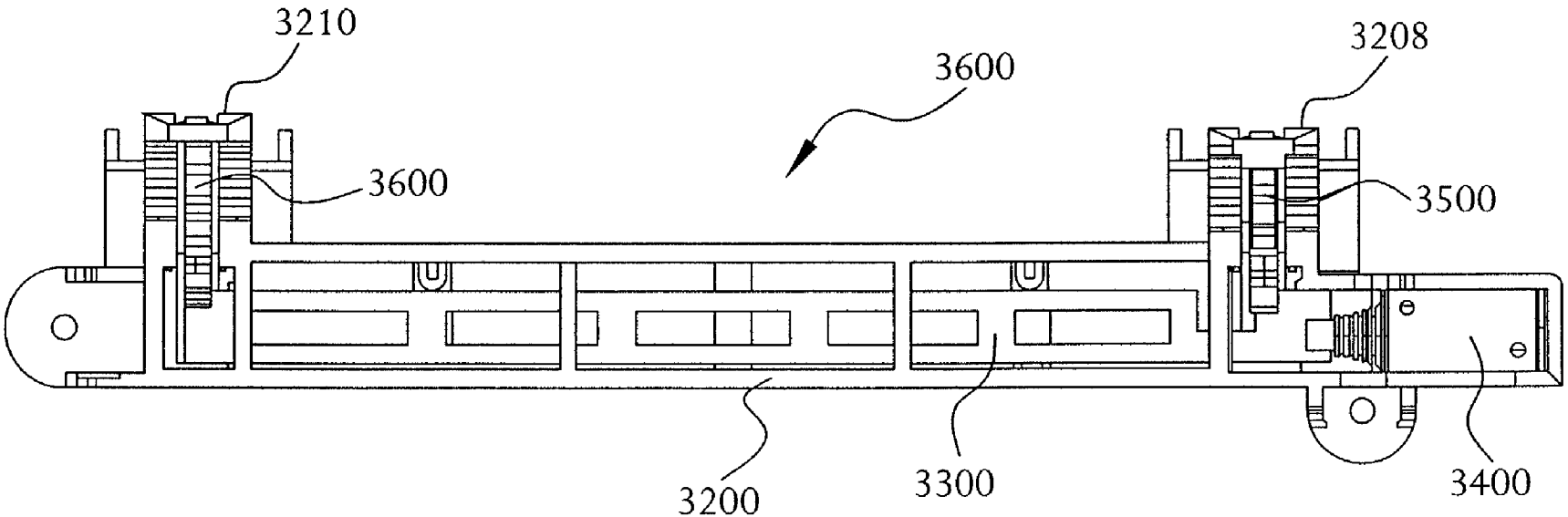

FIG. 142 is a front view of the latch assembly according to the present invention with the latch pawls in the closed position and the catch beam in the locked position.

Figure 143:
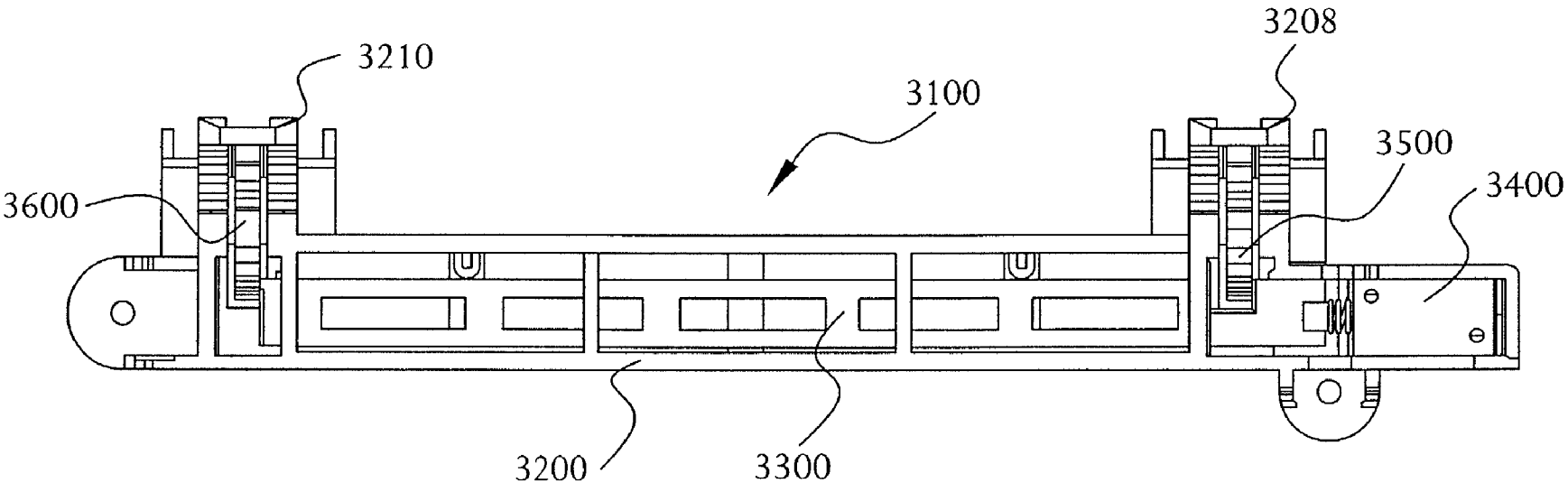

FIG. 143 is a front view of the latch assembly according to the present invention with the latch pawls in the open position and the catch beam in the unlocked position.

Figure 144:
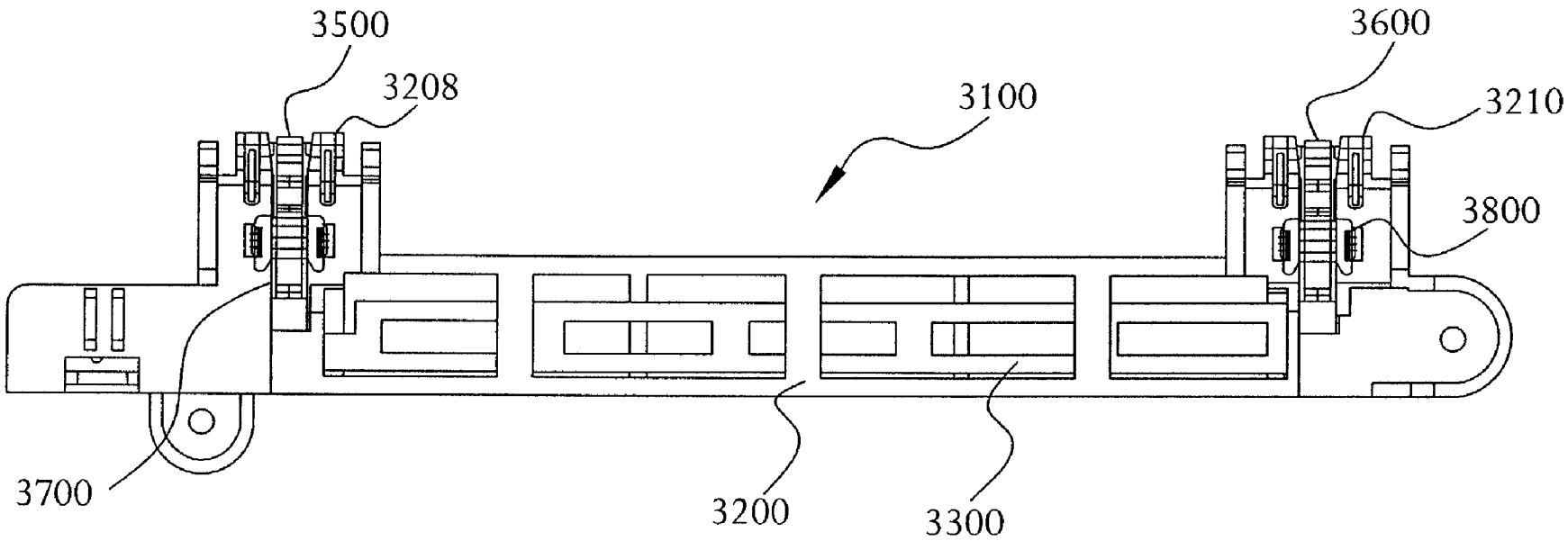

FIG. 144 is a rear view of the latch assembly according to the present invention with the latch pawls in the closed position and the catch beam in the locked position.

Figure 145:
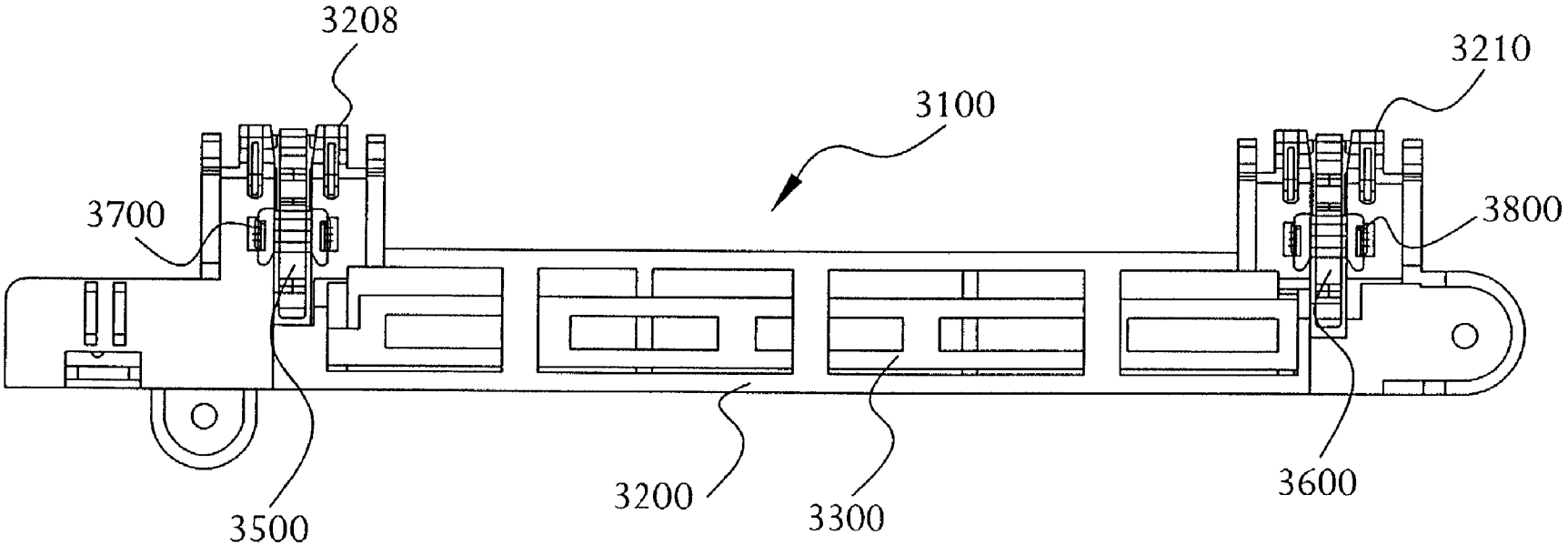

FIG. 145 is a rear view of the latch assembly according to the present invention with the latch pawls in the open position and the catch beam in the unlocked position.

Figure 146:
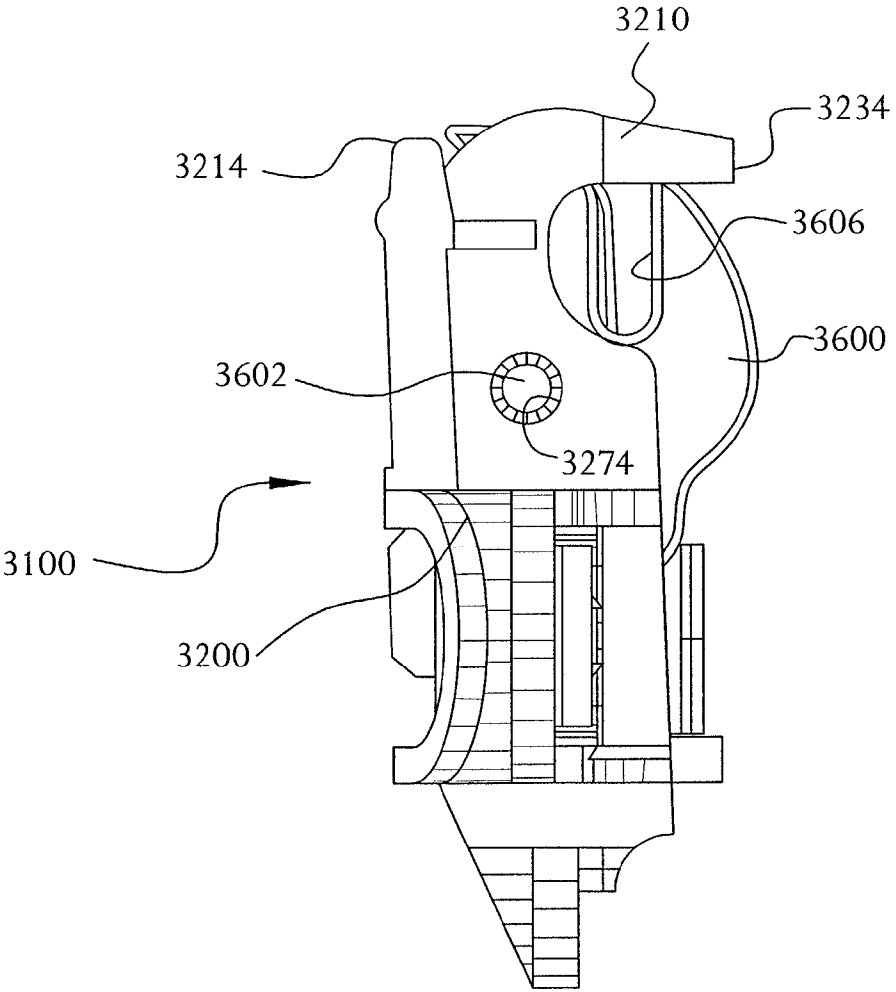

FIG. 146 is a right side view of the latch assembly according to the present invention with the latch pawls in the closed position.

Figure 147:
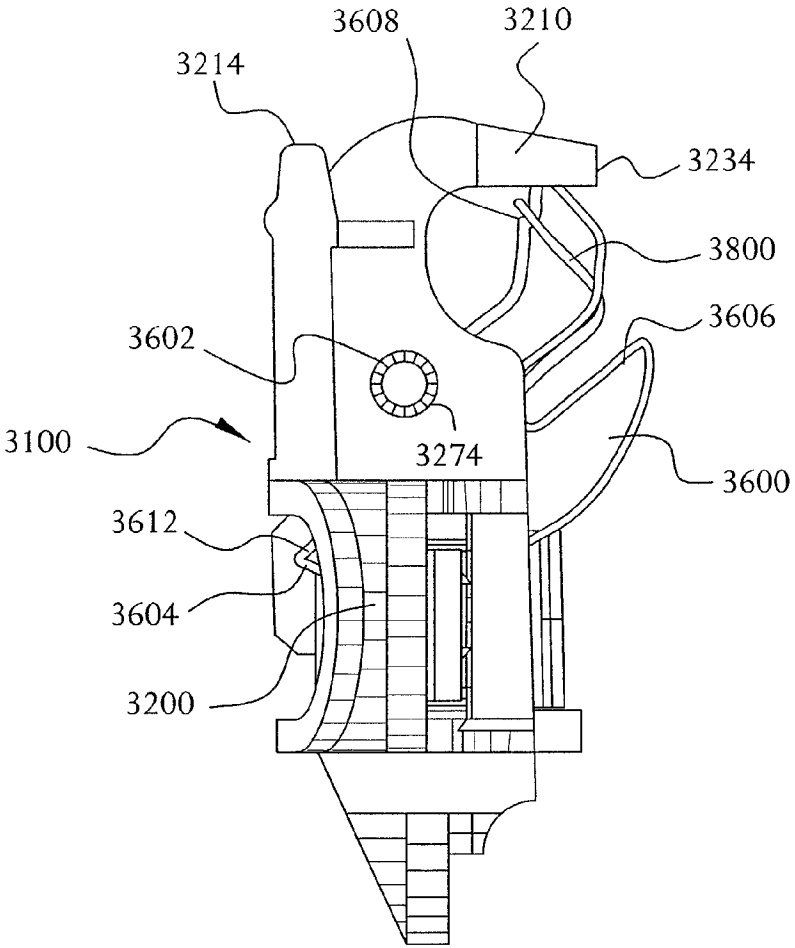

FIG. 147 is a right side view of the latch assembly according to the present invention with the latch pawls in the open position.

Figure 148:
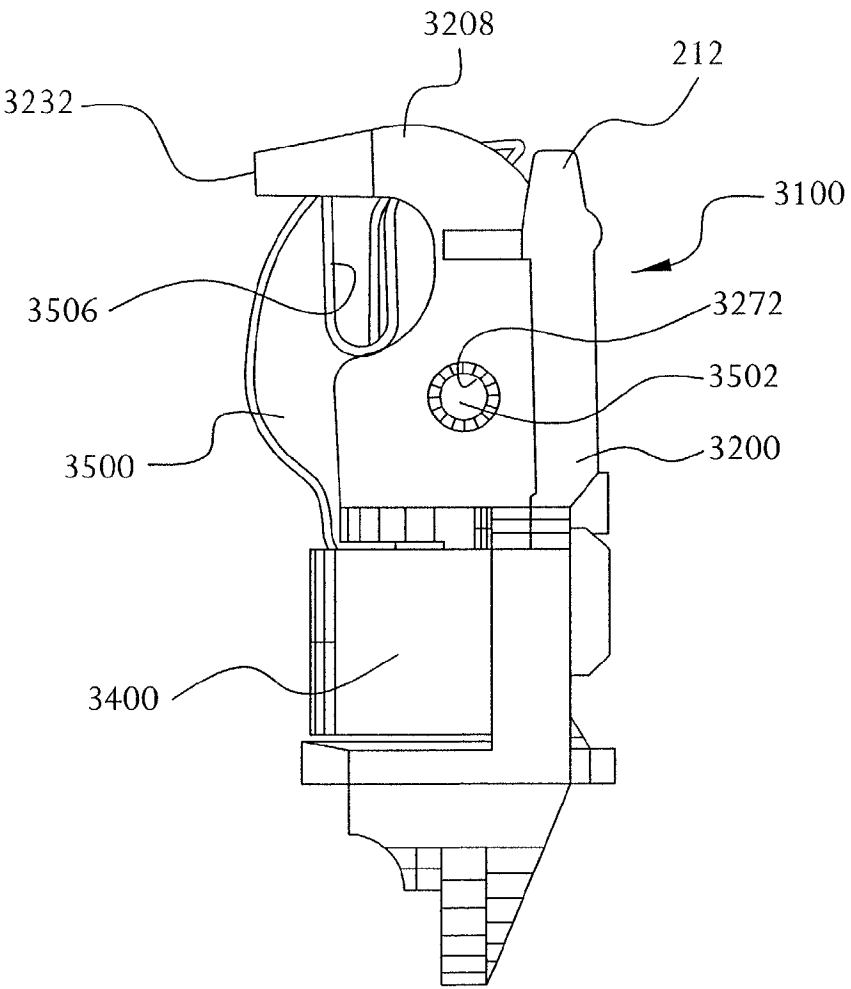

FIG. 148 is a left side view of the latch assembly according to the present invention with the latch pawls in the closed position.

Figure 149:
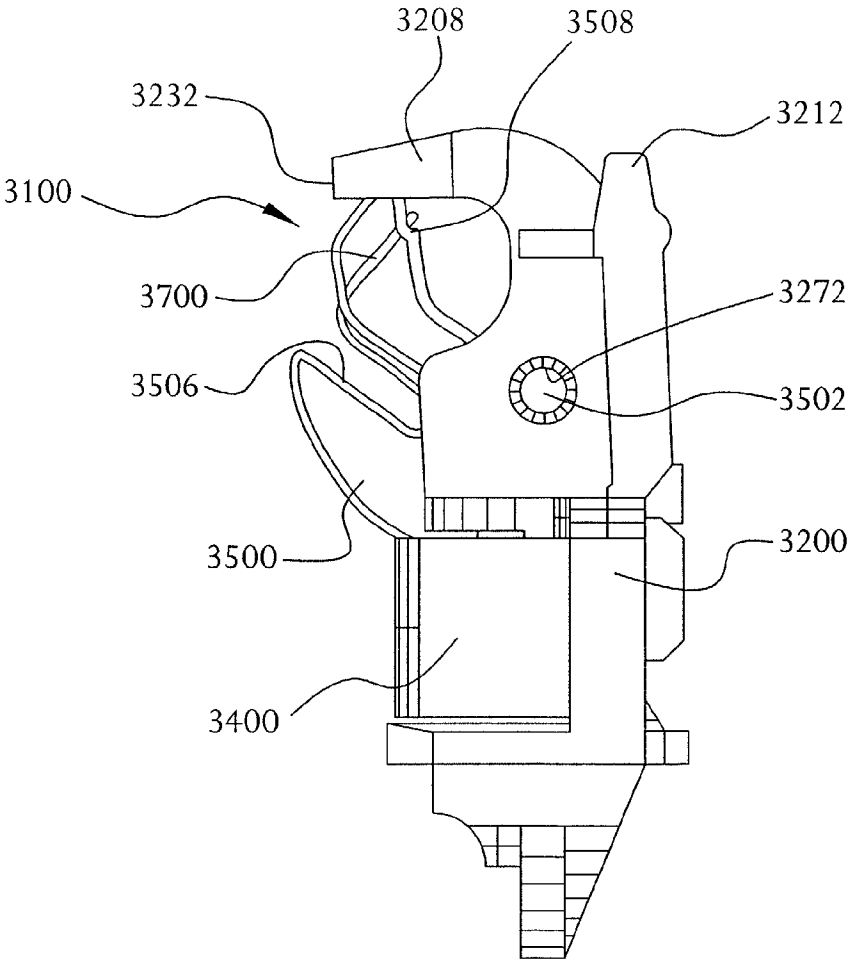

FIG. 149 is a left side view of the latch assembly according to the present invention with the latch pawls in the open position.

Figure 150:
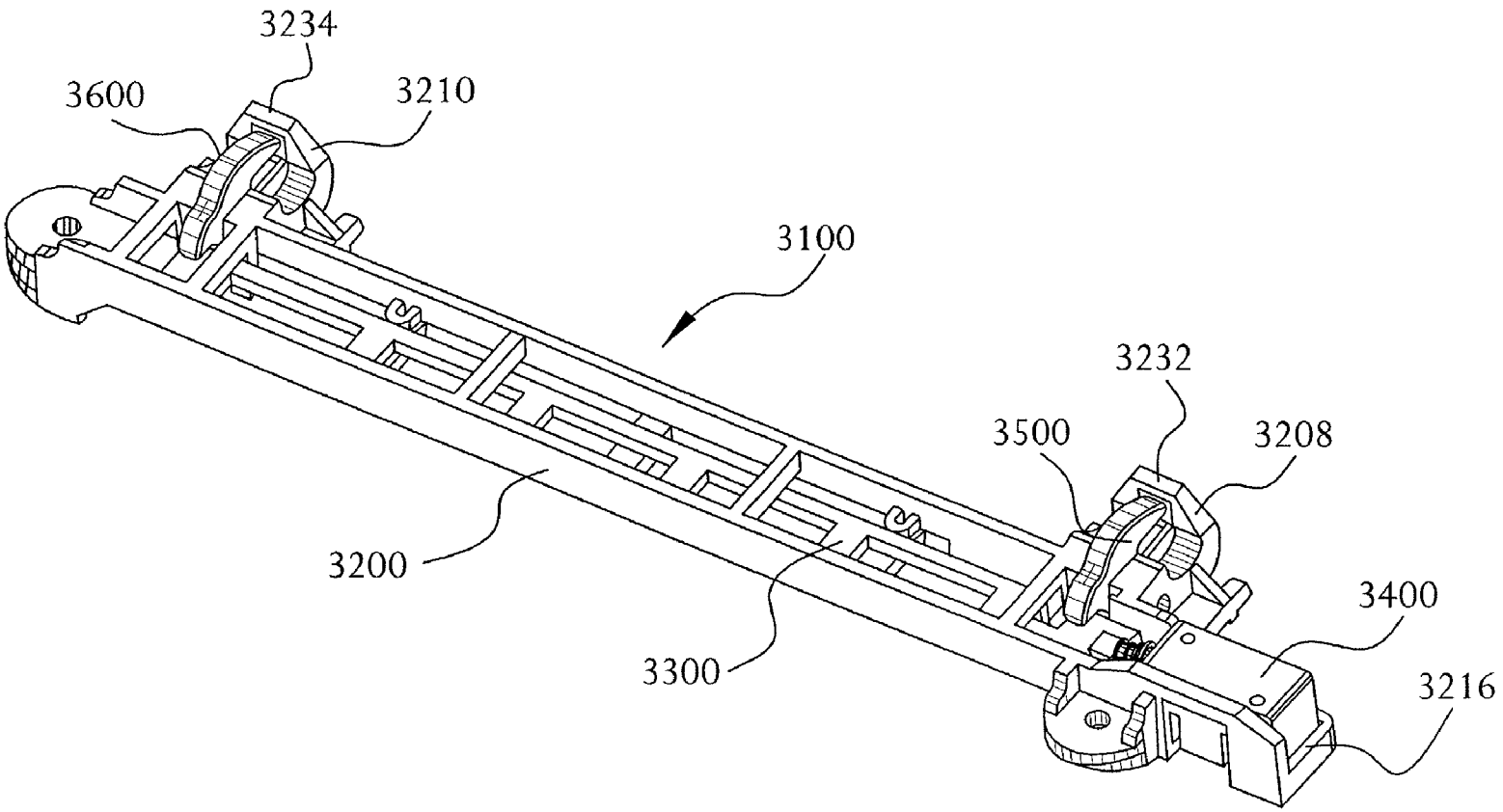

FIG. 150 is a front perspective view of the latch assembly according to the present invention shown with the latch pawls in the closed position.

Figure 151:
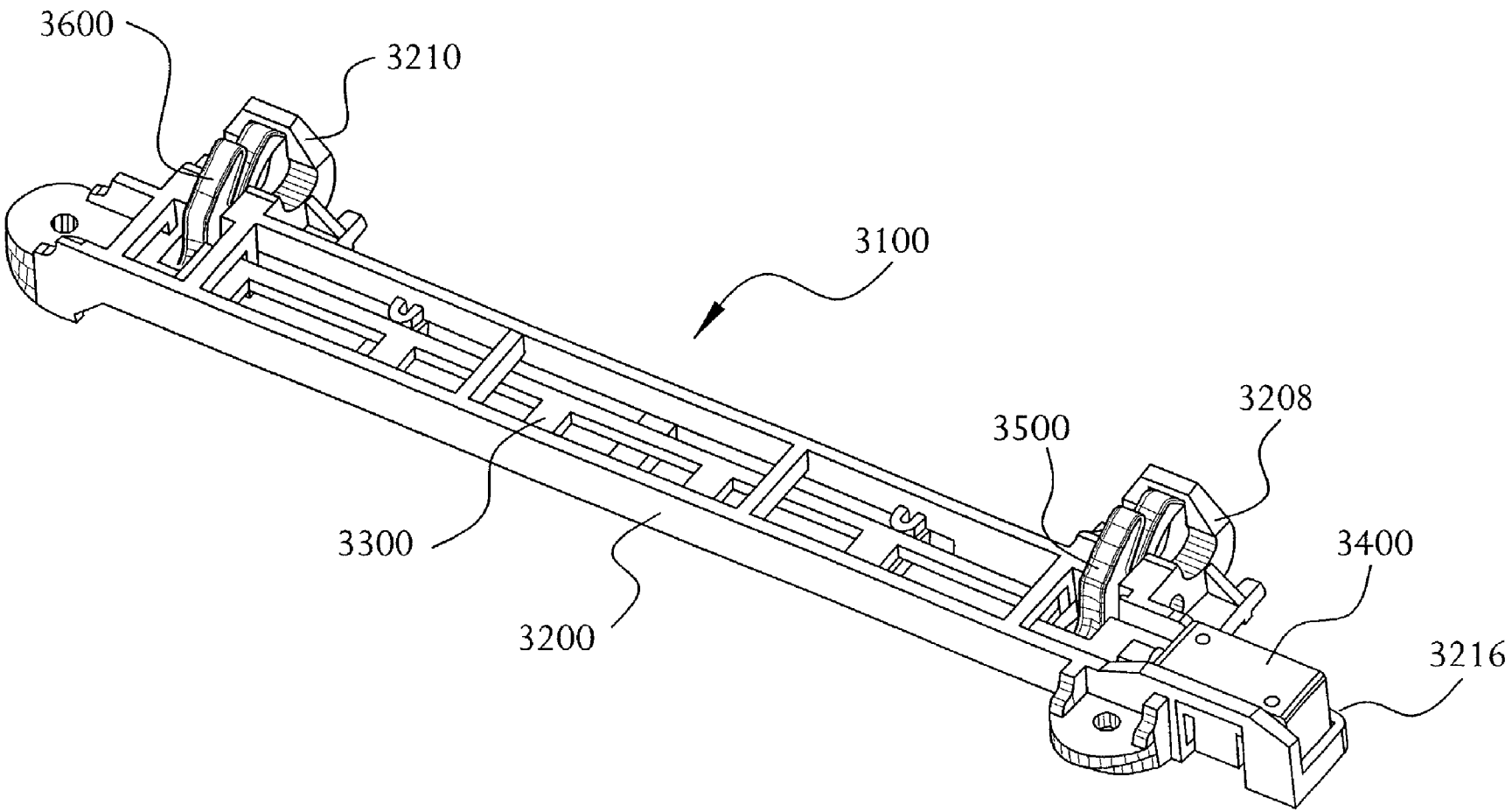

FIG. 151 is a front perspective view of the latch assembly according to the present invention shown with the latch pawls in the open position.

Figure 152:
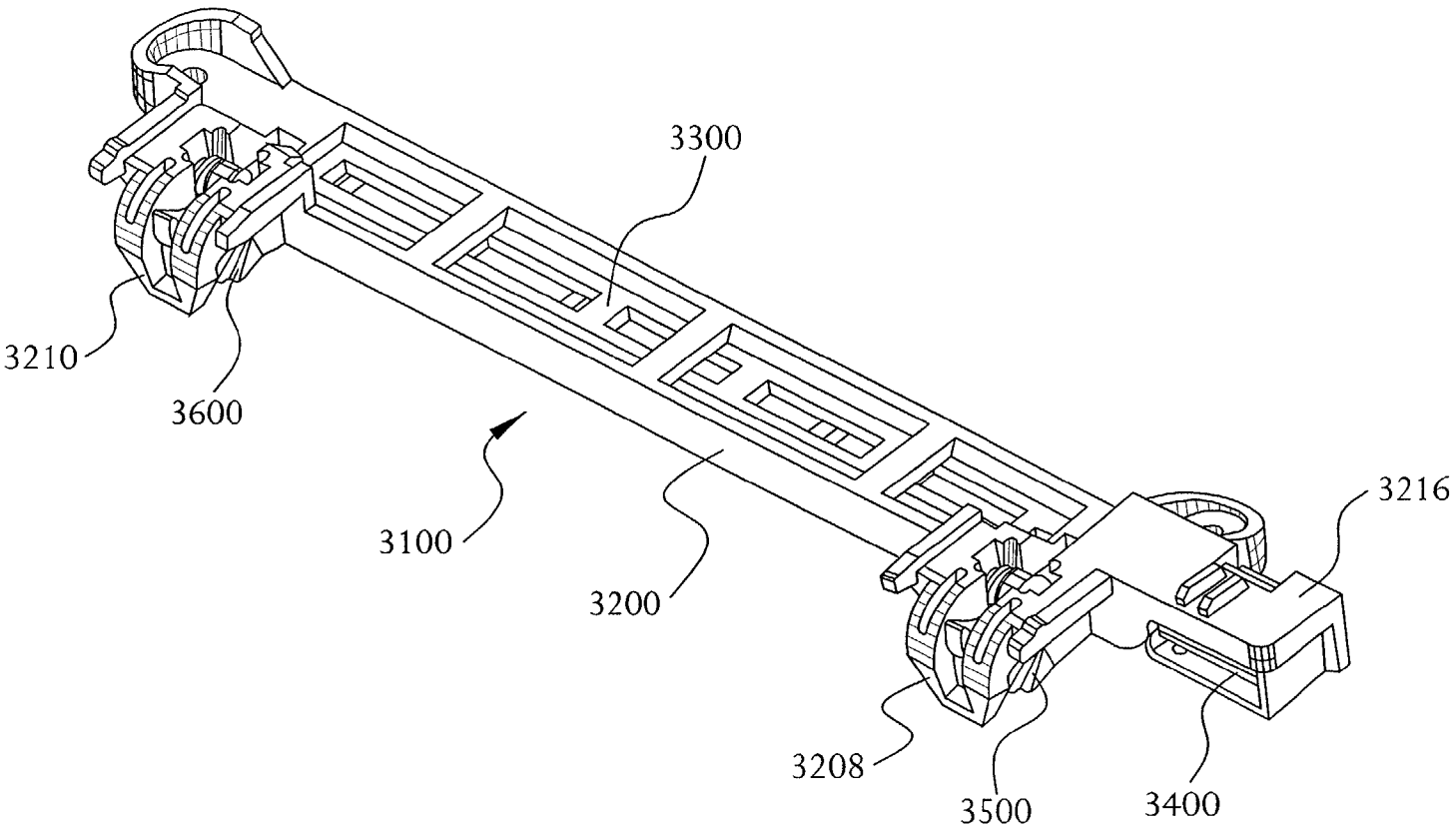

FIG. 152 is a rear perspective view of the latch assembly according to the present invention shown with the latch pawls in the closed position.

Figure 153:
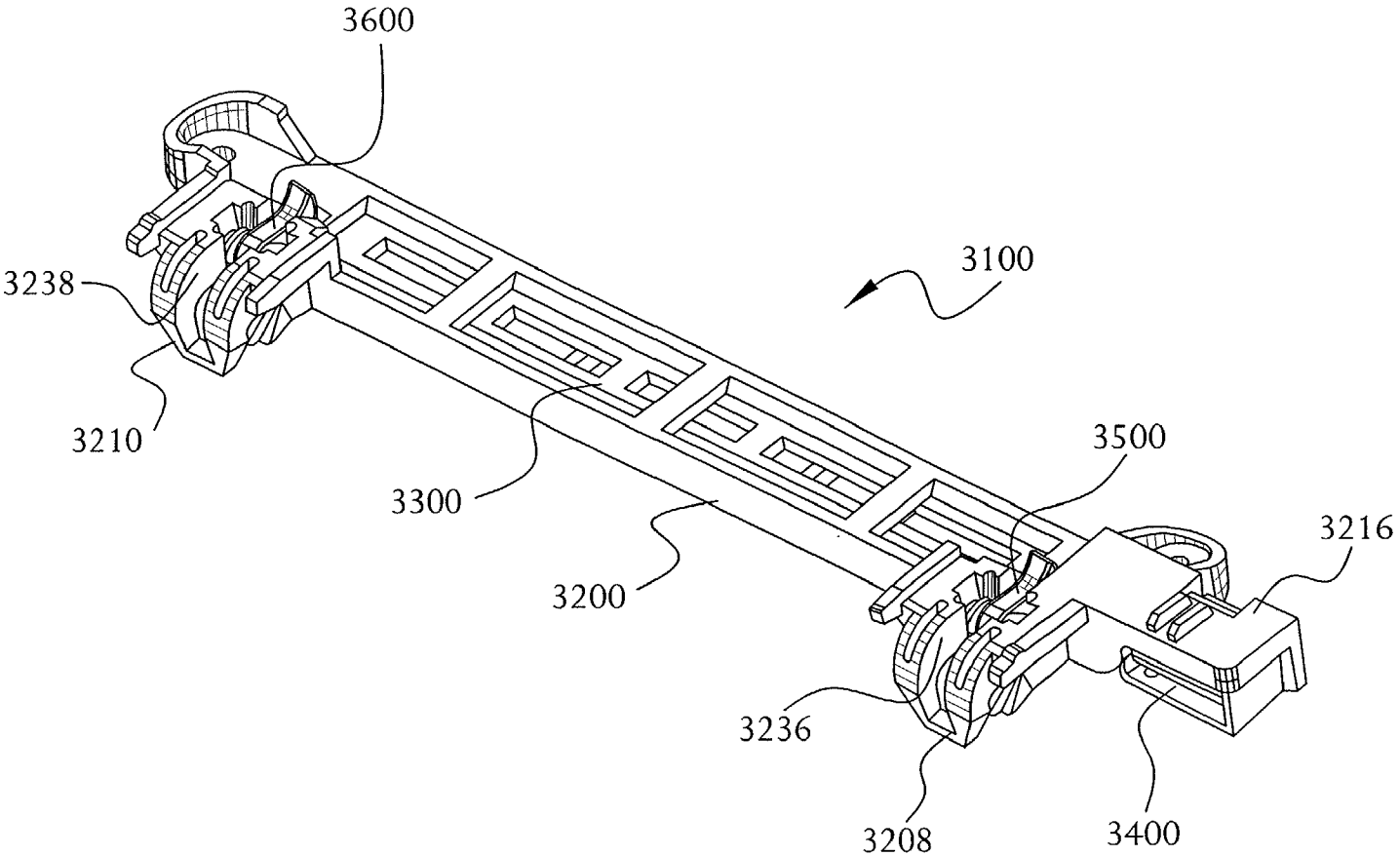

FIG. 153 is a rear perspective view of the latch assembly according to the present invention shown with the latch pawls in the open position.

Figure 154:
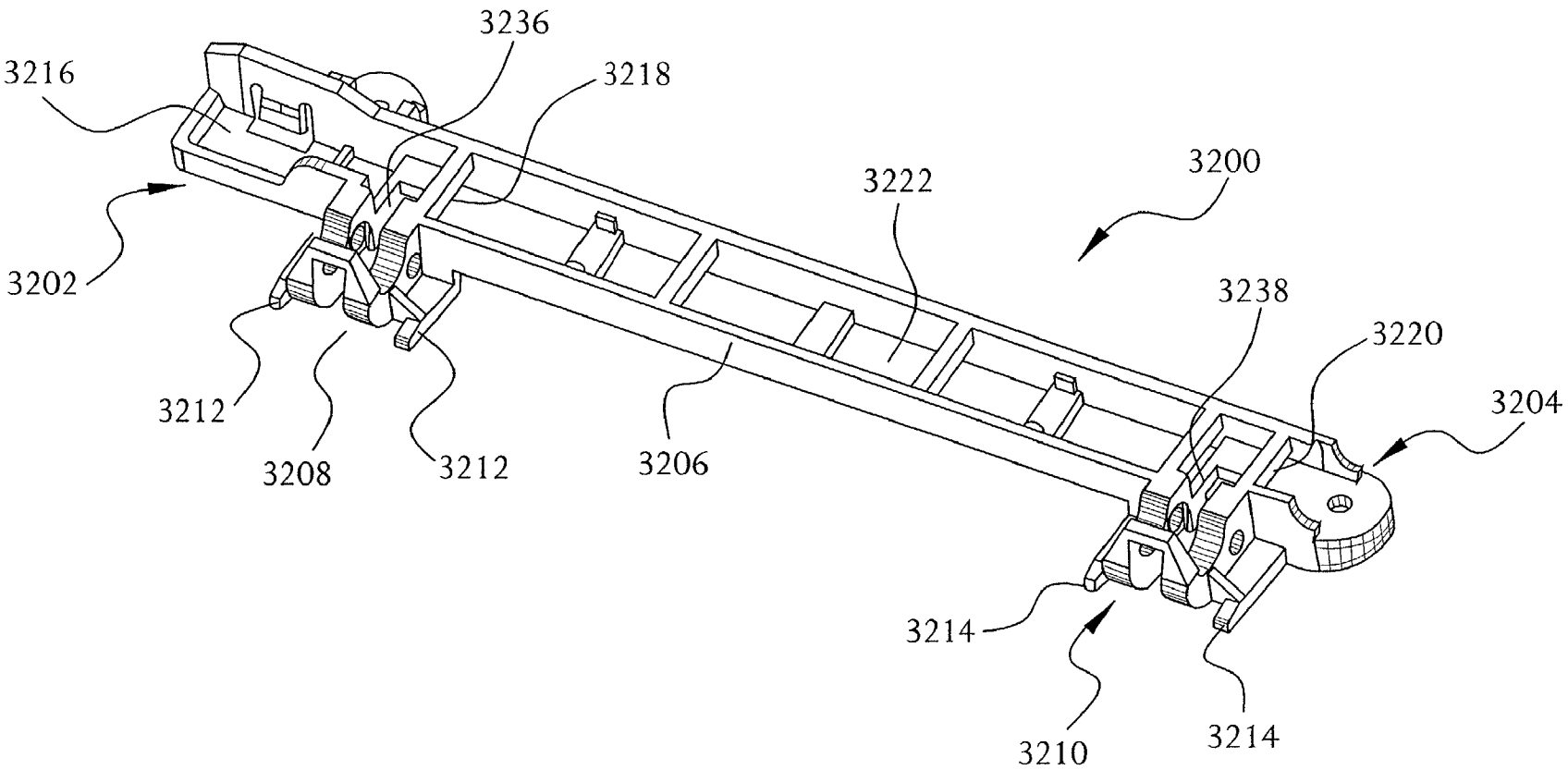

FIG. 154 is a top front perspective view of the housing of the latch assembly according to the invention.

Figure 155:
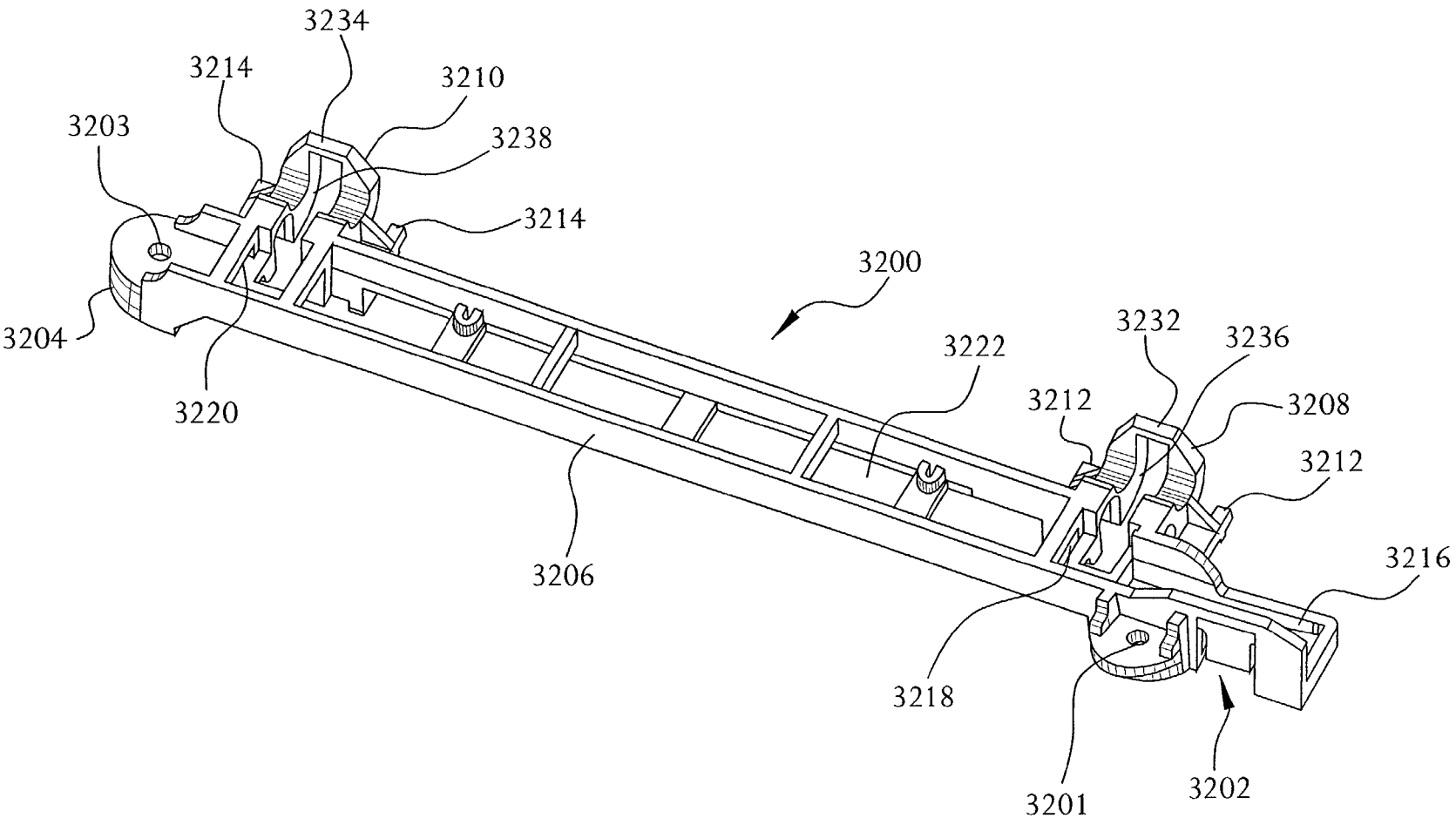

FIG. 155 is a bottom front perspective view of the housing of the latch assembly according to the invention.

Figure 156:
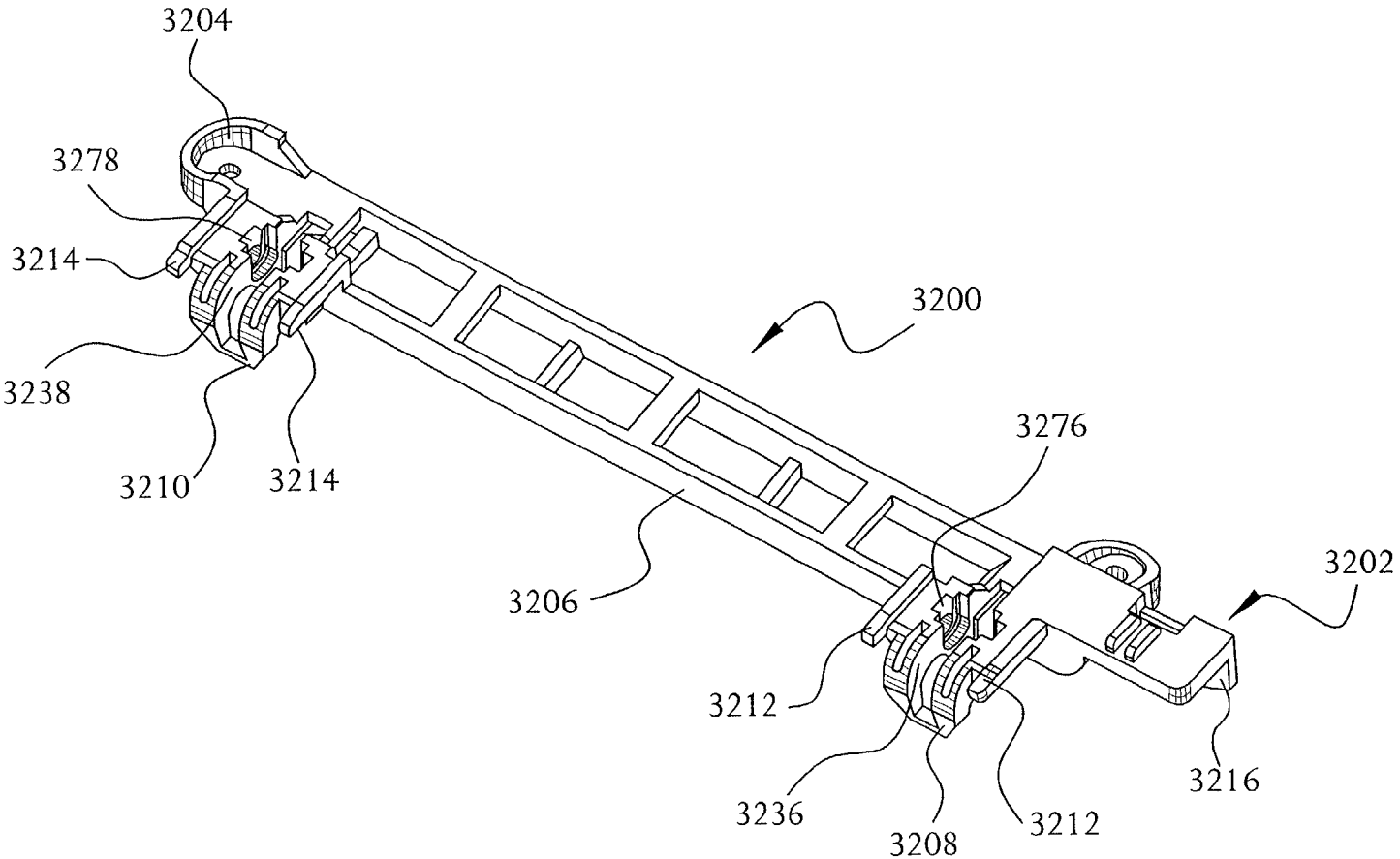

FIG. 156 is a top rear perspective view of the housing of the latch assembly according to the invention.

Figure 157:
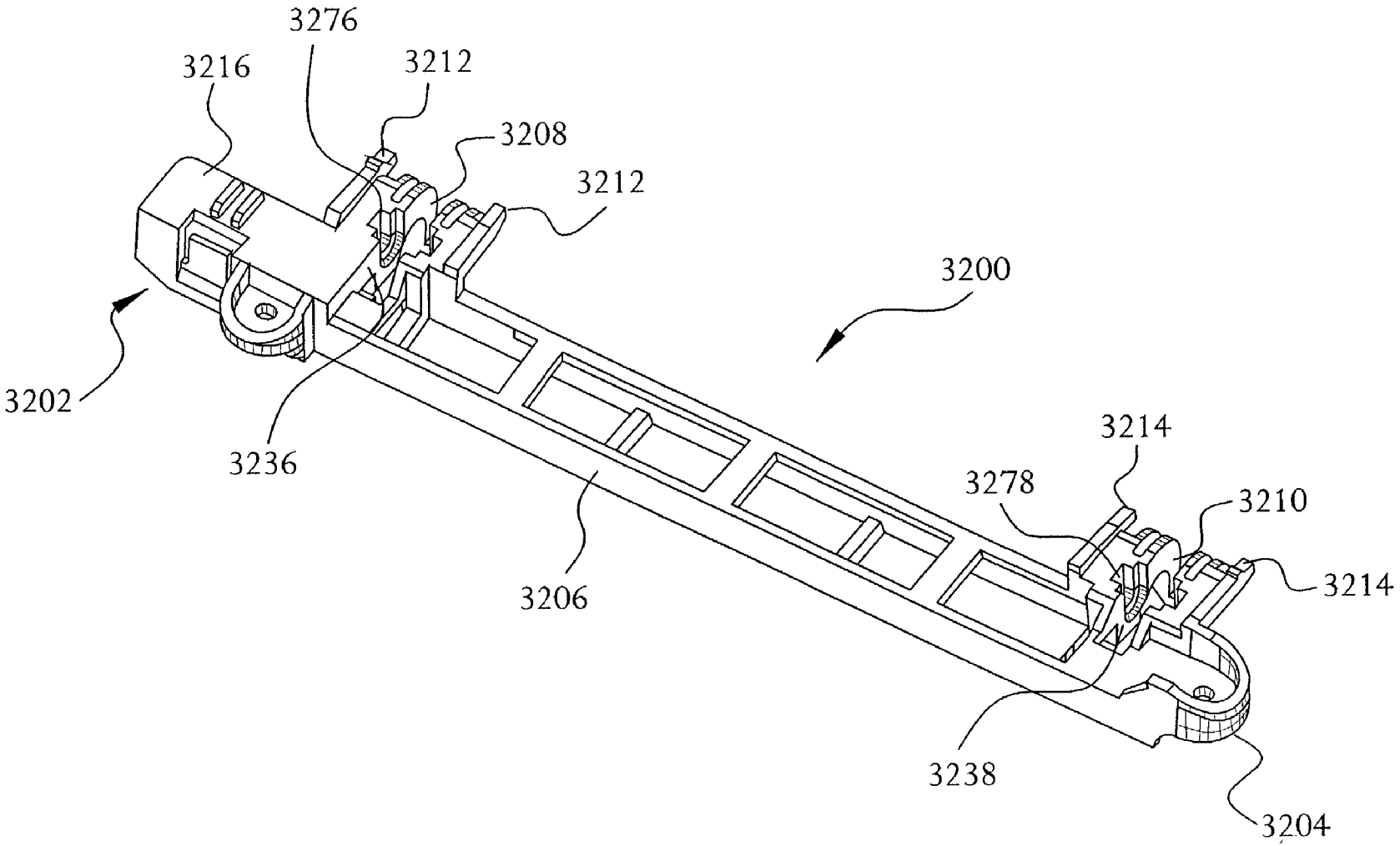

FIG. 157 is a bottom rear perspective view of the housing of the latch assembly according to the invention.

Figure 158:
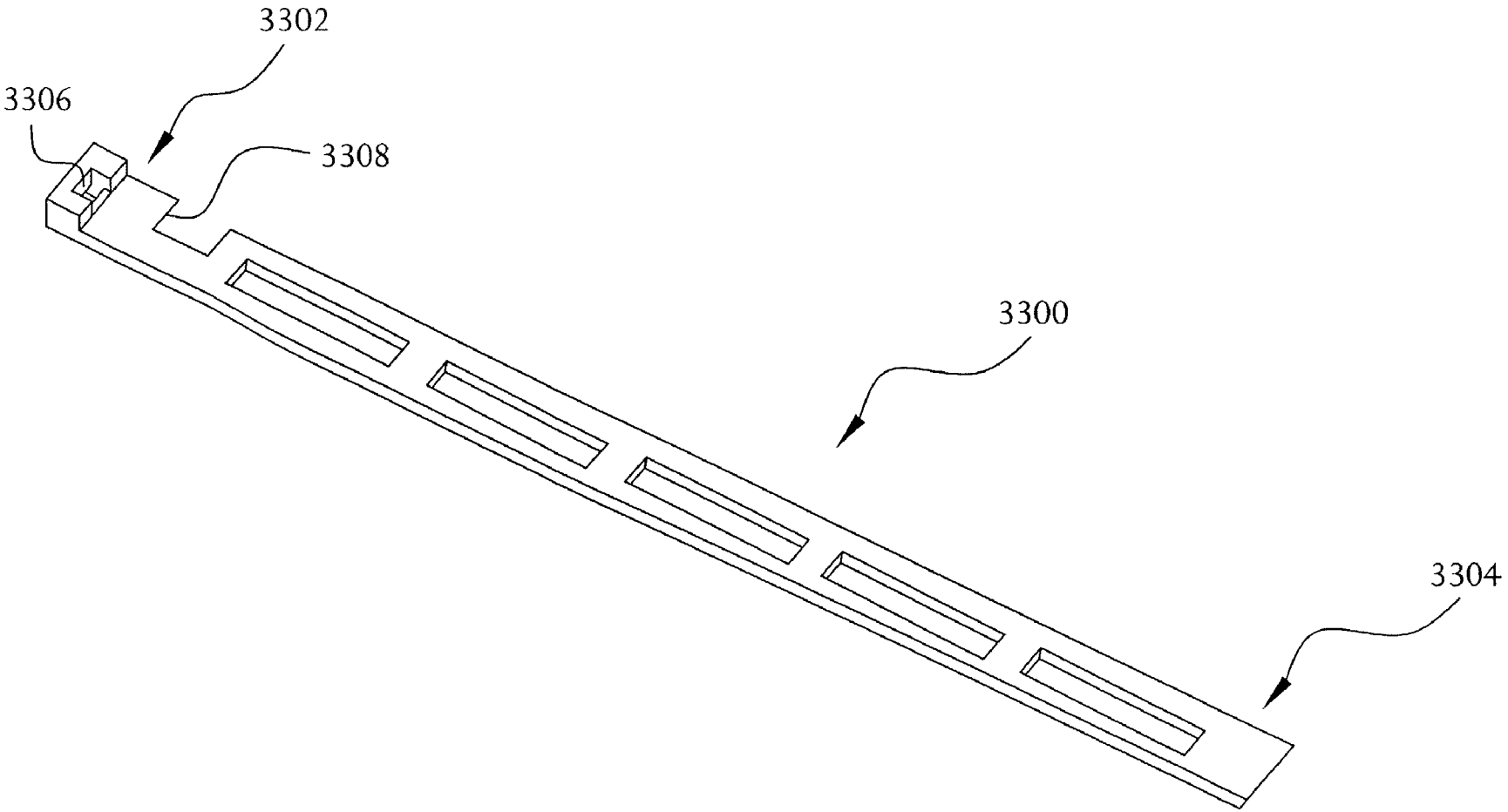

FIG. 158 is a rear perspective view of the catch beam of the latch assembly according to the invention.

Figures 159A, 159B:
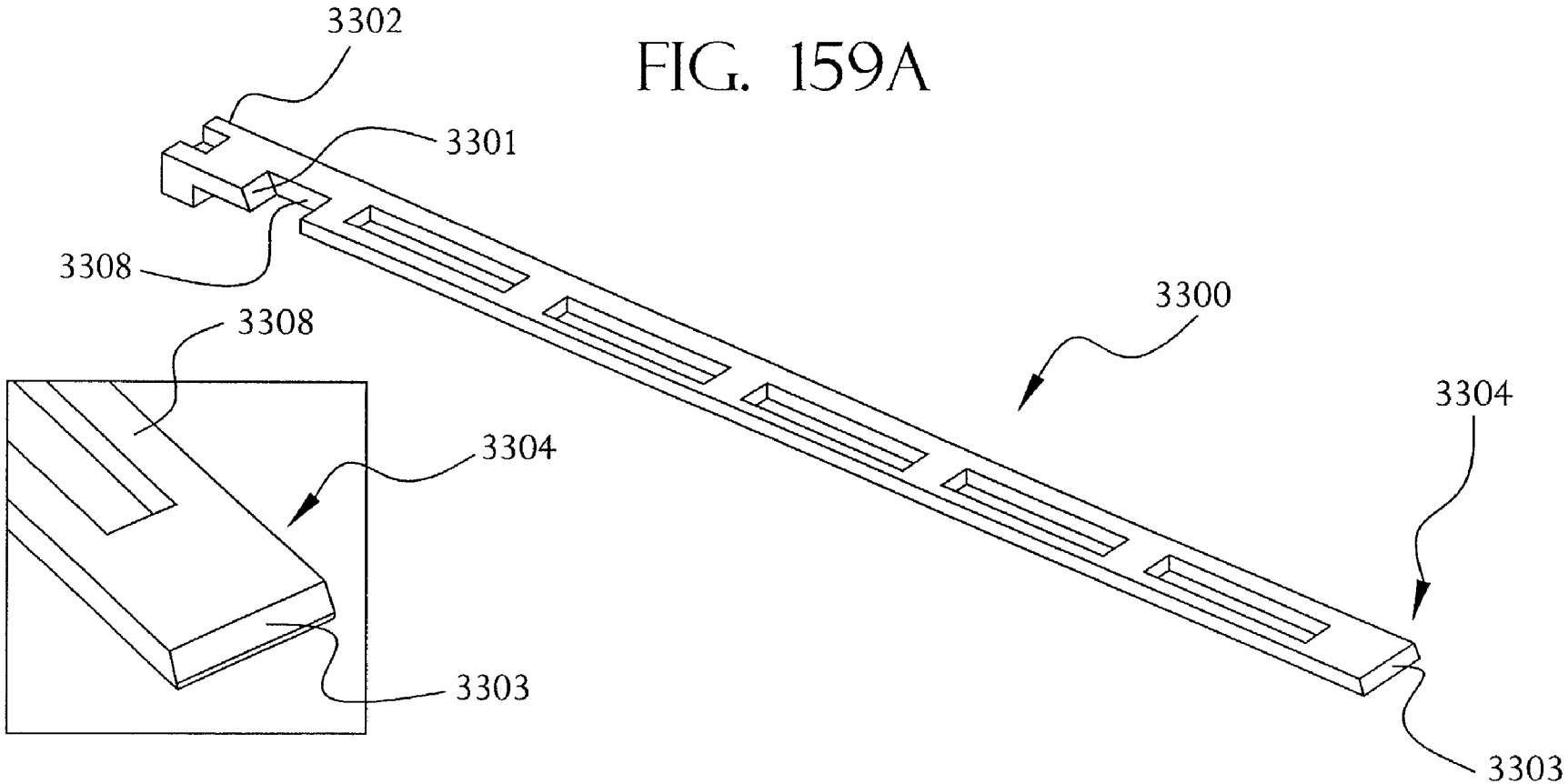

FIG. 159A is a front perspective view of the catch beam of the latch assembly according to the invention.

FIG. 159B is a close-up view of the tip of the catch beam of the latch assembly of the present invention.

Figure 160:
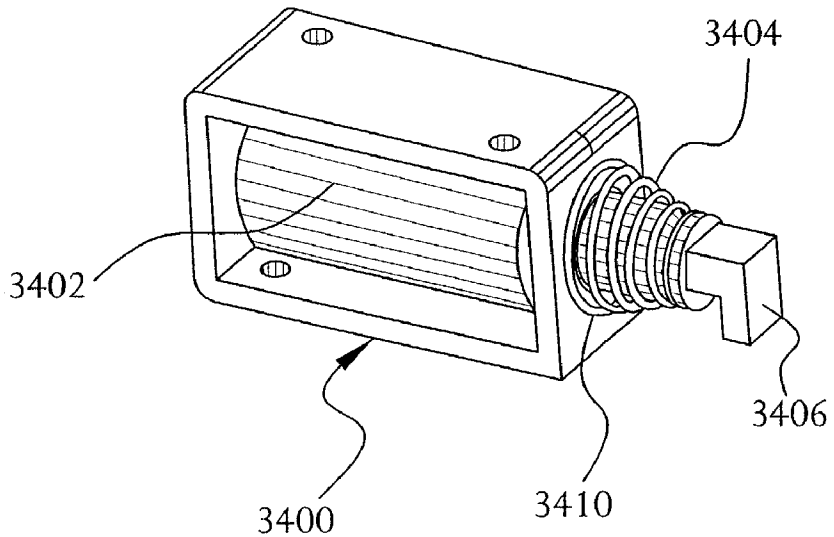
Figure 120:
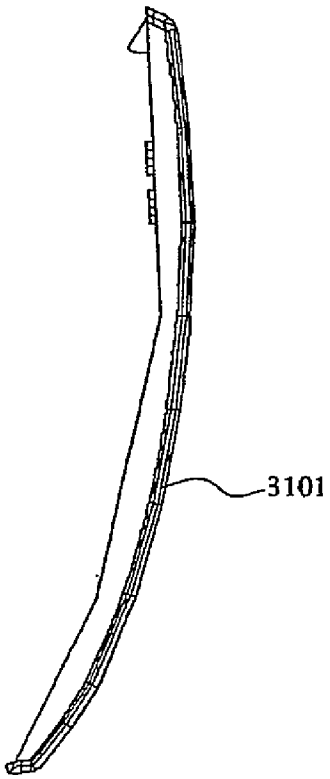
Figure 121:
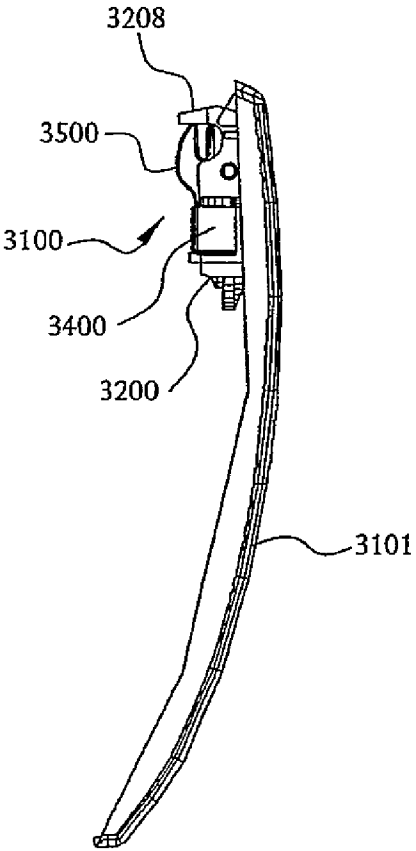
Figure 122:
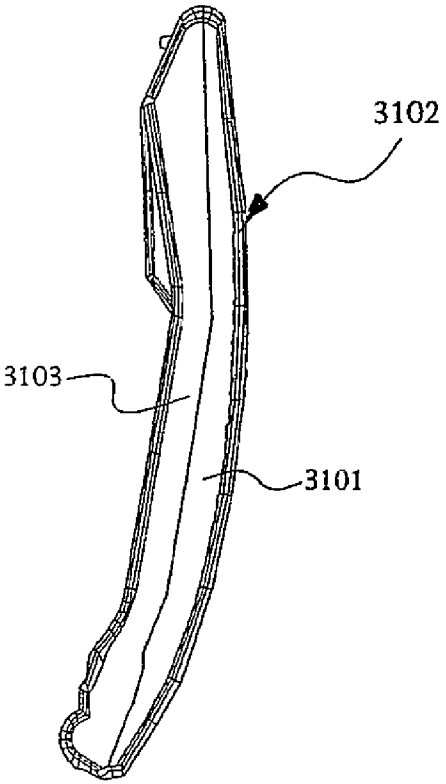
Figure 148:
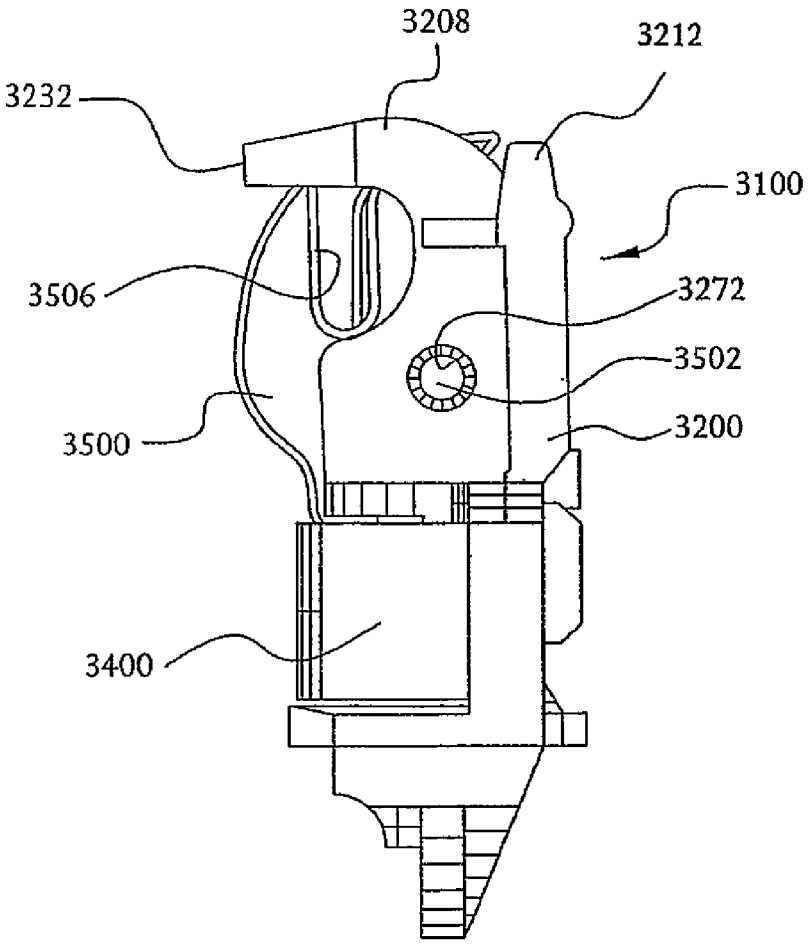

FIG. 160 is an isometric view of the solenoid assembly of the latch assembly of the present invention, showing the solenoid in the deactivated condition.

Figure 161:
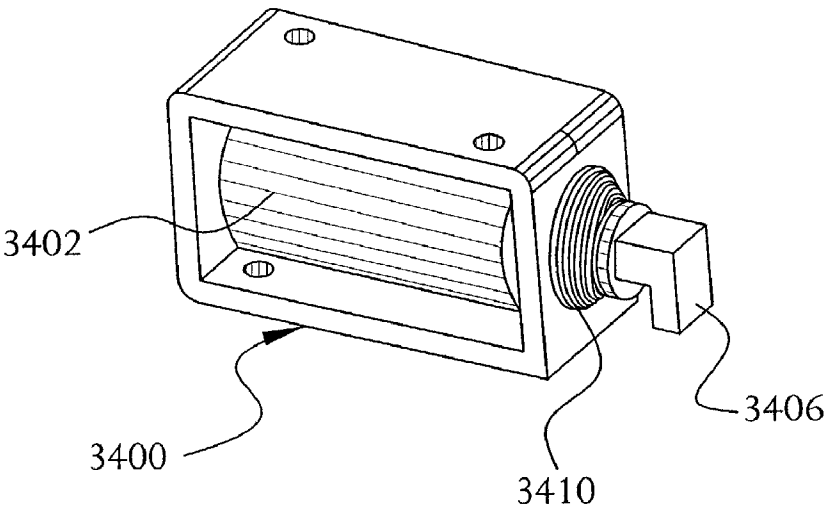

FIG. 161 is an isometric view of the solenoid assembly of the latch assembly of the present invention, showing the solenoid in the energized or activated condition.

DETAILED DESCRIPTION OF THE INVENTION

Referring to FIGS. 1–43, the latches 10 and 100 of the present invention are similar to that disclosed in U.S. Pat. No. 5,927,772, which is incorporated herein by reference. In the interest of brevity, the description herein will be directed in large part to the differences between the latch of the present invention and that disclosed in U.S. Pat. No. 5,927,772.

The latch 10 includes a latch housing 12, a pawl 14, a locking member 16, and means for selectively moving the locking member in and out of engagement with the pawl. In the illustrated embodiment, a solenoid 18 serves as the means for selectively moving the locking member in and out of engagement with the pawl.

In the illustrated example, the latch 10 is shown being used for securing the lid 20 of an automotive glove box 22 in the closed position. However, the latch 10 is generally applicable wherever one or more closure members need to be secured in a certain position. Further, in the illustrated embodiment the latch 10 is mounted to the frame 24 surrounding the glove box opening 26 while the keeper 28 is mounted to the lid 20 of the glove box 22. Of course, it is possible to arrange for the latch 10 to be mounted to the lid 20 of the glove box while the keeper 28 is in a fixed position relative to the glove box 22 itself without departing from the spirit and scope of the present invention. In addition, the latch 10 may be mounted in any orientation depending upon the particular application. In the illustrated example, the front of the latch housing 12 faces toward the lid 20 of the glove box, and the rear of the latch housing 12 faces toward the back wall 30 of the glove box.

The housing 12 is provided with a body portion 32 having a hook-like member 34 projecting from the bottom thereof. Hook-like as used herein refers to any member that has a crook, curve, or bend to thereby catch on another member. The hook-like member 34 extends downward and then forward from the bottom of the housing body portion 32 such that the tip 36 of the member 34 points toward the lid 20 of the glove compartment 22. A first slot 38 is provided within the hook-like member 34 and extends through a portion of the housing body 32. The housing body 32 has a cavity 40 for receiving and holding the solenoid 18.

The latch assembly 10 also includes a pawl 14 shown pivotally connected to the latch housing 12 with suitable attachment means such as the pawl pivot members or spindles 42,44 which are provided extending outwardly from the pawl 14 at opposite sides thereof. The pivot members 42, 44 can also be provided as a single pivot member extending through the pawl 14. A pair of larger diameter base portions 46 are provided at the base of the pawl pivot members 42,44. The base portions 46 prevent excessive lateral play of the pawl 14 once the pawl is installed to the housing 12. The pawl 14 is installed onto the housing 12 by snap-fit placement of the pawl pivot members 42,44 into the pawl pivot recesses 48 (only one being shown in FIG. 9, the other being a mirror image) disposed in opposite sides of the slot 38. A pair of guide slots 50 (only one being shown in FIG. 9, the other being a mirror image) are provided on either side of the slot 38 which lead to the recesses 48. The pair of guide slots 50 form ramped surfaces which spread farther apart from one another with increasing distance from the recesses 48. The guide slots 50 guide the pawl pivot members 42,44 in the direction of the pawl pivot recesses 48 during the snap-fitting process.

As shown in FIGS. 9, 10, 18, and 19, the pawl 14 is provided having a body portion 52 with the pair of pawl pivot members 42, 44 extending therefrom. The pawl 14 has a lug or projection 54 and is provided with a pawl slot 56 to retain the keeper member 28 when the pawl 14 is in the latched position. In the illustrated example, the keeper member is attached to the lid of the glove box at a position such that when the swinging lid or door 20 is closed, the keeper member 28 will be positioned or caught in the crook or bend of the hook-like member 34. The pawl 14 is also provided with an arm portion 58 extending from the pawl body 52.

A pawl torsion spring 60 is installed on the pawl 14 with the coiled portions 62 and 64 surrounding the base portions 46 of the pawl pivot members 42 and 44, respectively. The cross bar 66 of the torsion spring 60 engages the notch 68 in the arm portion 58. The torsion spring 60 also has tail portions 70,72 and arms 74,76. The vertical spring arms 74,76 extend from the respective coil portions 62 and 64 of the torsion spring 60 and connect to cross bar 66. The pawl arm 58 is positioned intermediate the spring arms 74 and 76. The pawl 14 is installed with the notch 68 facing toward the rear of the housing 12. The projection 54 has a flat surface 78 that extends roughly in a radial direction relative to the pivot axis of the pawl 14.

The tails 70, 72 of the torsion spring 60 fit into and lie along the grooves 80, 82, respectively, when the pawl 14 is snap-fitted to the housing 12. With the tails 70, 72 of the torsion spring 60 so positioned, the cross bar 66 of the torsion spring 60 exerts a force on the arm portion 58 of the pawl 14 that biases the pawl 14 toward the open or unlatched configuration.

The solenoid 18 is supported in a frame 84 that in turn fits in the cavity 40 of the housing 12. The locking member 16 is in essence a continuation of the shaft of the solenoid 18. The locking member 16 may be integral with the shaft of the solenoid 18, or the locking member 16 may be an extension attached to the shaft of the solenoid 18. The frame 84 is provided with an opening to allow the locking member 16, or the shaft of the solenoid 18 as the case may be, to pass through the frame 84. The locking member 16 is provided with a flange 86. A spring 88 is provided intermediate the flange 86 and the body portion or coils 90 of the solenoid 18. The spring may be in direct contact with the solenoid body 90 or it may be in contact with the frame 84, depending upon the size of the opening in the frame 84. The spring 88 biases the locking member 16 into the extended position. When the locking member 16 is in the extended position and the pawl 14 is in the closed or latched position, the locking member 16 is positioned behind the lug 54 and prevents the pawl 14 from rotating to the open or unlatched position.

The latch assembly 10 is actuated by energizing the solenoid 18. The solenoid 18 may be energized using a remotely located switch (not shown). When the solenoid 18 is energized, the locking member 16 is retracted such that the locking member 16 is moved out of engagement with the projection or lug 54 thereby freeing up the pawl 14 for pivoting. The bias provided by the pawl torsion spring 60 rotates the pawl 14 from its latched position, where the keeper 28 is cooperatively captured by the pawl slot 56 and the hook-shaped flange 34, and allows the pawl 14 to rotate in the counterclockwise direction as viewed in FIGS. 21 and 22. The rotation of the pawl 14 brings the opening of the pawl slot 56 out from the portion of the slot 38 formed in the hook-shaped flange 34, such that the opening of the pawl slot faces roughly toward the lid of the glove box and allows the keeper member 28 to be disengaged from the pawl 14. The door 20 of the glove box 22 can then be opened by swinging the door 20 downward. The keeper member or striker 28 may be a rod supported at each end by suitable means such as the posts 92 attached to the lid 20. In addition, the keeper 28 may be in the form of any other suitable member such as a bar, claw, or other suitable attachment member.

Suitable mounting means are provided to retain the latch assembly 10 on a panel or mounting surface. For example, installation of the latch assembly 10 to a panel may be accomplished with screws or pins that engage the holes 94 and 96 for fastening of the latch assembly to a panel, such as for example, the frame 24 of the glove box 22. Additionally, in the illustrated example a lateral tab 98 is provided on each side of the hook-like member 34. The lateral tabs 98 engage corresponding notches 99 formed in the glove box 22 to more securely hold the latch 10 in place.

When the door 20 is being closed, the opening of the pawl slot 56 faces toward the keeper 28 and is unobstructed by the hook-like member 34. As the door 20 is slammed shut, the keeper 28 is received in the slot 56 and impacts the pawl 14 causing the clockwise rotation of the pawl 14 to the closed configuration shown in FIG. 22. At this time, even though the solenoid 18 may not be energized, the locking member 16 is partially retracted because the lug 54 and/or the pawl body 52 prevent movement of the locking member 16 to the fully extended position. As the pawl 14 rotates to the closed position, the lug 54 clears the locking member 16 allowing the locking member 16 to extend under the bias of spring 88 and move behind the lug 54. Once the locking member 16 is in the extended position it catches the flat side 78 of the projection 54 to keep the pawl 14 in the closed position illustrated in FIG. 22, thus securing the door 20 in the closed position.

In addition to the solenoid 18, the latch 10 may be provided with a handle to manually operate the latch in the event the solenoid fails or there is no power to operate the solenoid. As an alternative or in addition to the handle, a mechanical key-operated lock plug can be incorporated into the design whereby rotation of the lock plug pushes the locking member 16, for example using some form of cam arrangement, out of engagement with the lug 54 to thereby allow the glove box to be opened in the event of an electrical power failure.

Another embodiment of the latch in accordance with the present invention is illustrated in FIGS. 23 through 43. The latch 100 in the present embodiment is similar in both structure and function to many of the features already described in detail with respect to the previous embodiment.

The latch 100 includes a latch housing 102, a pawl 104, a locking member 106, and means for selectively moving the locking member in and out of engagement with the pawl. In the illustrated embodiment, a solenoid assembly 108 serves as the means for selectively moving the locking member in and out of engagement with the pawl.

In the illustrated example, the latch 100 is shown being used for securing the lid 200 of an automotive glove box 202 in the closed position. However, the latch 100 is generally applicable wherever one or more closure members need to be secured in a certain position. Further, in the illustrated embodiment the latch 100 is mounted to the frame 204 surrounding the glove box opening 206 while the keeper 208 is mounted to the lid 200 of the glove box 202. Of course, it is possible to arrange for the latch 100 to be mounted to the lid 200 of the glove box while the keeper 208 is in a fixed position relative to the glove box 202 itself without departing from the spirit and scope of the present invention. In addition, the latch 100 may be mounted in any orientation depending upon the particular application. In the illustrated example, the front of the latch housing 102 faces toward the lid 200 of the glove box, and the rear of the latch housing 102 faces toward the back wall of the glove box 202.

The housing 102 is provided with a body portion 110 and has a hook-like member 112 projecting therefrom. Hook-like as used herein refers to any member that has a crook, curve, or bend to thereby catch on another member. In the illustrated example, once the latch 100 is installed to the glove box 202, the hook-like member 112 extends downward and then forward from the lower end of the housing body portion 1110 such that the tip 114 of the hook-like member 112 points toward the lid 200 of the glove compartment 202. A first slot 116 is provided within the hook-like member 112 and extends through a portion of the housing body 110. The housing body 110 has a cavity 118 for receiving and holding the solenoid assembly 108.

The cavity 118 is positioned relative to the hook-like member 112 such that the longitudinal axis of the shaft or plunger 120 of the solenoid 122 is directed in a direction that is substantially perpendicular to the axis of rotation of the pawl 104. In the illustrated embodiment, the longitudinal axis of the shaft or plunger 120 of the solenoid 122 essentially lies in the plane of rotation of the pawl 104. The plane of rotation of the pawl 104 is defined as a plane to which the axis of rotation of the pawl 104 is perpendicular and that passes through the center of the pawl 104. This geometric arrangement allows only a single fastener passing through the hole 124 to suffice for securely attaching the housing 102 to a door or doorframe in cooperation with the lateral tabs 126. Minimizing the number of fasteners required for installation reduces the overall cost to manufacturers of using the latch 100 in their products. Furthermore, the geometric arrangement of the latch housing 102 results in savings in materials because this arrangement yields a more compact latch housing, A resilient snap leg 128 is provided integrally with a wall of the cavity 118. The snap leg 128 is used to secure the solenoid assembly 108 within the cavity or solenoid housing 118, thus obviating the need for fasteners or glue for this purpose. The snap leg 128 has a sloped surface or ramp 130 that terminates in a projecting ridge 132. A substantially flat surface 134 extends from the ridge 132 toward the outer surface of the wall of the cavity 118 to which the snap leg 128 is attached. The surface 134 extends from the ridge 132 in a direction substantially parallel to the bottom 117 of the cavity 118. The snap leg 128 obviates the need for glue or fasteners in securing the solenoid assembly 108 to the housing 102. The solenoid assembly 108 is installed simply by pressing or pushing the solenoid assembly 108 into the cavity 118. As the solenoid assembly 108 is being pushed into the cavity 118, the solenoid frame 136 acts on the ramp 130 to push the snap leg 128 out of the way of the solenoid assembly 108. Once the solenoid assembly 108 is properly seated against the bottom of the cavity 118, the solenoid frame 136 clears the ridge 132 allowing the snap leg 128 to snap back to its original position. Once the snap leg 128 is in its original position, a portion of the solenoid frame 136 is captured between the surface 134 and the bottom 117 of the cavity 118 thus securing the solenoid assembly 108 within the cavity 118. The elimination of the need for glue and/or fasteners for securing the solenoid assembly 108 to the housing 102 results in further cost savings.

The latch assembly 100 also includes a pawl 104 shown pivotally connected to the latch housing 102 with suitable attachment means such as the pawl pivot members or spindles 138, 140 which are provided extending outwardly from the pawl 104 at opposite sides thereof. The pivot members 138, 140 can also be provided as a single pivot member extending through the pawl 104. A pair of larger diameter base portions 142 and 144 are provided at the base of the pawl pivot members 138 and 140 respectively. The base portions 142 and 144 prevent excessive lateral play of the pawl 104 once the pawl is installed to the housing 102. The pawl 104 is installed onto the housing 102 by snap-fit placement of the pawl pivot members 138 and 140 into the pawl pivot recesses 146 and 148, respectively, disposed on opposite sides of the first slot 116. A pair of guide slots 150 and 152 are provided on either side of the slot 116. The guide slots 150 and 152 lead to the recesses 146 and 148, respectively. The pair of guide slots 150 and 152 form ramped surfaces which spread farther apart from one another with increasing distance from the recesses 146 and 148. The guide slots 150, 152 guide the pawl pivot members 138, 140 in the direction of the pawl pivot recesses 146 and 148 during the snap-fitting process.

The pawl 104 is has a body portion 154 with the pair of pawl pivot members 138,140 extending therefrom. The pawl 104 has a lug or projection 156 and is provided with a pawl slot 158 to retain the keeper member 208 when the pawl 104 is in the latched position. In the illustrated example, the keeper member is attached to the lid of the glove box at a position such that when the swinging lid or door 200 is closed, the keeper member 208 will be positioned or caught in the crook or bend of the hook-like member 112. The pawl 104 is also provided with an arm portion 160 extending from the pawl body 154.

A pawl torsion spring 162 is installed on the pawl 104 with the coiled portions 164 and 166 surrounding the base portions 142, 144 of the pawl pivot members 138 and 140, respectively. The cross bar 168 of the torsion spring 162 engages the notch 170 in the arm portion 160. In the illustrated example the notch 170 is enlarged to more positively retain the cross bar 168 in position relative to the pawl 104. The torsion spring 162 also has tail portions 172,174 and arms 176,178. The vertical spring arms 176,178 extend from the respective coiled portions 164 and 166 of the torsion spring 162 and connect to cross bar 168. The pawl arm 160 is positioned intermediate the spring arms 176 and 178. When the pawl 104 is installed in the housing 102, the notch 170 is located further to the rear relative to the pawl slot 158. The projection or lug 156 has a flat surface 180 that extends roughly in a radial direction relative to the pivot axis of the pawl 104.

The tails 172, 174 of the torsion spring 162 fit into and lie along the grooves 182, 184, respectively, when the pawl 104 is snap-fitted to the housing 102. With the tails 172, 174 of the torsion spring 162 positioned in the grooves 182,184, the cross bar 168 of the torsion spring 162 exerts a force on the arm portion 160 of the pawl 104 that biases the pawl 104 toward the open or unlatched configuration.

The solenoid 122 is supported in a frame 136 that in turn fits in the cavity 118 of the housing 102. The locking member 106 is in essence a continuation of the shaft 120 of the solenoid 122. The locking member 106 may be integral with the shaft 120 of the solenoid 122, or the locking member 106 may be an extension attached to the shaft 120 of the solenoid 122. The frame 136 is provided with an opening to allow the locking member 106, or the shaft 120 of the solenoid 122 as the case may be, to pass through the frame 136. The locking member 106 is provided with a flange 186. A spring 188 is provided intermediate the flange 186 and the body portion or coils 190 of the solenoid 122. The spring may be in direct contact with the solenoid body 190 or it may be in contact with the frame 136, depending upon the size of the opening in the frame 136. The spring 188 biases the locking member 106 into the extended position. When the locking member 106 is In the extended position and the pawl 104 is in the closed or latched position, the locking member 106 is positioned behind the lug 156 and prevents the pawl 104 from rotating to the open or unlatched position.

The latch assembly 100 is actuated by energizing the solenoid 122. The solenoid 122 may be energized using a remotely located switch (not shown). When the solenoid 122 is energized, the locking member 106 is retracted such that the locking member 106 is moved out of engagement with the projection or lug 156 thereby freeing up the pawl 104 for pivoting. The bias provided by the pawl torsion spring 162 rotates the pawl 104 from its latched position where the keeper 208 is cooperatively captured by the pawl slot 158 and the hook-shaped flange 112, and allows the pawl 104 to rotate in the clockwise direction as viewed in FIGS. 36, 37, 40, and 41. The rotation of the pawl 104 brings the opening of the pawl slot 158 out from the portion of the slot 116 formed in the hook-shaped flange 112, such that the opening of the pawl slot faces roughly toward the lid of the glove box and allows the keeper member 208 to be disengaged from the pawl 104. The door 200 of the glove box 202 can then be opened by swinging the door 200 downward. The keeper member or striker 208 may be a rod supported at each end by suitable means such as the posts 192 (only one shown) attached to the lid 200. In addition, the keeper 208 may be in the form of any other suitable member such as a bar, claw, or other suitable attachment member.

Suitable mounting means are provided to retain the latch assembly 100 on a panel or mounting surface. For example, installation of the latch assembly 100 to a panel may be accomplished with a screw or pin that engages the hole 124 for fastening of the latch assembly to a panel, such as for example, the frame 204 of the glove box 202. Additionally, in the illustrated example a lateral tab 126 is provided on each side of the hook-like member 112. The lateral tabs 126 engage corresponding notches or openings 210 formed in the glove box 202 to more securely hold the latch 100 in place.

When the door 220 is being closed, the opening of the pawl slot 158 faces toward the keeper 208 and is unobstructed by the hook-like member 112. As the door 200 is slammed shut, the keeper 208 is received in the slot 158 and impacts the pawl 104 causing the counterclockwise rotation of the pawl 104 (as viewed in FIGS. 36, 37, 40, and 41) to the closed configuration shown in FIGS. 36 and 37. At this time, even though the solenoid 122 may not be energized, the locking member 106 is partially retracted because the lug 156 and/or the pawl body 154 prevent movement of the locking member 106 to the fully extended position. As the pawl 104 rotates to the closed position, the lug 156 clears the locking member 106 allowing the locking member 106 to extend under the bias of spring 188 and move behind the lug 156. Once the locking member 106 is in the extended position it catches the flat side 180 of the projection 156 to keep the pawl 104 in the closed position illustrated in FIGS. 36 and 37, thus securing the door 200 in the closed position.

In addition to the solenoid 122, the latch 100 may be provided with a handle to manually operate the latch in the event the solenoid fails or there is no power to operate the solenoid. As an alternative or in addition to the handle, a mechanical key-operated lock plug can be incorporated into the design whereby rotation of the lock plug pushes the locking member 106, for example using some form of cam arrangement, out of engagement with the lug 156 to thereby allow the glove box to be opened in the event of an electrical power failure.

Another embodiment of the latch in accordance with the present invention is illustrated in FIGS. 44 through 83. The latch 1100 in the present embodiment is similar in both structure and function to many of the features already described in detail with respect to the previous embodiments.

Referring to FIGS. 44–83, the latch 1100 of the present invention includes a paddle-shaped handle 1102 which is pivotally mounted to a latch housing 1104. The housing 1104 is provided with flanges 1106 and 1108 which have projections thereon, respectively 1110 and 1112. The paddle or handle 1102 is preferably provided with suitable means for attachment to the housing such as pintels, raised bosses or the like. In the illustrated example, the handle 1102 is provided with openings 1114 and 1116 to receive projections 1110 and 1112, respectively. It should be readily apparent that the positions of the projections 1110 and 1112 and of the holes 1114 and 1116 can be reversed, i.e. the holes can be provided in the housing and the projections can be attached to the handle, without departing from the spirit and scope of the present invention. Preferably, the flanges 1106 and 1108 are resilient and the projections 1110 and 1112 are beveled on one side to allow the handle 1102 to be snap-fitted to the housing 1104.

The housing 1104 has a lock plug socket 1118 having a generally cylindrical bore for receipt of a lock plug 1120. The lock plug socket 1118 is especially adapted to receive the lock plug 1120. The lock plug 1120 has an end portion which has projections 1122 and cavities 1124. The lock plug 1120 also has retractable projections 1126 which retract upon the insertion of an appropriate key into the keyhole 1128 to thereby allow rotation of the lock plug 1120 within the socket 1118.

Also supported within the socket 1118 is a cam plug 1130. The cam plug 1130 has projections 1132 and 1134 that mate with the projections 1122 and cavities 1124 such that the lock plug 1120 and the cam plug 1130 rotate as a unit. The end of the cam plug 1130, located distally from the lock plug 1120 is provided with an eccentric cam pin 1136.

Figure 1:
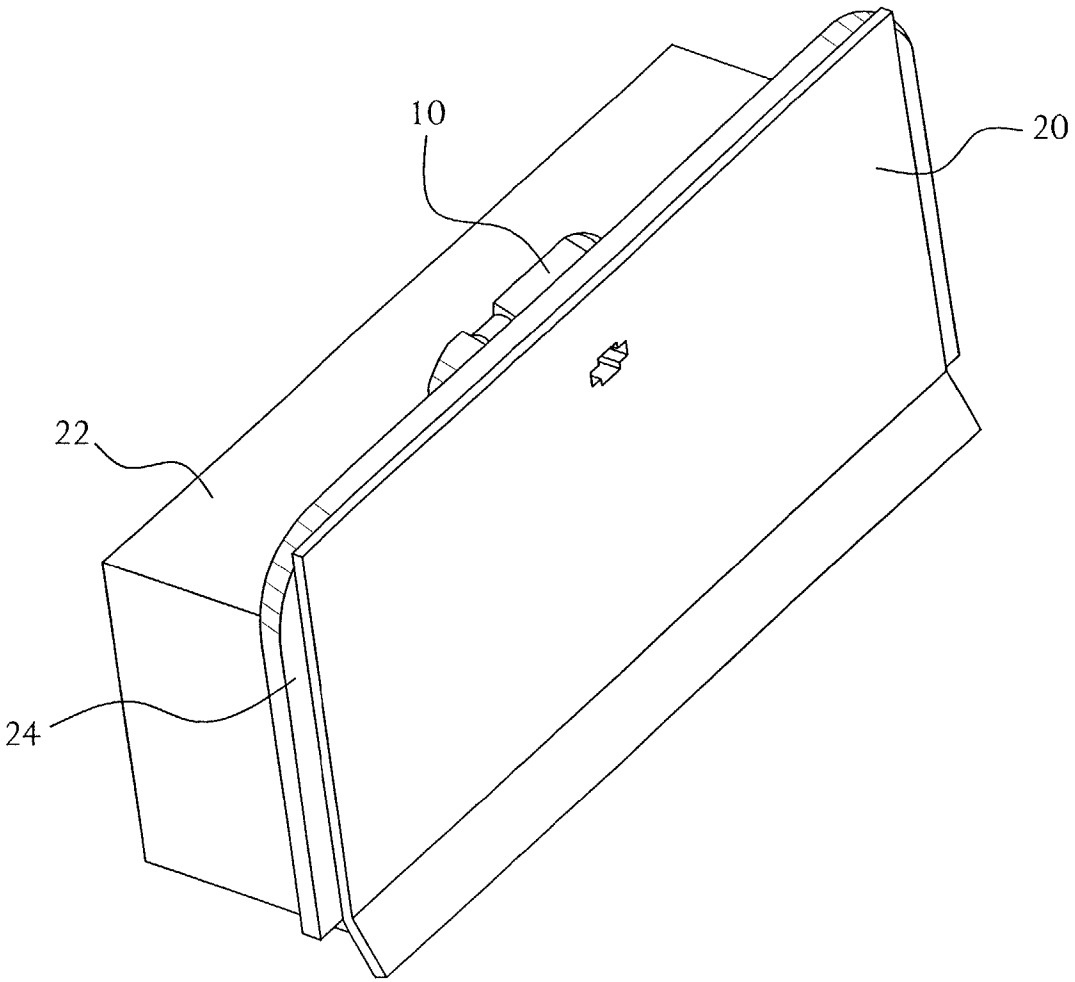
FIG. 1 is an environmental view showing the latch of the present invention installed to an automotive glove box with the lid of the glove box in the closed position.
Figure 2:
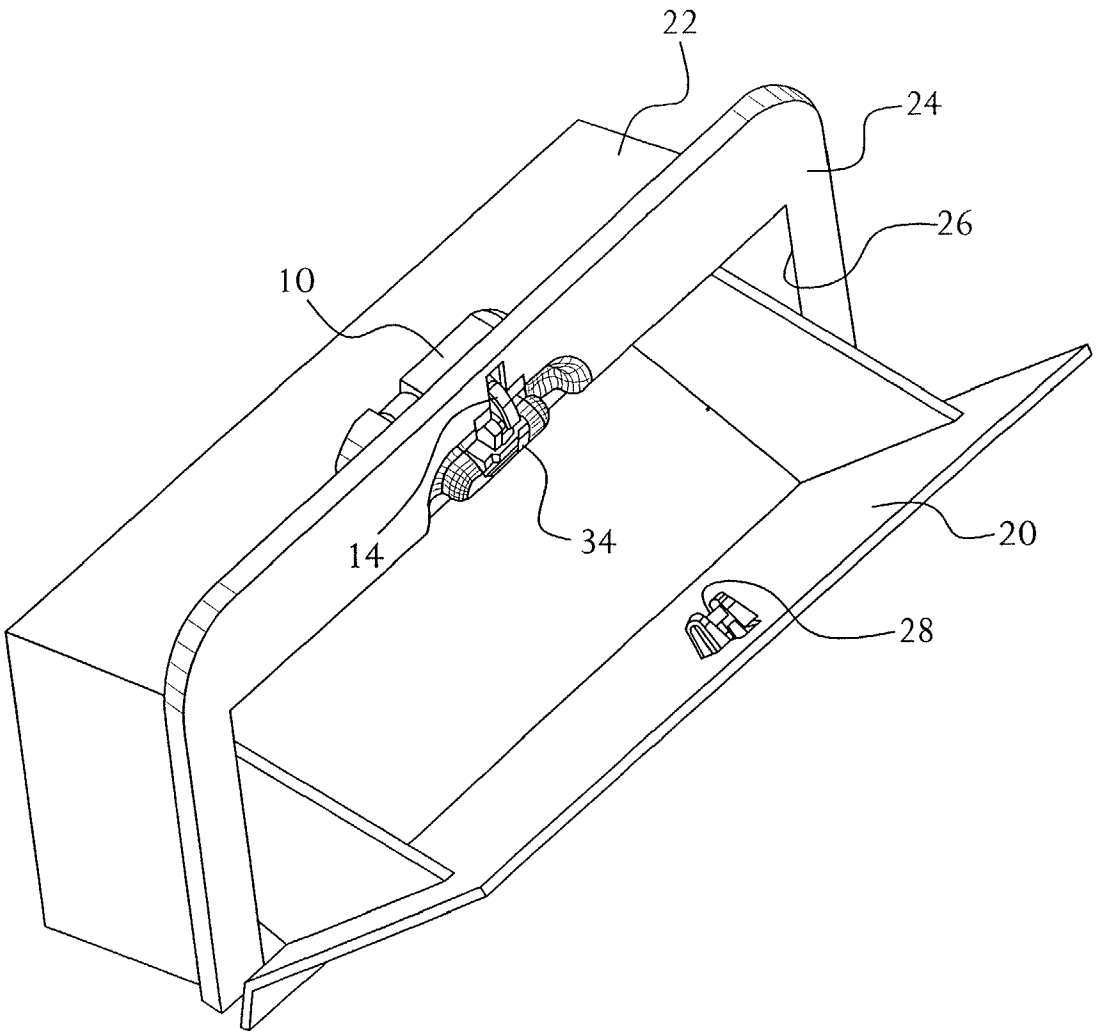
FIG. 2 is an environmental view showing the latch of the present invention installed to an automotive glove box with the lid of the glove box in the open position.
Figure 3:
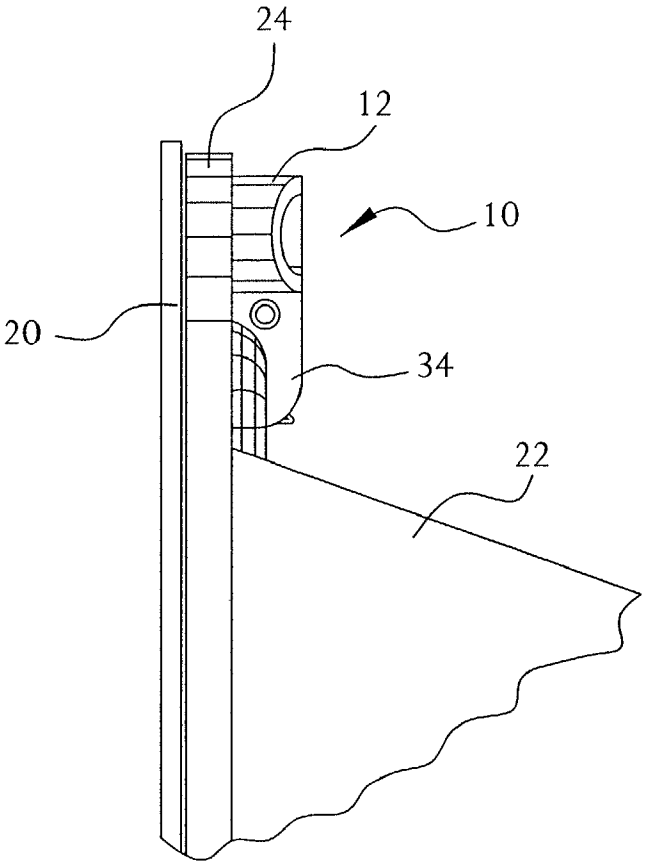
FIG. 3 is an environmental left side view showing the latch of the present invention installed to an automotive glove box with the lid of the glove box in the closed position.
Figure 4:
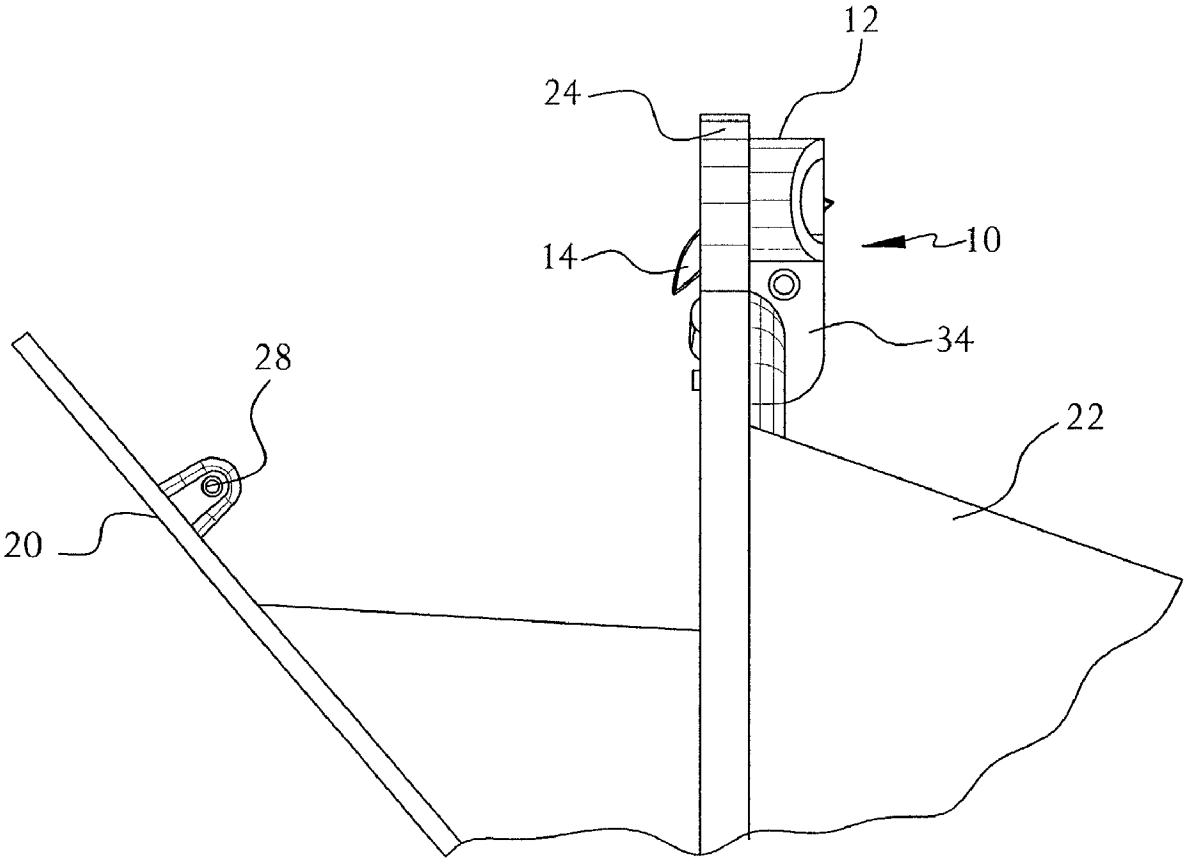
FIG. 4 is an environmental left side view showing the latch of the present invention installed to an automotive glove box with the lid of the glove box in the open position.
Figure 5:
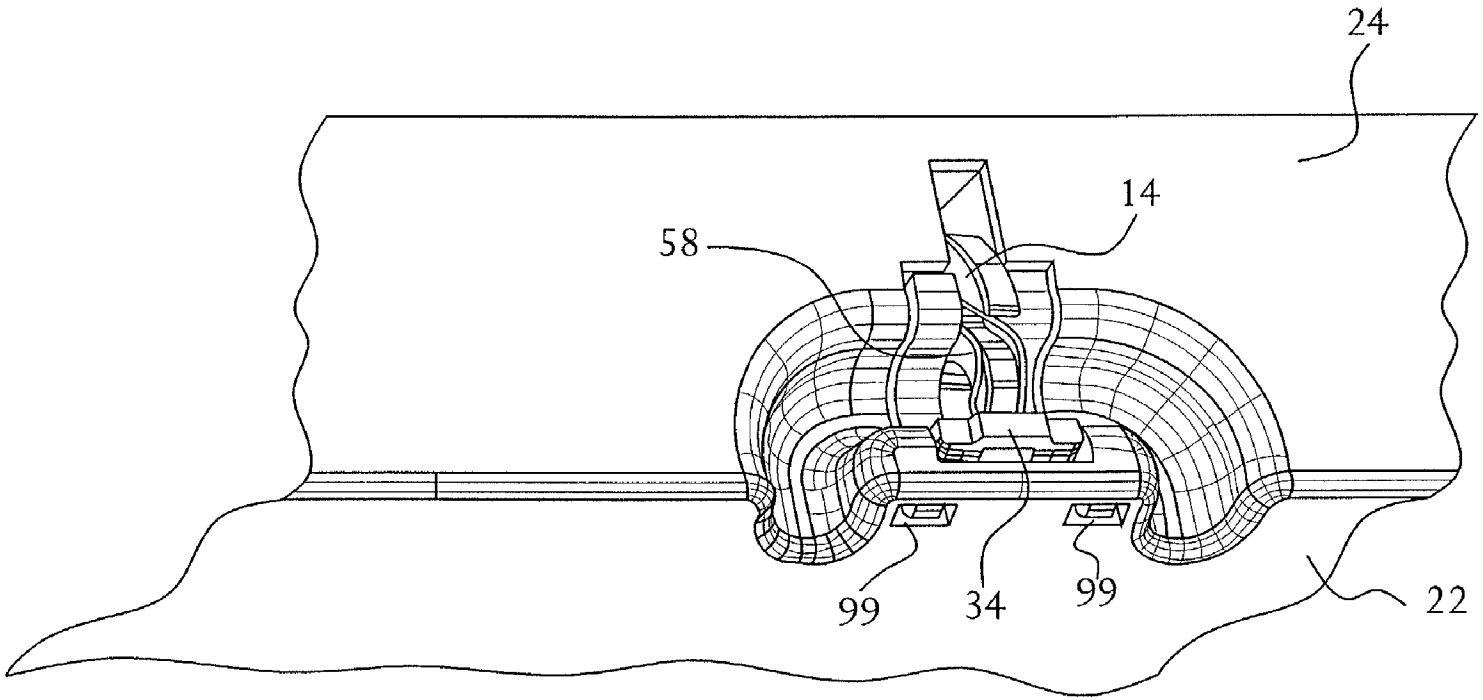
FIG. 5 is an environmental front view showing the latch of the present invention installed on the frame surrounding the opening of an automotive glove box.
Figure 6:
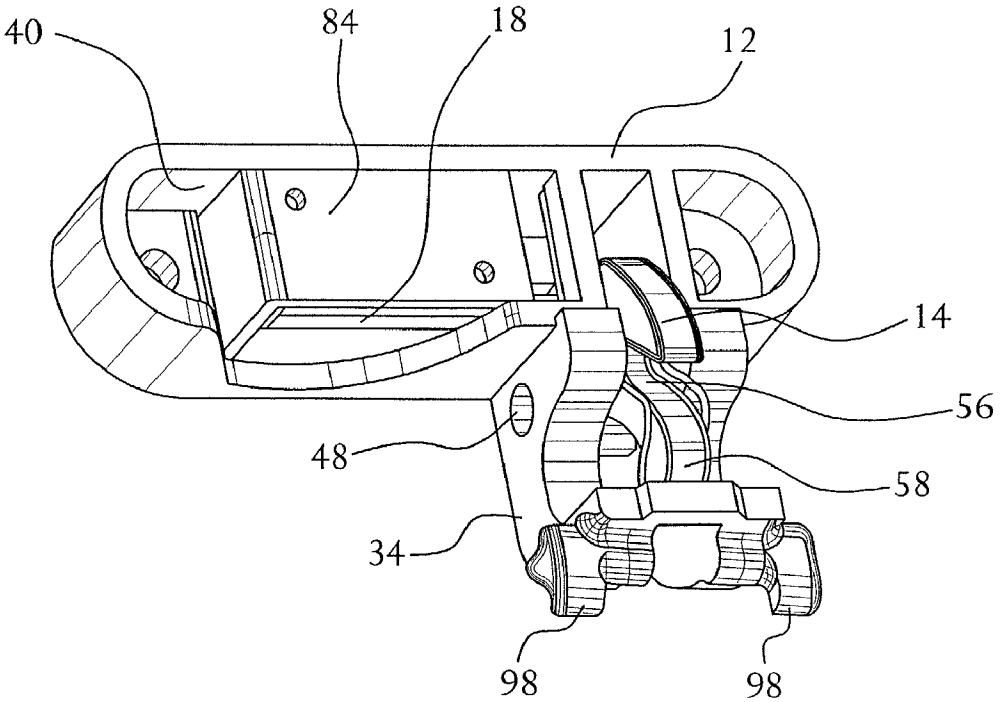
FIG. 6 is a front perspective view of the latch of the present invention showing the latch in the open configuration.
Figure 7:
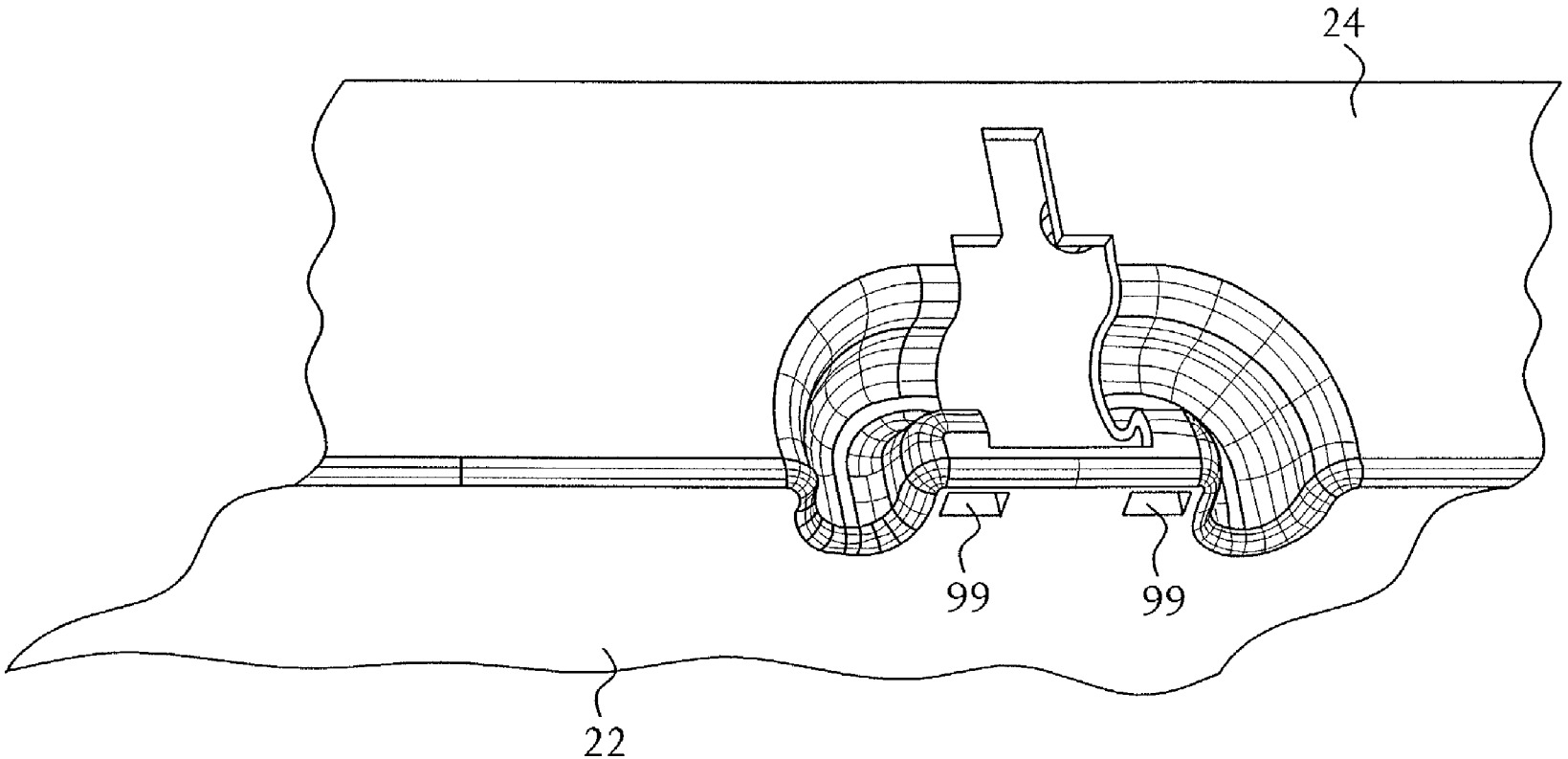
FIG. 7 is a front view showing the frame, surrounding the opening of an automotive glove box, adapted for installation of the latch of the present invention.
Figure 8:
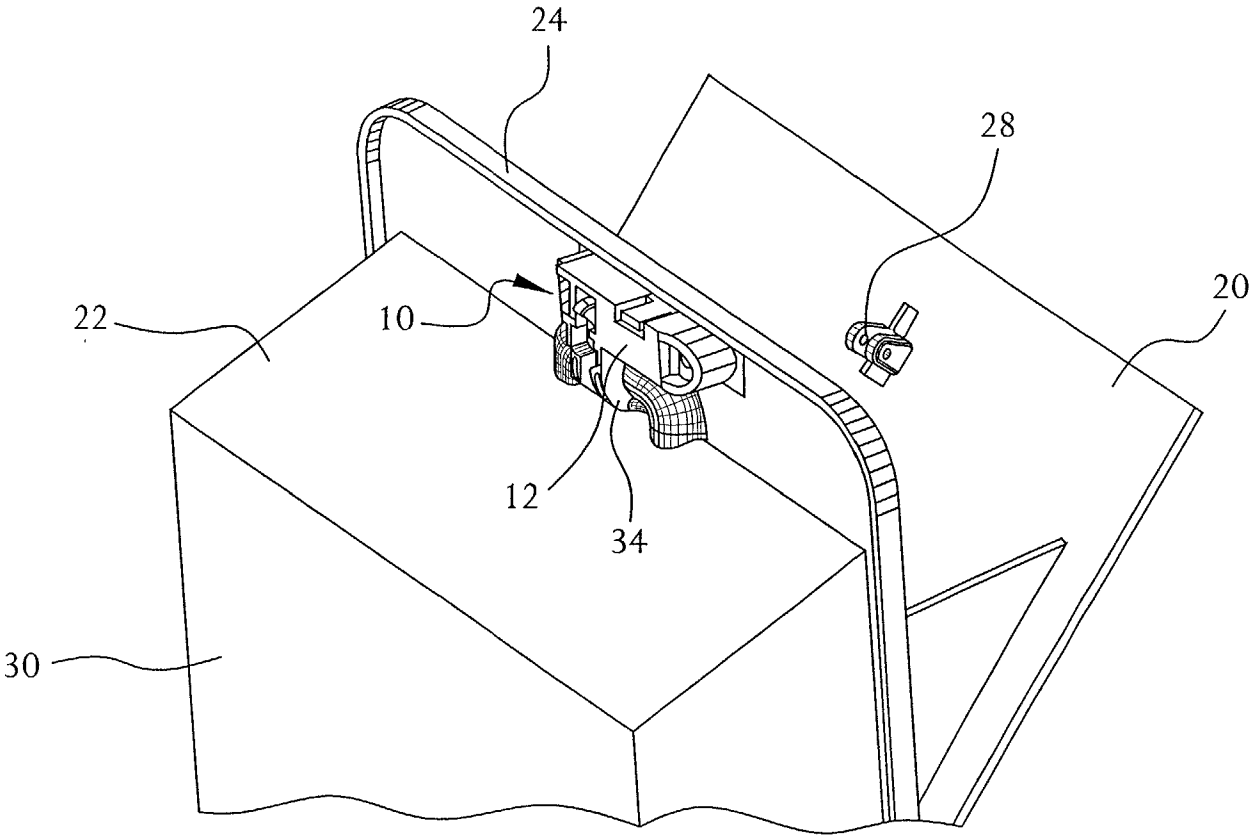
FIG. 8 is an environmental rear perspective view showing the latch of the present invention installed to an automotive glove box with the lid of the glove box in the open position.
Figure 9:
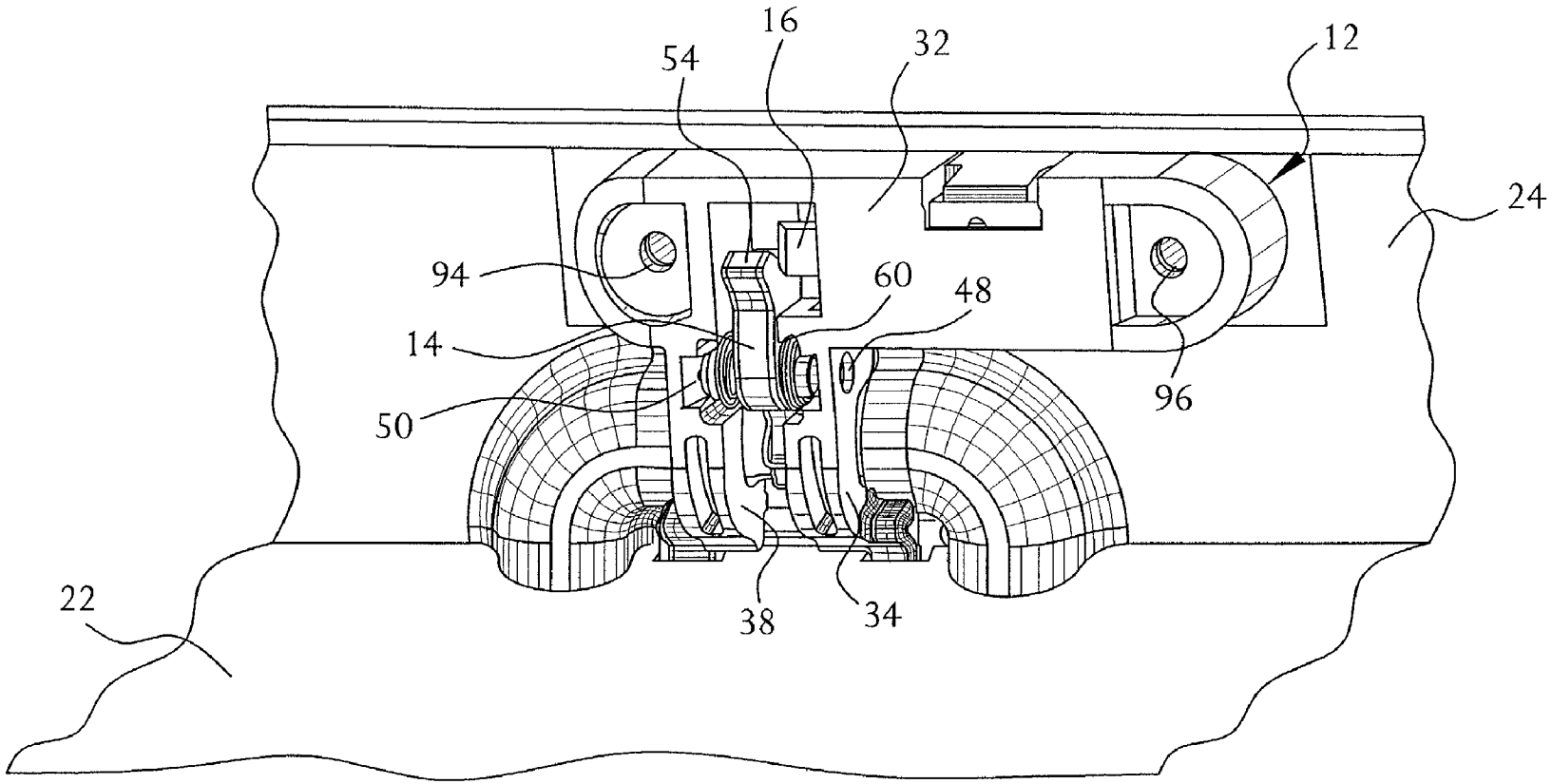
FIG. 9 is an environmental rear perspective view showing the latch of the present invention installed on the frame surrounding the opening of an automotive glove box, with the latch in the open configuration.
Figure 10:
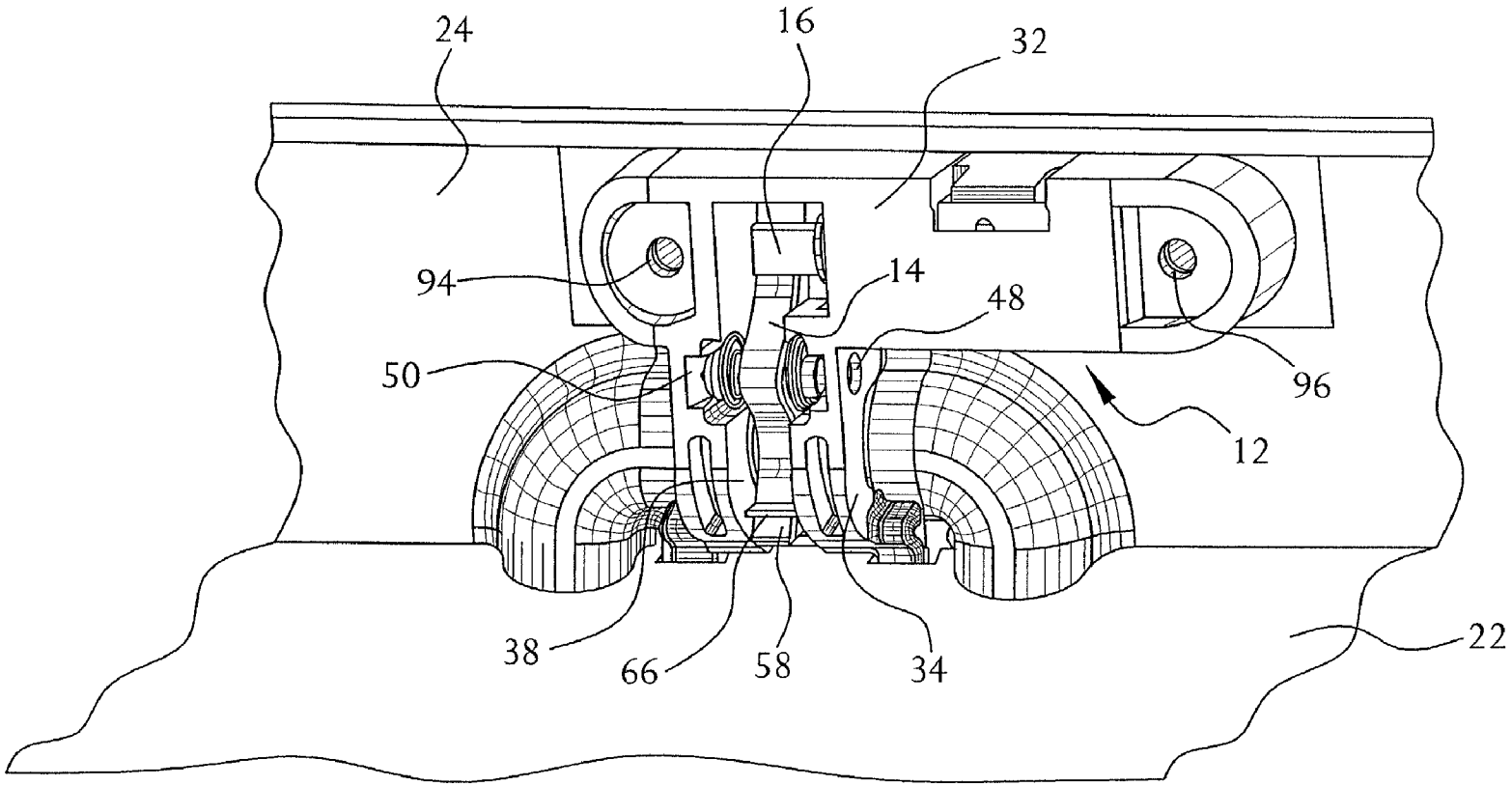
FIG. 10 is an environmental rear perspective view showing the latch of the present invention installed on the frame surrounding the opening of an automotive glove box, with the latch in the closed configuration.
Figure 11:
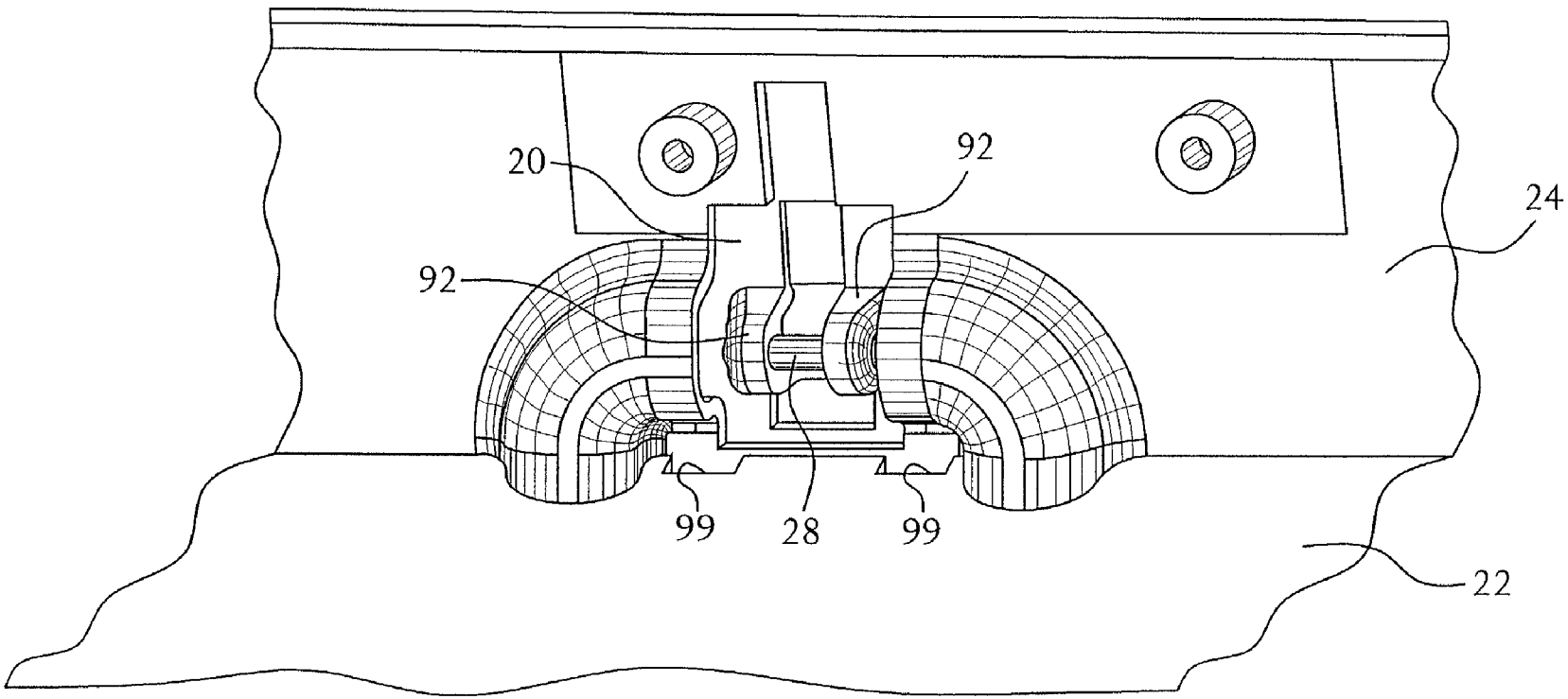
FIG. 11 is a rear perspective view showing the frame surrounding the opening of the automotive glove box with the latch removed and the lid in the closed position to illustrate the position of the keeper when the lid is closed.
Figure 12:
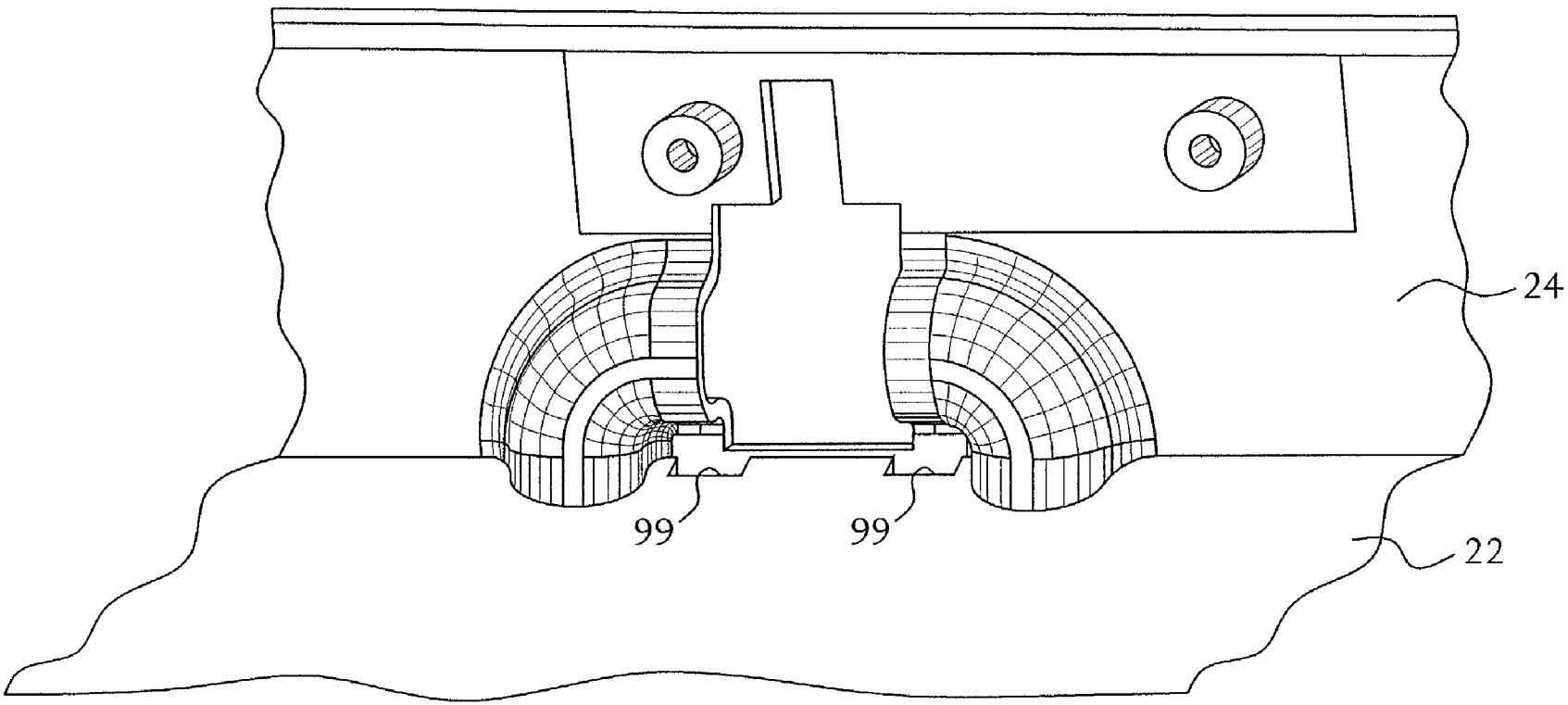
FIG. 12 is a rear perspective view showing the frame surrounding the opening of the automotive glove box with the latch removed.
Figure 13:
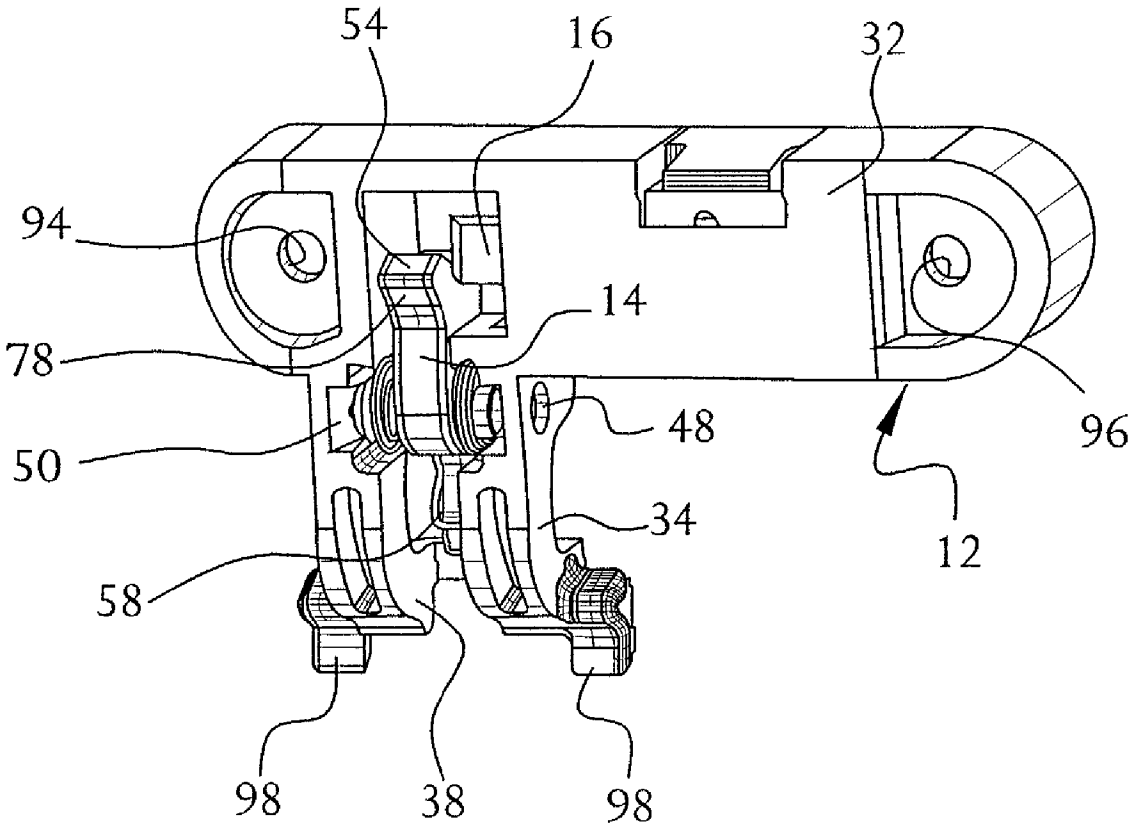
FIG. 13 is a rear perspective view of the latch of the present invention with the pawl of the latch in the open or unlatched configuration.
Figure 14:
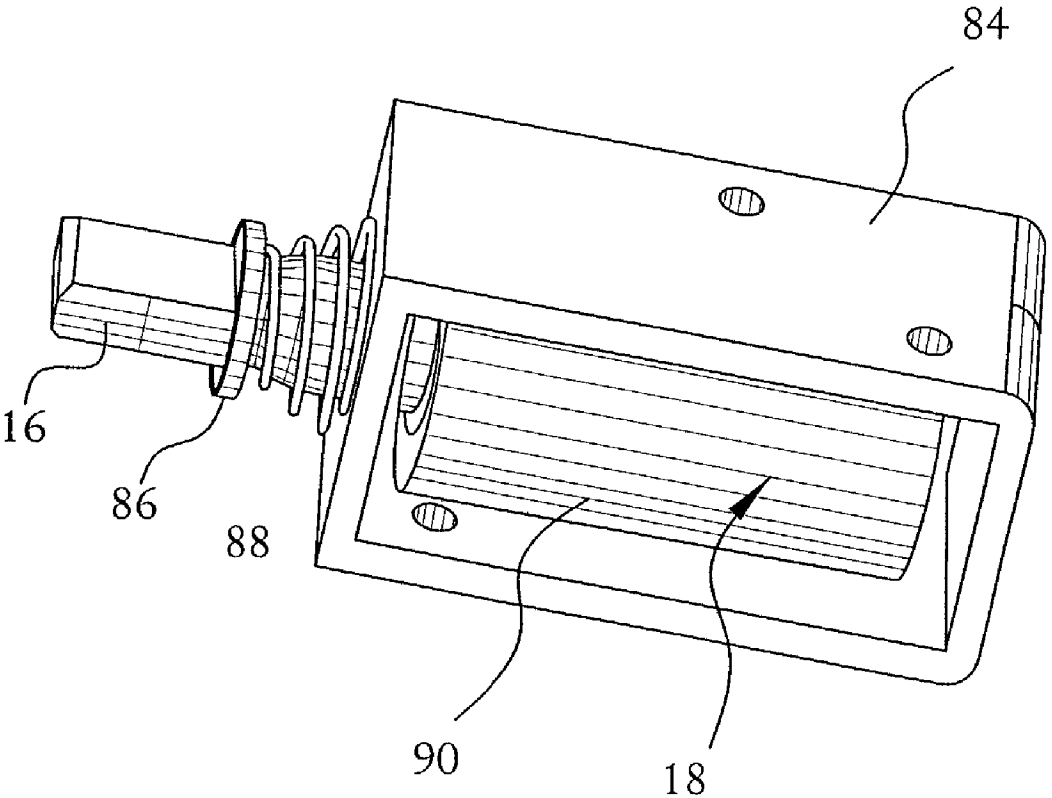
FIG. 14 is a perspective view of the solenoid and locking member assembly of the present invention showing the locking member in the extended position.
Figure 15:
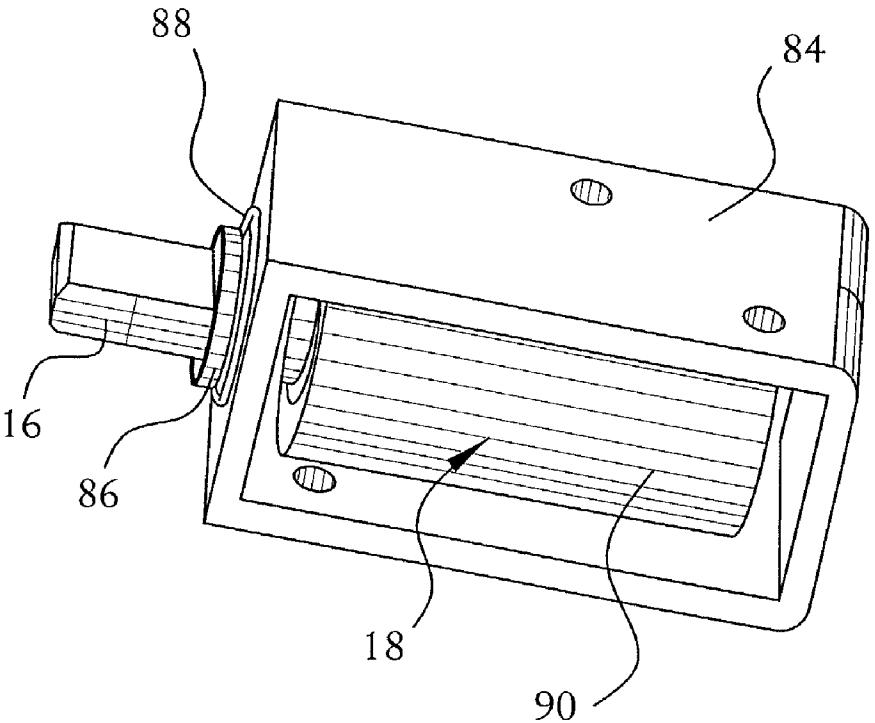
FIG. 15 is a perspective view of the solenoid and locking member assembly of the present invention showing the locking member in the retracted position.
Figure 16:
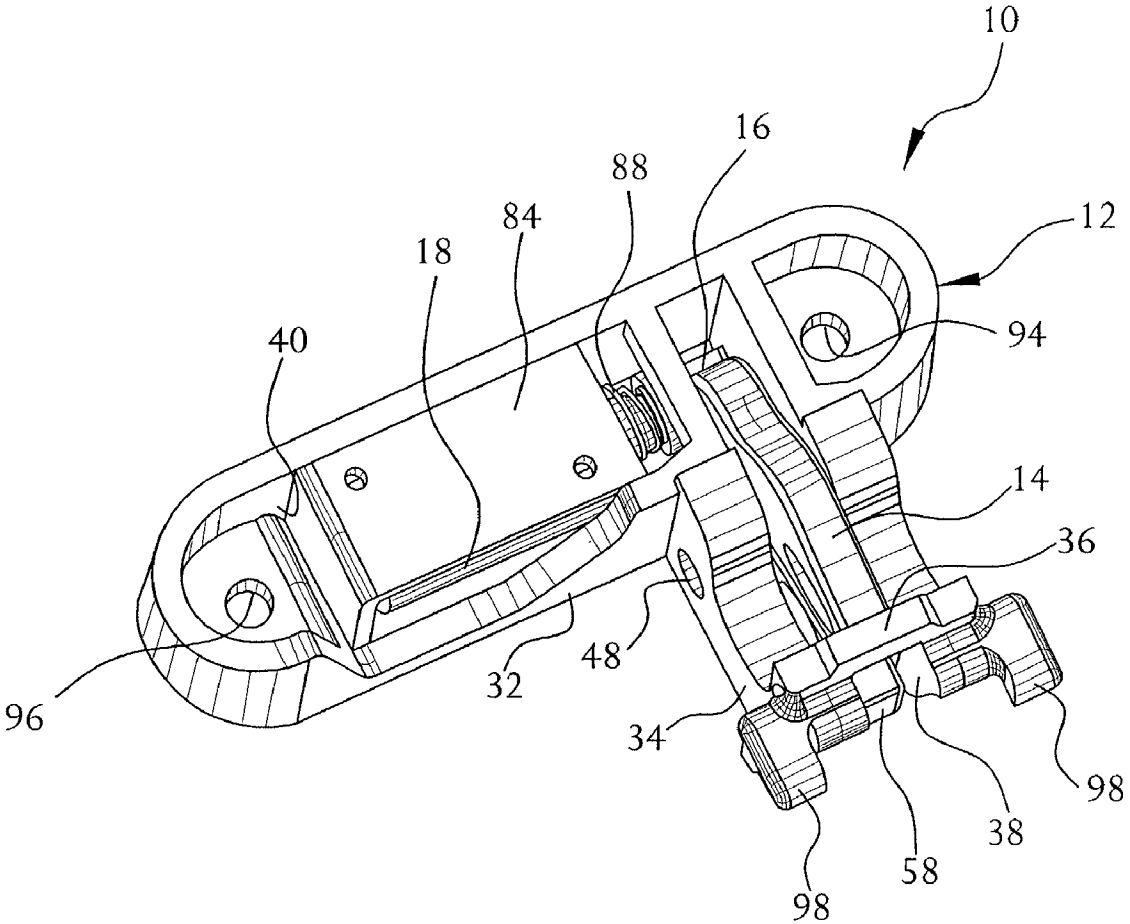
FIG. 16 is a front perspective view of the latch of the present invention with the pawl of the latch in the closed or latched configuration.
Figure 17:
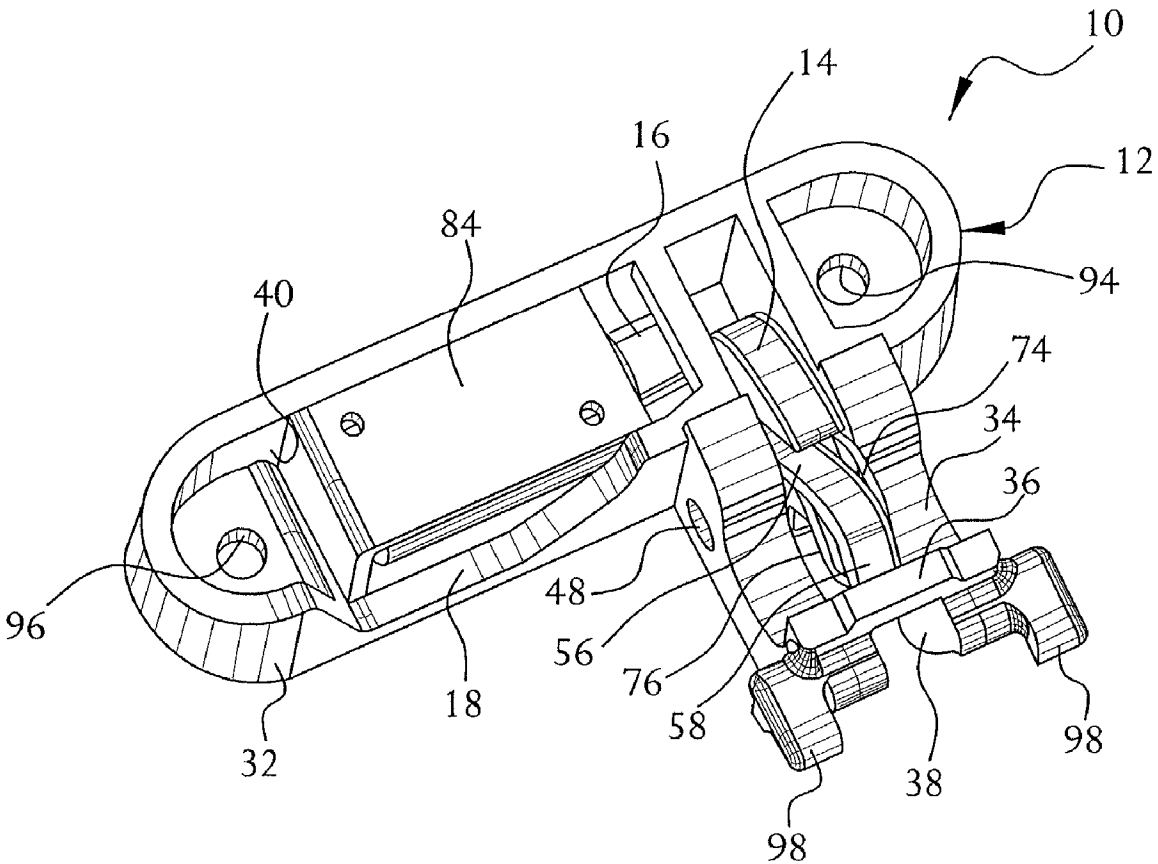
FIG. 17 is a front perspective view of the latch of the present invention with the pawl of the latch in the open or unlatched configuration.
Figure 18:
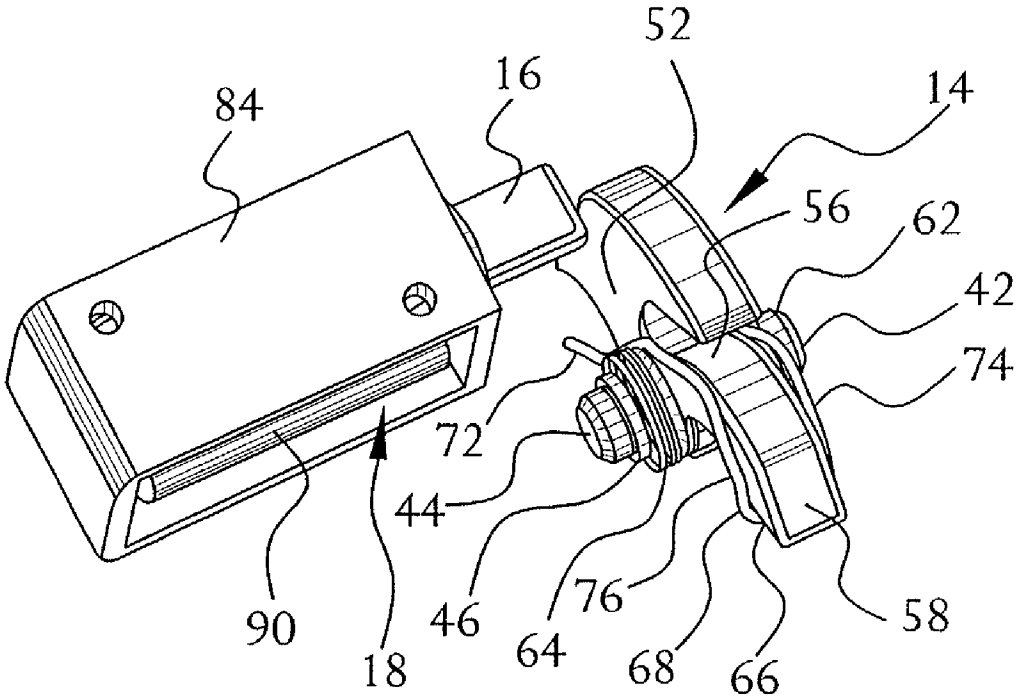
FIG. 18 is fragmentary view showing the spatial relationship between the pawl and the solenoid assembly when the pawl is in the open or unlatched configuration.
Figure 19:
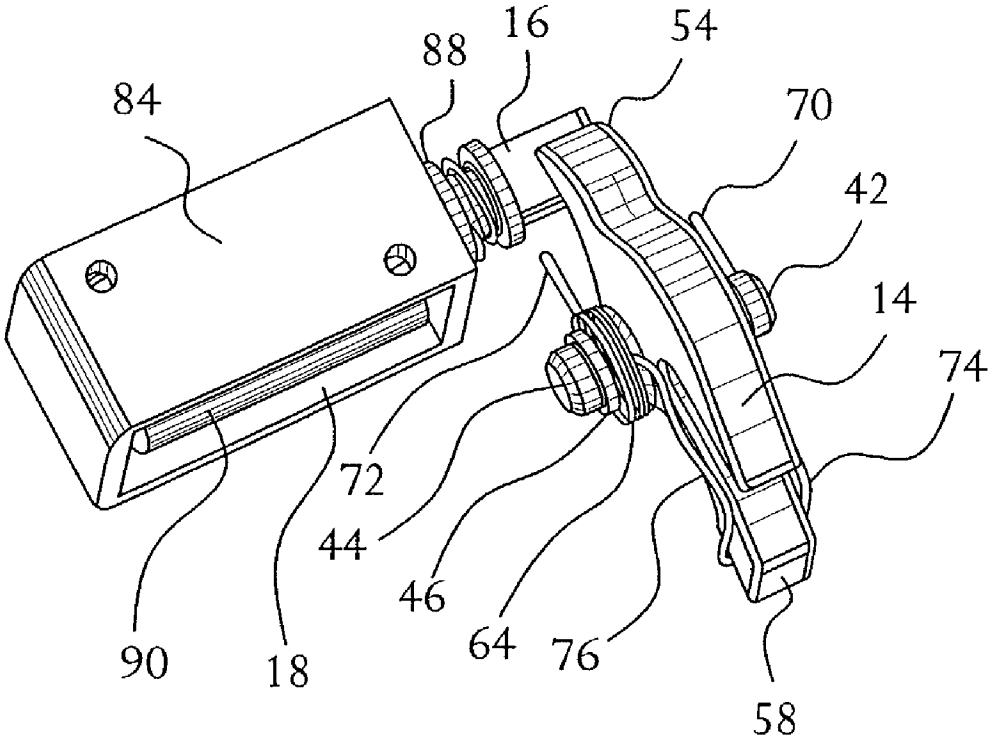
FIG. 19 is fragmentary view showing the spatial relationship between the pawl and the solenoid assembly when the pawl is in the closed or latched configuration.
Figure 20:
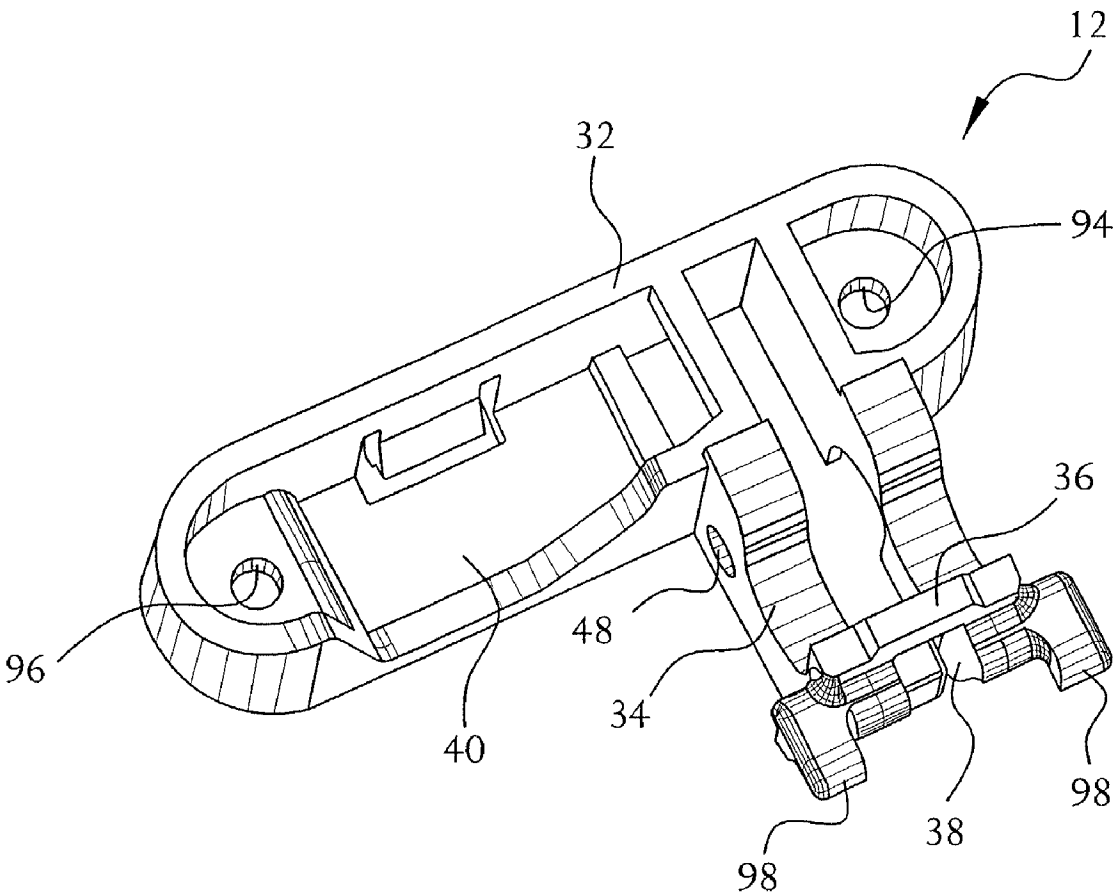
FIG. 20 is a front perspective view of the housing of the latch of the present invention.
Figure 21:
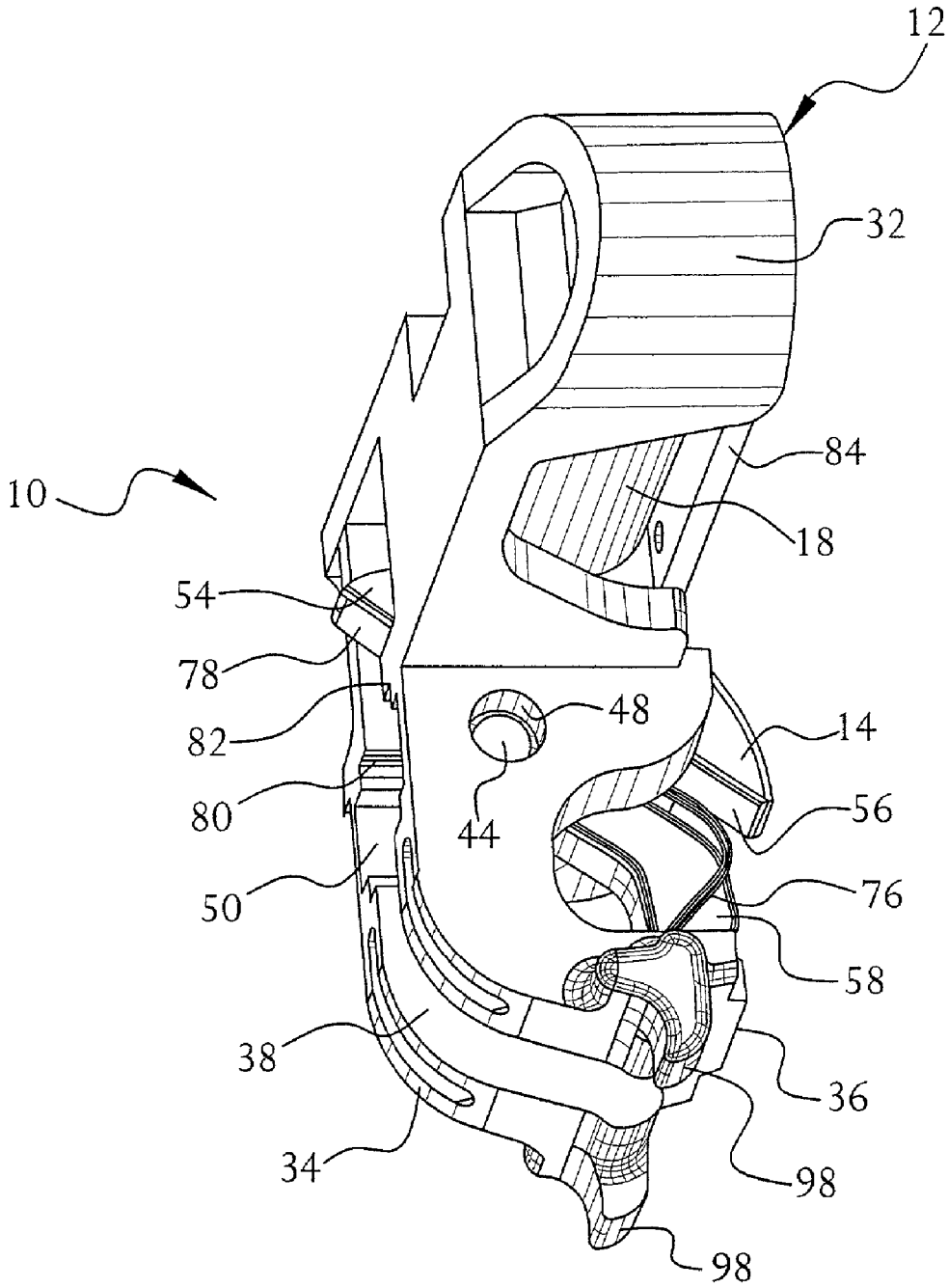
FIG. 21 is a right side perspective view of the latch of the present invention with the pawl of the latch in the open or unlatched configuration.
Figure 22:
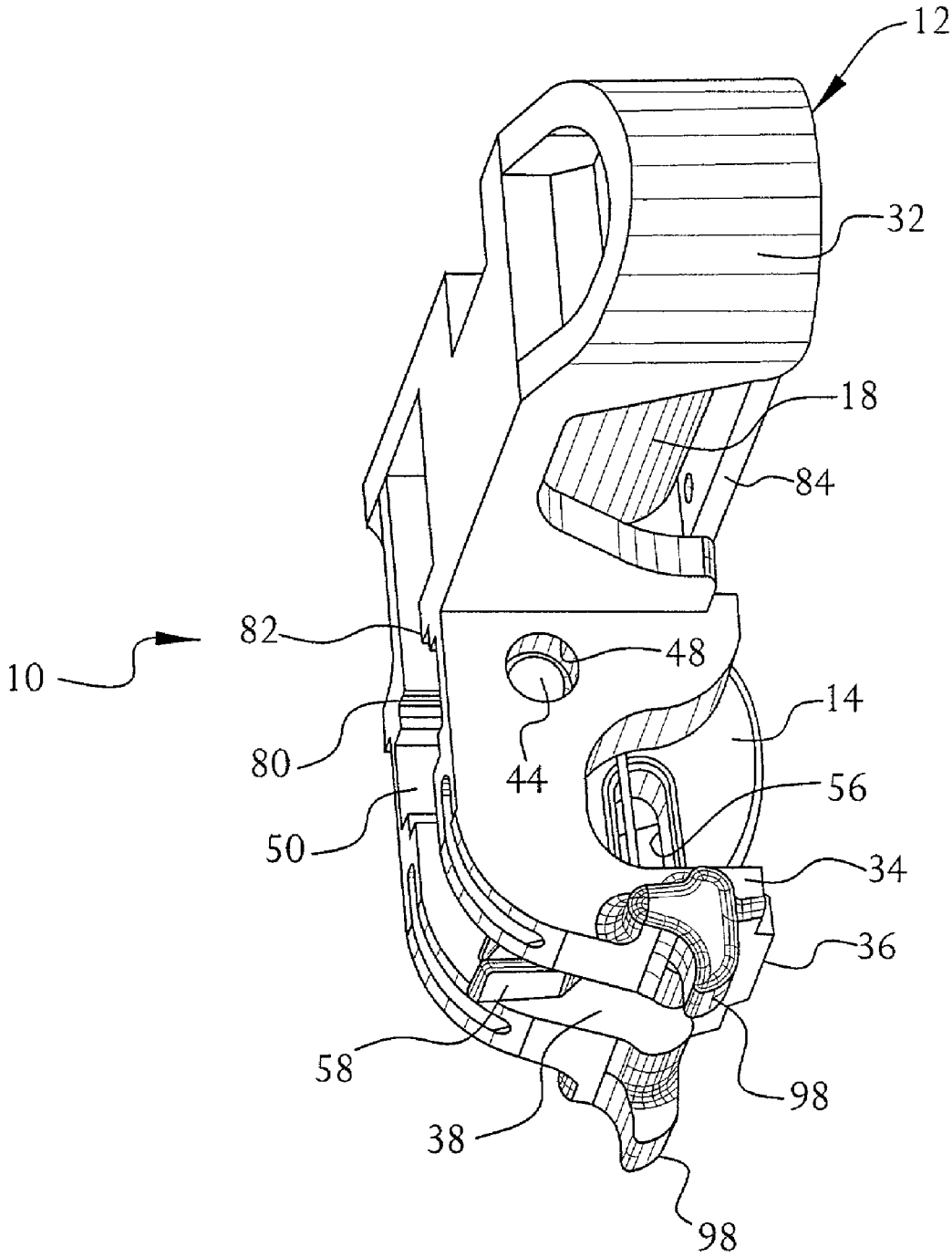
FIG. 22 is a right side perspective view of the latch of the present invention with the pawl of the latch in the closed or latched configuration.
Figure 23:
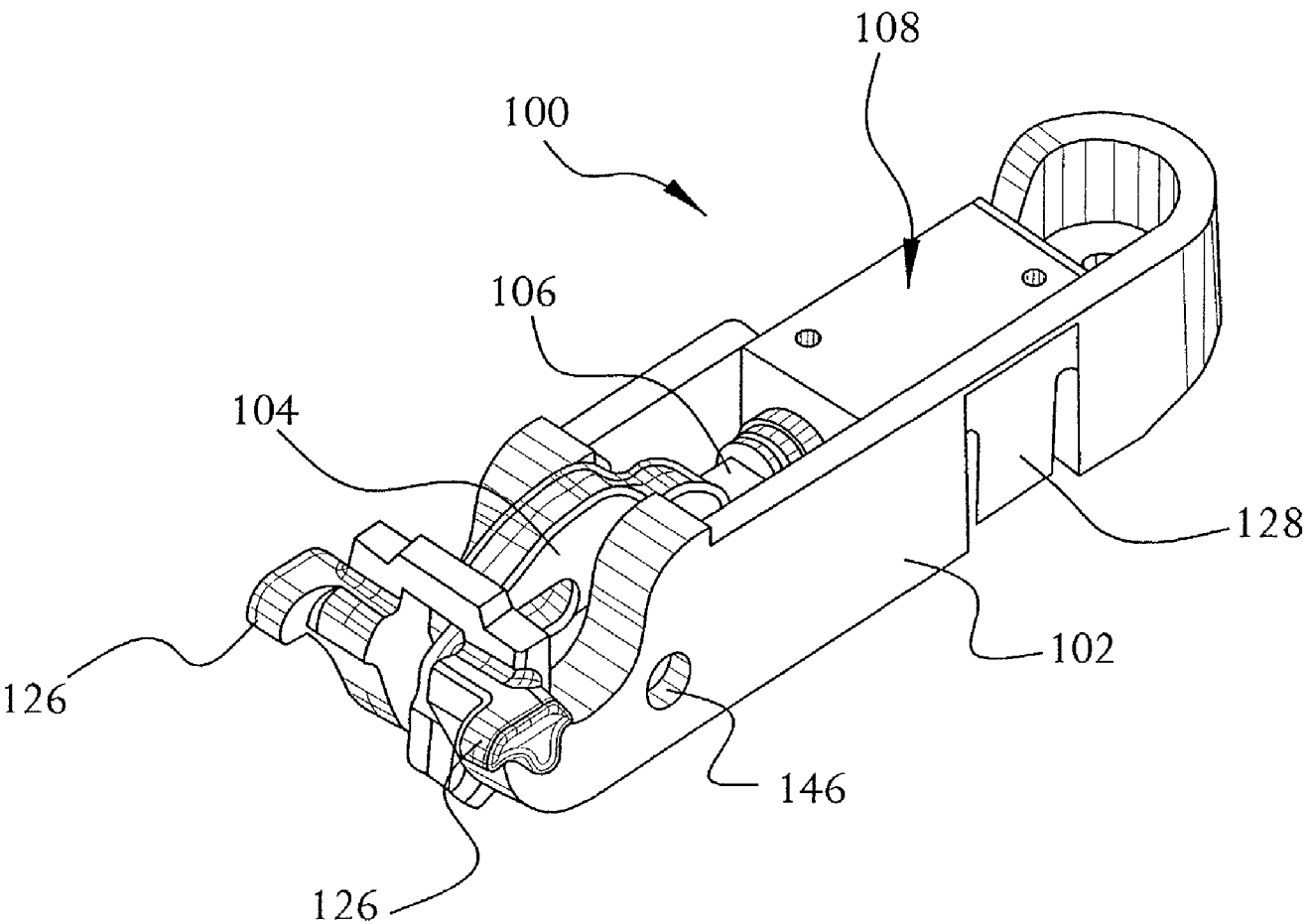
FIG. 23 is a left side perspective view of a latch assembly according to the present invention showing the latch pawl in the closed configuration.
Figure 26:
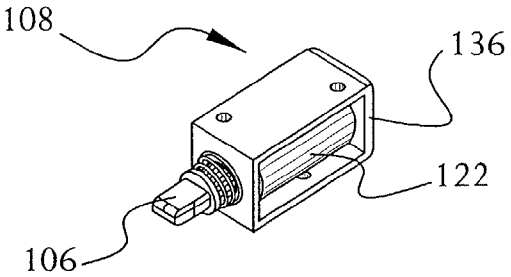
FIG. 26 is a perspective view of the solenoid assembly of the latch of the present invention.
Figure 27:
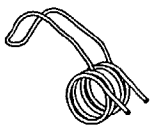
FIG. 27 is a perspective view of the torsion spring of the latch of the present invention.
Figure 24:
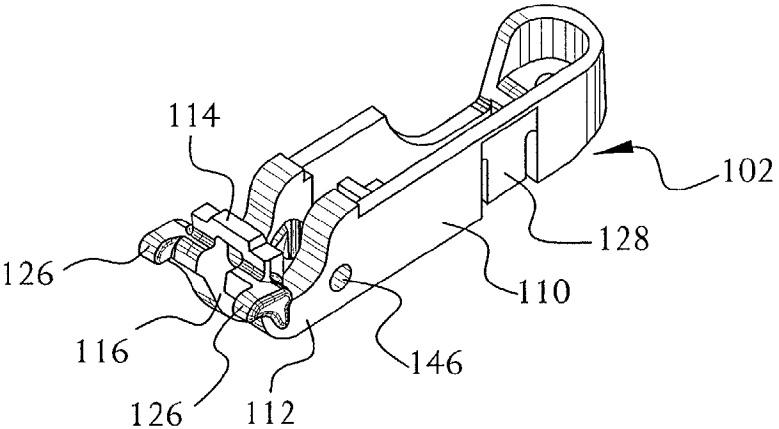
FIG. 24 is a perspective view of the housing of the latch of the present invention.
Figure 25:
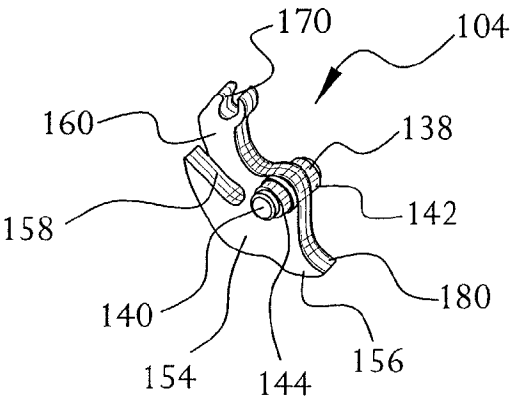
FIG. 25 is a perspective view of the pawl of the latch of the present invention.
Figure 28A:
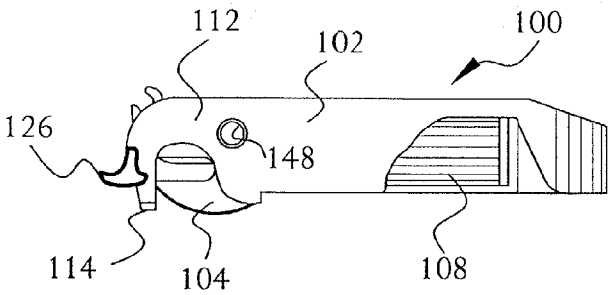
FIGS. 28A–28F are views of the latch assembly of the present invention shown with the latch pawl in the closed configuration.
Figure 28D:
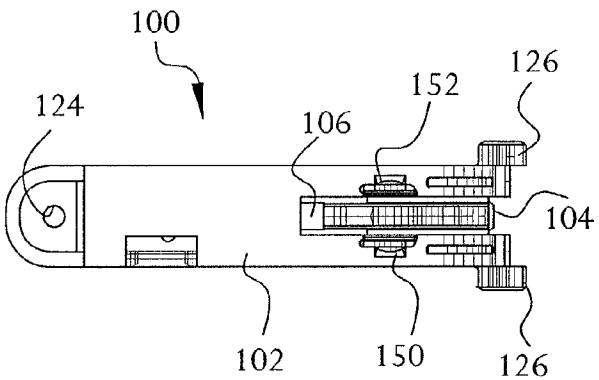
Figure 28F:
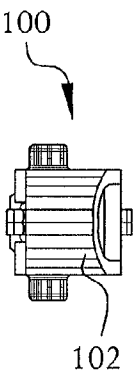
Figure 28C:
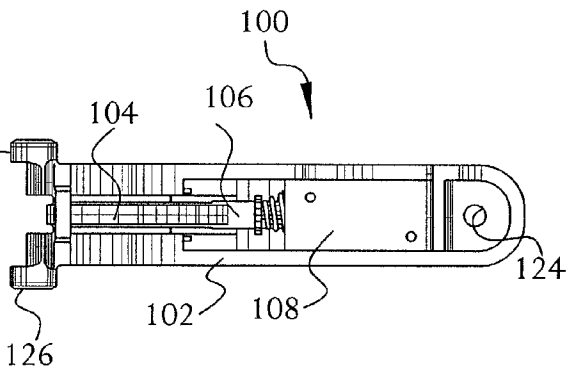
Figure 28E:
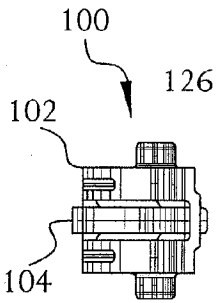
Figure 28B:
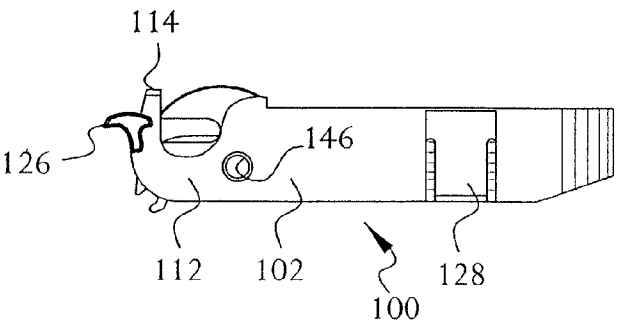
Figure 29A:
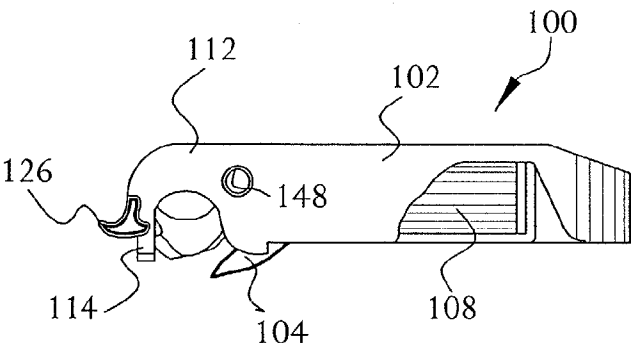
FIGS. 29A–29F are views of the latch assembly of the present invention shown with the latch pawl in the open configuration.
Figure 29D:
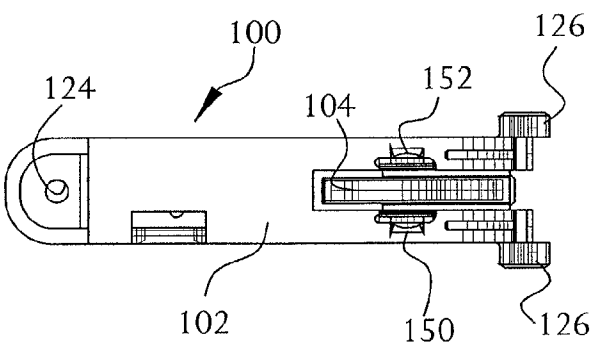
Figure 29F:
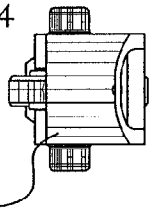
Figure 29C:
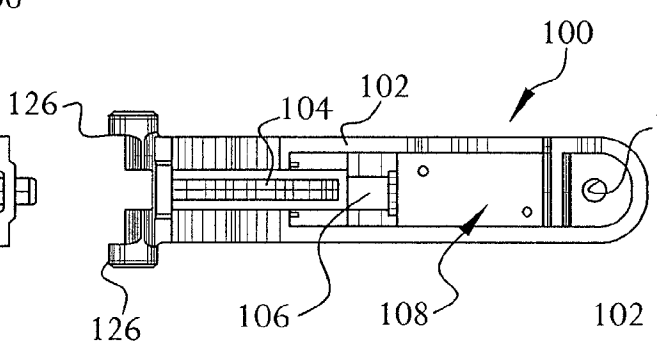
Figure 29E:
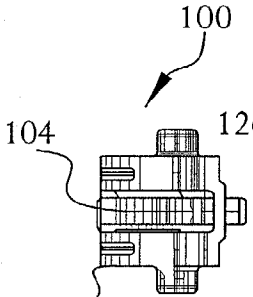
Figure 29B:
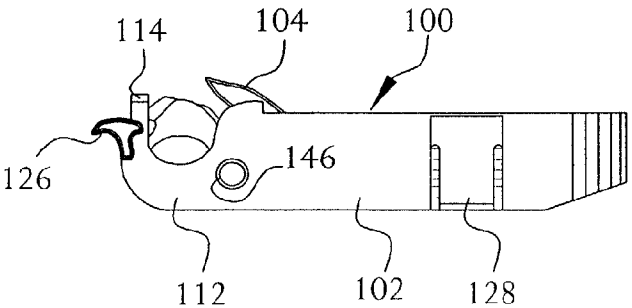
Figure 30:
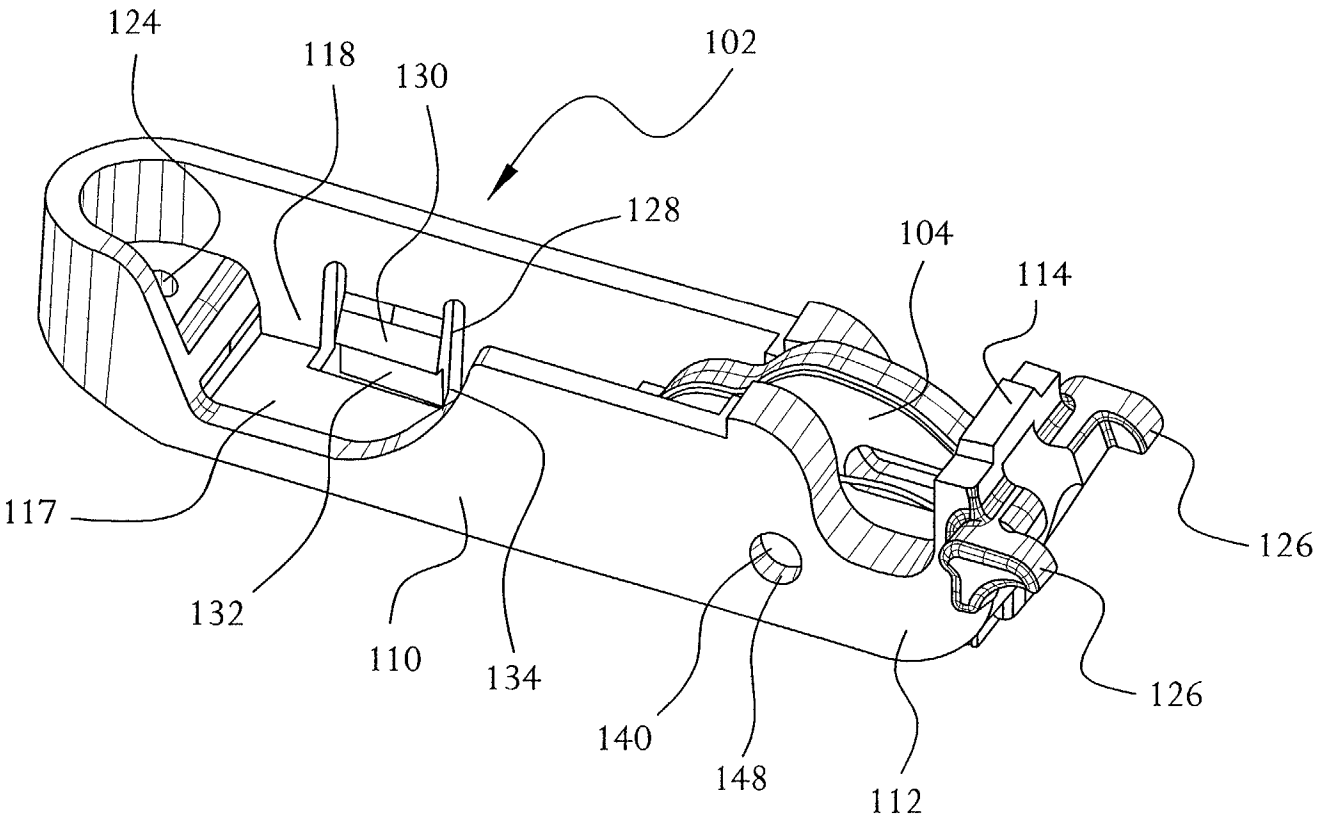
FIG. 30 is a perspective view of an assembly including the housing, pawl, and torsion spring of the latch of the present invention.
Figure 31:
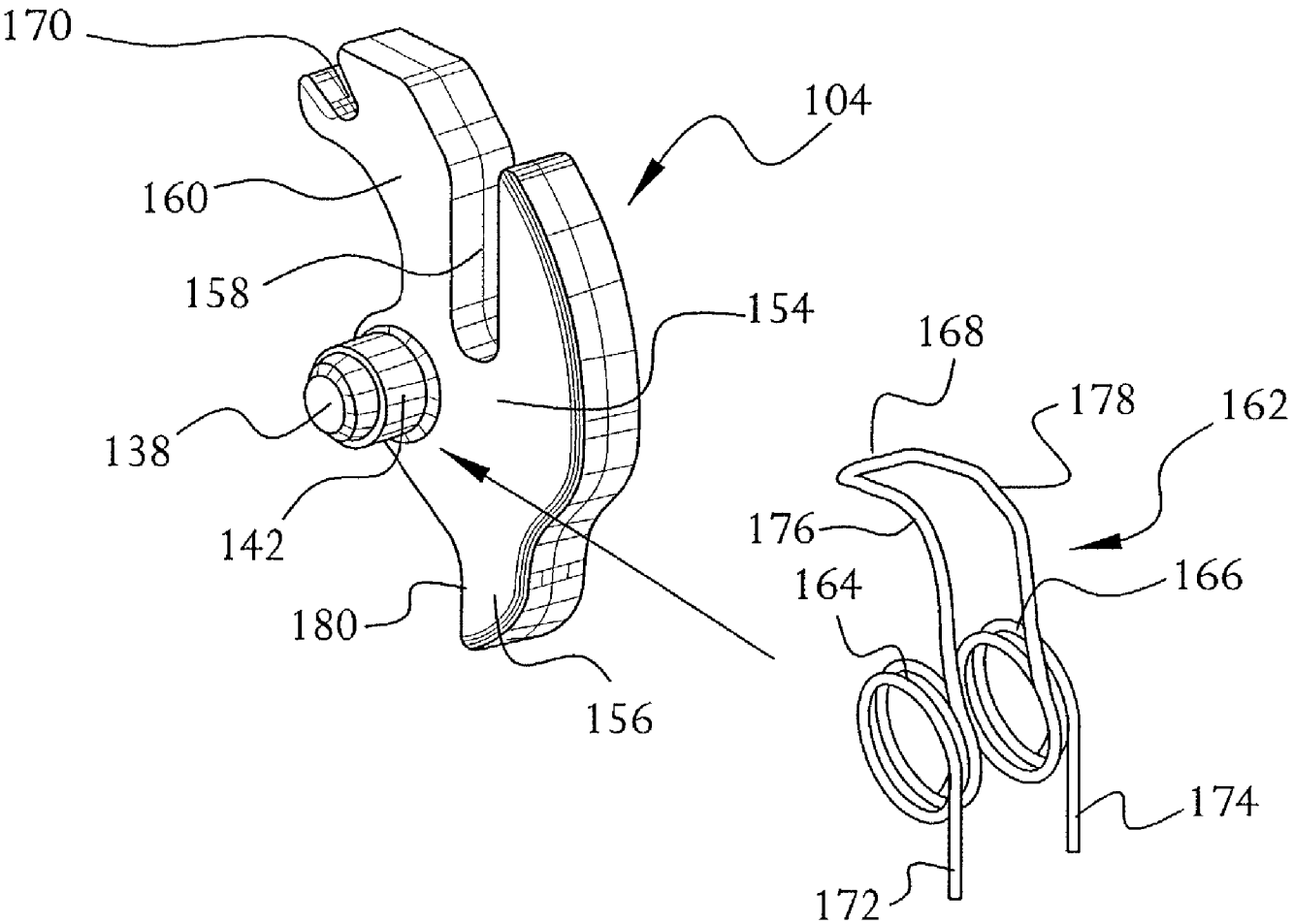
FIG. 31 is an exploded view of the latch pawl and torsion spring of the latch of the present invention.
Figure 32:
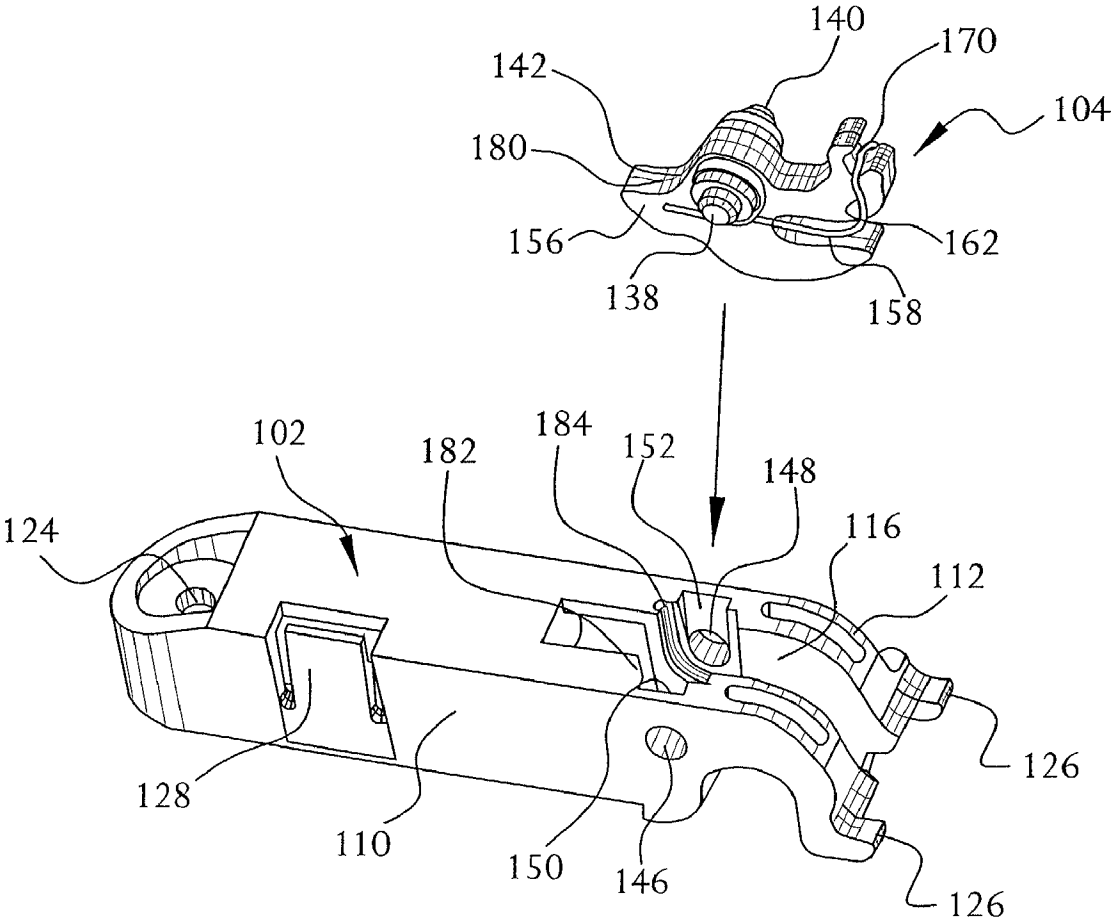
FIG. 32 is an exploded view illustrating the process of assembling together the latch pawl, the torsion spring and the latch housing of the latch of the present invention.
Figure 33:
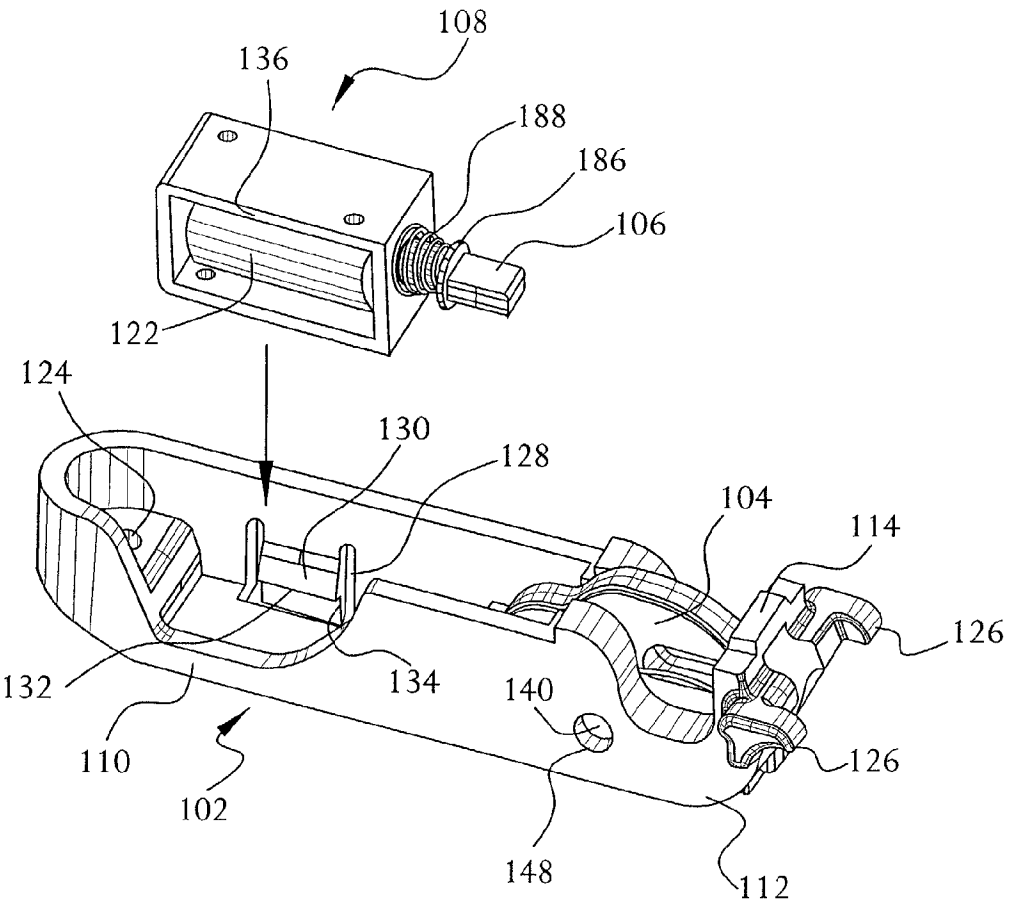
FIG. 33 is an exploded view illustrating the process of assembling together the solenoid assembly and a subassembly composed of the latch pawl, the torsion spring and the latch housing of the latch of the present invention.
Figure 34:
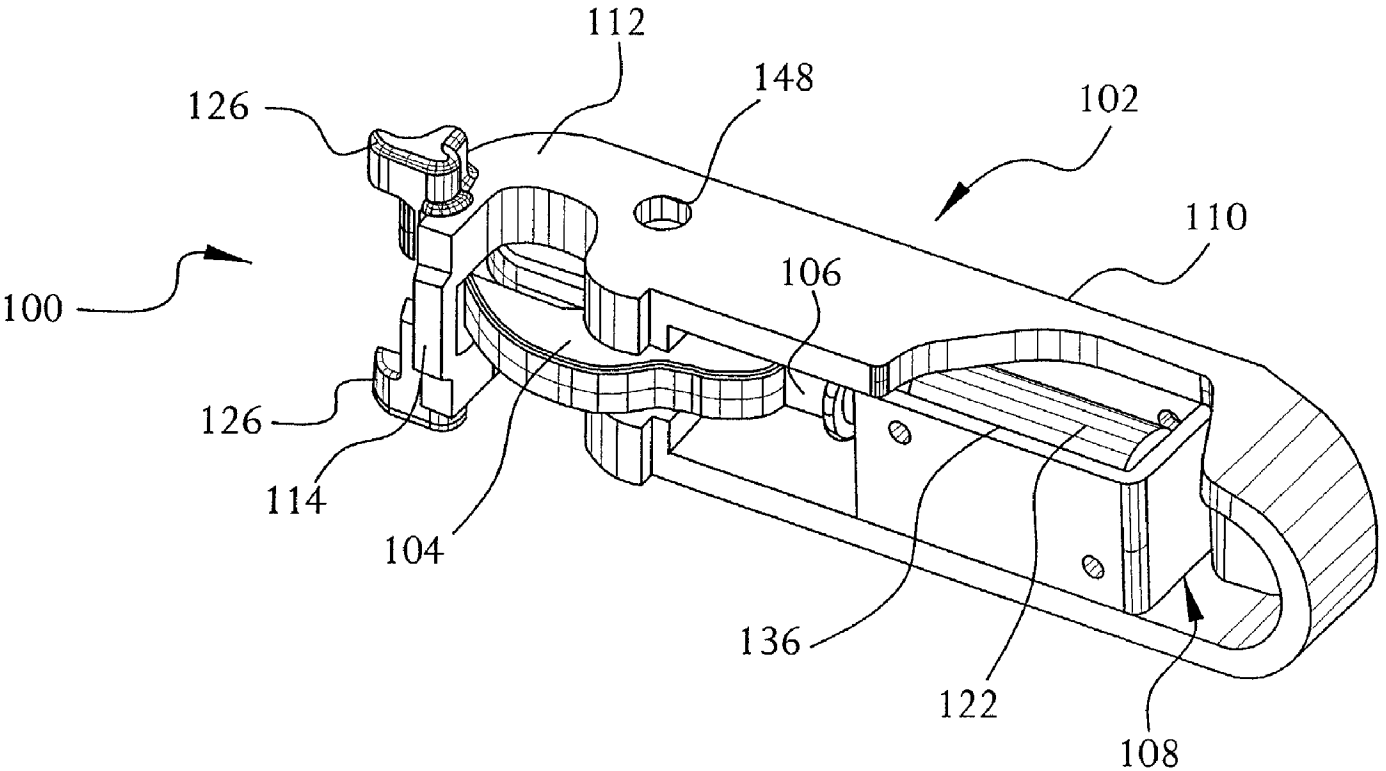
FIG. 34 is a right side perspective view of a latch assembly according to the present invention showing the latch pawl in the closed configuration.
Figure 35:
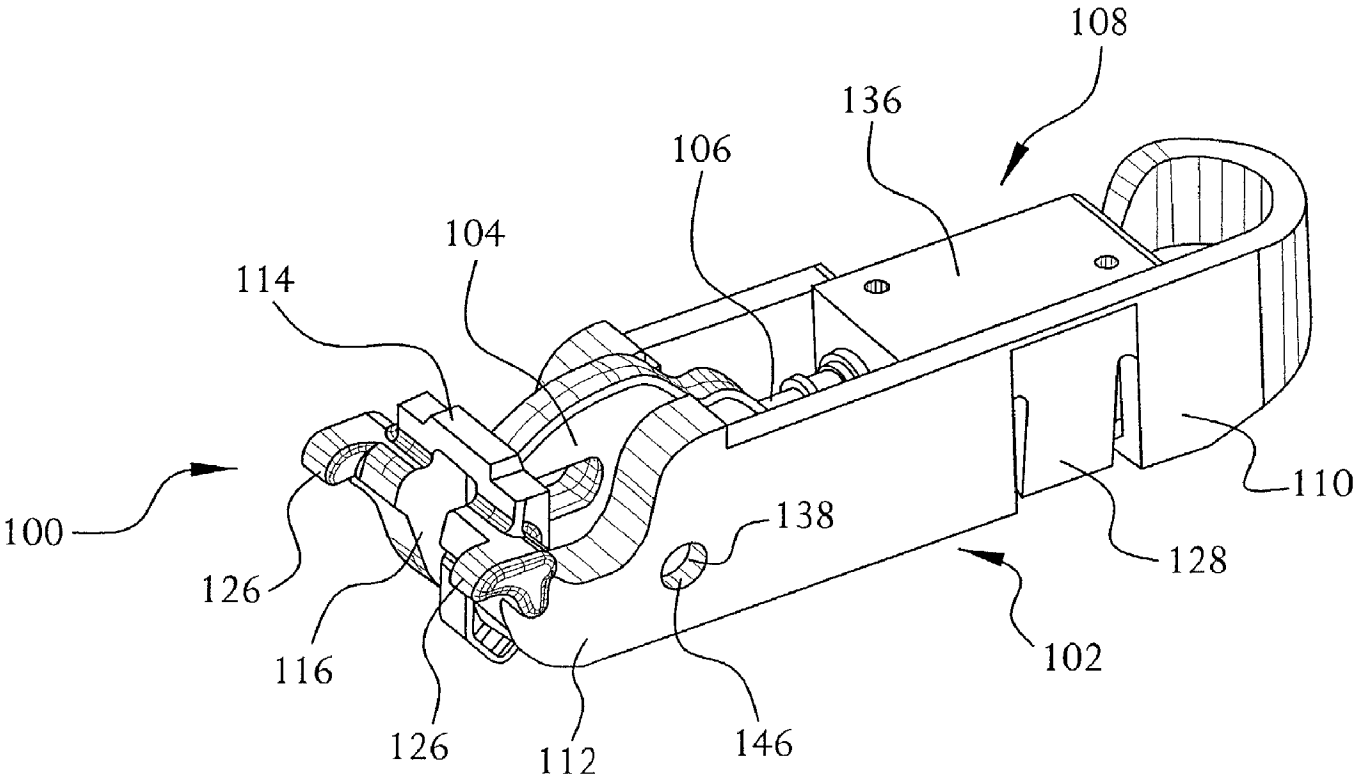
FIG. 35 is a left side perspective view of a latch assembly according to the present invention showing the latch pawl in the closed configuration.
Figure 36:
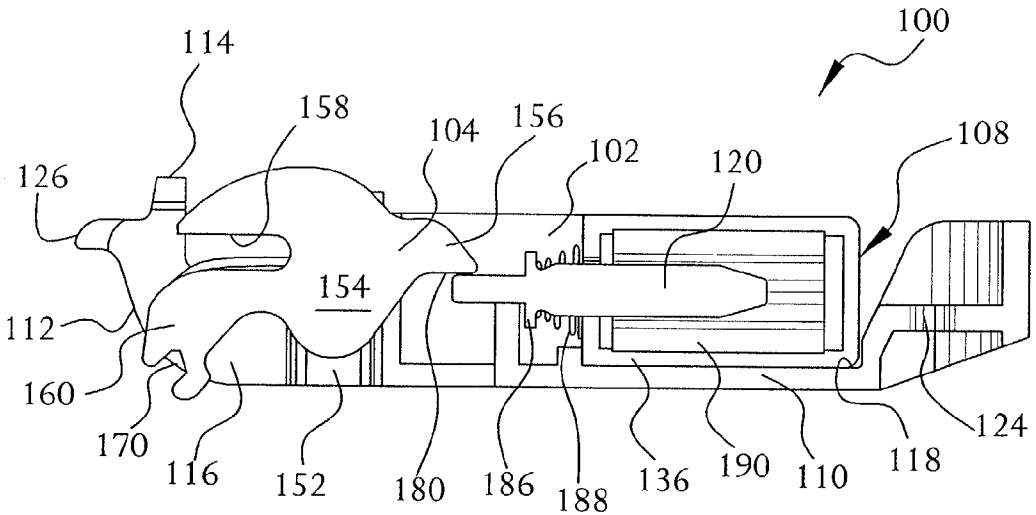
FIG. 36 is a cross sectional view of the latch of the present invention with the pawl of the latch in the closed or latched configuration.
Figure 37:
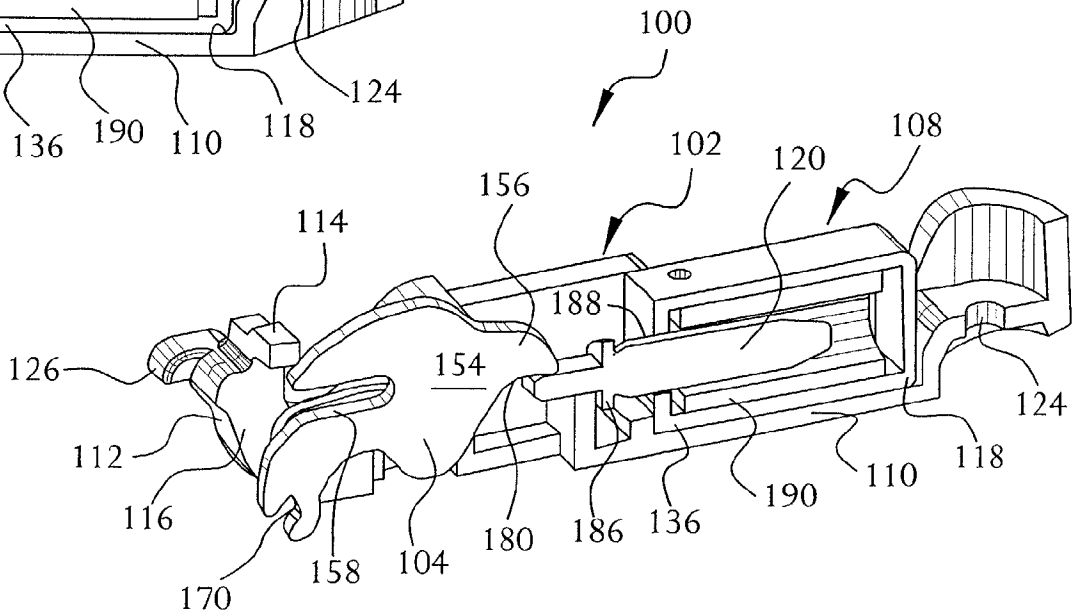
FIG. 37 is a perspective view of the cross section shown in FIG. 36.
Figure 38:
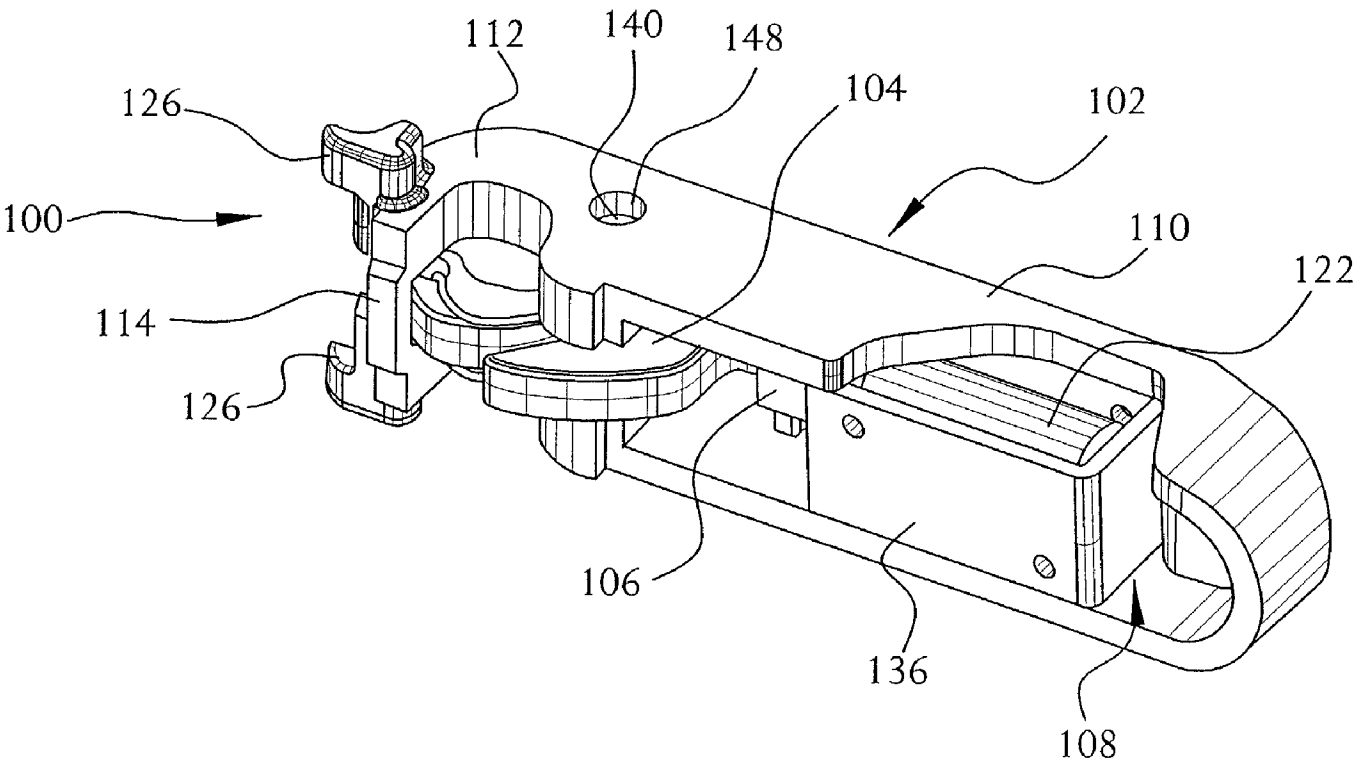
FIG. 38 is a right side perspective view of a latch assembly according to the present invention showing the latch pawl in the open configuration.
Figure 39:
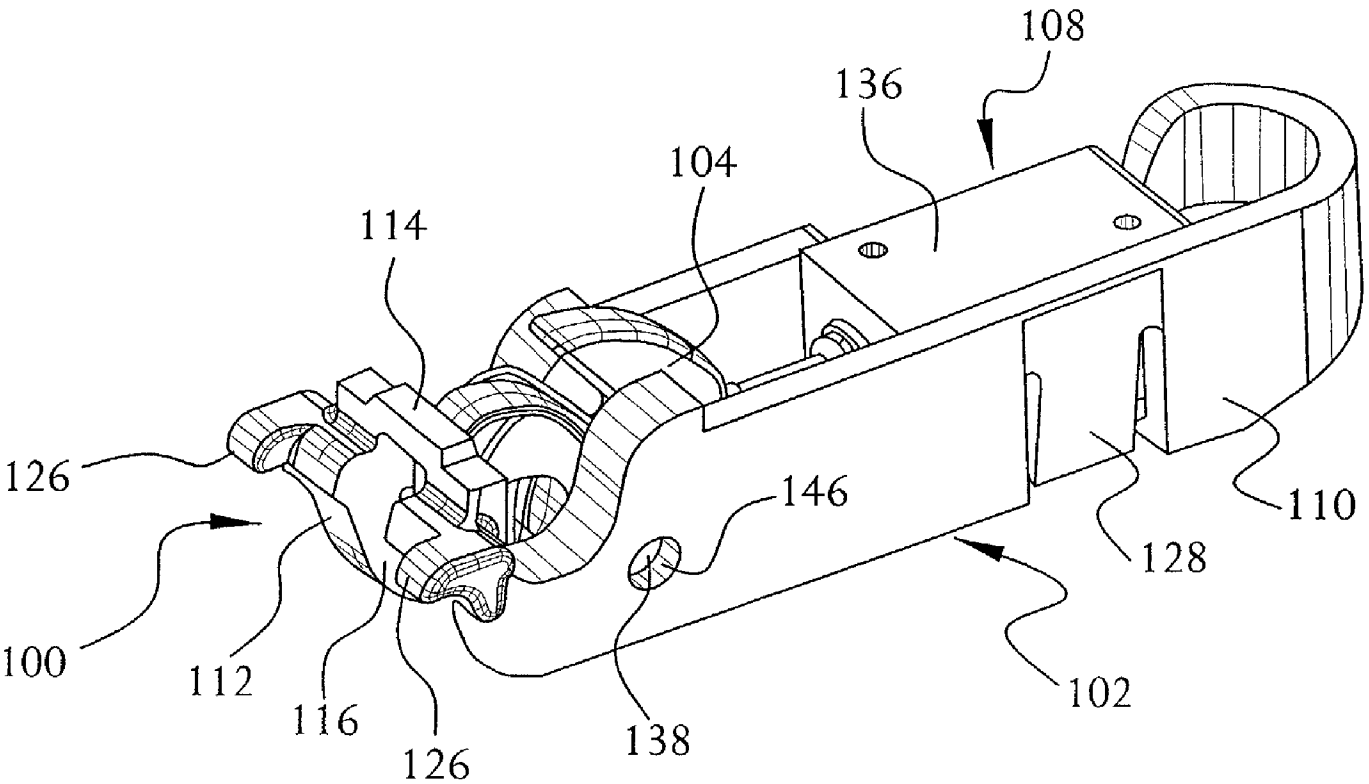
FIG. 39 is a left side perspective view of a latch assembly according to the present invention showing the latch pawl in the open configuration.
Figure 40:
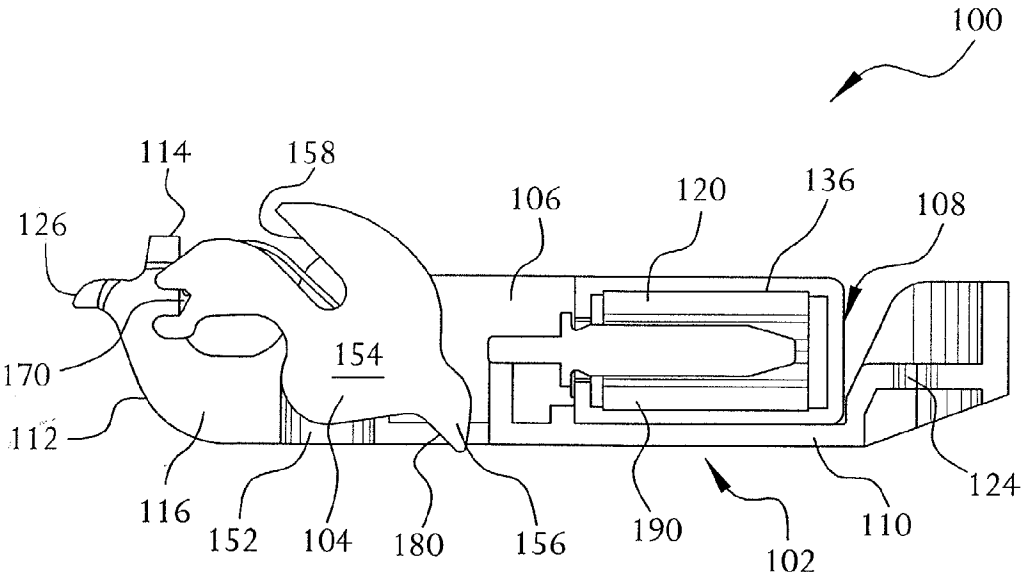
FIG. 40 is a cross sectional view of the latch of the present invention with the pawl of the latch in the open or unlatched configuration.
Figure 41:
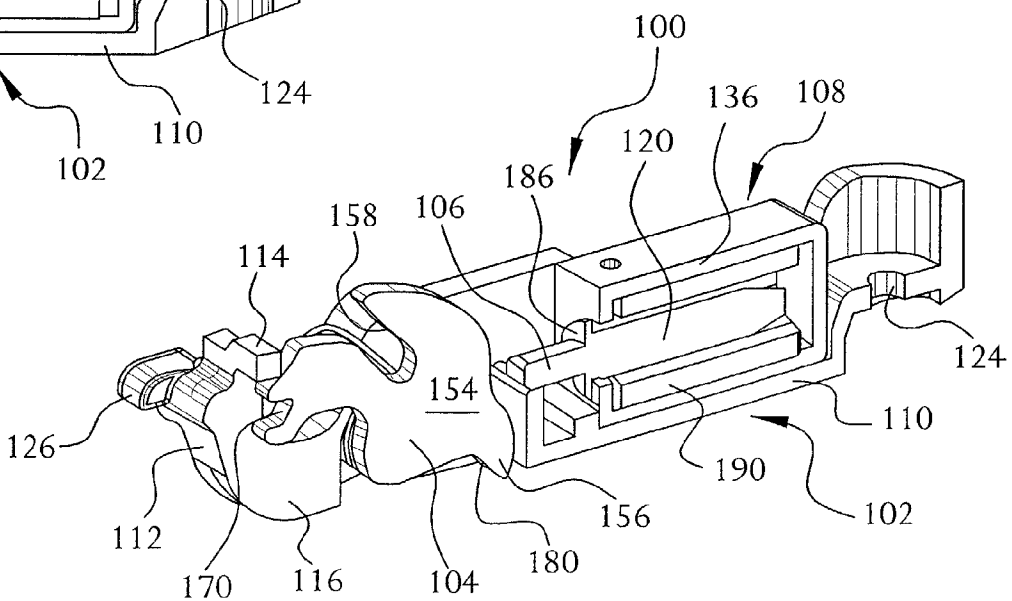
FIG. 41 is a perspective view of the cross section shown in FIG. 40.
Figure 42:
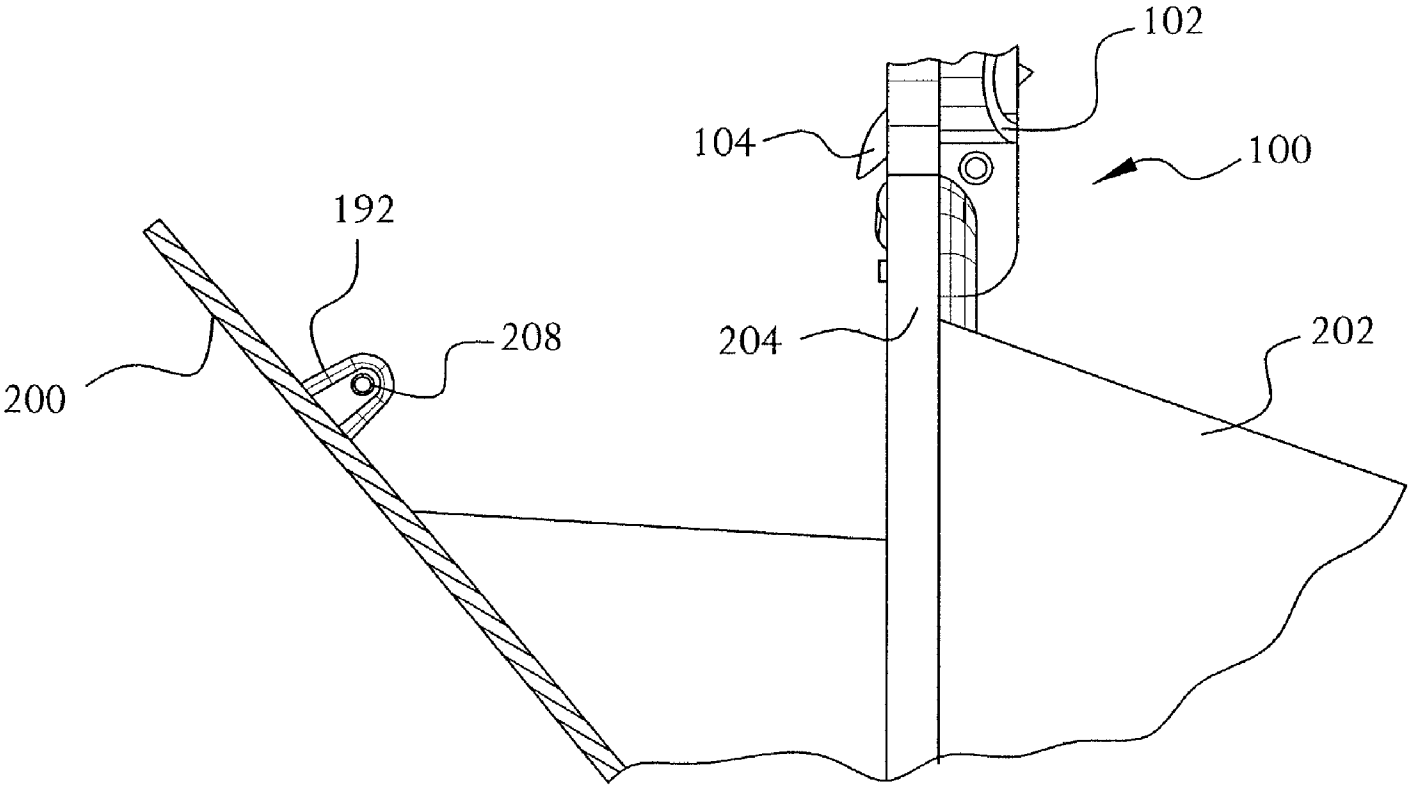
FIG. 42 is an environmental view showing the latch of the present invention installed to an automotive glove box with the lid of the glove box in the open position.
Figure 43:
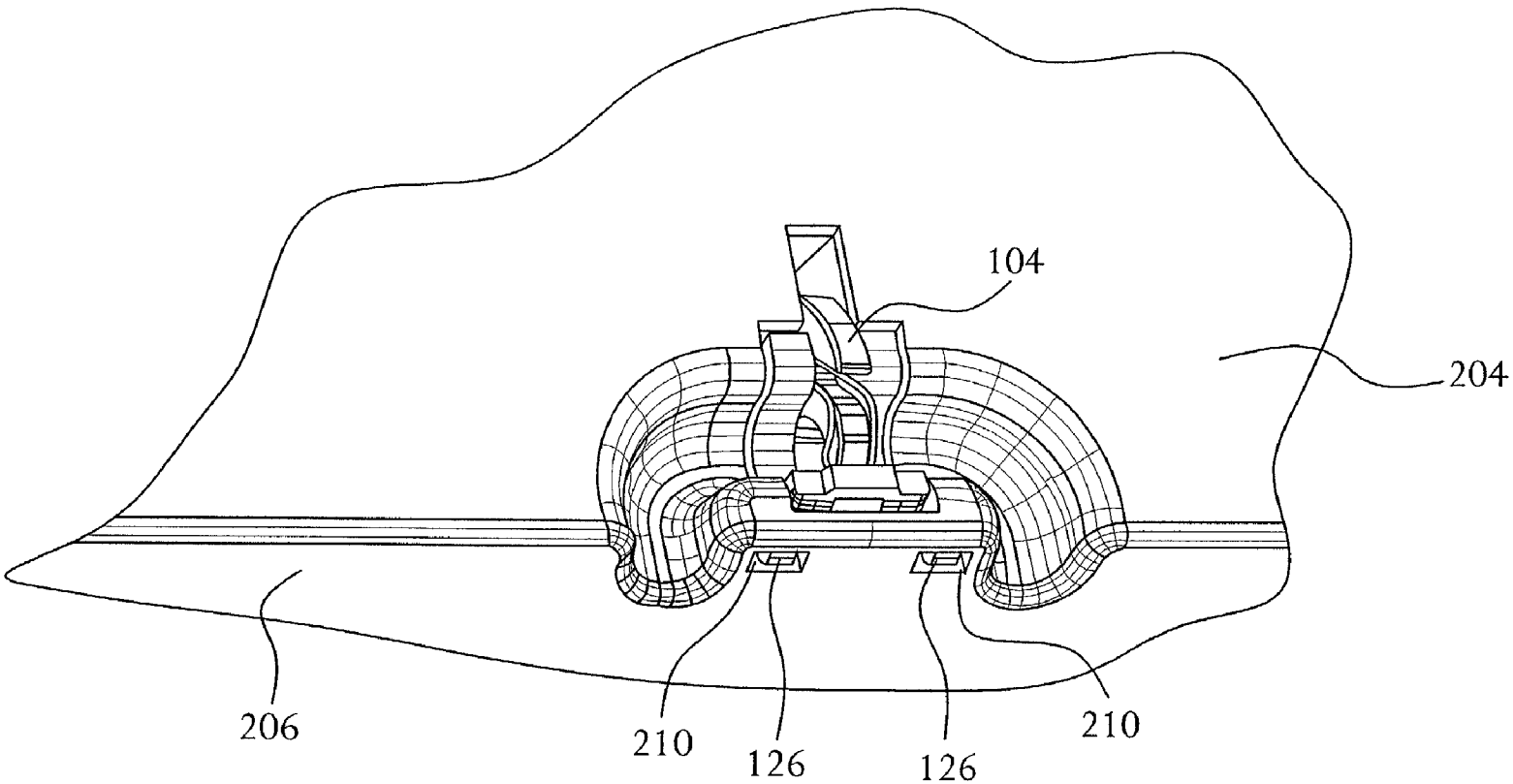
FIG. 43 is an environmental front view showing the latch of the present invention installed on the frame surrounding the opening of an automotive glove box.
Figure 44:
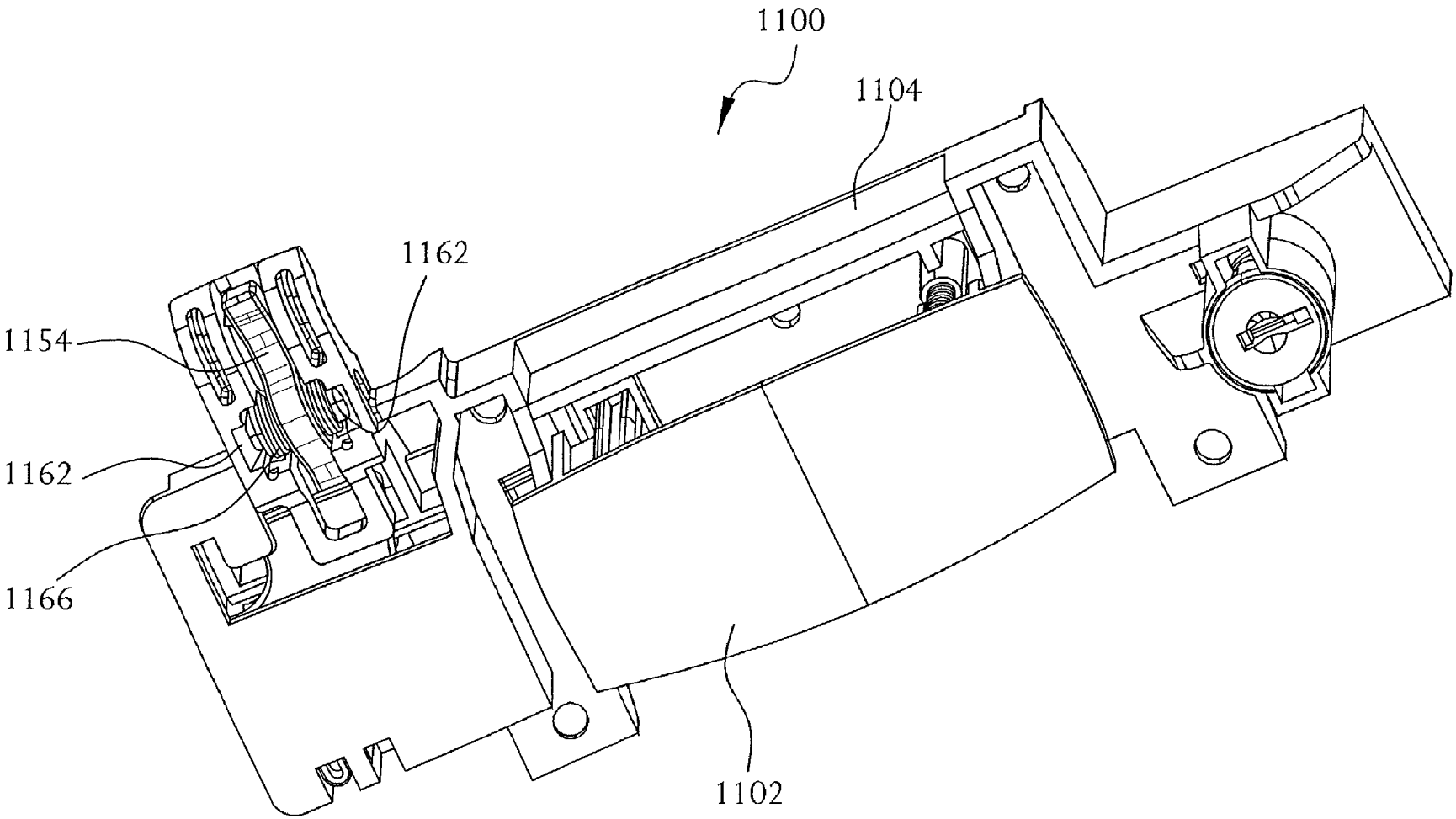
FIG. 44 is a rear perspective view of the latch assembly according to the present invention.
Figure 45:
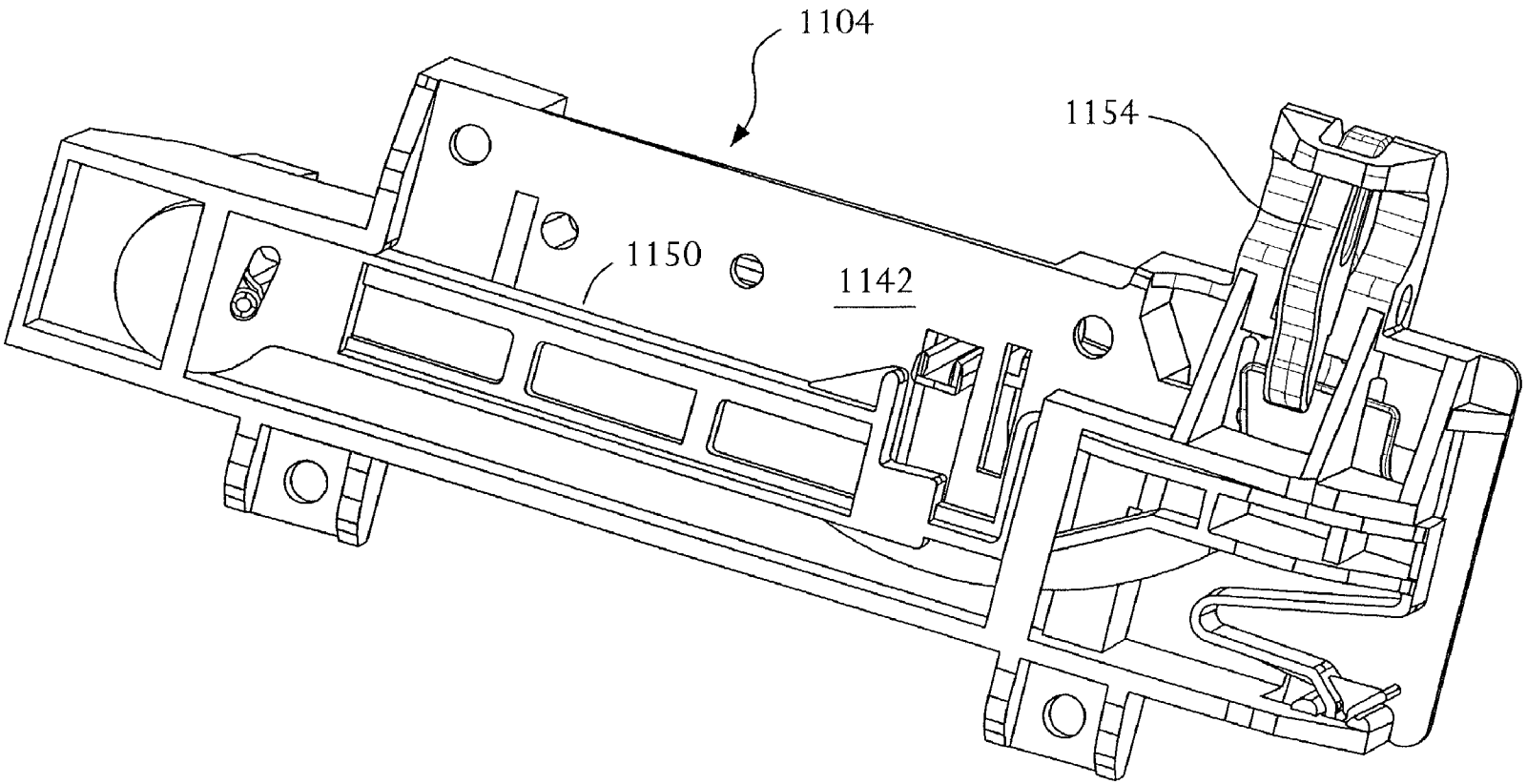
FIG. 45 is a front perspective view of the latch assembly according to the present invention.
Figure 46:
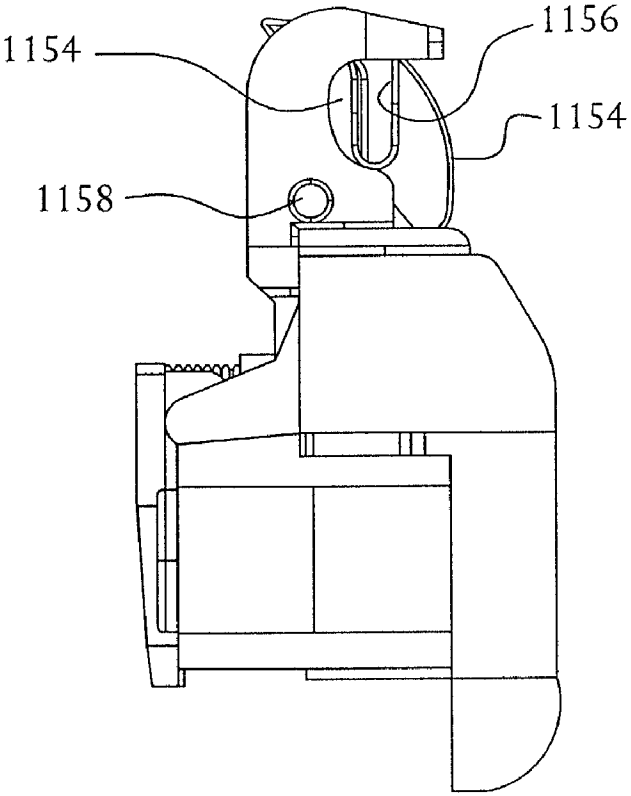
FIG. 46 is an elevational view of the right side of the latch assembly of the present invention, showing the pawl in the closed configuration.
Figure 47:
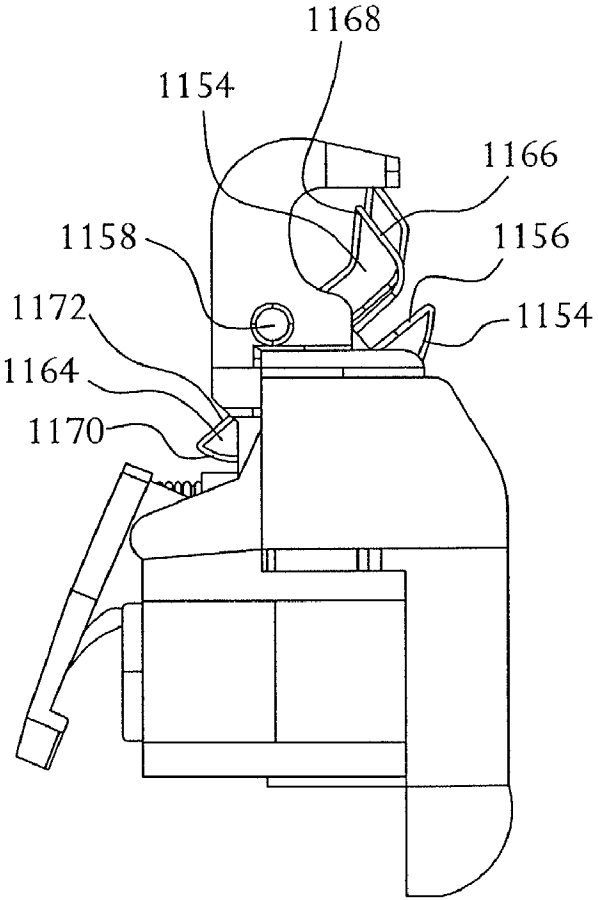
FIG. 47 is an elevational view of the right side of the latch assembly of the present invention, showing the pawl in the open configuration.
Figure 48:
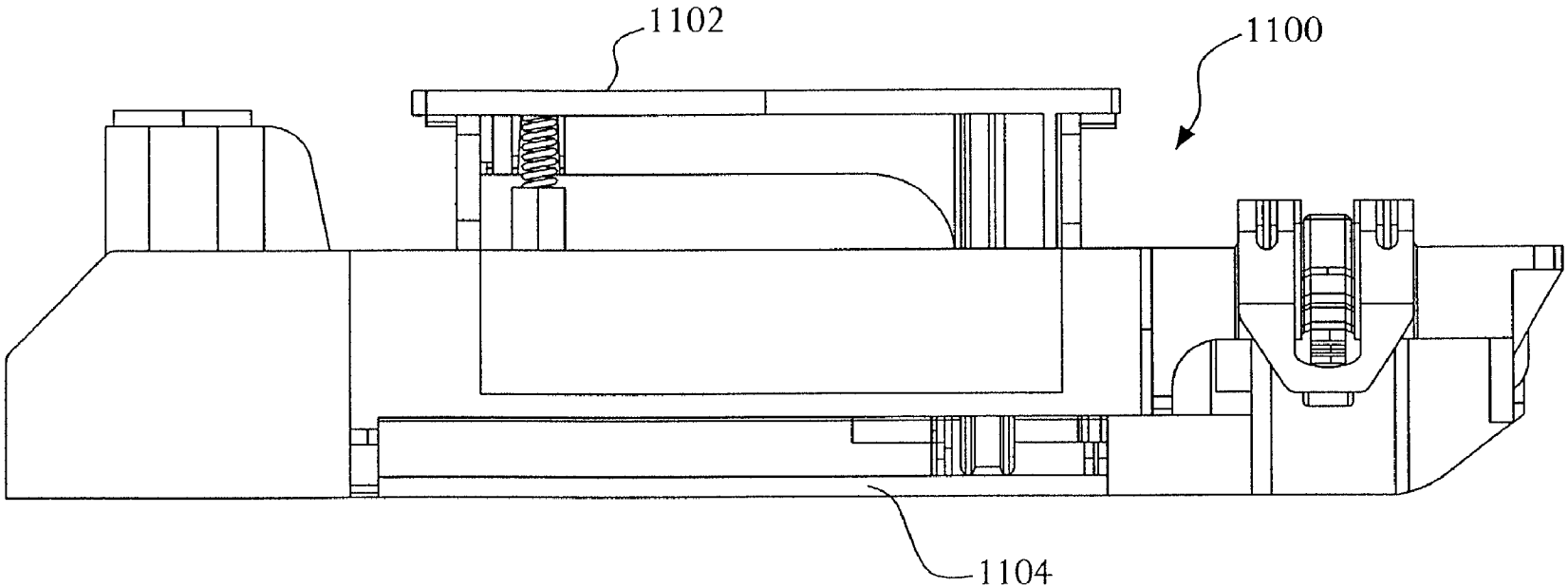
FIGS. 48 is a top view of the latch assembly according to the present invention, showing the pawl in the closed configuration.
Figure 49:
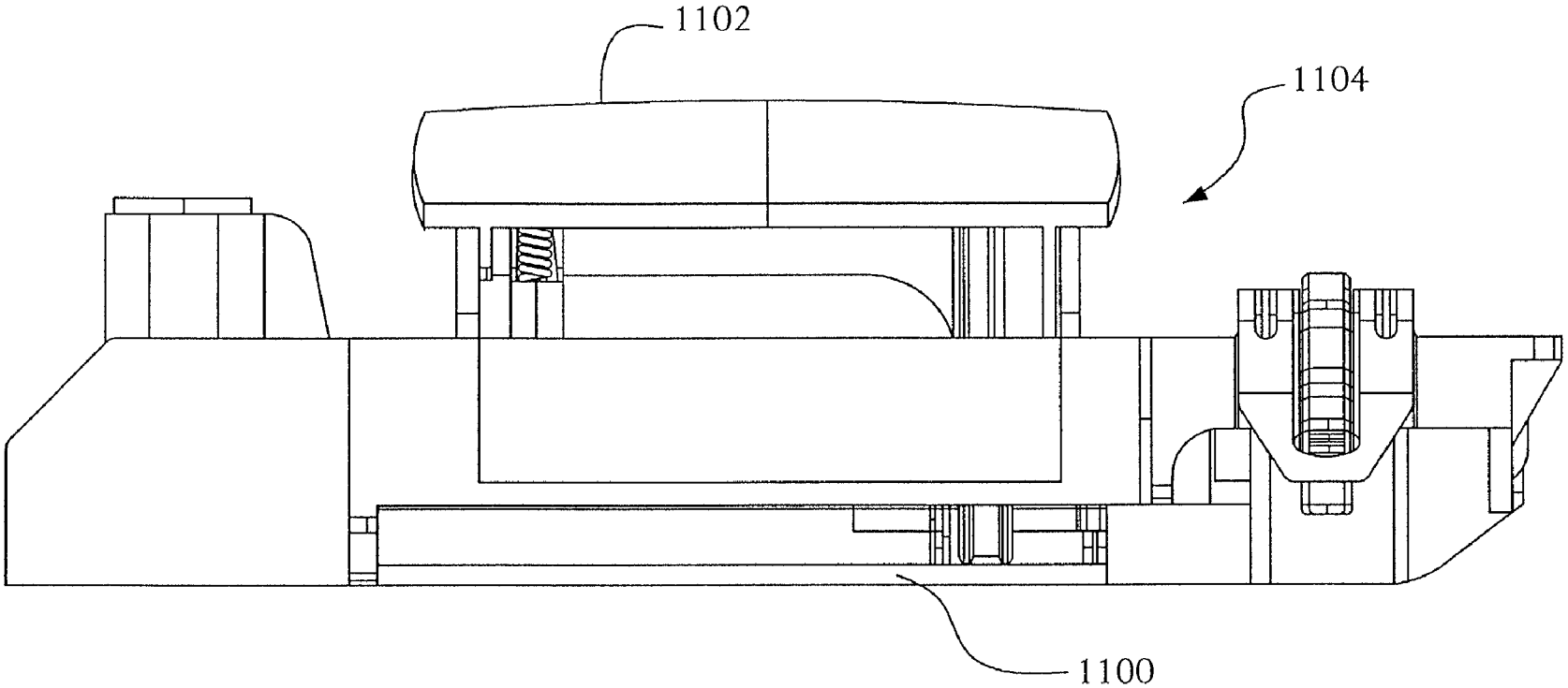
FIGS. 49 is a top view of the latch assembly according to the present invention, showing the pawl in the open configuration.
Figure 50:
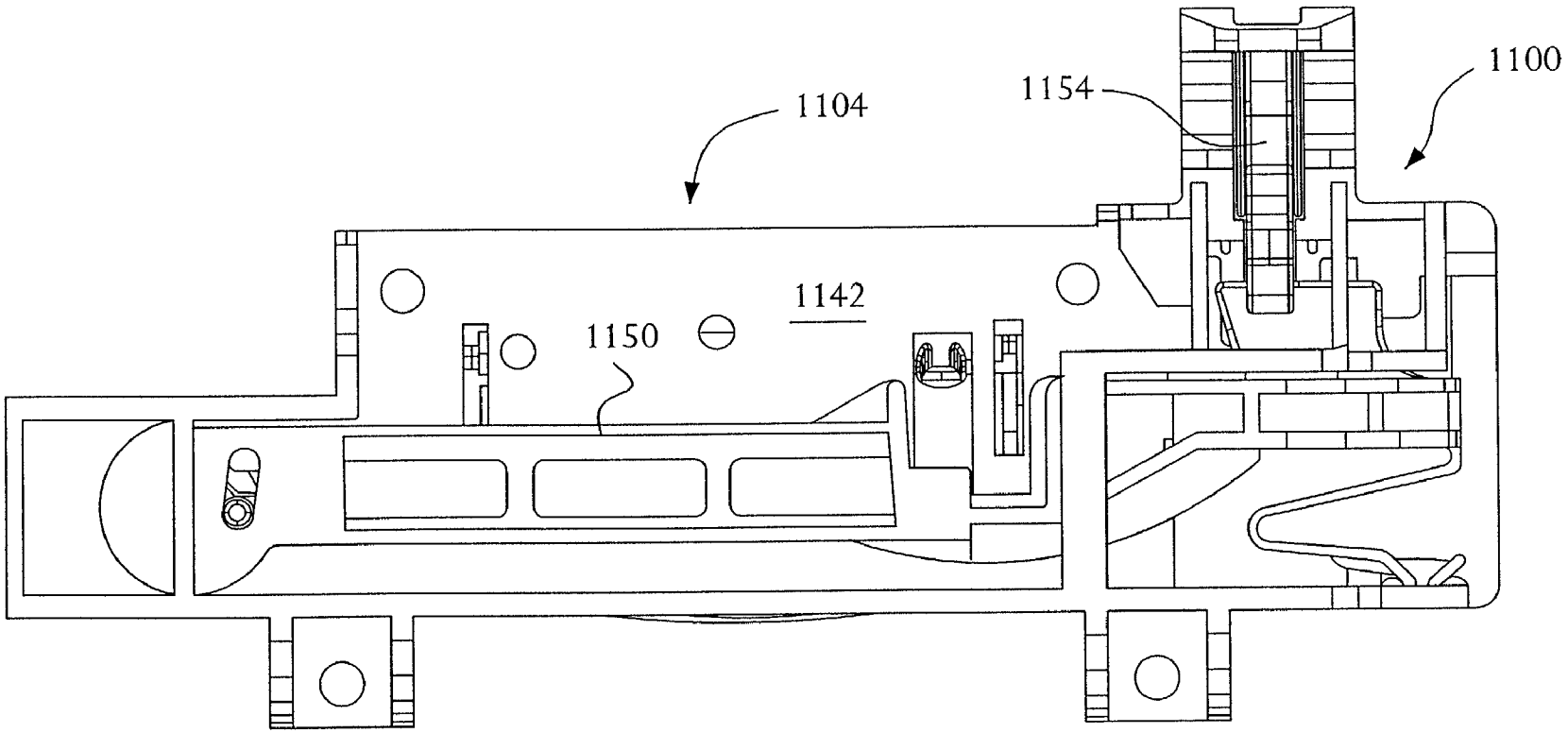
FIGS. 50 is a front view of the latch assembly according to the present invention, showing the pawl in the closed configuration.
Figure 51:
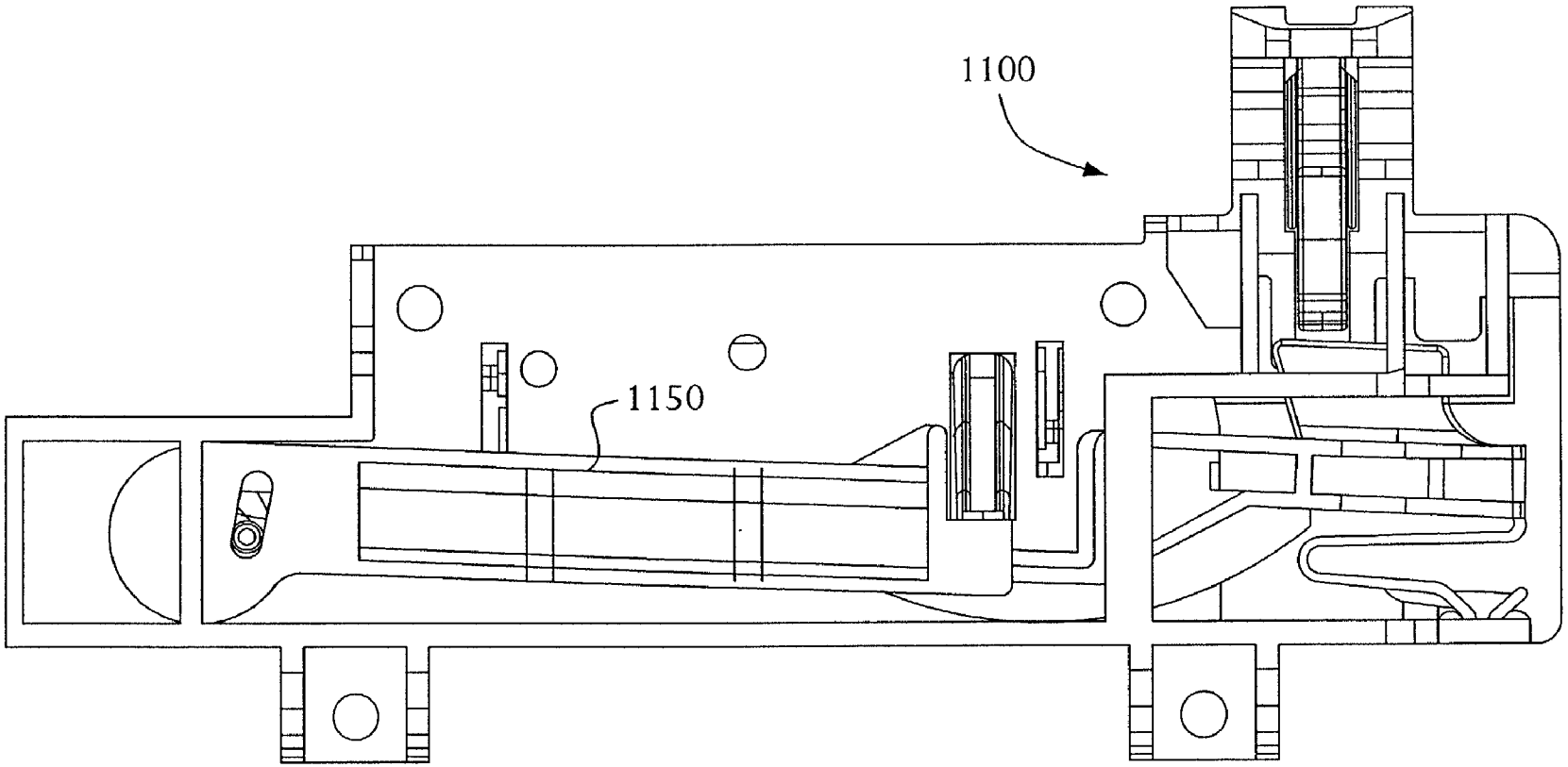
FIGS. 51 is a front view of the latch assembly according to the present invention, showing the pawl in the open configuration.
Figure 52:
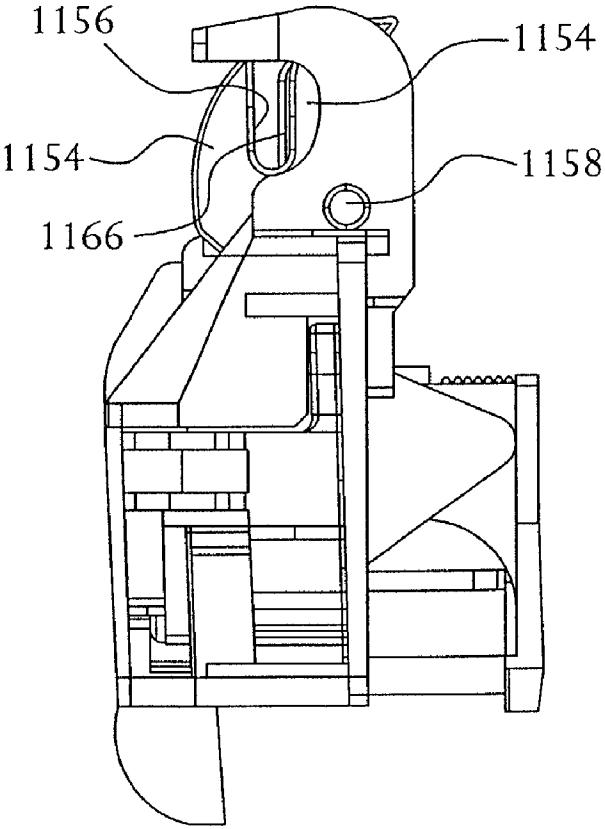
FIG. 52 is an elevational view of the left side of the latch assembly of the present invention, showing the pawl in the closed configuration.
Figure 53:
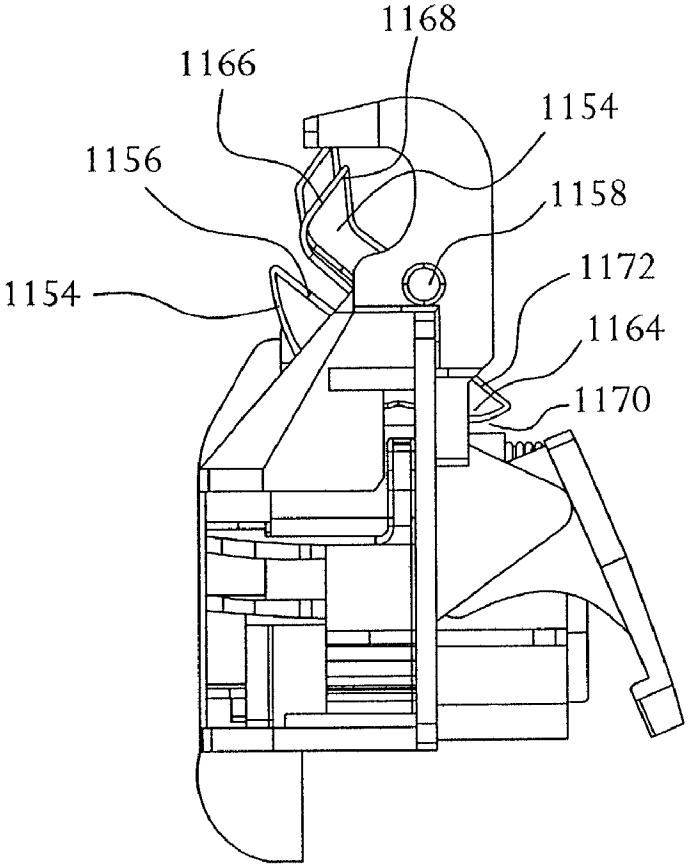
FIG. 53 is an elevational view of the left side of the latch assembly of the present invention, showing the pawl in the open configuration.
Figure 54:
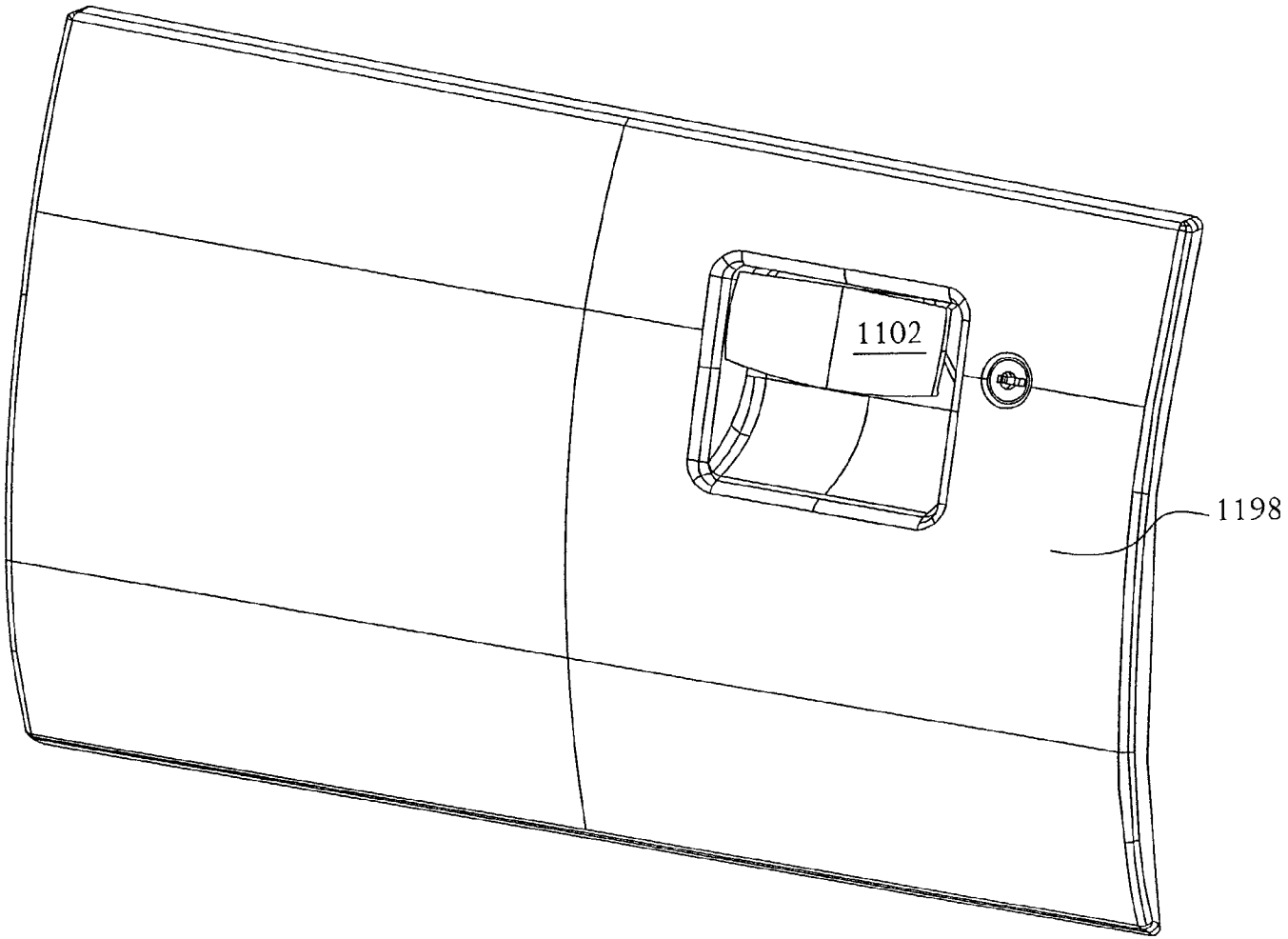
FIG. 54 is a perspective view of a glove compartment door having the latch assembly according to the present invention installed therein.
Figure 55:
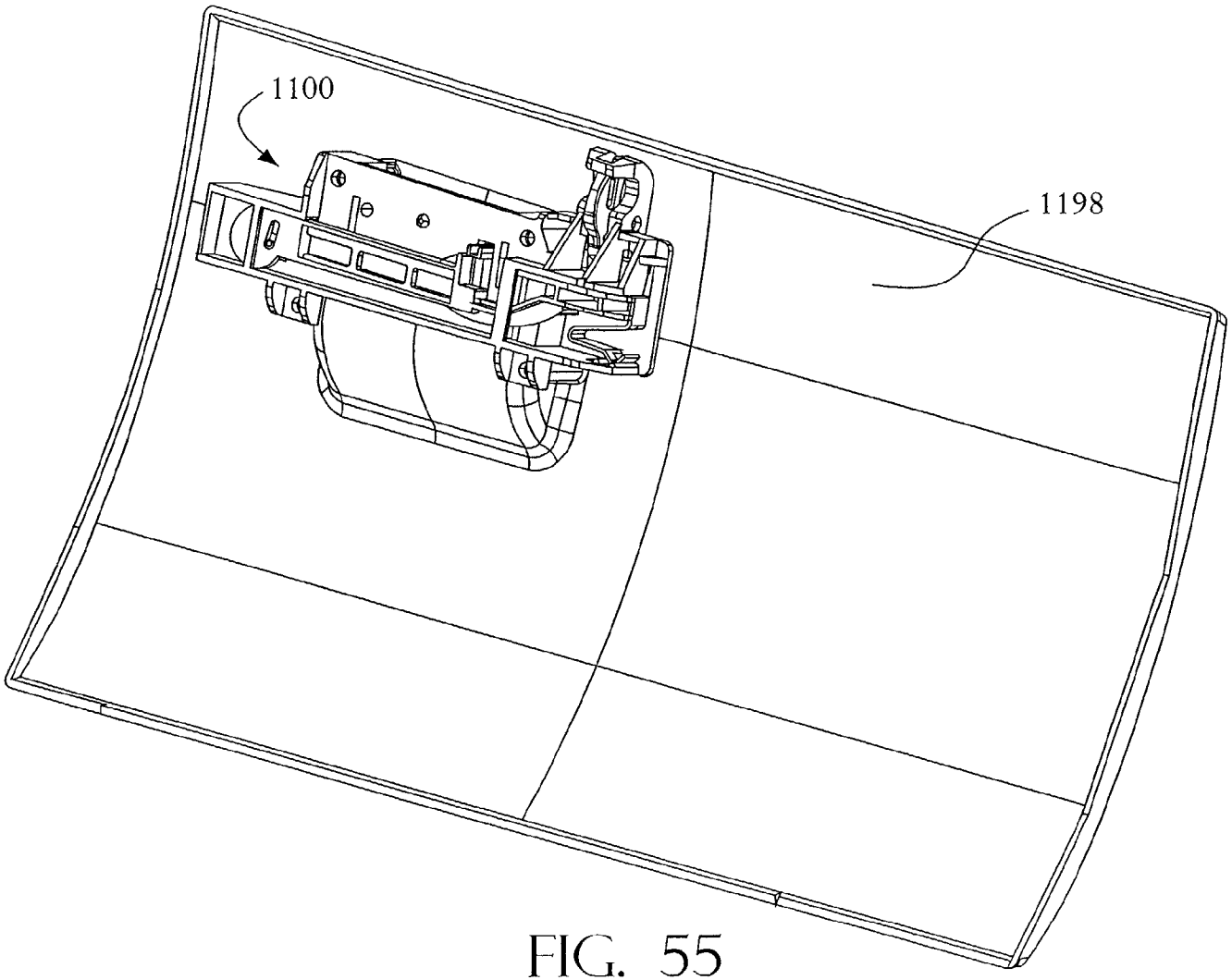
FIG. 55 is a perspective view of the back side of the outer shell of the glove compartment door shown with the latch assembly of the present invention installed thereto.
Figure 56:
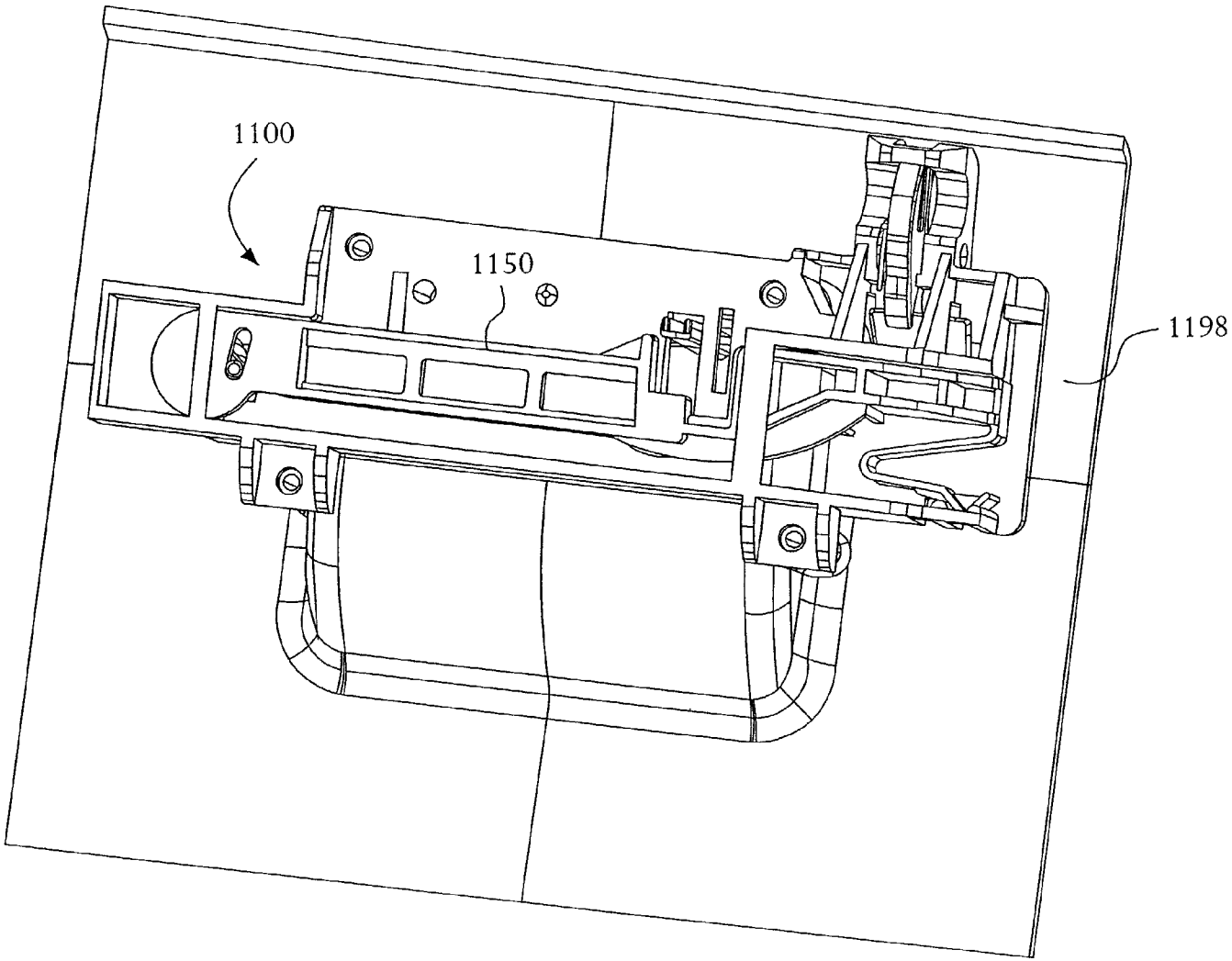
FIG. 56 is a close-up view of the back side of a portion of the outer shell of the glove compartment door shown with the latch assembly of the present invention installed thereto.
Figure 57:
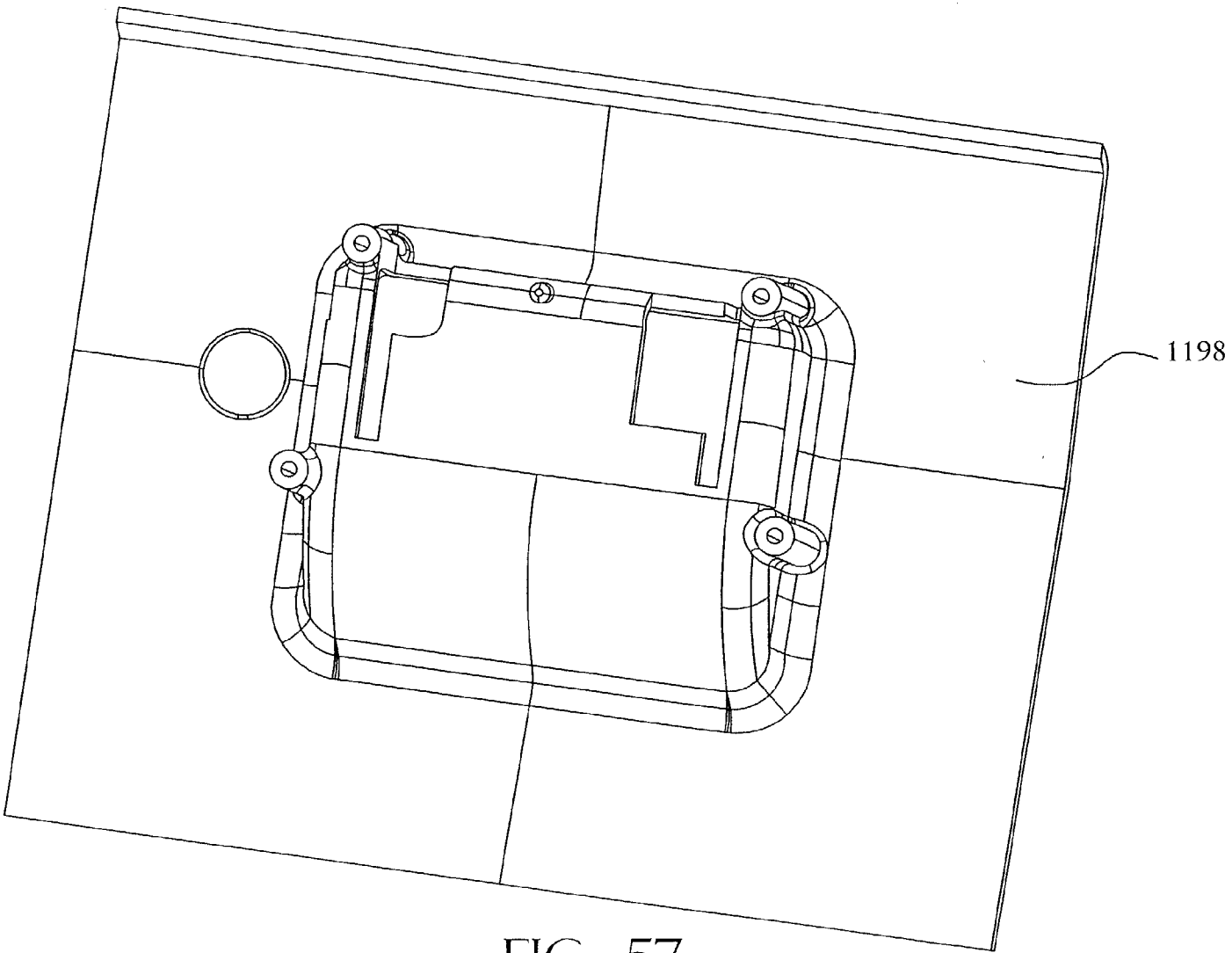
FIG. 57 is a close-up view showing the back side of the portion of the outer shell of the glove compartment door adapted for the installation of a latch assembly according to the present invention.
Figure 58:
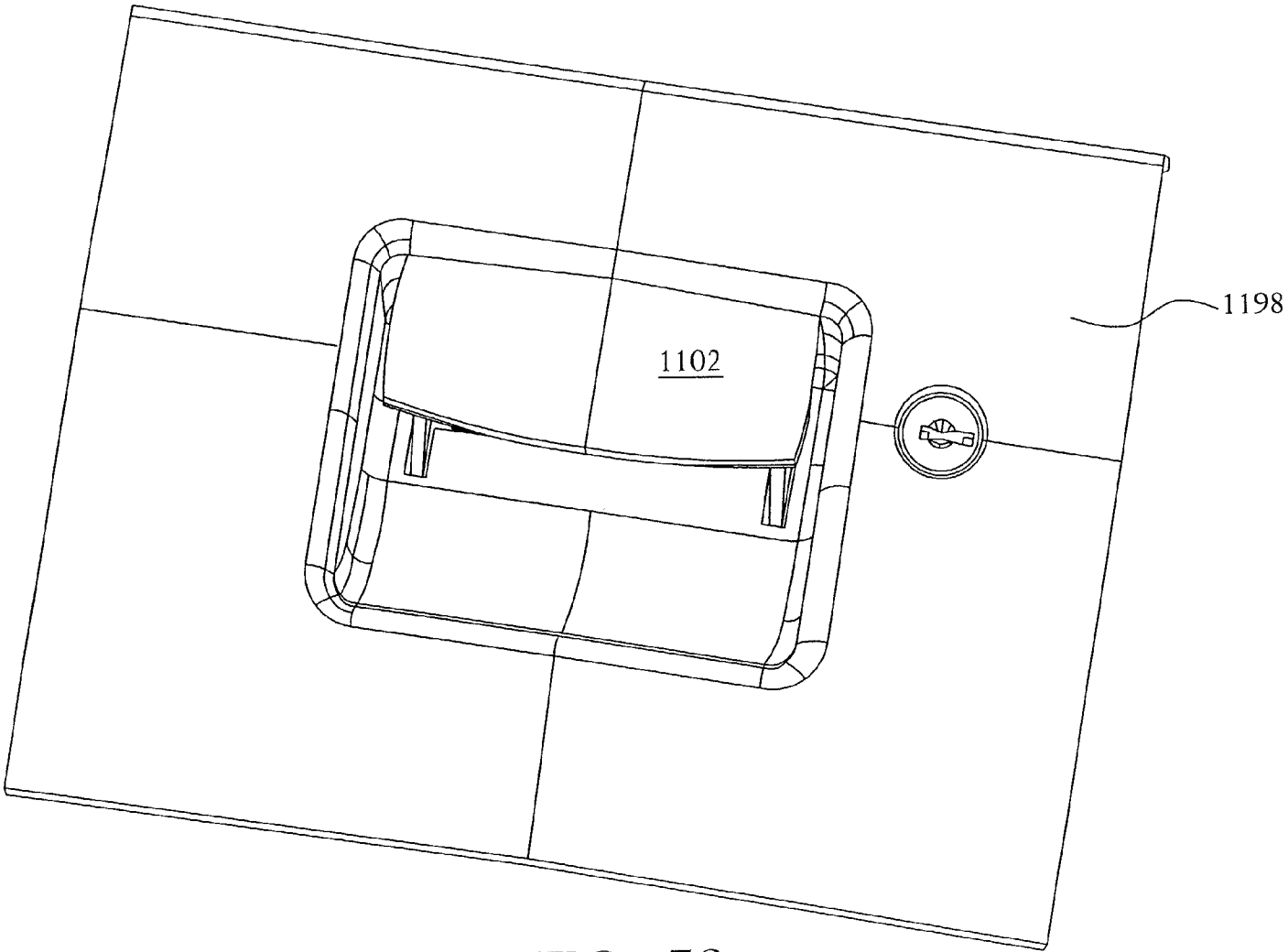
FIG. 58 is a close-up view of the exterior side of a portion of the outer shell of the glove compartment door shown with a latch assembly according to the present invention installed thereto.
Figure 59:
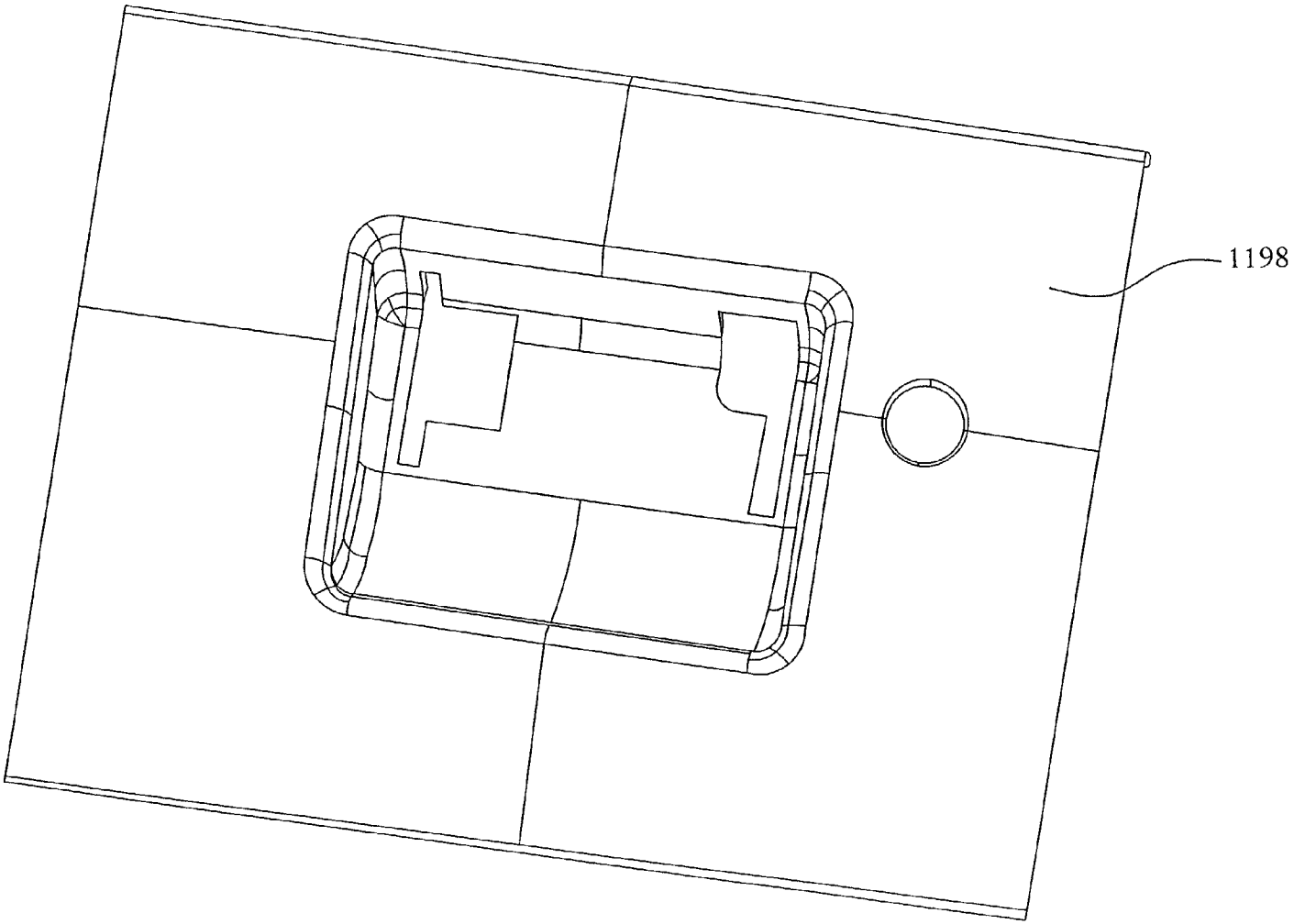
FIG. 59 is a close-up view showing the exterior side of the portion of the outer shell of the glove compartment door adapted for the installation of a latch assembly according to the present invention.
Figure 60:
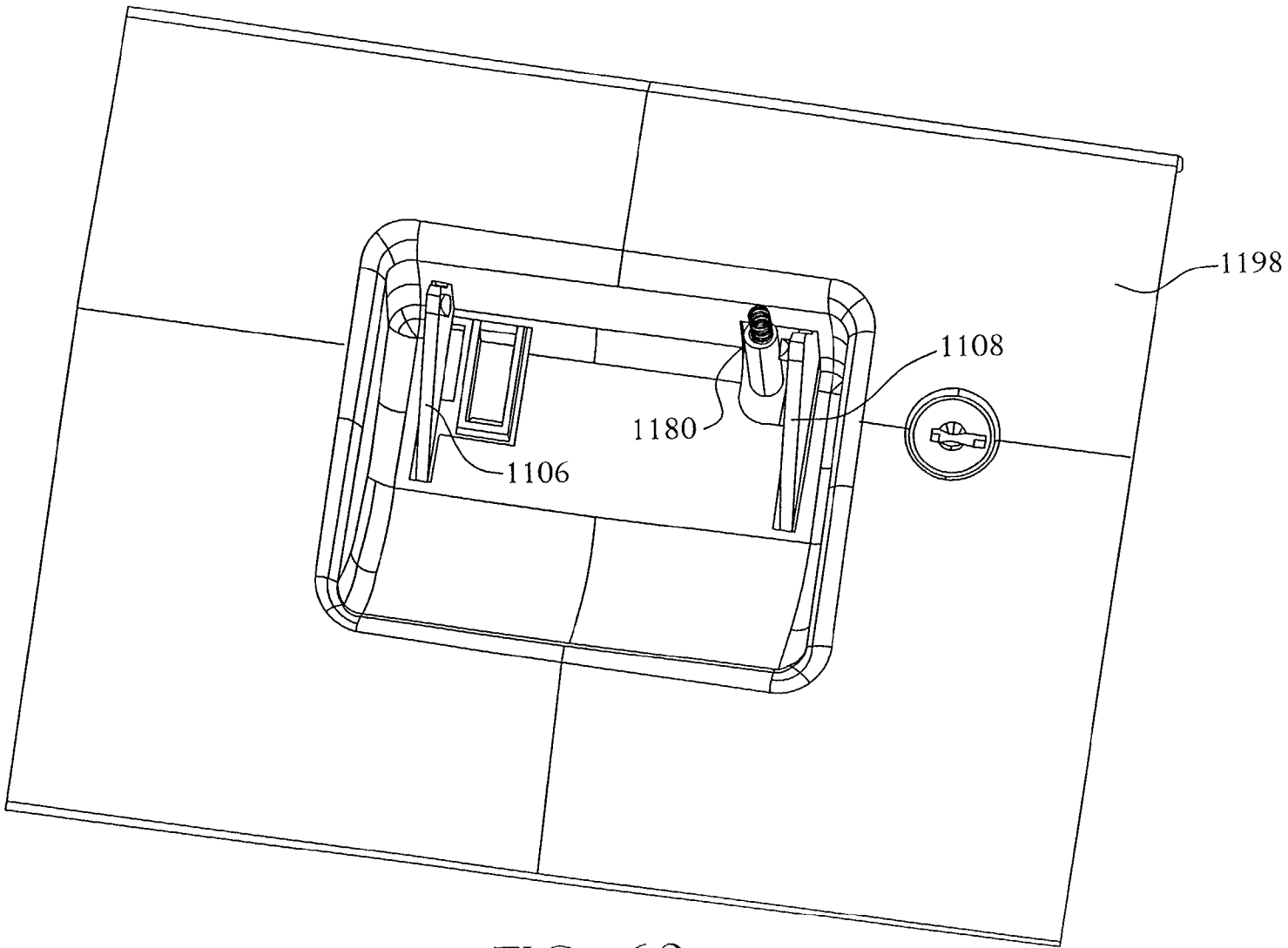
FIG. 60 is a close-up view of the exterior side of a portion of the outer shell of the glove compartment door shown with a latch assembly according to the present invention installed thereto prior to attachment of the latch handle.
Figure 61:
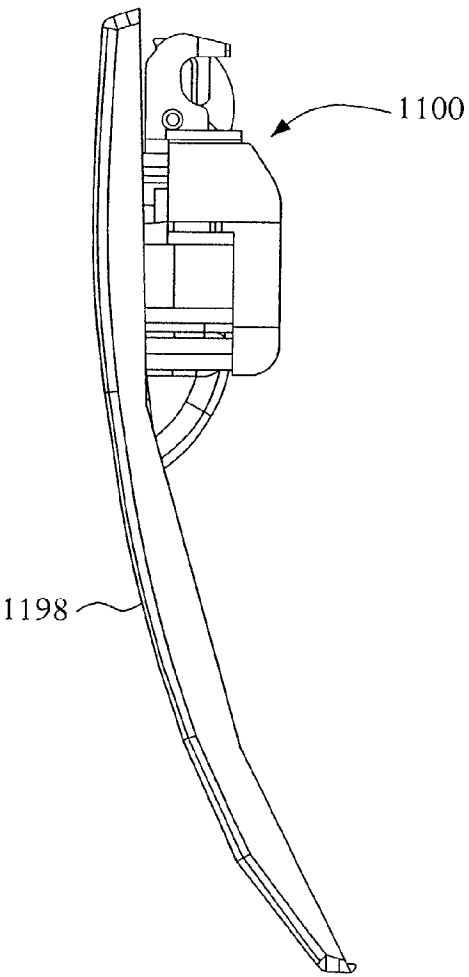
FIG. 61 is an elevational view of the right side of the outer shell of a glove compartment door shown with a latch assembly according to the present invention installed thereto, with the pawl shown in the closed configuration.
Figure 62:
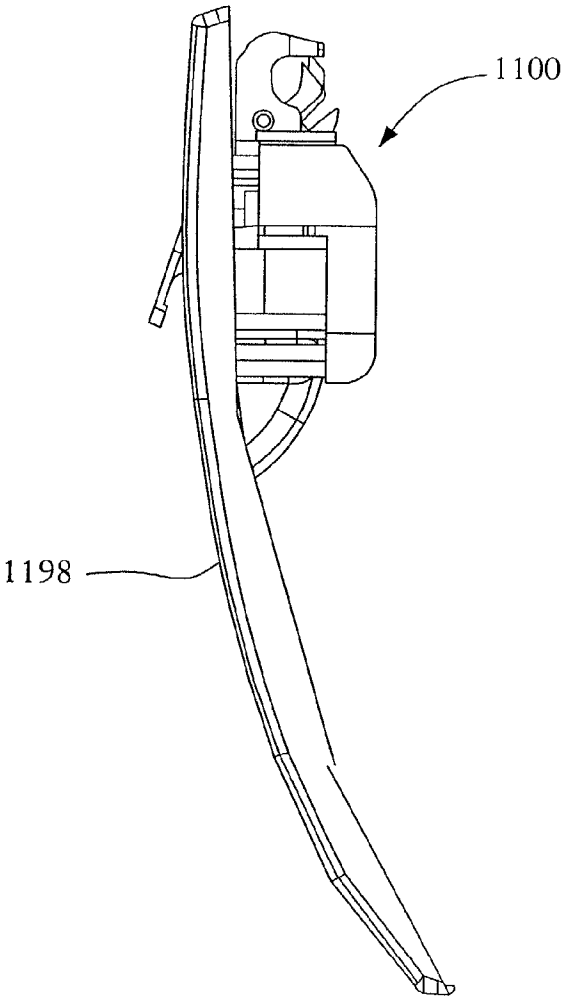
FIG. 62 is an elevational view of the right side of the outer shell of a glove compartment door shown with a latch assembly according to the present invention installed thereto, with the pawl shown in the open configuration.
Figure 63:
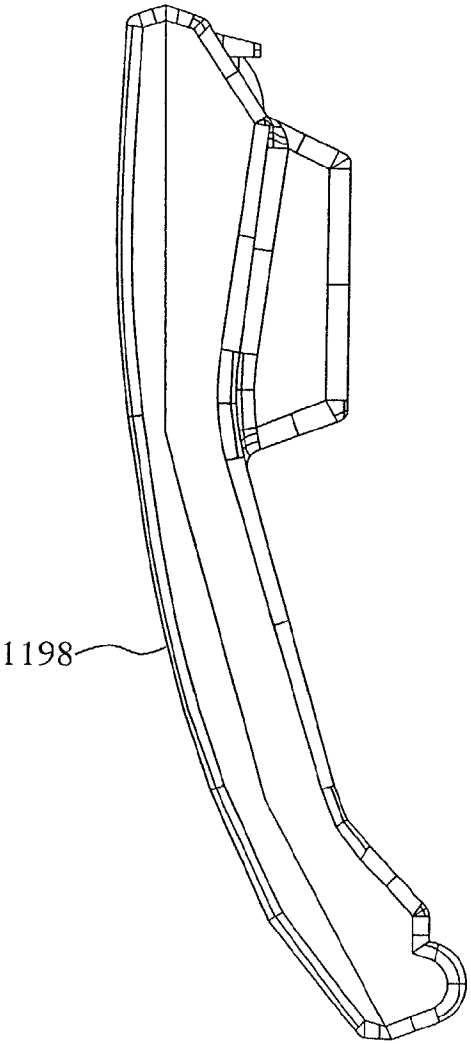
FIG. 63 is an elevational view of the right side of a glove compartment door shown with a latch assembly according to the present invention installed therein, with the pawl shown in the closed configuration.
Figure 64:
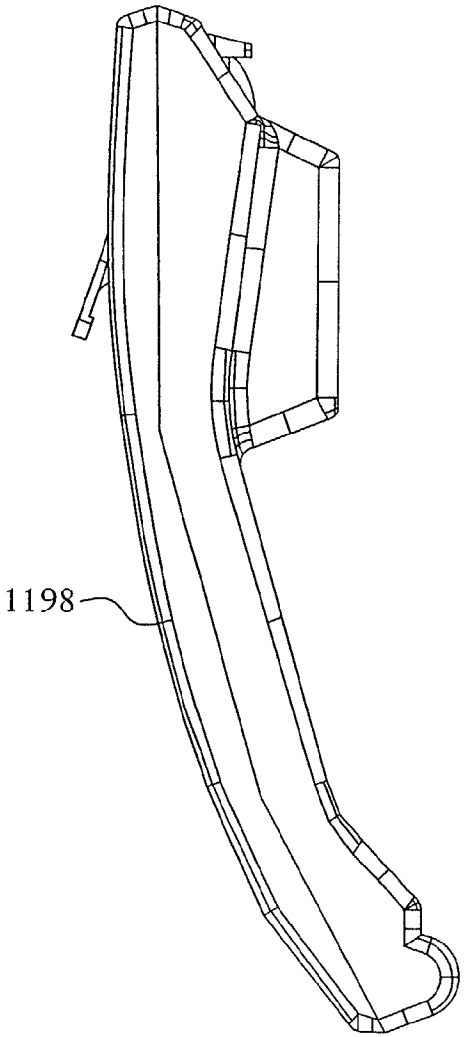
FIG. 64 is an elevational view of the right side of a glove compartment door shown with a latch assembly according to the present invention installed therein, with the pawl shown in the open configuration.
Figure 65:
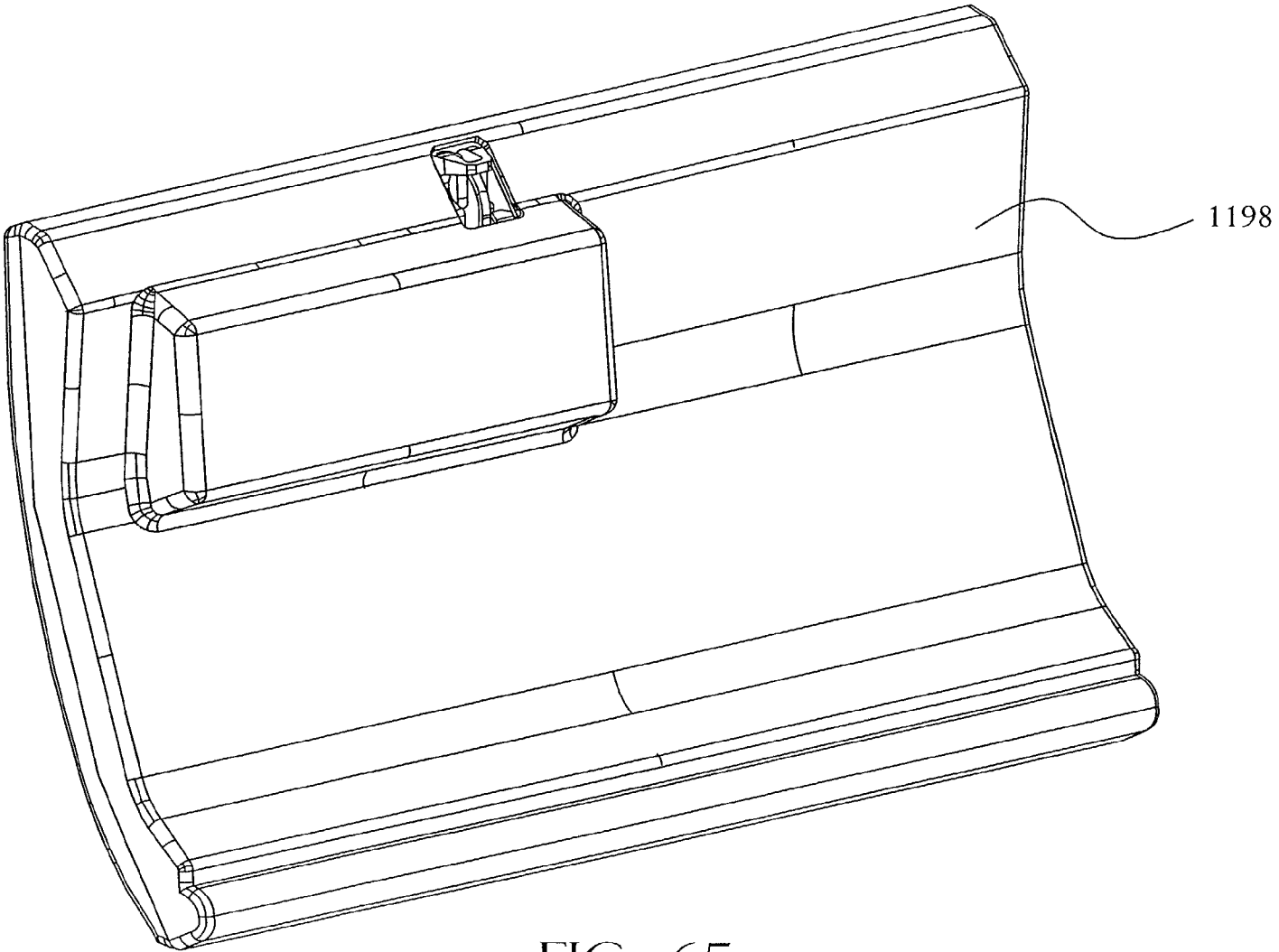
FIG. 65 is a perspective view of the interior side of a glove compartment door shown with a latch assembly according to the present invention installed therein, with the pawl shown in the closed configuration.
Figure 66:
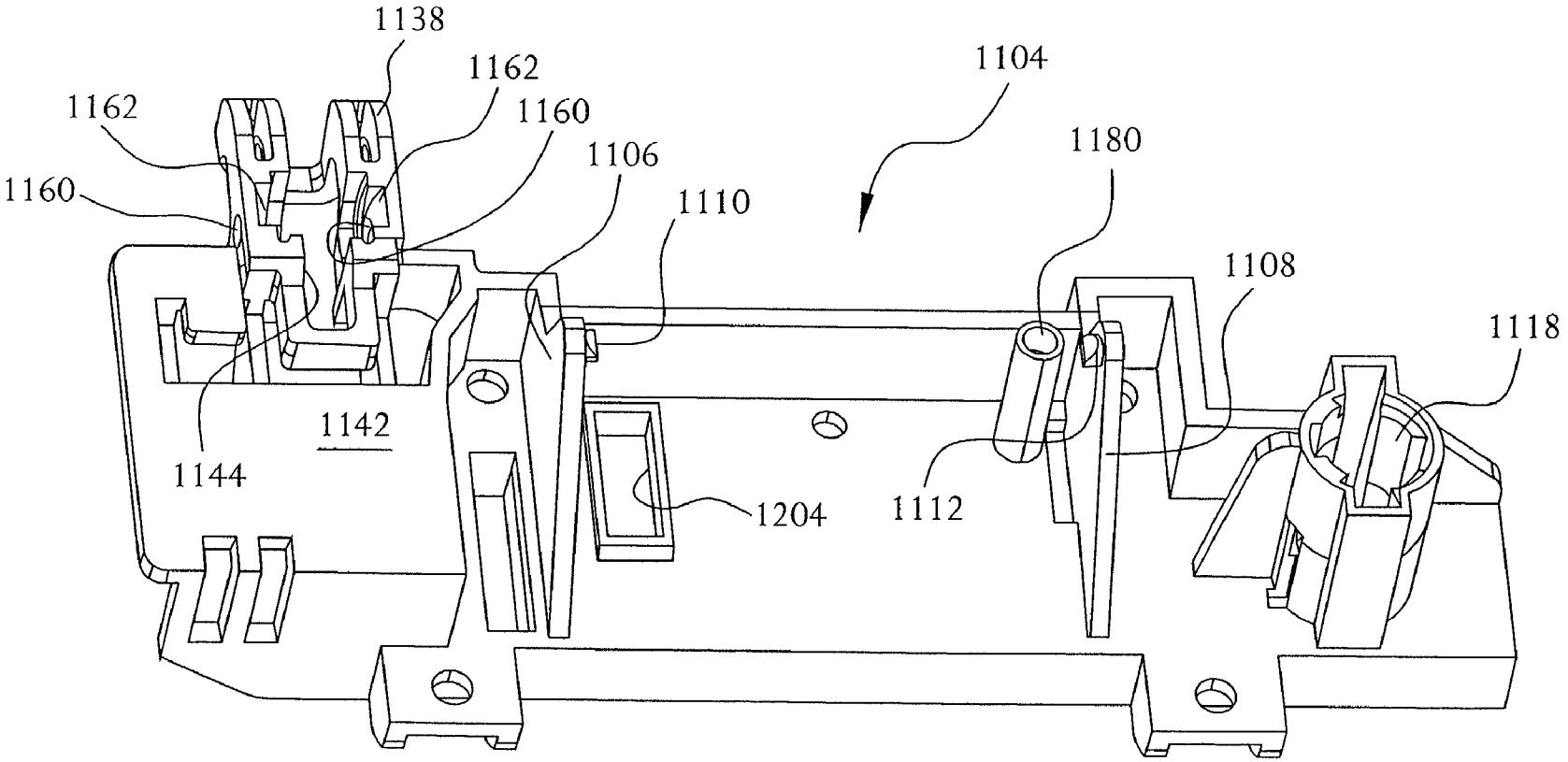
FIG. 66 is a rear perspective view of the housing of the latch assembly according to the present invention.
Figure 67:
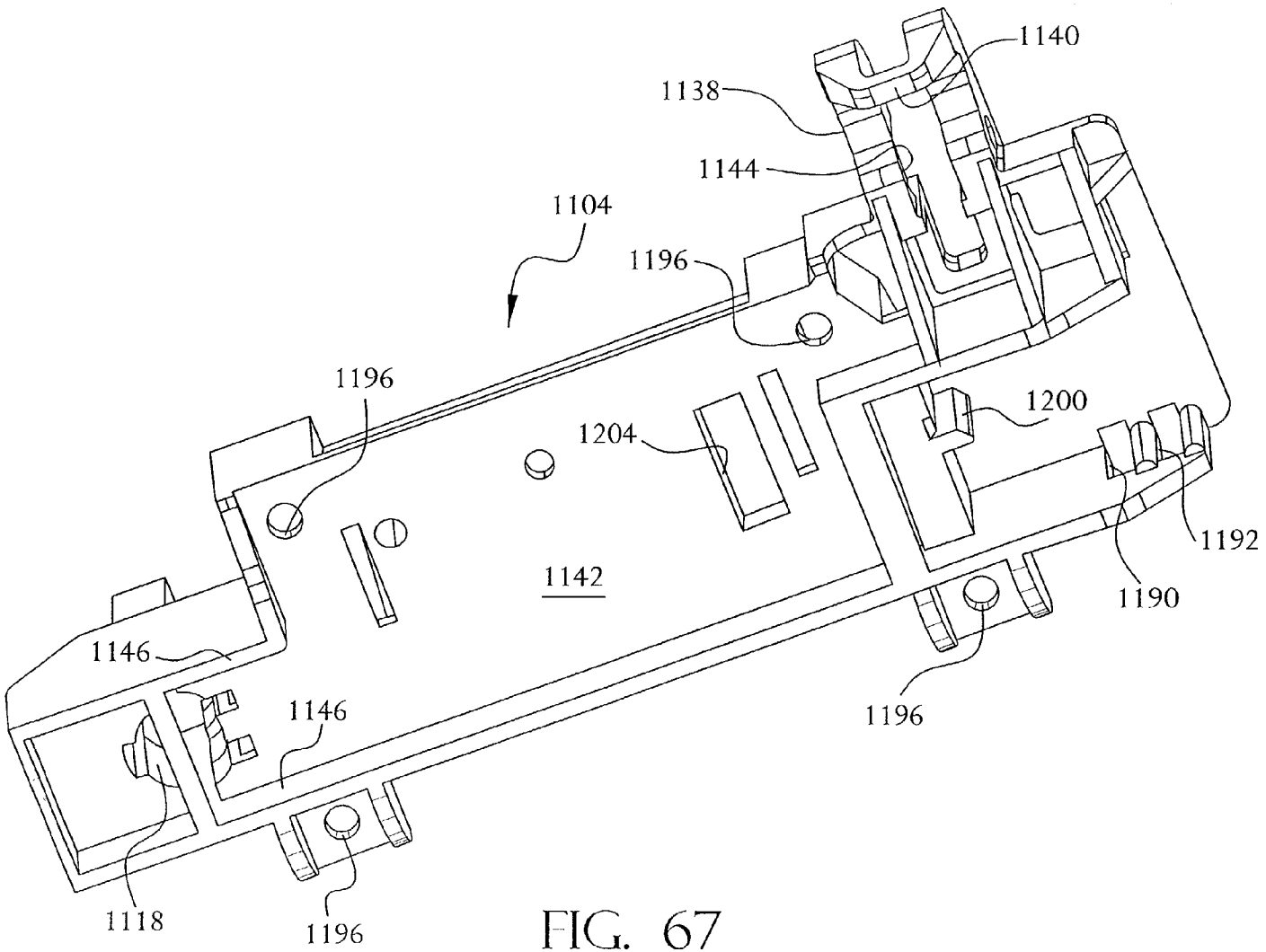
FIG. 67 is a front perspective view of the housing of the latch assembly according to the present invention.

A hook-like structure 1138 projects from the top of the housing 1104. An illustrative example of the application of the latch assembly 1100 is for latching the door of a vehicle's glove compartment. References to top, bottom, front, rear, left side and right side as used herein are applied by reference to the vehicle in which the latch assembly 1100 is installed. For example, the front of the latch housing faces toward the front of the vehicle when the latch housing 1104 is installed to the door of the vehicle's glove compartment and the door of the glove compartment is closed. The rear of the latch housing faces toward the rear of the vehicle when the latch housing 1104 is installed to the door of the vehicle's glove compartment and the door of the glove compartment is closed, the bottom of the latch housing faces toward the floor of the vehicle's passenger compartment when the latch housing 1104 is installed to the door of the vehicle's glove compartment and the door of the glove compartment is closed. The top of the latch housing faces toward the roof of the vehicle's passenger compartment when the latch housing 1104 is installed to the door of the vehicle's glove compartment and the door of the glove compartment is closed and so forth. Hook-like as used herein refers to any member that has a crook, curve, or bend to thereby catch on another member. The hook-like member 1138 extends upward and then forward from the top of the housing 1104 such that the tip 1140 of the hook-like member 1138 points toward the front of the vehicle when the latch housing 1104 is installed to the door of the vehicle's glove compartment and the door of the glove compartment is closed. A first slot 1144 is provided within the hook-like member 138 and extends through a portion of the housing body 1142 (as shown in FIG. 67). The housing body 1142 has a pair of opposing walls 1146 which support the bulbous end 1148 of the catch beam 1150. The bulbous end 1148 has a perimeter the majority of which follows a substantially circular arc such that a surface following a substantially circular arc bears against the walls 1146 throughout the range of pivotal movement of the catch beam 1150. This arrangement allows for the pivotal movement of the catch beam 1150 as well as the linear translation of the catch beam to either the left or the right.

The catch beam 1150 has an elongated slot 1152 in its bulbous end which is engaged by the cam pin 1136. Through the interaction of the cam pin 1136 and the slot 1152, rotation of the lock plug 1120 causes the linear translational motion of the catch beam 1150 to either the left or the right.

The latch assembly 1100 also includes a pawl 1154 shown pivotally connected to the latch housing 1104 with suitable attachment means such as the pawl pivot members 1158 which are provided extending outwardly from the pawl 1154 at opposite sides thereof. The pawl 1154 is installed onto the housing 1104 by snap-fit placement of the pawl pivot members 1158 into the pawl pivot recesses 1160 disposed in the housing 1104. A pair of guide slots 1162 is provided on the housing leading from the edge of the housing to the pawl pivot recesses 1160 for guiding the pawl pivot members 1158, in the direction of the pawl pivot recesses 1160.

The pawl 1154 has a locking lug 1164 and is provided with a pawl slot 1156 to retain a keeper rod (not shown). Preferably the keeper rod is attached to a stationary panel, doorframe or compartment (not shown) at a position such that as the swinging panel or door, to which the latch assembly 1100 is attached, is rotated to the closed position, the keeper rod will pass below the forward pointing portion of the hook-shaped structure 1138 and come into engagement with the pawl 1154.

A pawl torsional spring 1166 is installed on the pawl 1154 with the coiled portions surrounding the pawl pivot members 1158. A loop of the torsion spring 1166 engages the notch 1168 near the top of the pawl 1154. The torsion spring 1166 biases the pawl 1154 toward the open position shown in FIGS. 47 and 53. The pawl lug 1164 has a sloping surface 1170 and a flat radially extending side 1172. The sloping surface 1170 provides a camming action to push the catch beam 1150 downward and out of the way of the lug 1164 as the pawl 1154 rotates from the open position of FIGS. 47 and 53 to the closed position of FIGS. 46 and 52. Once the pawl 1154 is in the closed position the catch plate 1174 of the catch beam 1150 snaps up behind the lug 1164, under the bias of the spring 1176, and catches the flat side of the lug 1164 to retain the pawl 1154 in the closed configuration. In the illustrated example, the spring 1176 is a living spring that is one piece construction with the catch beam 1150. The catch plate 1174 is dimensioned such that the catch plate 1174 can maintain engagement with the lug 1164 over the entire range of the linear translational movement of the catch beam 1150.

The handle 1102 has an actuation arm 1178 extending forward therefrom. Extending from the housing body 1142 is a spring retaining socket 1180 which is aligned with spring retaining structure 1182 of the handle 1102. A handle spring 1184 is cooperatively held by the spring retaining structure 1182 and the socket 1180. The spring 1184 provides a bias when the handle 1102 is lifted so that after actuation takes place the handle 1102 is returned to its original position by the force of the compression spring 1184.

The actuation arm 1178 of the paddle 1102 passes through an opening 1204 in the housing 1104 and is provided to engage the catch beam 1150 at the engaging pad 1186. The free end of the living spring 1176 is provided with a bulge 1188 which alternatively engages the slots 1190 and 1192 to provide a detent feature which stabilizes the catch beam 1150 in the locked and unlocked positions, respectively.

Figure 68:
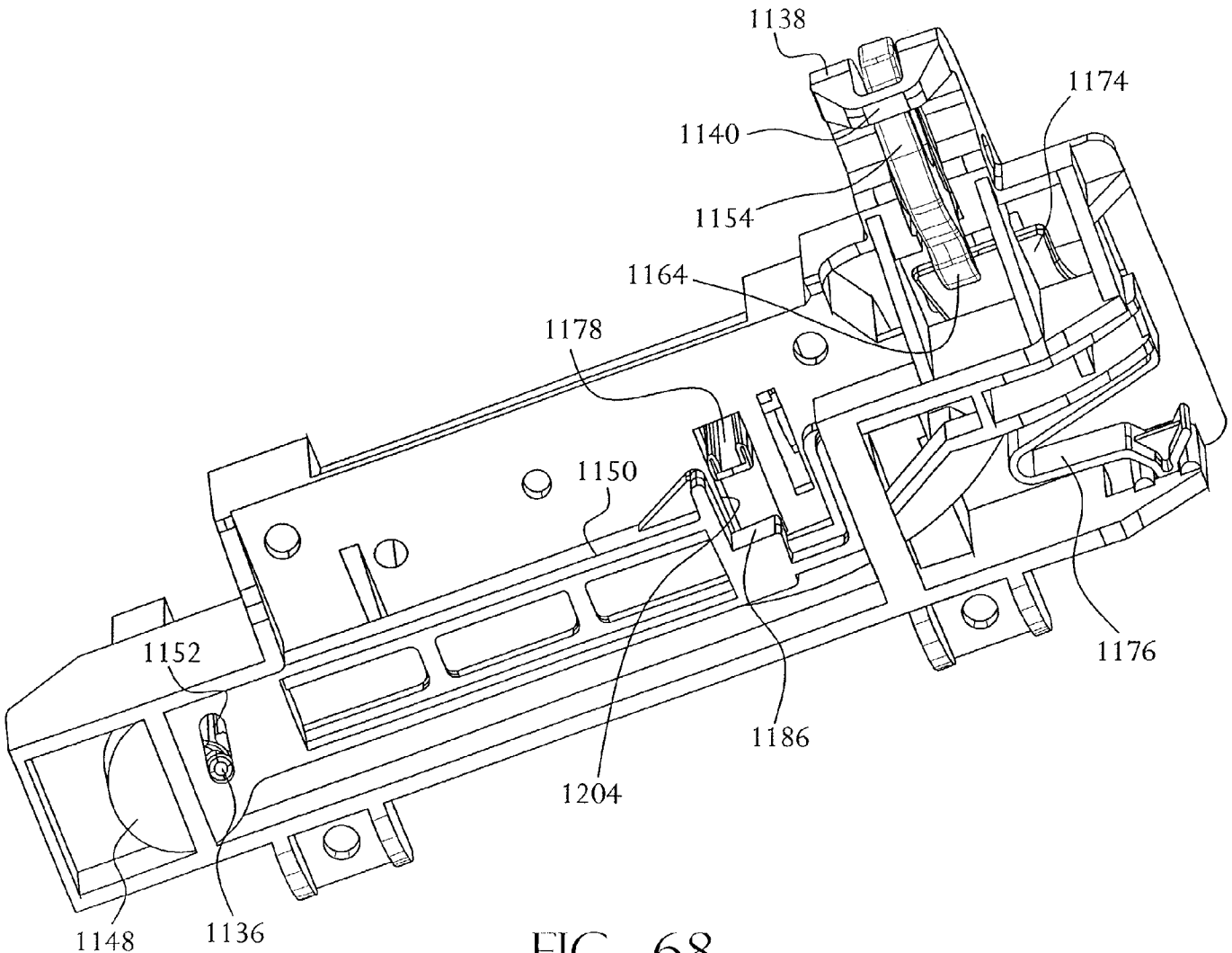
FIG. 68 is a front perspective view of the latch assembly according to the present invention, showing the catch bar in the unlocked position.
Figure 69:
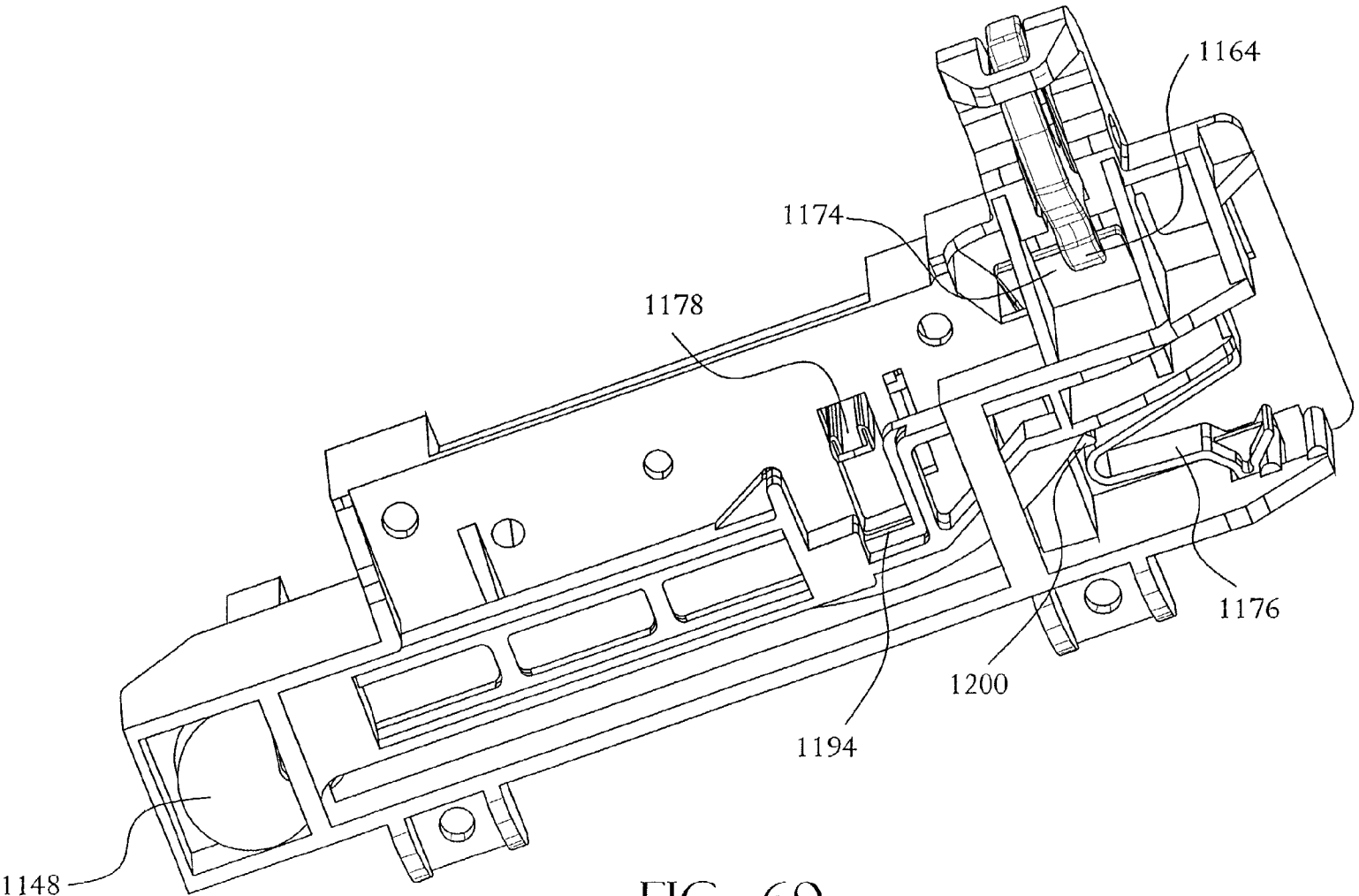
FIG. 69 is a front perspective view of the latch assembly according to the present invention, showing the catch bar in the locked position.
Figure 70:
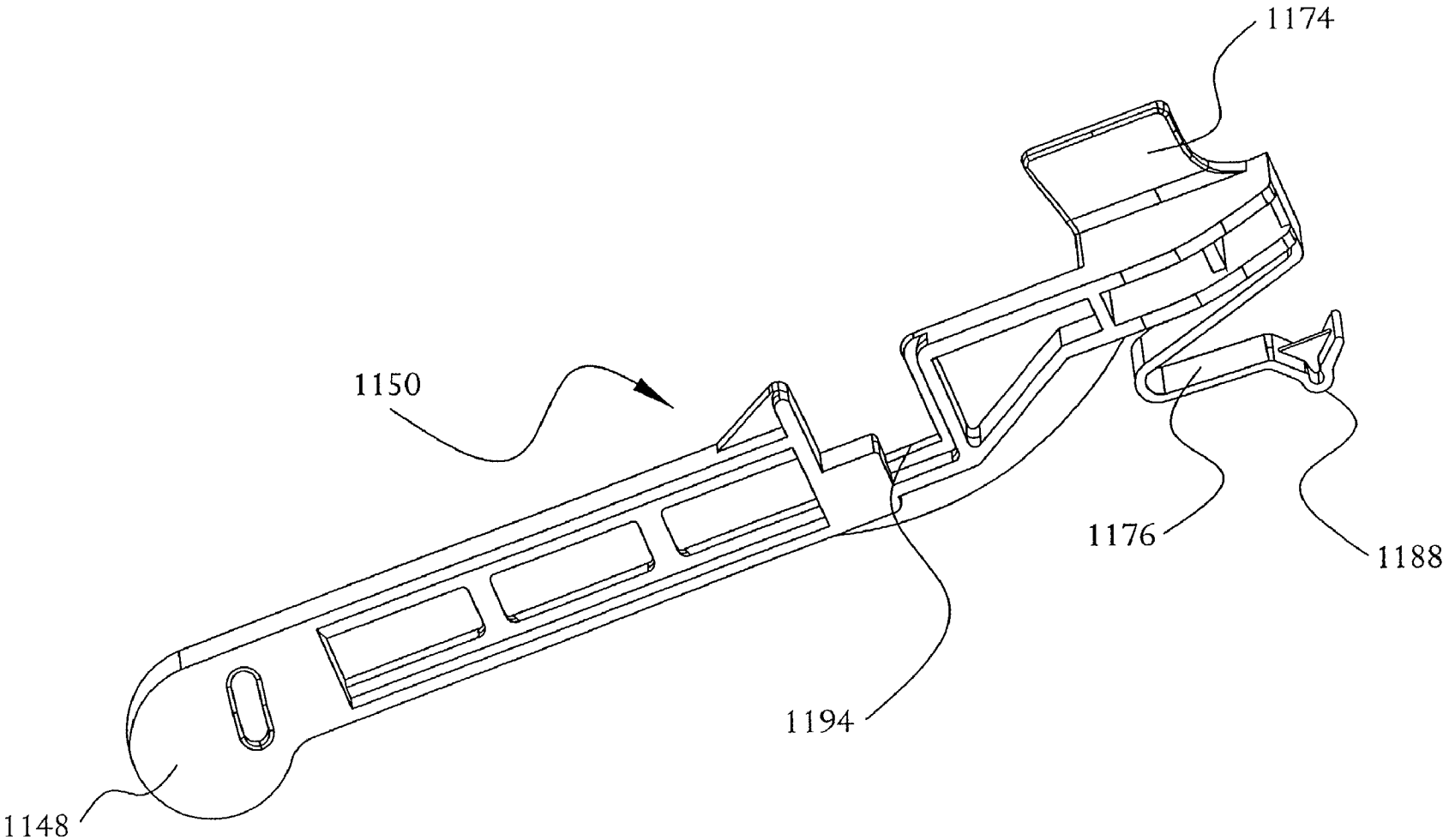
FIG. 70 is a front perspective view of the catch bar of the latch assembly according to the present invention.
Figure 71:
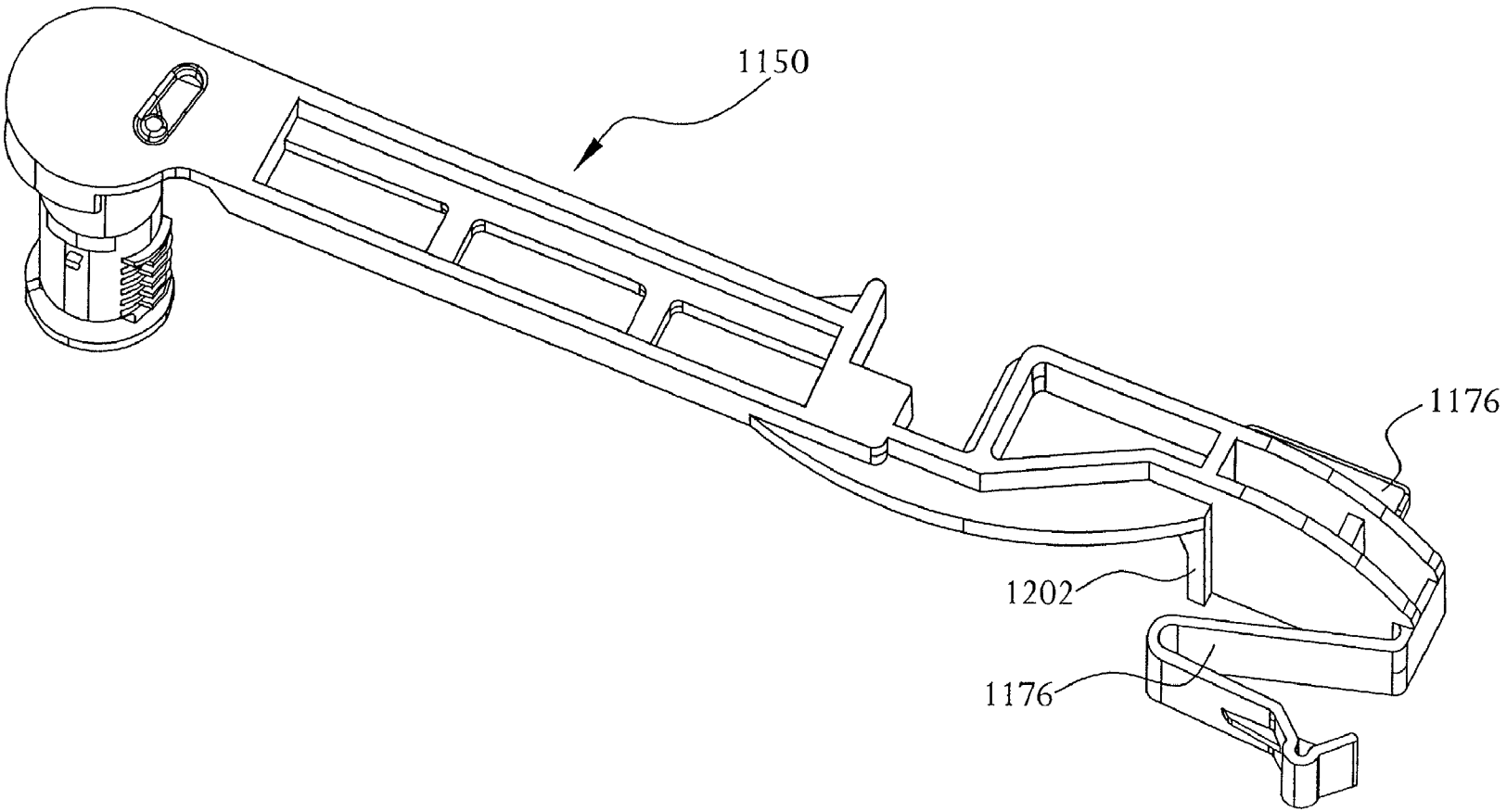
FIG. 71 is a front perspective view of the catch bar of the latch assembly according to the present invention, shown assembled together with the lock plug and actuating cam of the latch assembly.
Figure 72:
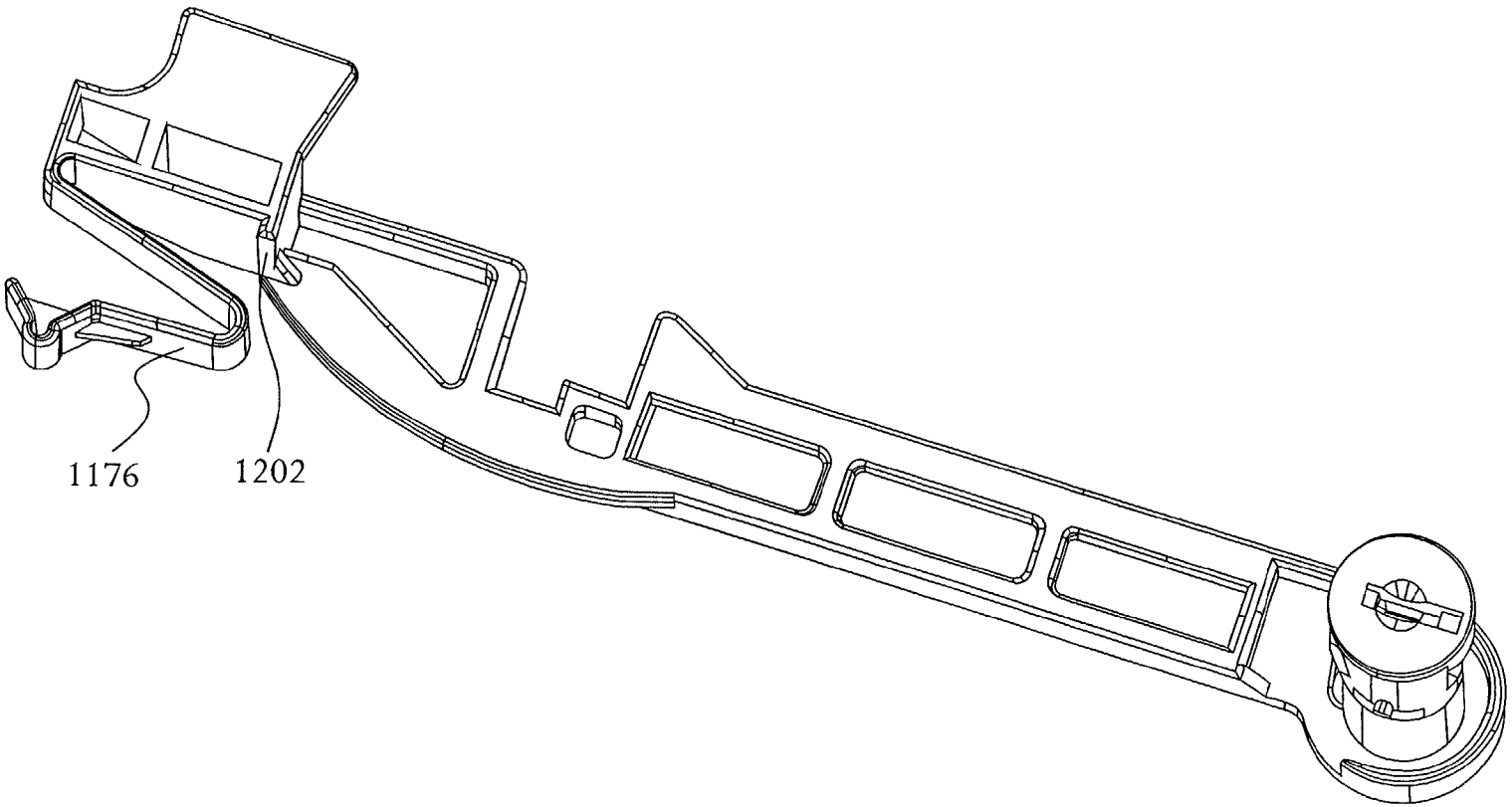
FIG. 72 is a rear perspective view of the catch bar of the latch assembly according to the present invention, shown assembled together with the lock plug and actuating cam of the latch assembly.
Figure 73:
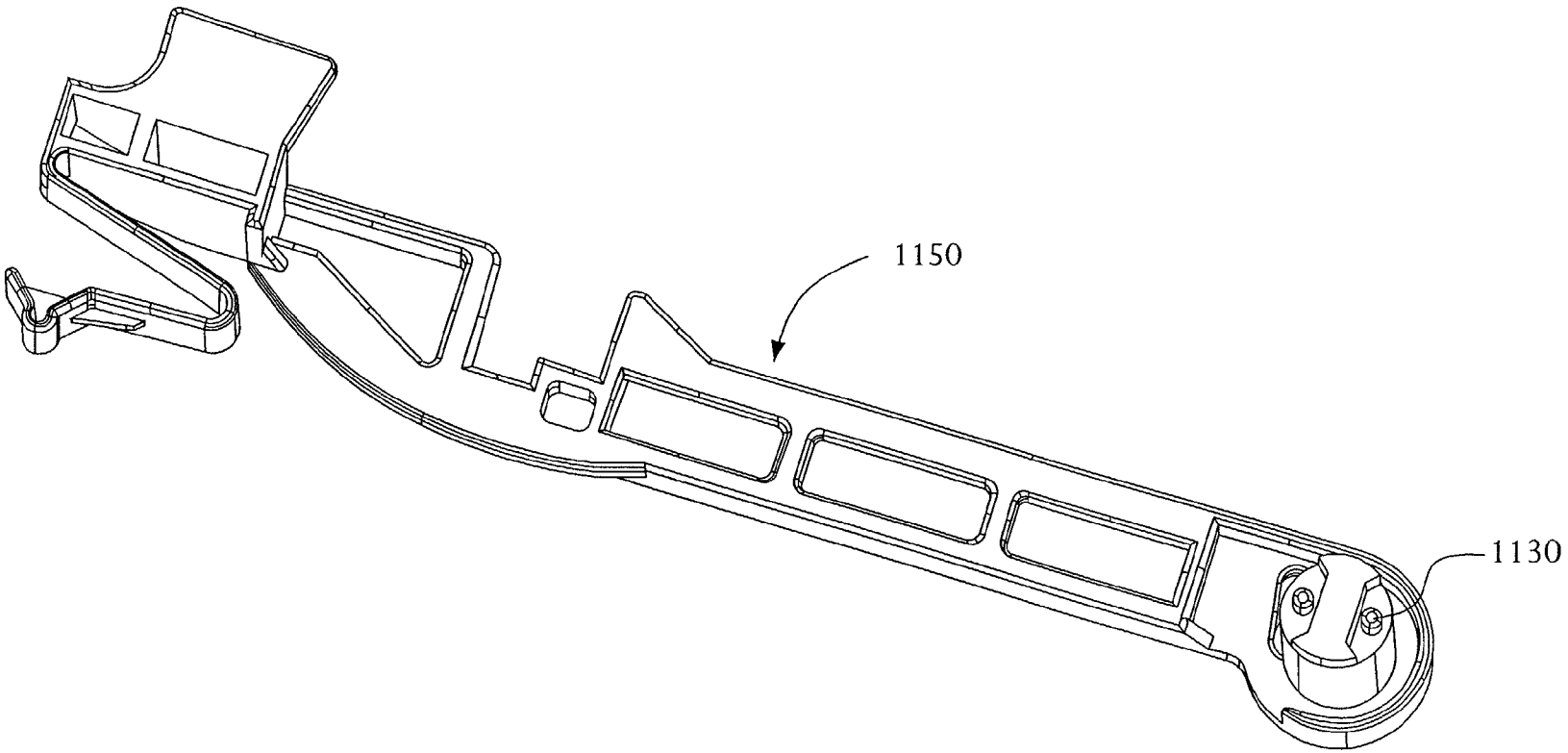
FIG. 73 is a rear perspective view of the catch bar of the latch assembly according to the present invention, shown assembled together with the actuating cam of the latch assembly.
Figure 74:
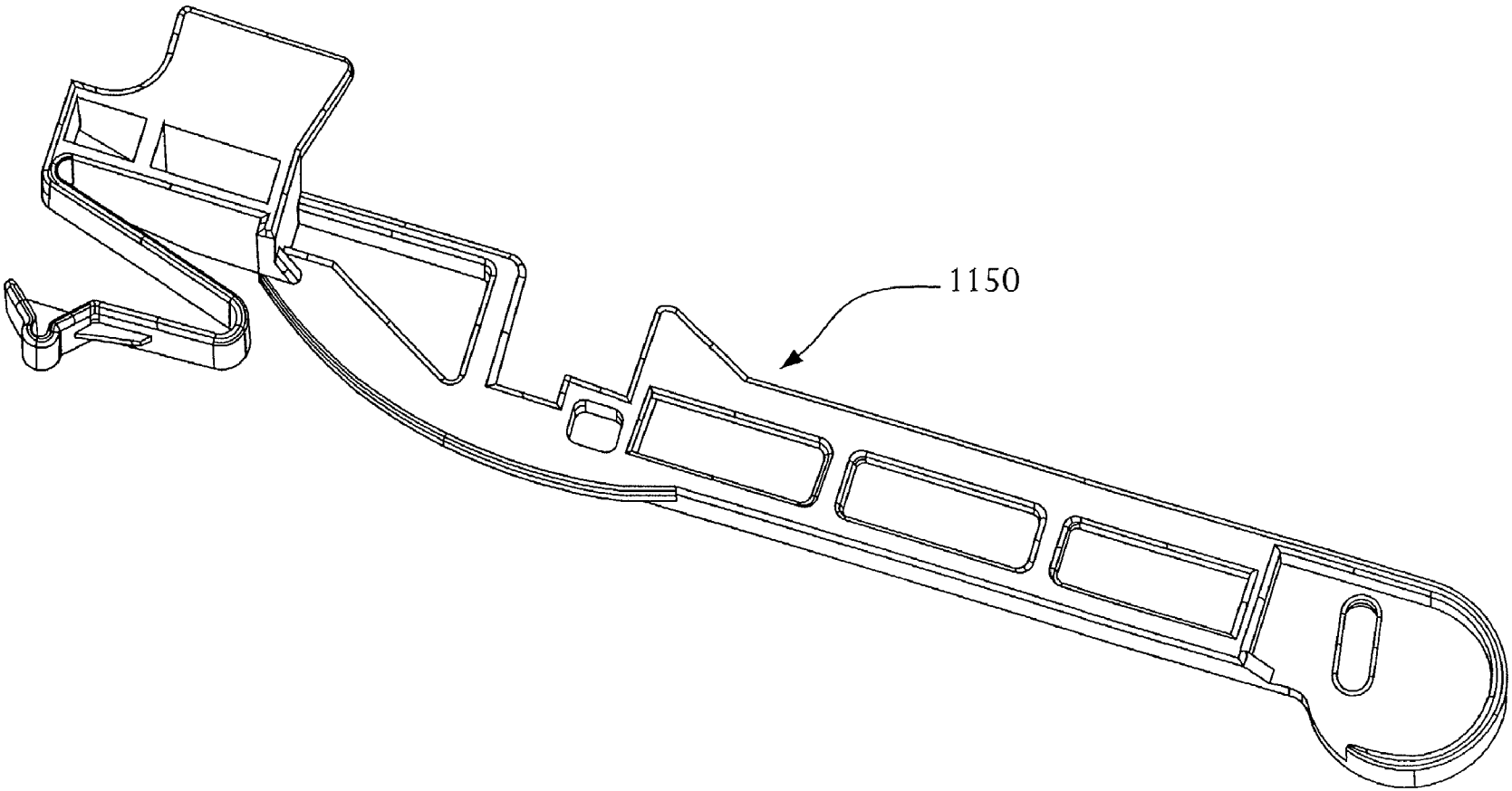
FIG. 74 is a rear perspective view of the catch bar of the latch assembly according to the present invention.
Figure 75:
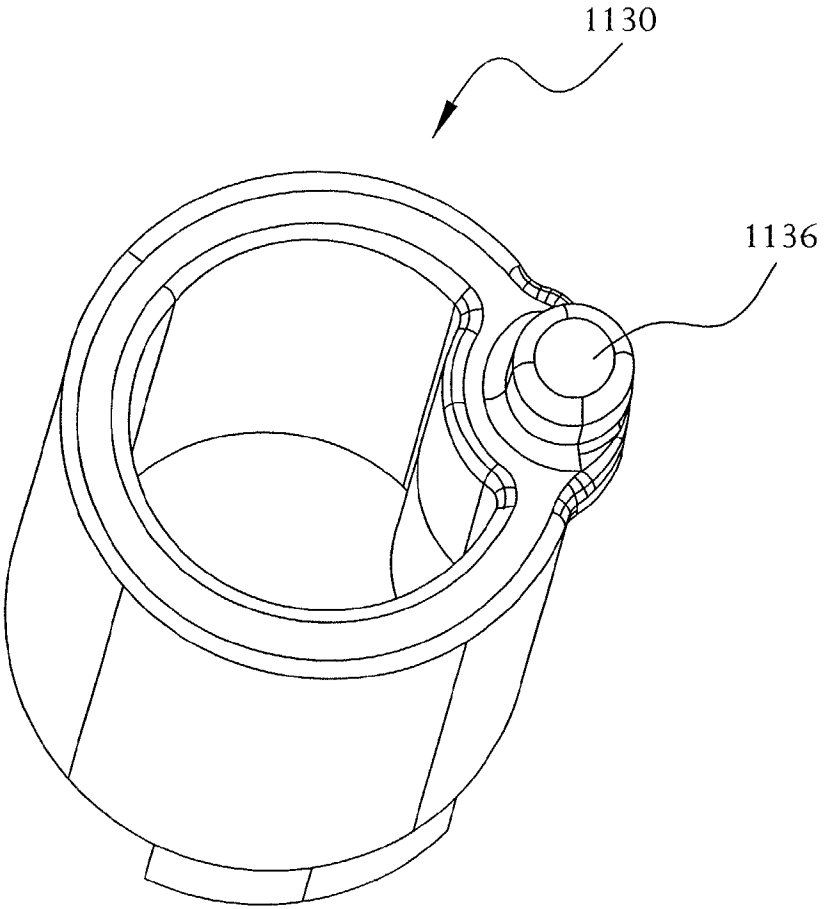
FIG. 75 is a front perspective view of the actuating cam of the latch assembly according to the present invention.
Figure 76:
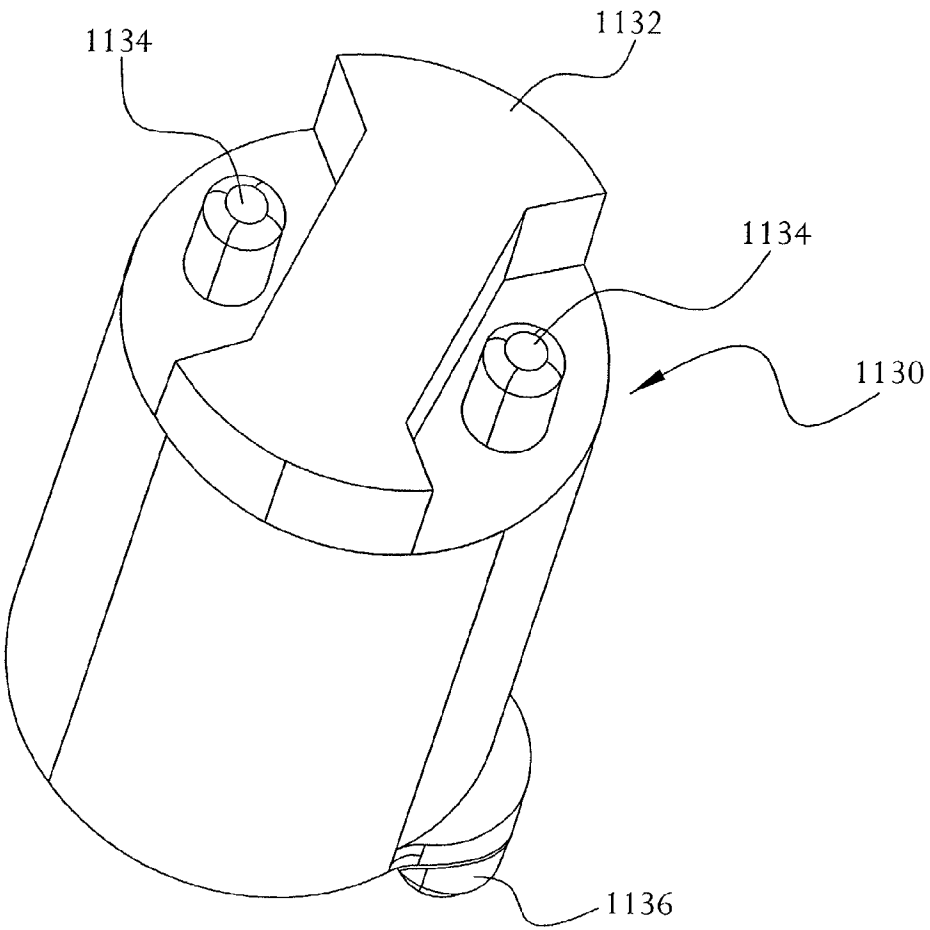
FIG. 76 is a rear perspective view of the actuating cam of the latch assembly according to the present invention.
Figure 77:
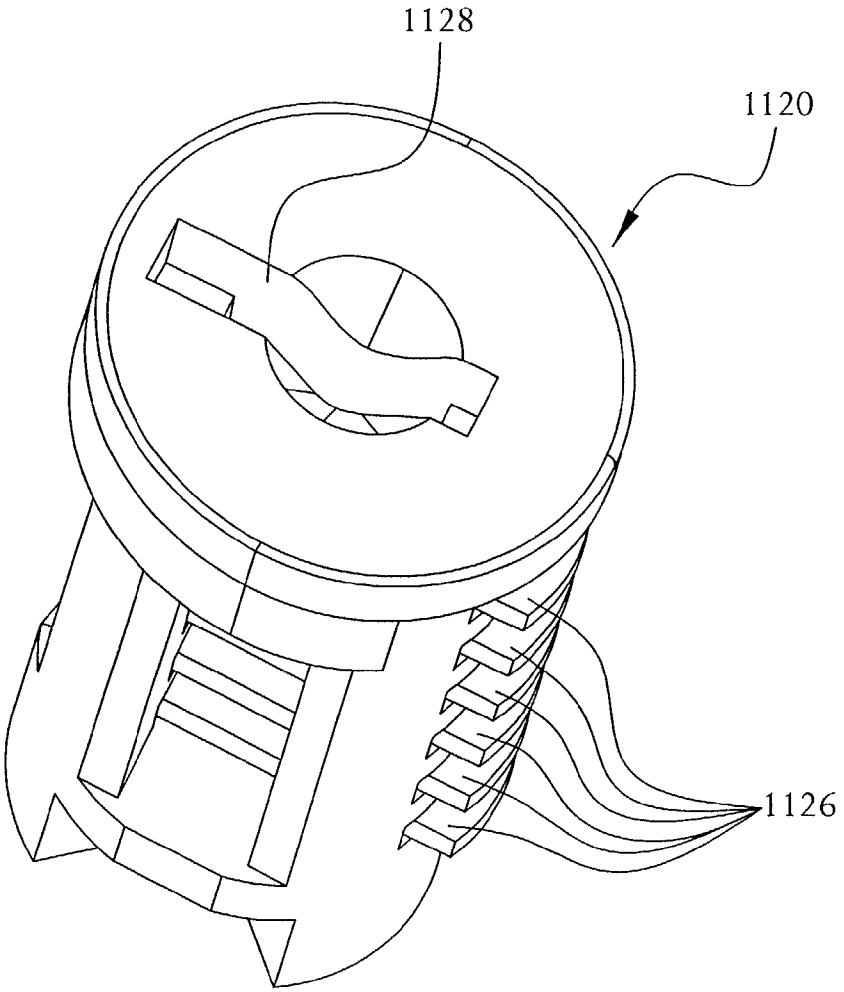
FIG. 77 is a rear perspective view of the lock plug of the latch assembly according to the present invention.
Figure 78:
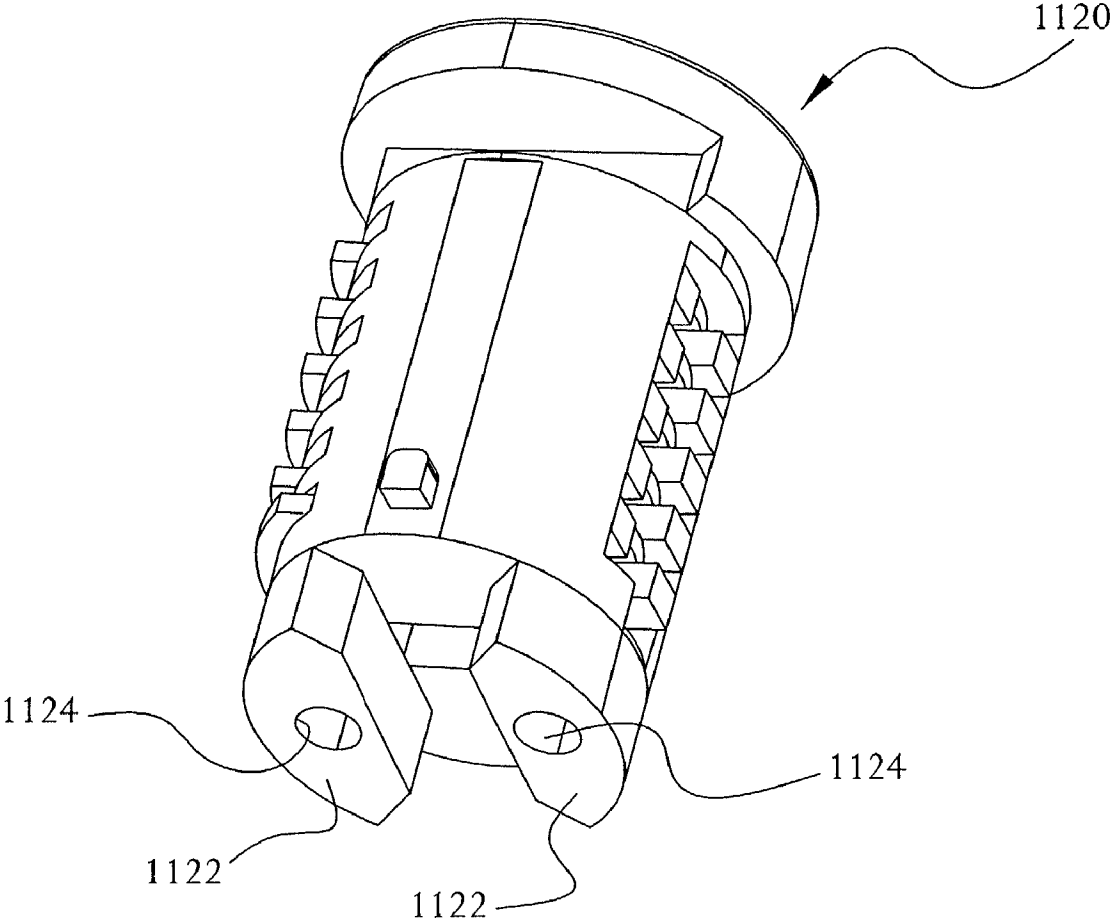
FIG. 78 is a front perspective view of the lock plug of the latch assembly according to the present invention.
Figure 79:
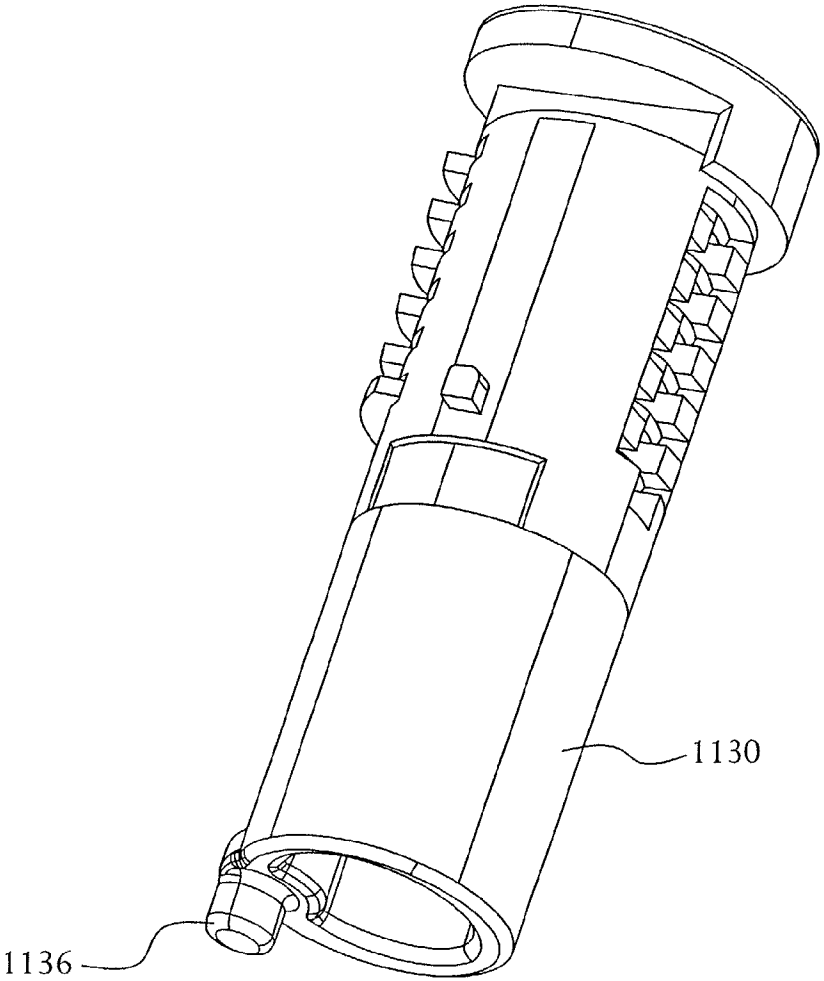
FIG. 79 is a front perspective view of the lock plug and actuating cam of the latch assembly according to the present invention, shown assembled together.
Figure 80:
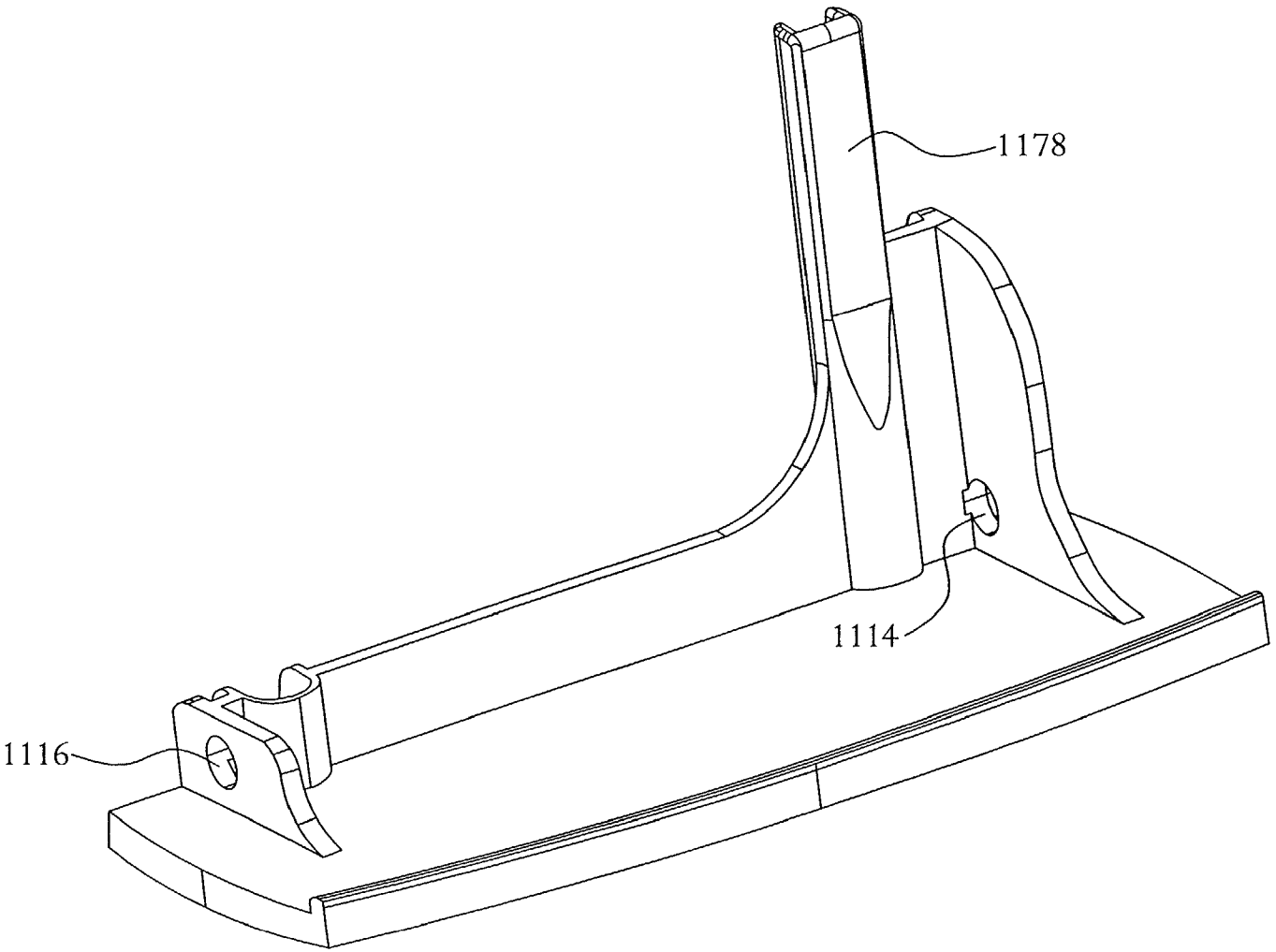
FIG. 80 is a bottom front perspective view of the handle of the latch assembly according to the present invention.
Figure 81:
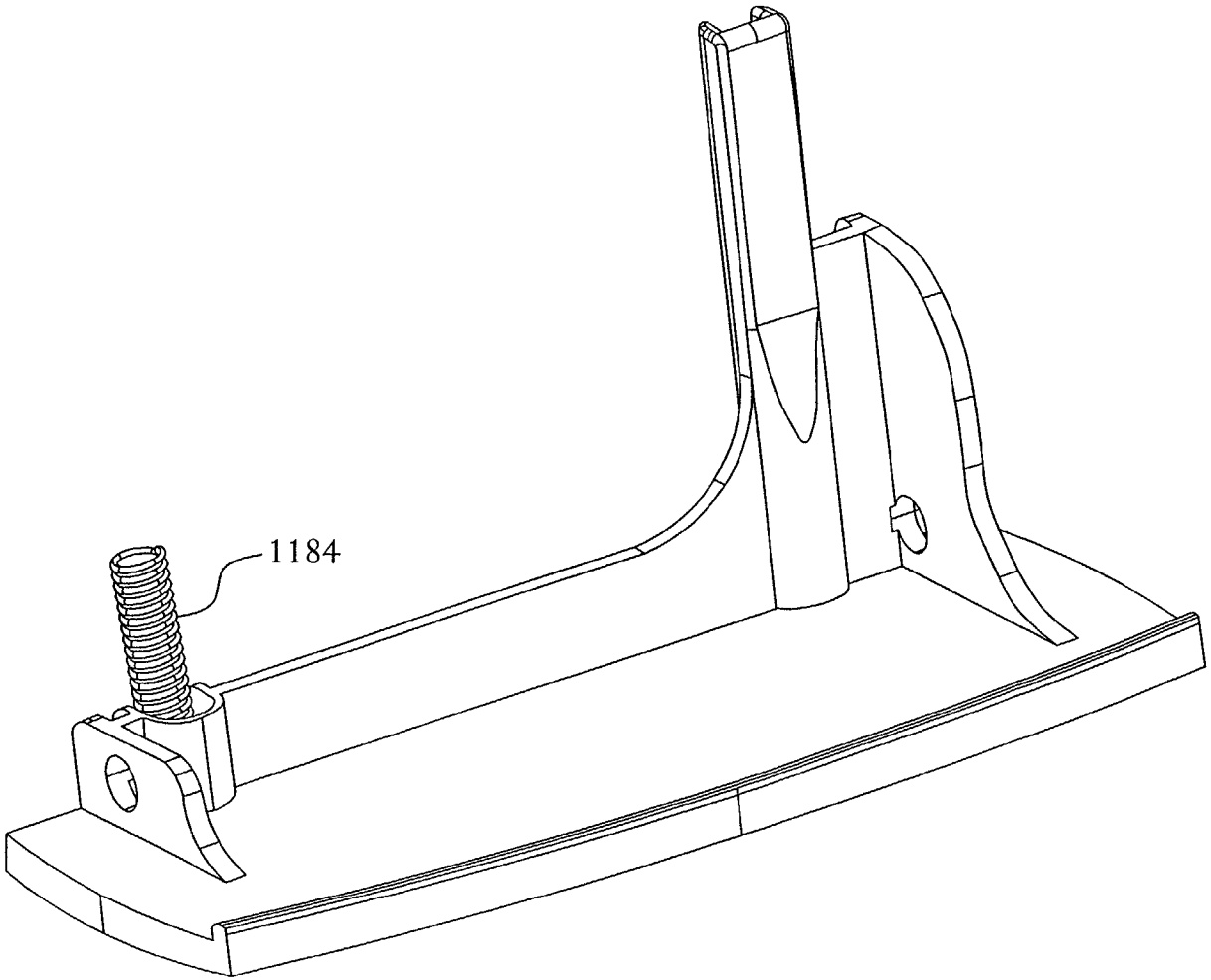
FIG. 81 is a bottom front perspective view of the handle of the latch assembly according to the present invention, shown assembled together with the handle spring.
Figure 82:
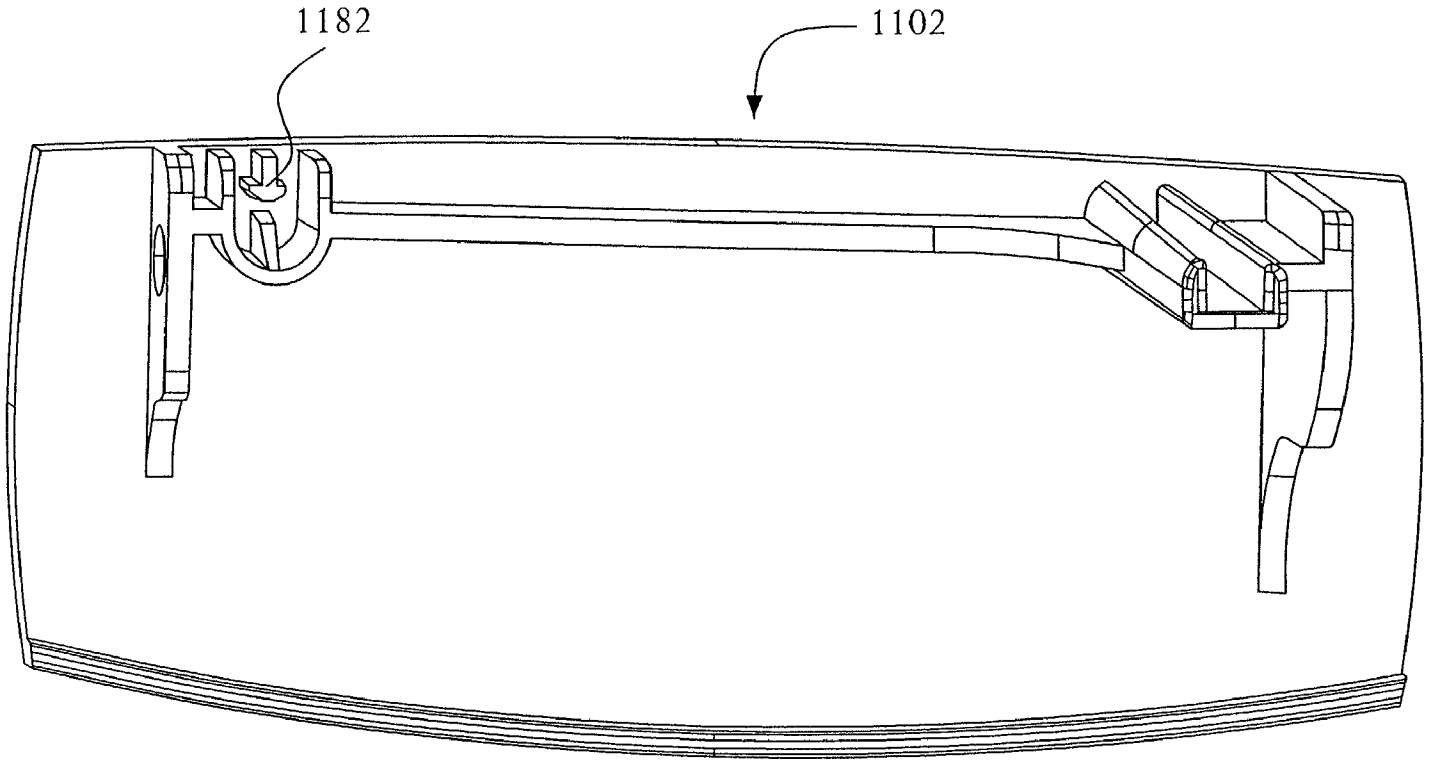
FIG. 82 is a front perspective view of the handle of the latch assembly according to the present invention.
Figure 83:
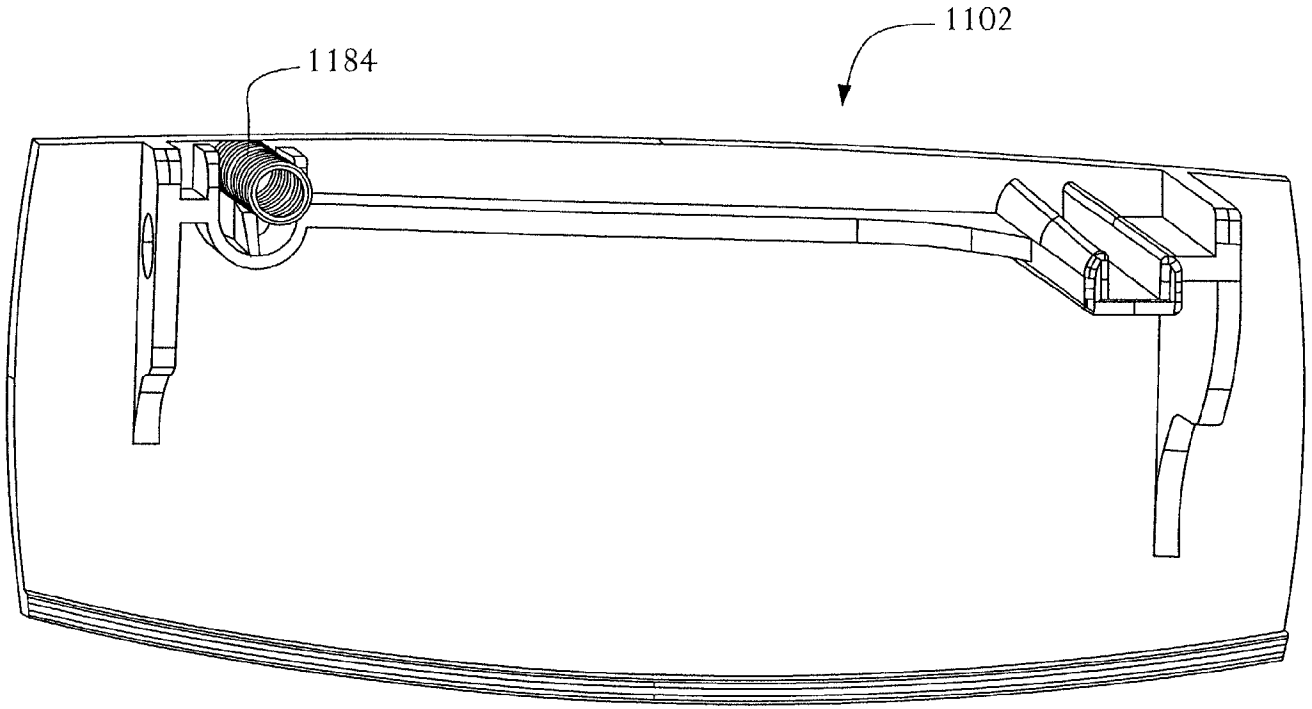
FIG. 83 is a front perspective view of the handle of the latch assembly according to the present invention, shown assembled together with the handle spring.
Figure 84:
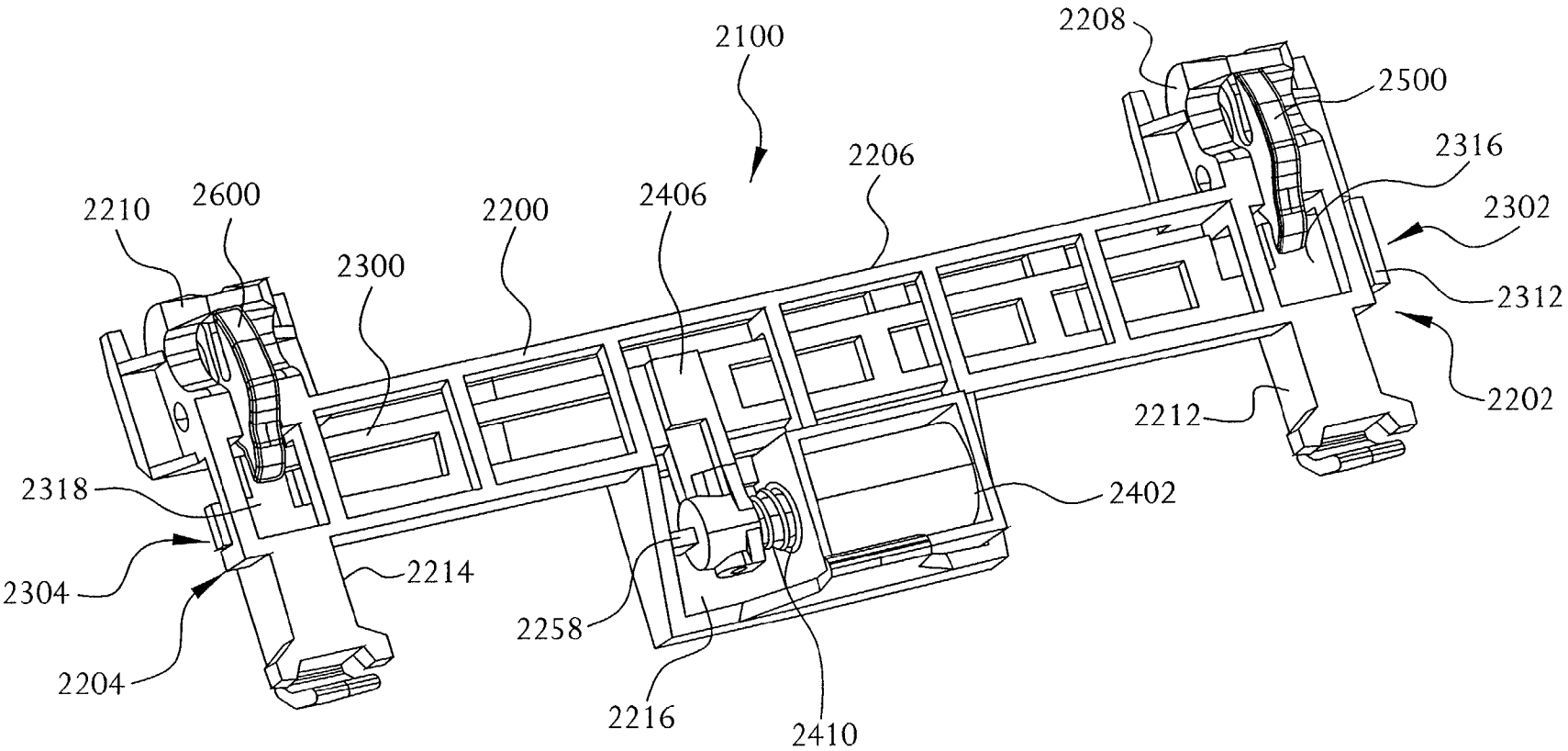
FIG. 84 is a front perspective view of the latch assembly according to the present invention, showing the catch beam in the locked position.
Figure 85:
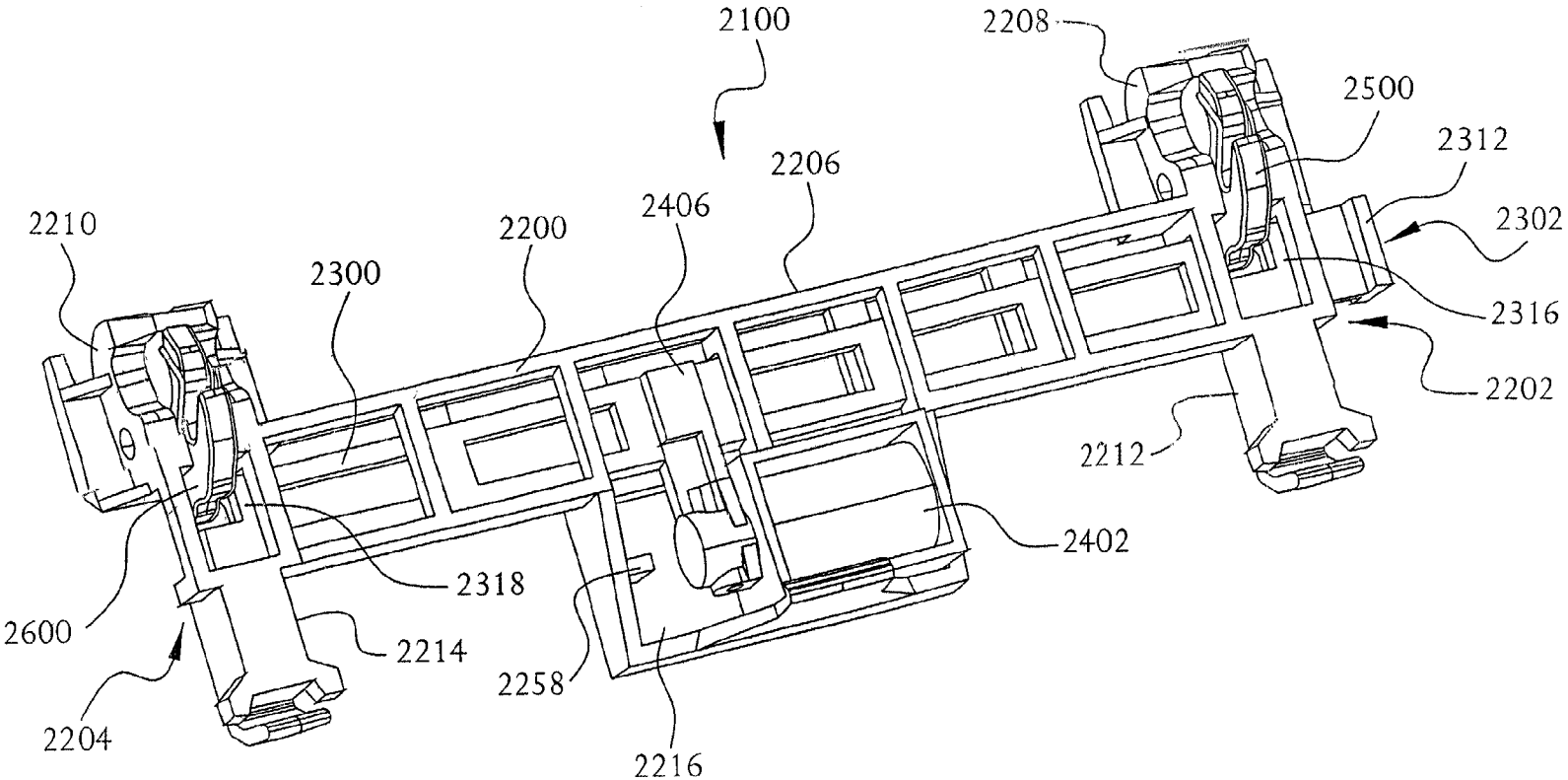
FIG. 85 is a front perspective view of the latch assembly according to the present invention, showing the catch beam in the unlocked position.
Figure 86:
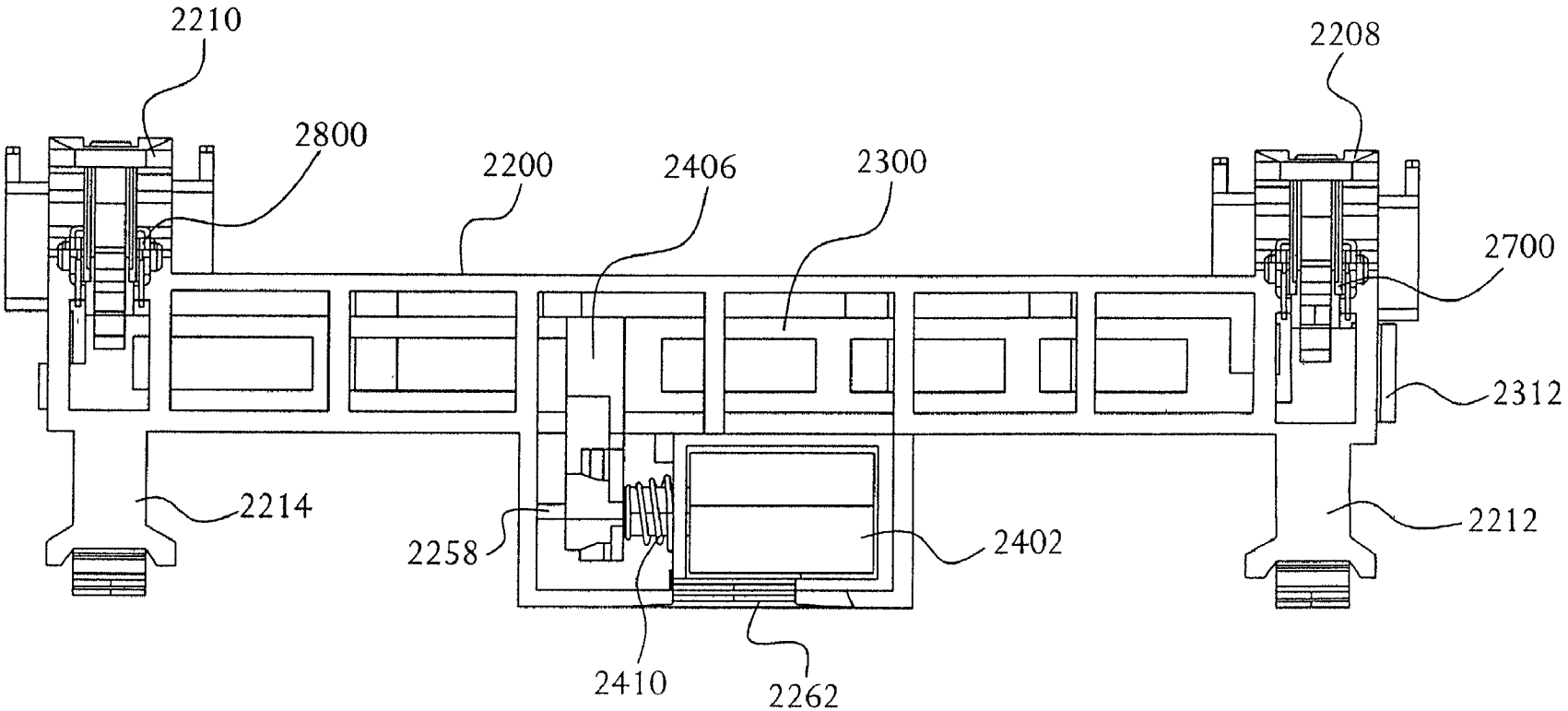
FIG. 86 is a front view of the latch assembly according to the present invention, showing the catch beam in the locked position.
Figure 87:
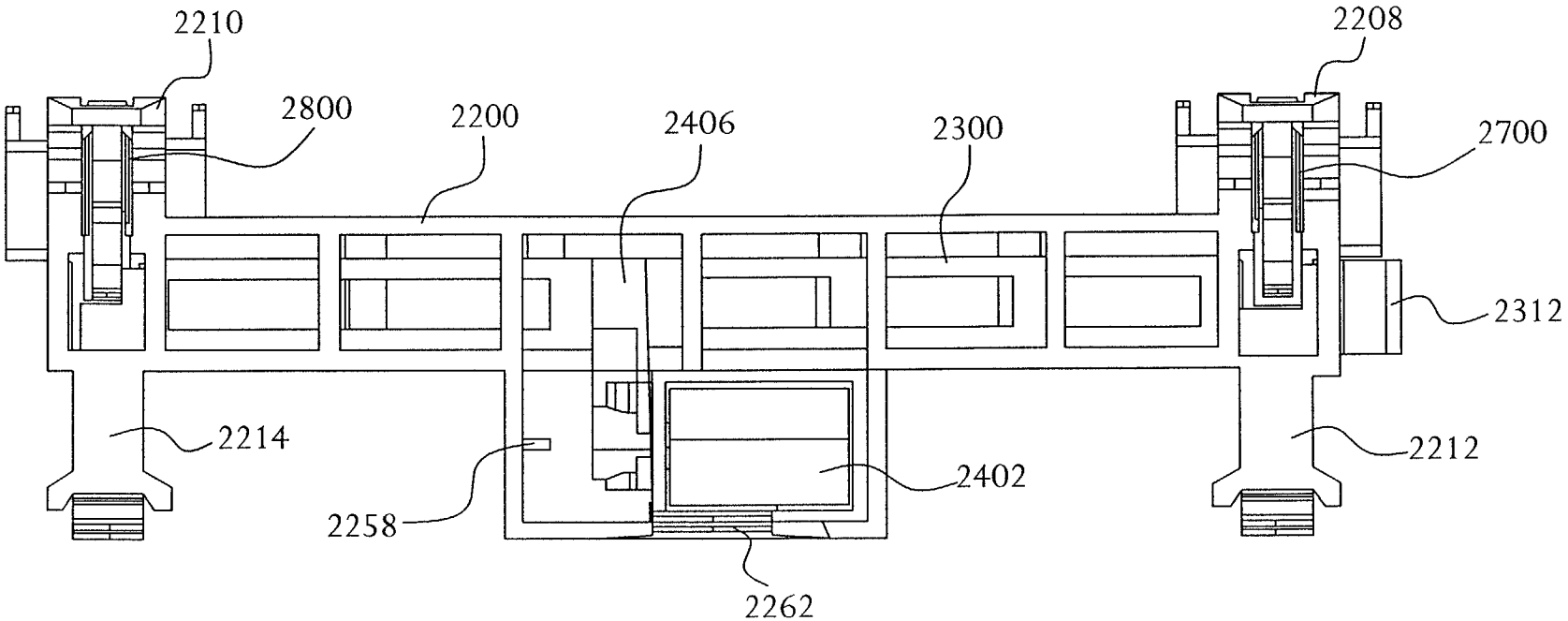
FIG. 87 is a front view of the latch assembly according to the present invention, showing the catch beam in the unlocked position.
Figure 88:
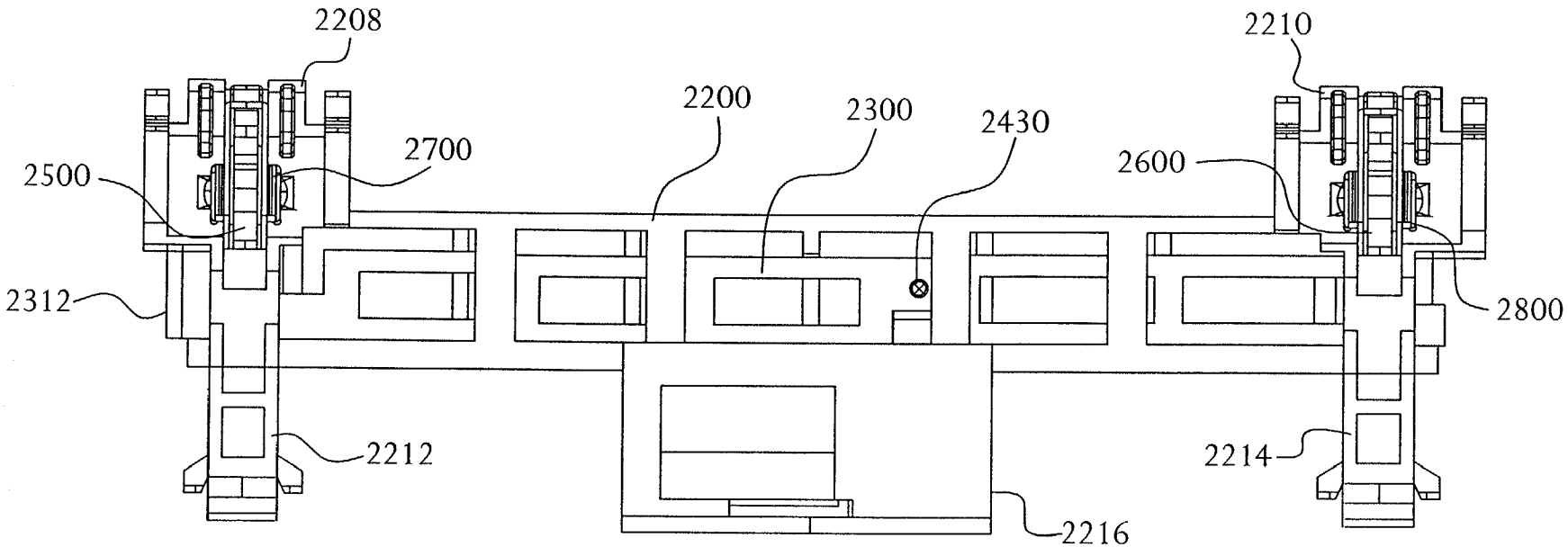
FIG. 88 is a rear view of the latch assembly according to the present invention, showing the catch beam in the locked position.
Figure 89:
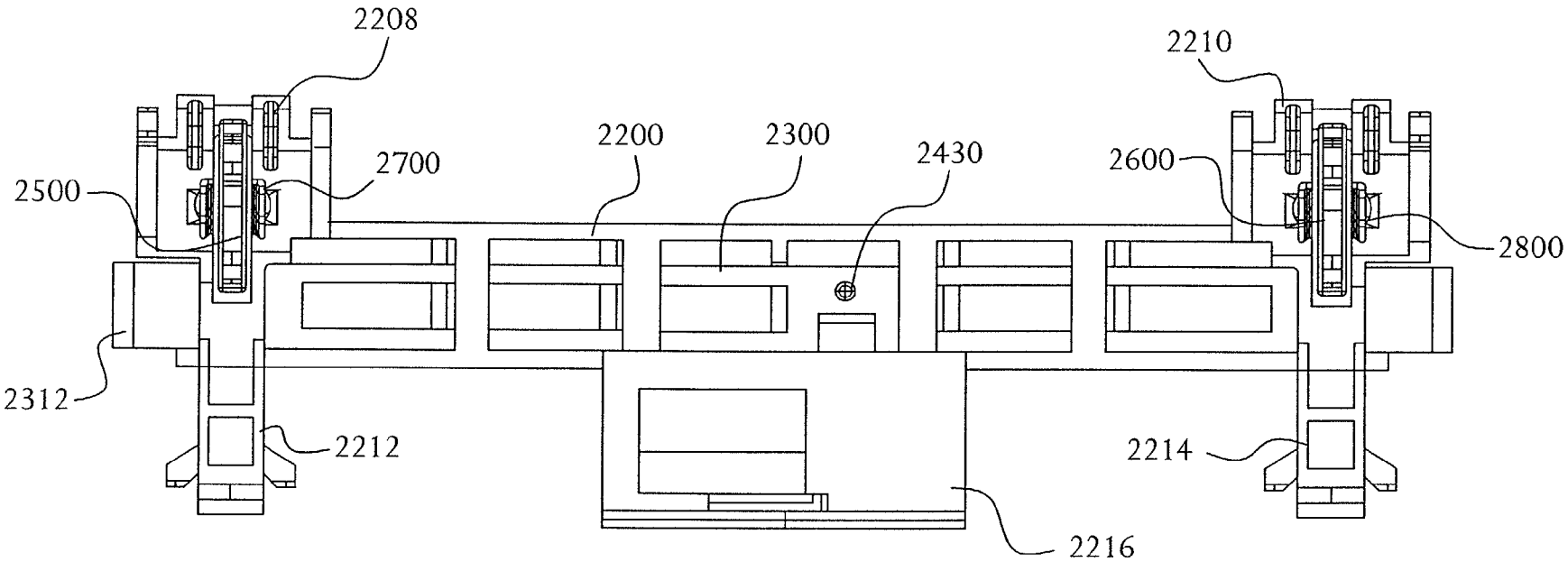
FIG. 89 is a rear view of the latch assembly according to the present invention, showing the catch beam in the unlocked position.
Figure 90:
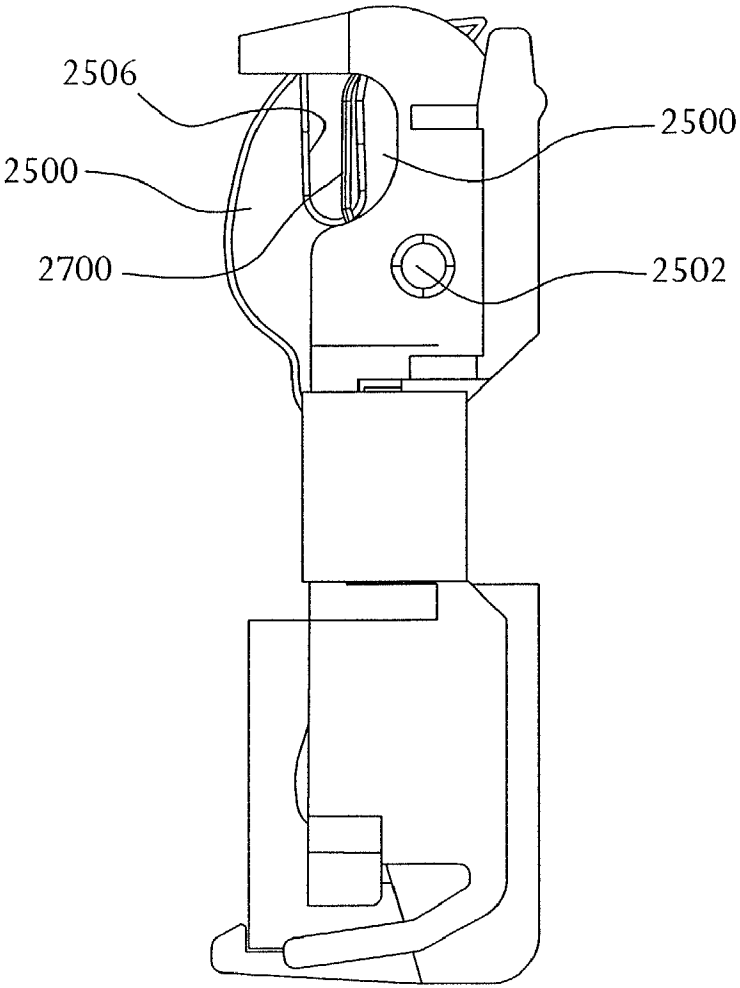
FIG. 90 is an elevational view of the left side of the latch assembly of the present invention, showing the first pawl in the closed configuration.
Figure 91:
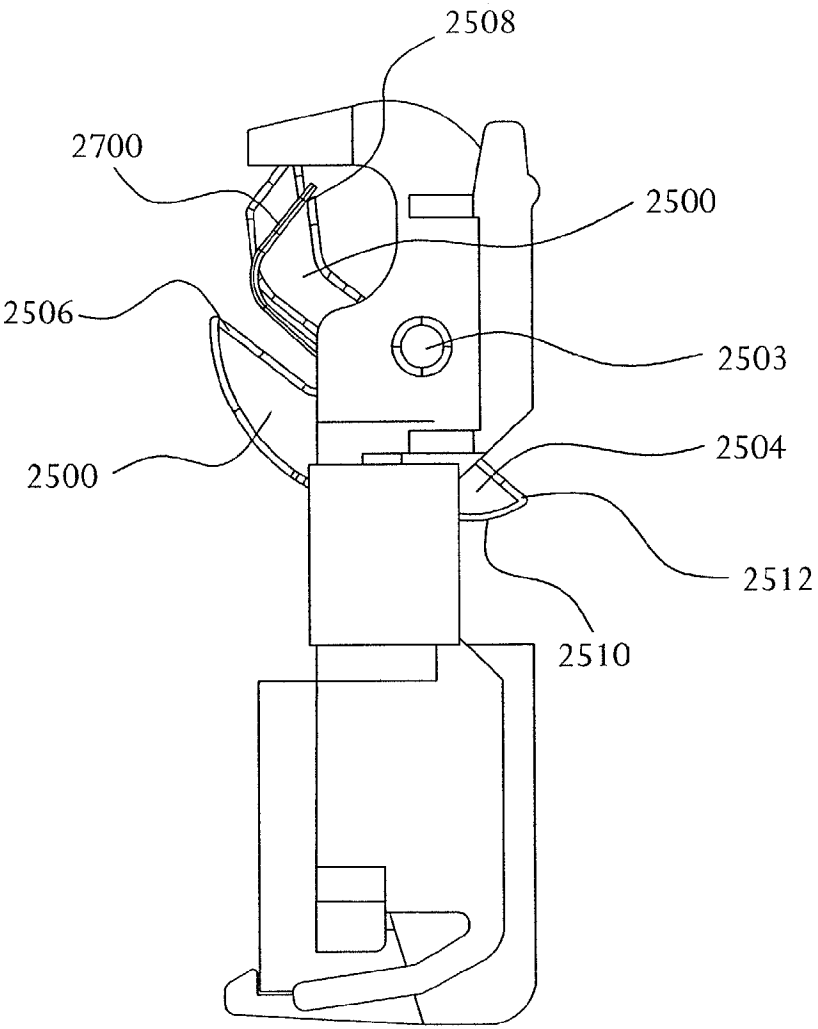
FIG. 91 is an elevational view of the left side of the latch assembly of the present invention, showing the first pawl in the open configuration.
Figure 92:
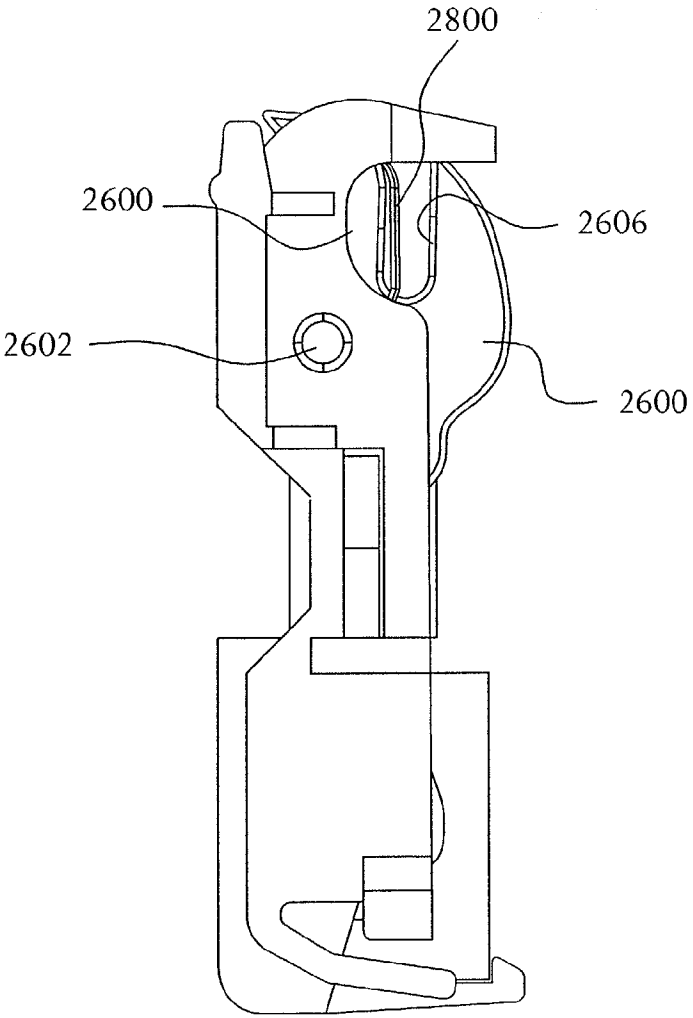
FIG. 92 is an elevational view of the left side of the latch assembly of the present invention, showing the second pawl in the closed configuration.
Figure 93:
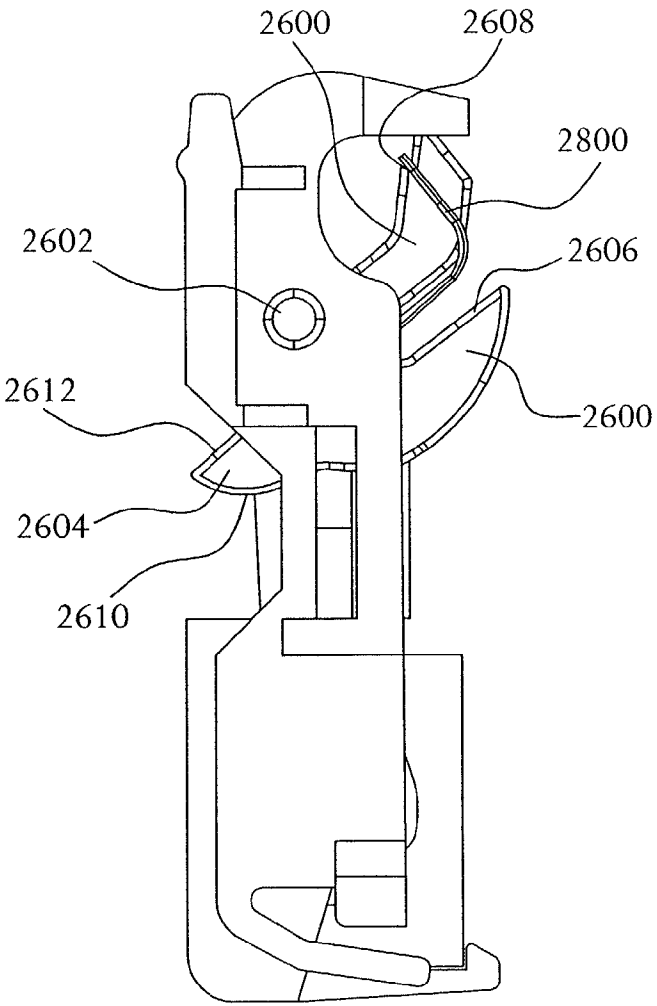
FIG. 93 is an elevational view of the left side of the latch assembly of the present invention, showing the second pawl in the open configuration.
Figure 94:
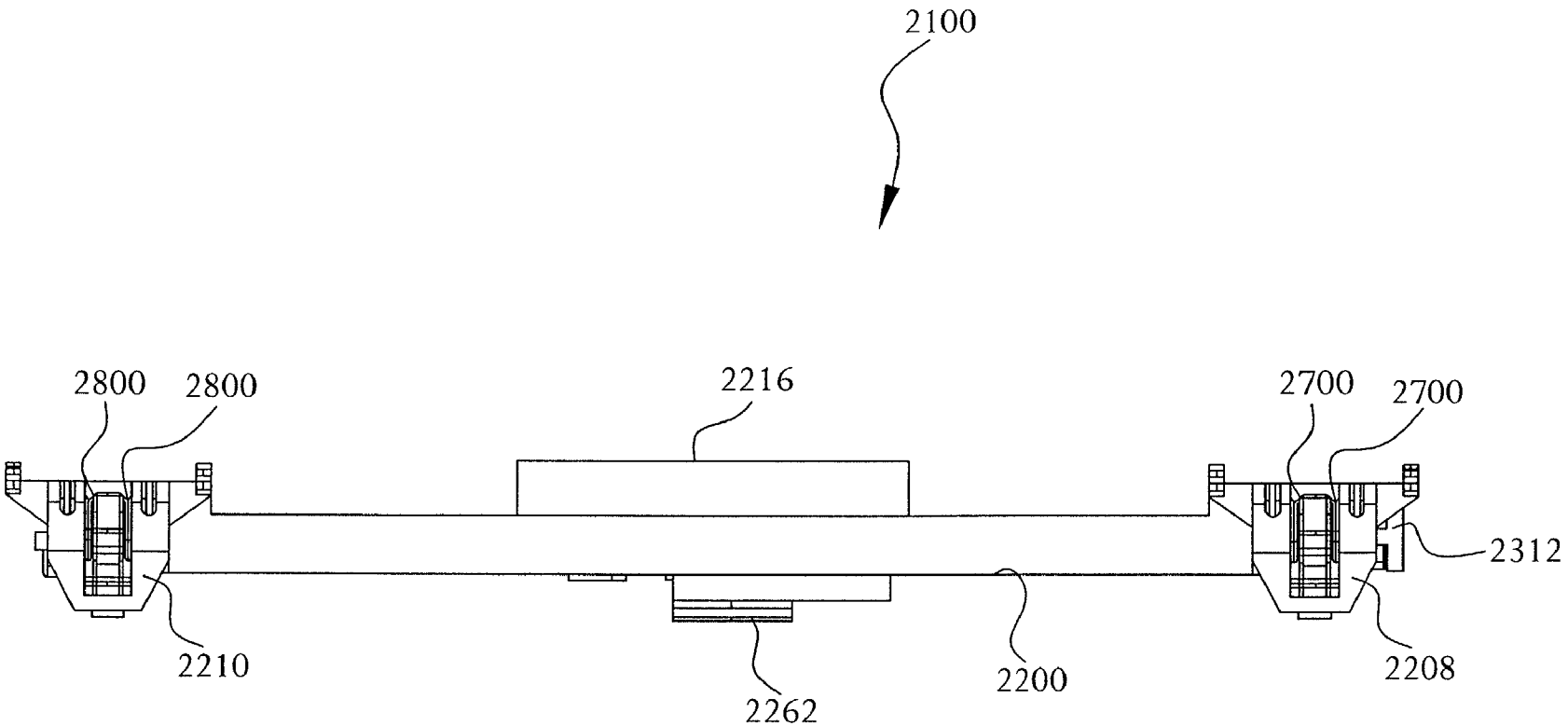
FIG. 94 is a top view of the latch assembly according to the present invention, showing the catch beam in the locked position.
Figure 95:
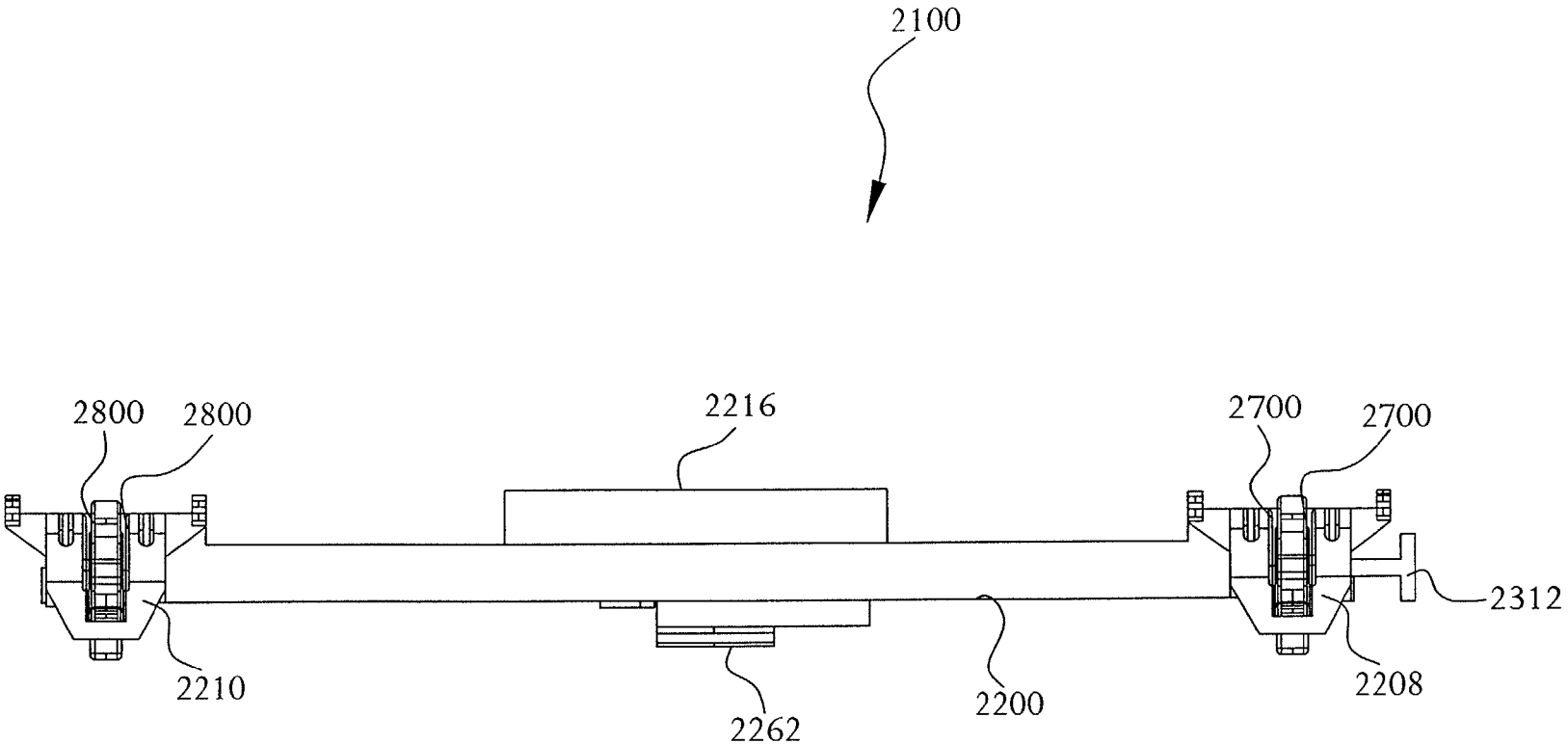
FIG. 95 is a top view of the latch assembly according to the present invention, showing the catch beam in the unlocked position.
Figure 96:
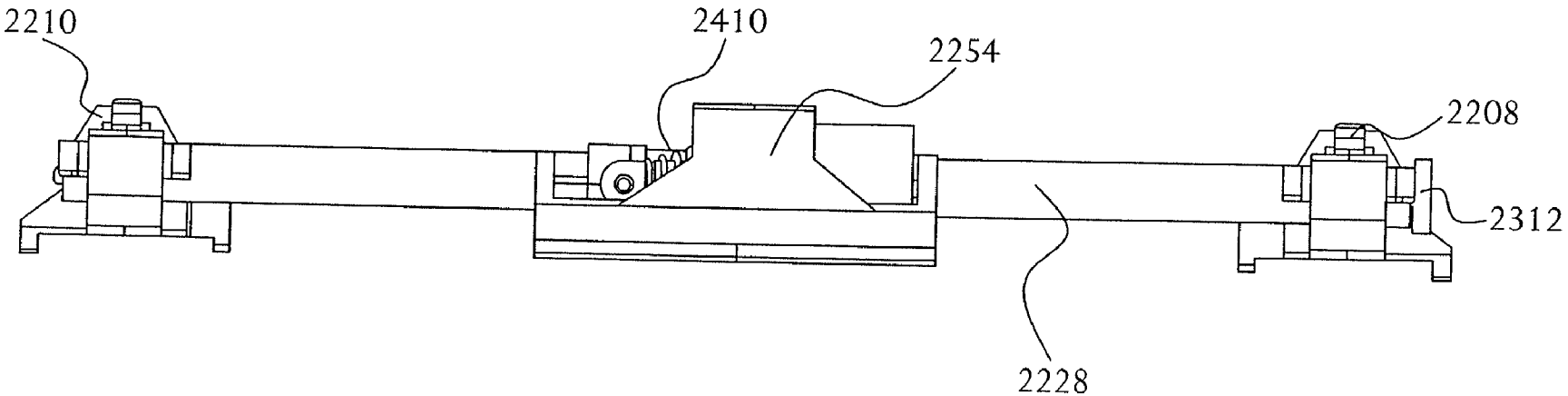
FIG. 96 is a bottom view of the latch assembly according to the present invention, showing the catch beam in the locked position.
Figure 97:
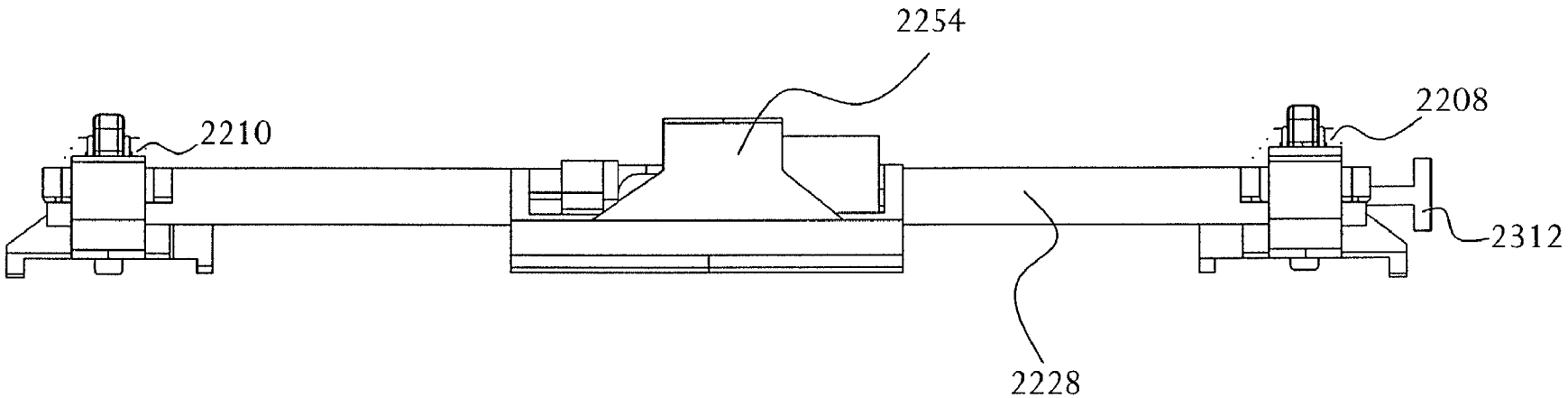
FIG. 97 is a bottom view of the latch assembly according to the present invention, showing the catch beam in the unlocked position.

The catch beam 1150 is moved between the locked and unlocked positions by the selective rotation of the lock plug 1120 by a user with a key. As shown in FIG. 68, the latch 1100 is in the unlocked position with the actuating arm 1178 of the handle 1102 engageable with the pad 1186 of the catch beam 1150 seen positioned below the actuation arm 1178 of the handle 1102 for selective engagement therewith when the handle 1102 is pivoted up and away from the door to which the latch 1100 is mounted. In order to lock the assembly, the lock plug 1120 is rotated to slide the catch beam 1150 to the left (as viewed in FIGS. 68 and 69) to position the cutout or notch 1194 under the actuation arm 1178 thus drawing catch beam 1150 out of the reach of the actuating arm 1178. In the locked position, pulling up on the handle 1102 has no affect on the catch beam 1150, thereby preventing opening of the latch 1100.

The latch assembly 1100 is actuated by lifting the handle 1102 in an upward direction. The actuation arm 1178 of the handle 1102 engages the pad 1186 of the catch beam 1150 to pivotally move the catch beam 1150 downward and move the catch plate 1174 out of engagement with the pawl lug 1164 thereby freeing up the pawl 1154 for pivoting. The bias provided by the pawl torsion spring 1166 rotates the pawl 1154 from its closed position, where the keeper rod is cooperatively captured by the pawl slot 1156 and the hook-shaped structure 1138, to its open position shown in FIGS. 47 and 53, the rotation of the pawl 1154 brings the opening of the pawl slot 1156 out from under the hook-shaped member 1138 and allows the keeper rod to be disengaged from the pawl 1154. The compartment or panel to which the latch assembly 1100 is attached can then be opened.

Suitable mounting means are provided to retain the latch assembly 1100 on a panel or mounting surface. For example, installation of the latch assembly 1100 to a panel may be accomplished with screws or pins which pass through holes 1196 for fastening of the latch assembly to a panel, such as for example, a glove box door 1198 of an automobile.

The latch assembly 1100 also has some additional features which enhance its resistance to tampering. First, the pawl 1154 and the hook-like structure 1138 are off-set to one side of the handle 1102 such that if the handle is broken off by a thief, a screw driver or other tool inserted through the access holes for the handle mounts or the actuating arm cannot reach the pawl 1154. Also, a lug 1200 is provided in the housing that engages a rib 1202 (FIG. 71) provided on the catch beam 1150 when the catch beam is in the locked position. This housing lug 1200 prevents pivotal movement of the catch beam 1150 when the catch beam is in the locked position, and thus disengaging the catch beam from the pawl lug by inserting a tool through the access opening for the actuating arm is prevented or greatly impeded. Lastly, the latch assembly is designed such that the handle can be assembled to the latch housing after the housing has been installed to the door. This feature keeps the number and size of the openings needed in the door for the installation of the latch assembly to a minimum, thereby reducing the opportunity for unauthorized access to the latch assembly.

Another embodiment of the latch in accordance with the present invention is illustrated in FIGS. 84 through 112. The latch 2100 in the present embodiment is similar in both structure and function to many of the features already described in detail with respect to the previous embodiments.

Referring to FIGS. 84–112, the latch 2100 of the present invention includes a latch housing 2200, a catch beam 2300, a solenoid assembly 2400, a pair of pawls 2500, 2600, and a pair of pawl torsional springs 2700, 2800.

As shown in FIGS. 98–101 and 109, an illustrative example of the application of the latch 2100 is for latching the door 2102 of a vehicle's glove compartment (not shown). References to top, bottom, front, rear, left side and right side as used herein are applied by reference to the vehicle (not shown) in which the latch 2100 is installed. For example, the front of the latch housing 2200 faces toward the front of the vehicle when the latch housing 2200 is installed to the door 2102 of the vehicle's glove compartment and the door 2102 of the glove compartment is closed. The rear of the latch housing 2200 faces toward the rear of the vehicle when the latch housing 2200 is installed to the door 2102 of the vehicle's glove compartment and the door 2102 of the glove compartment is closed. The bottom of the latch housing 2200 faces toward the floor of the vehicle's passenger compartment when the latch housing 2200 is installed to the door 2102 of the vehicle's glove compartment and the door 2102 of the glove compartment is closed. The top of the latch housing 2200 faces toward the roof of the vehicle's passenger compartment when the latch housing 2200 is installed to the door 2102 of the vehicle's glove compartment and the door 2102 of the glove compartment is closed and so forth.

As best shown in FIGS. 84–89 and 102–103, the latch housing 2200 has a first end 2202, a second end 2204, a housing body 2206, a pair of hook-shaped structures 2208, 2210, a pair of attachment legs 2212, 2214, and a solenoid housing 2216. The housing body 2206 extends longitudinally between the first and second ends 2202, 2204. The housing body 2206 has an opening 2218, 2220 at each of the corresponding first and second ends 2202, 2204, and a channel 2222 there between for receiving the catch beam 300. The housing body 2206 also has a front side wall 2224, a rear side wall 2226, and a bottom wall 2228 for retaining the catch beam 2300 within the housing body 206. The front side wall 2224 and bottom wall 2228 of the housing body 2206 define a cutout 2230 at about the midpoint of the housing body 2206 that accommodates the solenoid lever (described below) of the solenoid assembly 2400.

Figure 102:
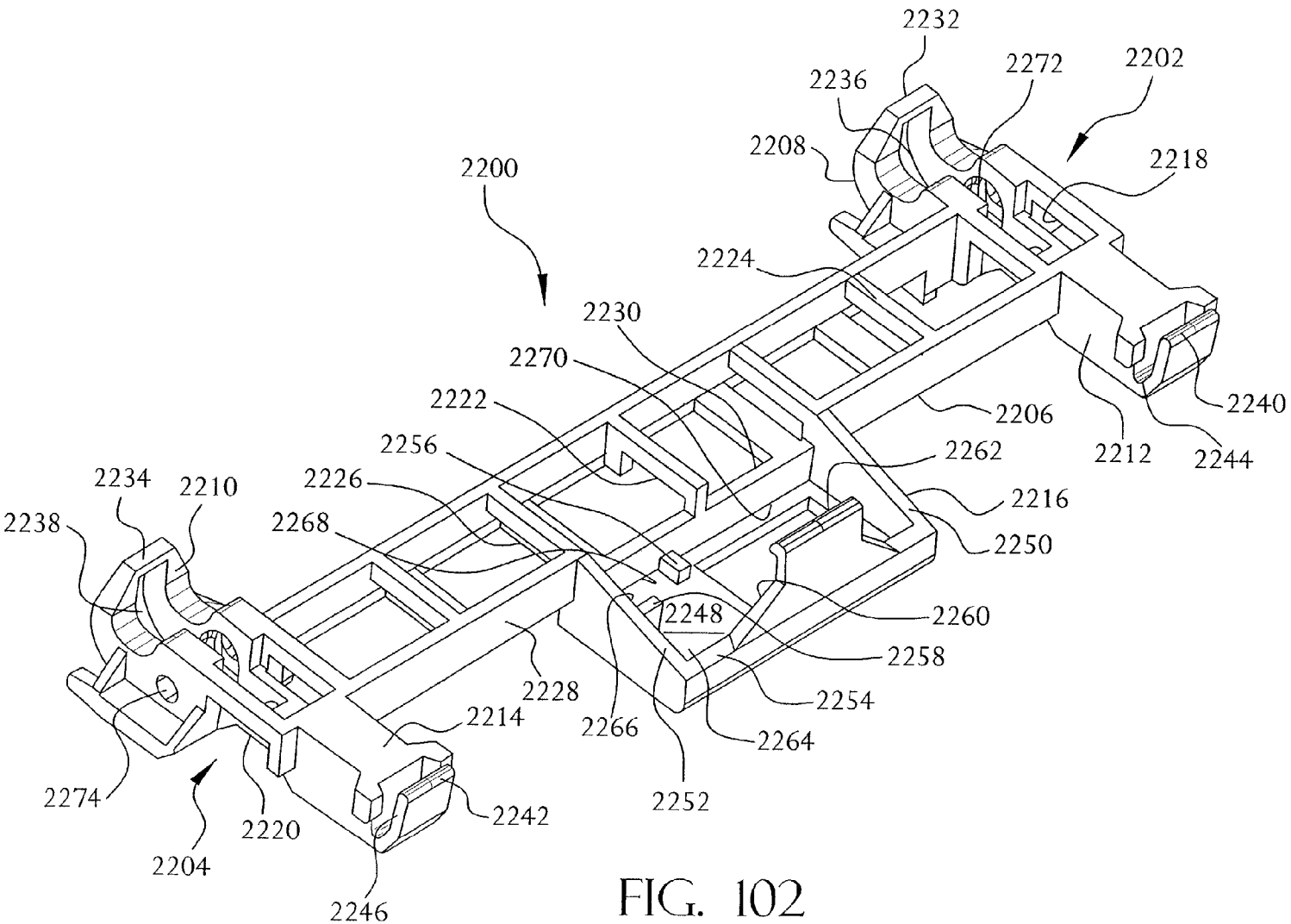
FIG. 102 is a front perspective view of the housing of the latch assembly according to the present invention.
Figure 103:
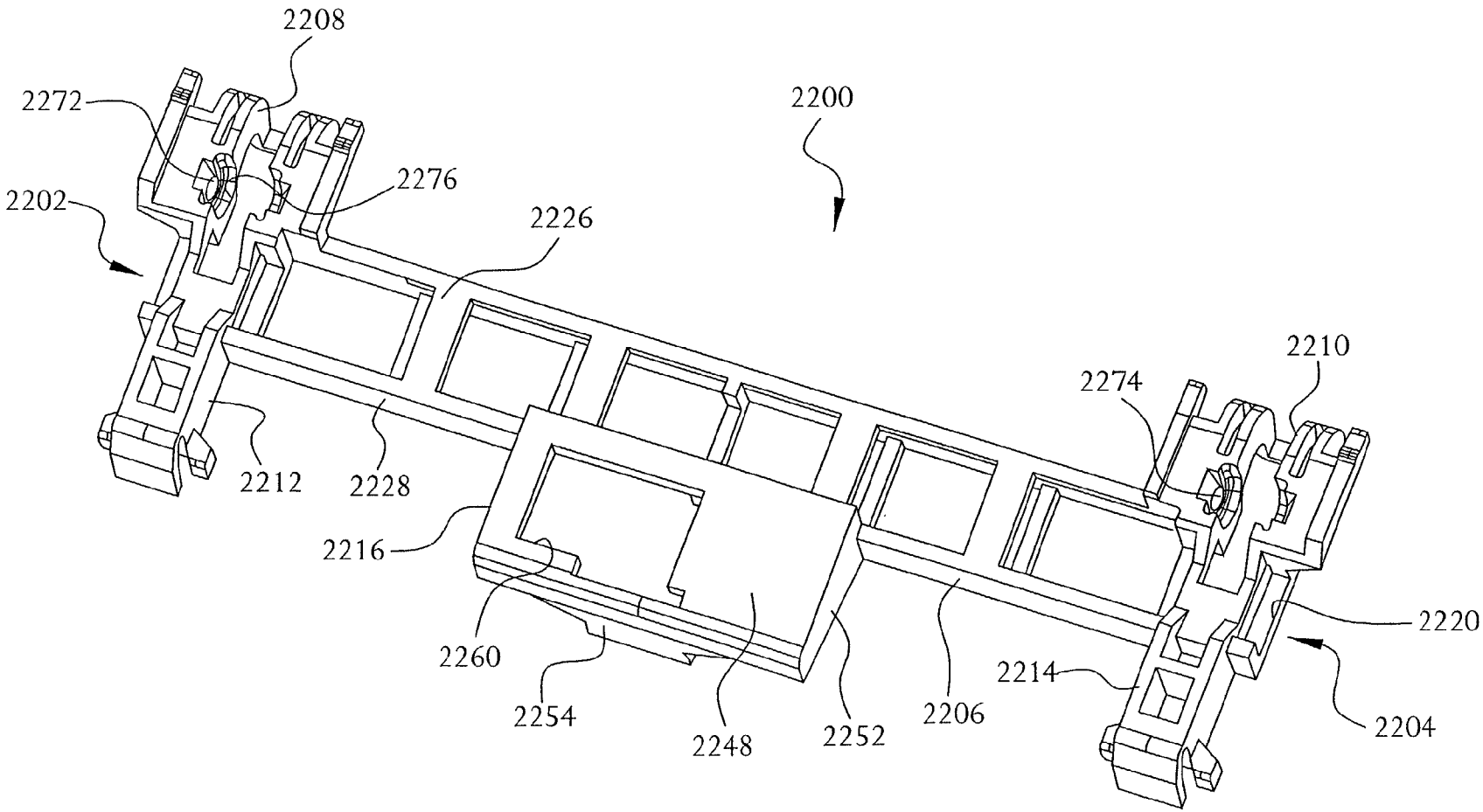
FIG. 103 is a rear perspective view of the housing of the latch assembly according to the present invention.

Each hook-shaped structure 2208, 2210 projects from the top of the latch housing 2200 proximate one of the corresponding ends 2202, 2204. Hook-shaped as used herein refers to any member that has a crook, curve, or bend to thereby catch on another member. Each hook-shaped structure 2208, 2210 extends upwardly and then forwardly from the top of the latch housing 2200 such that the tip 2232, 2234 of that hook-shaped structure 2208, 2210 points toward the front of the vehicle when the latch housing 2200 is installed to the door 2102 of the vehicle's glove compartment and the door 2102 of the glove compartment is closed. A first slot 2236, 2238 is provided within each corresponding hook-shaped structure 2208, 2210 and extends through a portion of the housing body 2206 (as shown in FIG. 102).

The attachment legs 2212, 2214 are for mounting the latch 2100 to the door 2102 of the vehicle's glove compartment. Each attachment leg 2212, 2214 projects from the bottom of the latch housing 2200 proximate one of the corresponding ends 2202, 2204. Each attachment leg 2212, 2214 extends downwardly and then forwardly from the bottom of the latch housing 2200 such that the flexible tip 2240, 2242 of that attachment leg 2212, 2214 points toward the front of the vehicle when the latch housing 2200 is installed to the door 2102 of the vehicle's glove compartment and the door 2102 of the glove compartment is closed. A receiving slot 2244, 2246 is provided proximate the tip 2240, 2242 of each corresponding attachment leg 2212, 2214 to permit the latch 2100 to be mounted to the door 2102 of the vehicle's glove compartment.

The solenoid housing 2216 has a generally rectangular frame for receiving the solenoid assembly 2400. The solenoid housing 2216 has a rear wall 2248, a first side wall 2250, a second side wall 2252, a bottom wall 2254, a first stop projection 2256, and a second stop projection 2258. The rearwall 2248 has a cutout 2260 to permit the solenoid (described below) of the solenoid assembly 2400 to be readily activated by a push or touch button (not shown) so that the door 2102 of the vehicle's glove compartment can be placed from the closed or locked position to the open or unlocked position. The opposing first and second side walls 2250, 22252 extend downwardly from the bottom wall 2228 of the housing body 2206. The bottom wall 2254 extends forwardly from the bottom of the rear wall 2248 toward the front of the vehicle, and has a flexible tip 2262 that points toward the rear of the vehicle when the latch housing 2200 is installed to the door 2102 of the vehicle's glove compartment and the door 2102 of the glove compartment is closed. The first stop projection 22256 is positioned at the top of the inner surface 2264 of the rear wall 2248 at a predetermined distance from the second side wall 2252. The second stop projection 2258 is positioned at about the midpoint of the inner surface 2266 of the second side wall 2252. The rear wall 2248, first stop projection 2256, and second stop projection 2258 define a cutout 2268 for receiving the solenoid lever (described below) of the solenoid assembly 2400. The first and second stop projections 2256, 2258 help to retain the solenoid lever within the cutout 2268 when the solenoid lever is caused to have translational linear motion. The rear wall 2248, first side wall 2250, bottom wall 2254, and first stop projection 2256 define a cutout 2270 for receiving the solenoid (described below) of the solenoid assembly 2400. The first stop projection 2256 and flexible tip 2262 help to retain the solenoid within the cutout 2270 when the solenoid assembly 2400 is assembled in the solenoid housing 2216.

Figure 104:
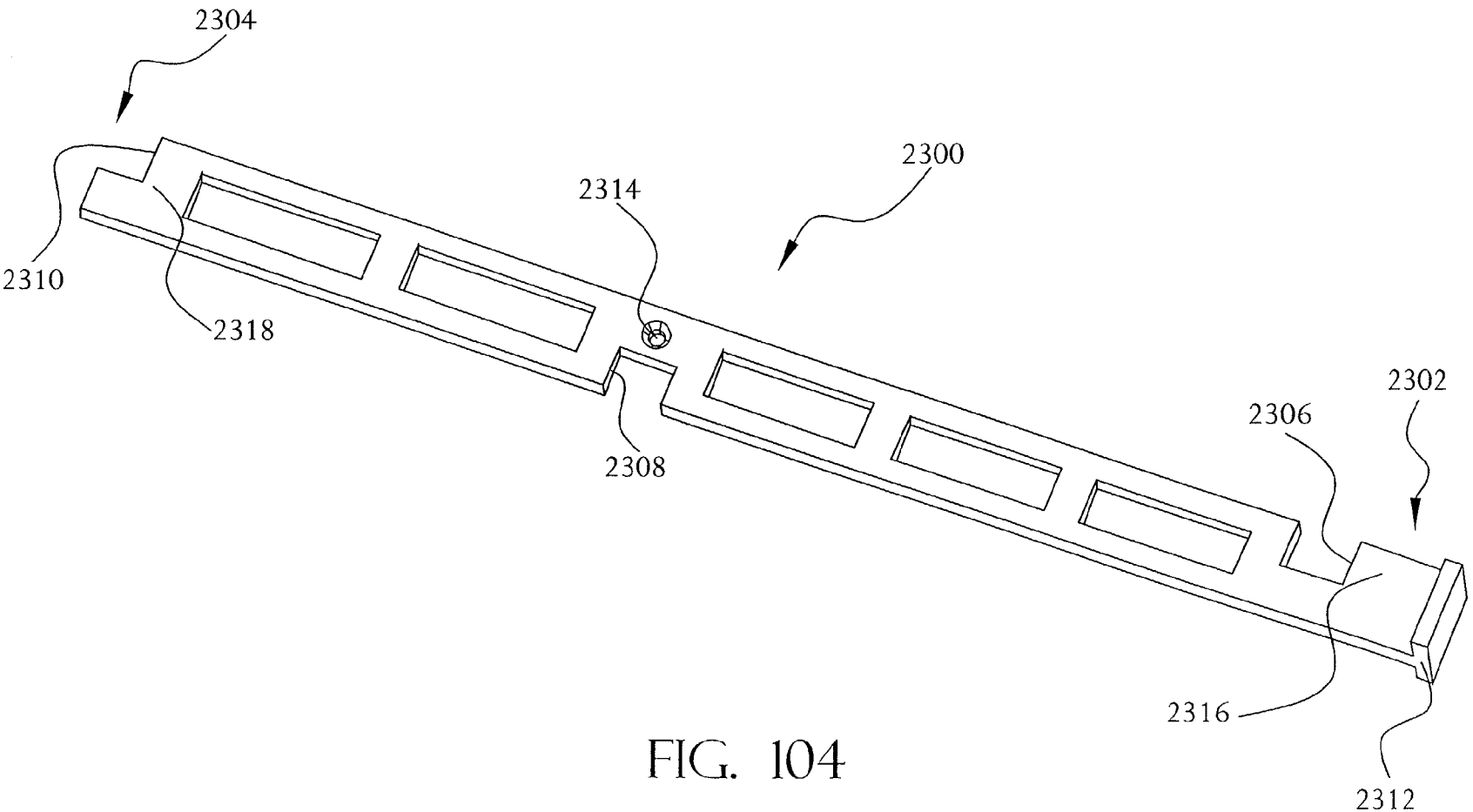
FIG. 104 is a front perspective view of the catch beam of the latch assembly according to the present invention.
Figure 105:
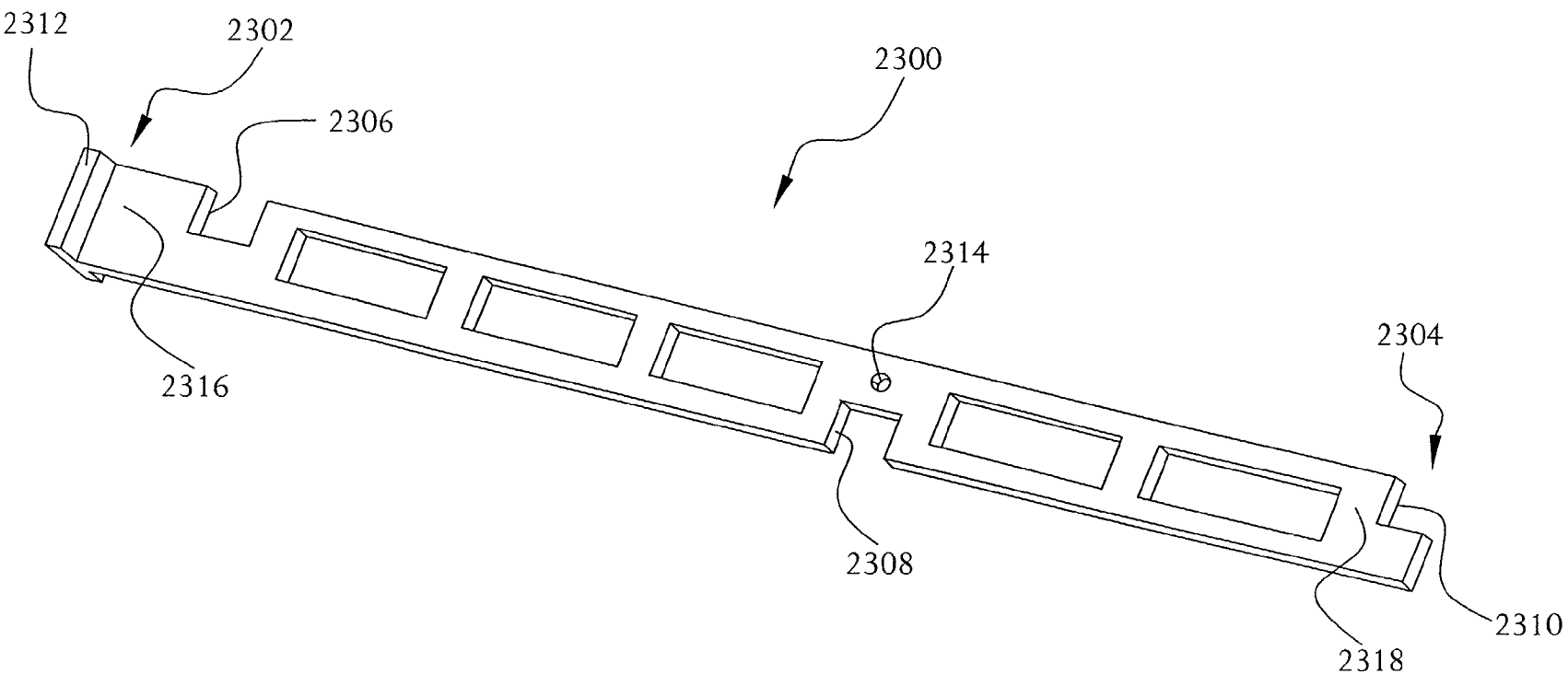
FIG. 105 is a rear perspective view of the catch beam of the latch assembly according to the present invention.

As best shown in FIGS. 104–105, the catch beam 2300 is elongated, and has a first end 2302, a second end 2304, a first cutout 2306, a second cutout 2308, a third cutout 2310, a first end stop projection 2312, and an attachment opening 2314. The first cutout 2306 is located at the top proximate the first end 2302, and the third cutout 2310 is located at the top at the second end 2304. The first and third cutouts 2306, 2310 permit the pawls 2500, 2600 to be biased by the pawl torsional springs 2700, 2800 in the unlatched position. The second cutout 2308 is located at the bottom about the midpoint of the catch beam 2300. The second cutout 2308 and attachment opening 2314 engage with the solenoid lever (described below) of the solenoid assembly 2400. Through the interaction of the second cutout 2308, the attachment opening 2314, and the solenoid lever, activation of the solenoid (described below) causes the linear translational motion of the catch beam 2300 such that the second end 2304 of the catch beam 2300 moves toward the first end 2202 of the latch housing 2200. The first end stop projection 2312 is located at the first end 2302, and projects perpendicularly from both sides of the first end 2302 of the catch beam 2300. The first end stop projection 2312 helps to prevent the catch beam 2300 from moving past its locked position by making contact with the first end 2202 of the latch housing 2200 when the catch beam 2300 is caused to return to its locked position from its unlocked position.

Figure 106:
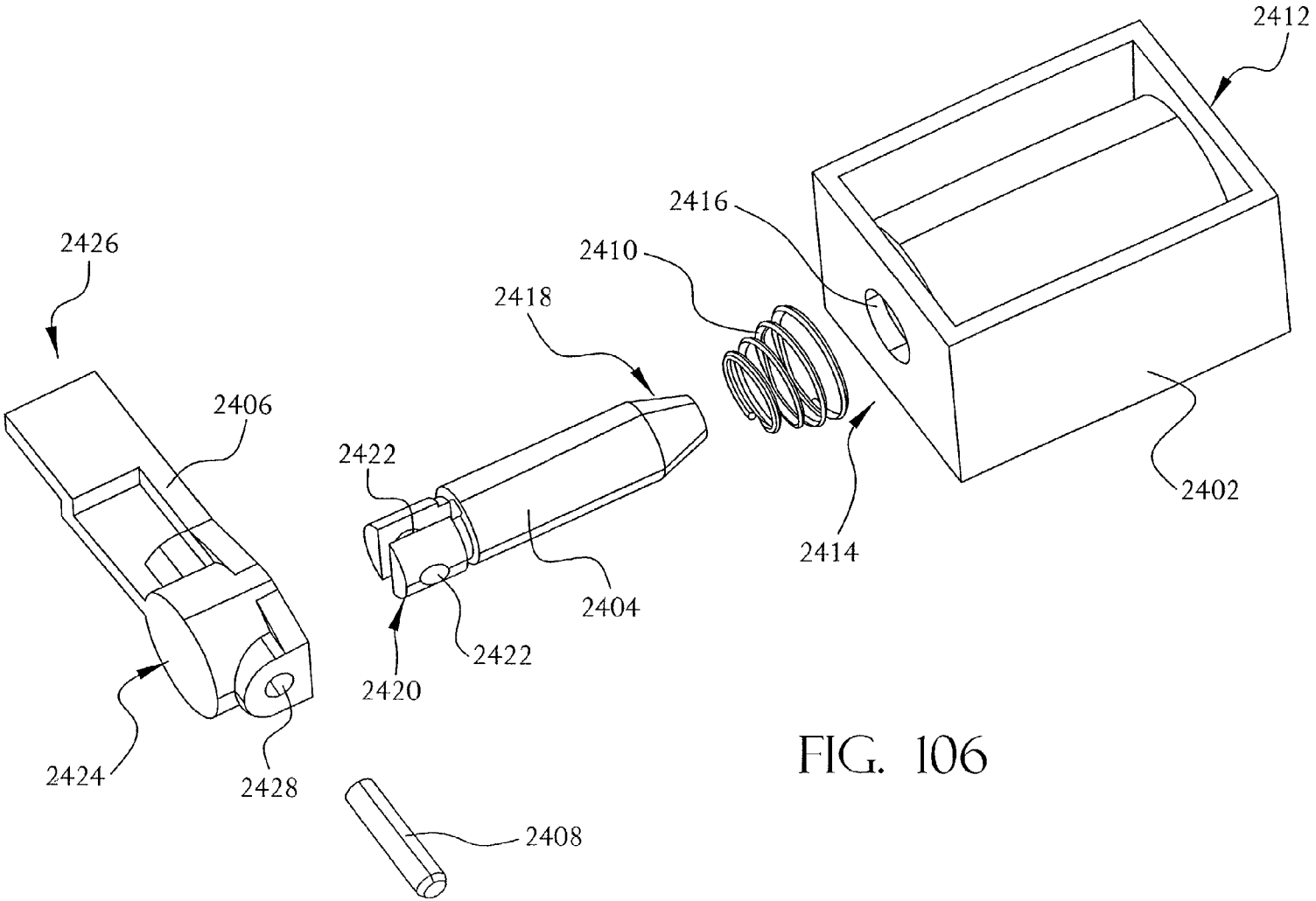
FIG. 106 is a perspective view of the solenoid assembly of the latch assembly according to the present invention.
Figure 107:
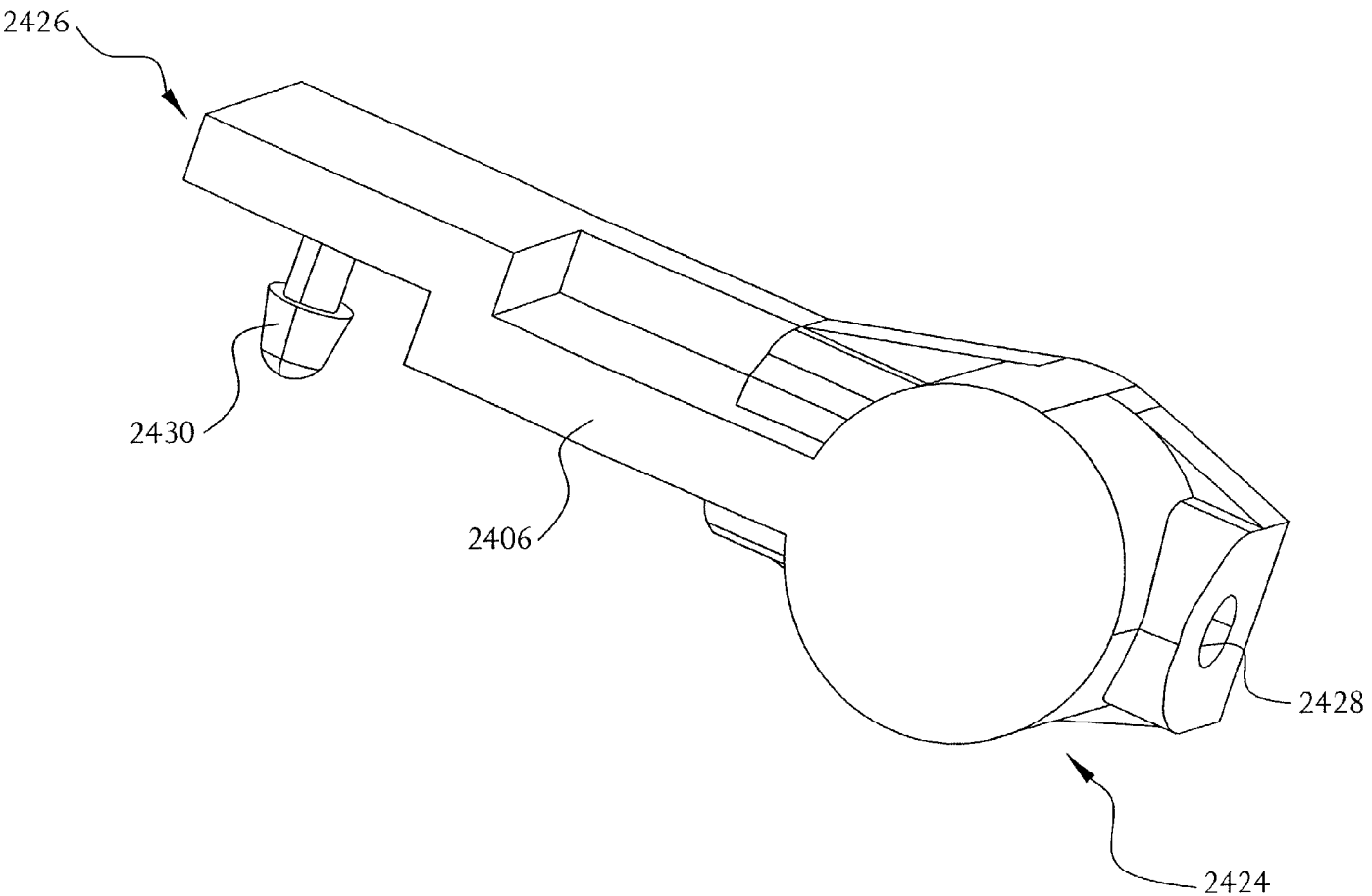
FIG. 107 is a front perspective view of the solenoid lever of the latch assembly according to the present invention.
Figure 108:
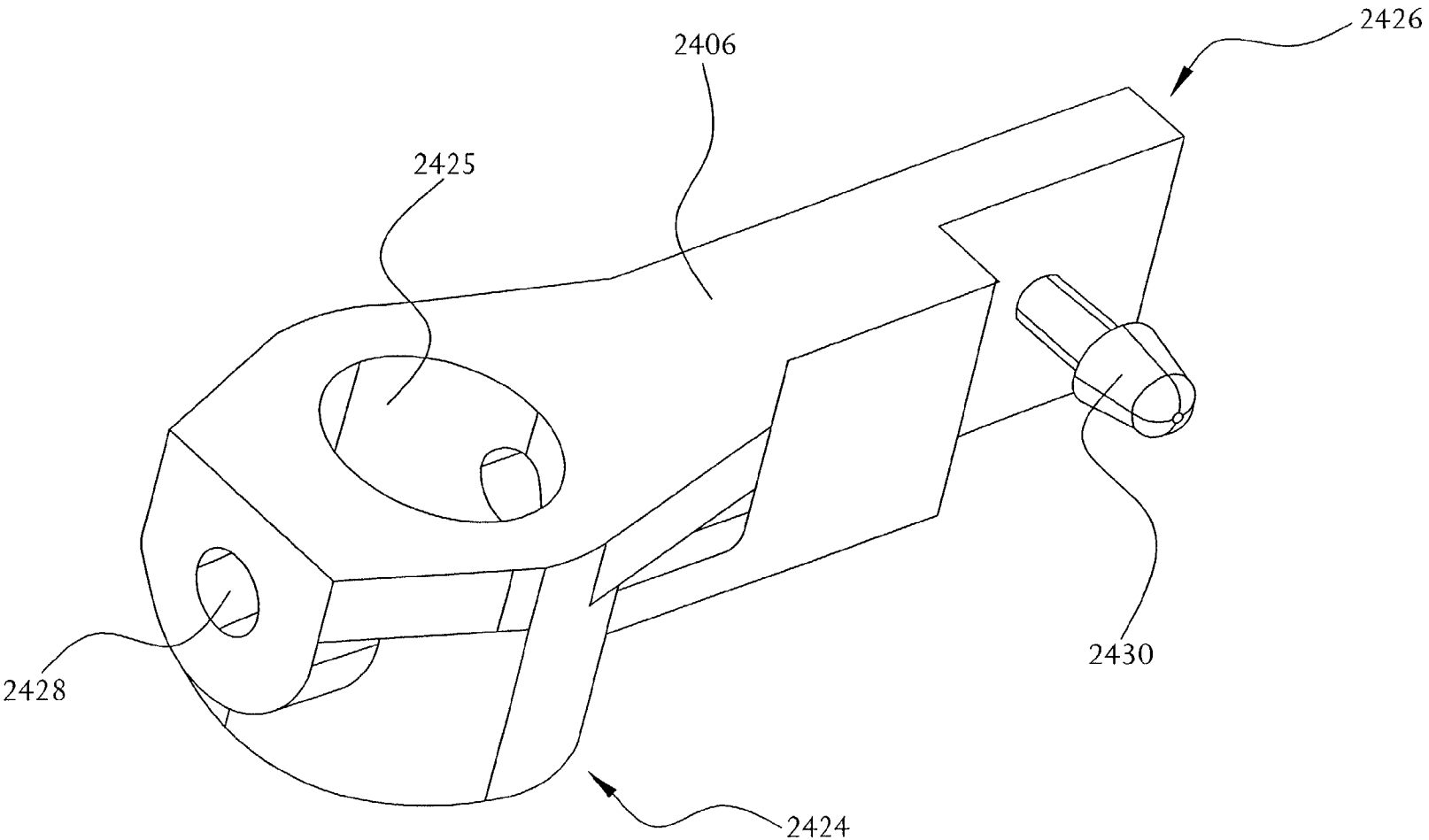
FIG. 108 is a rear perspective view of the solenoid lever of the latch assembly according to the present invention.
Figure 109:
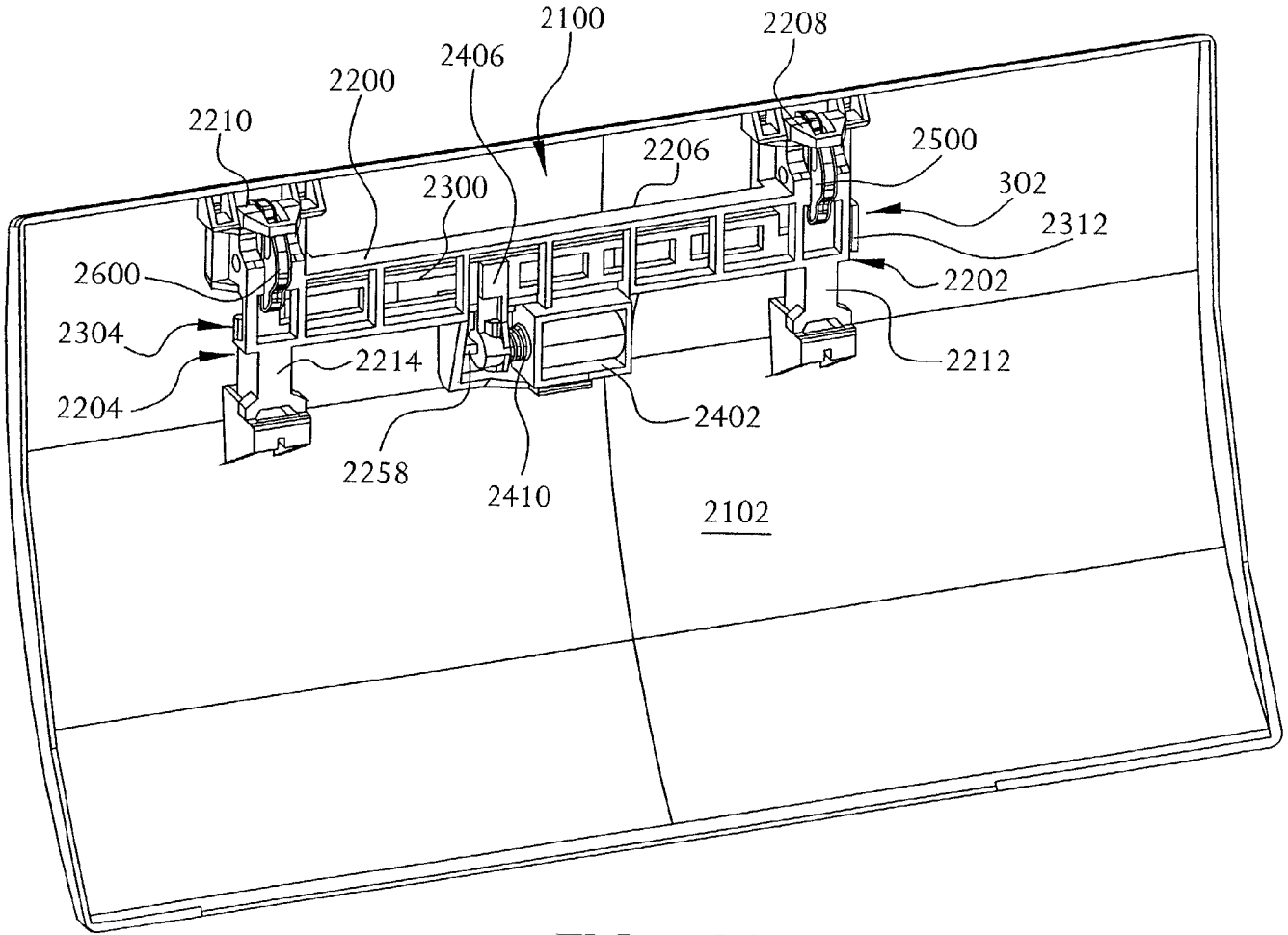
FIG. 109 is a close-up view of the back side of a portion of the outer shell of the glove compartment door shown with the latch assembly of the present invention installed thereto.

As best shown in FIGS. 106–108, the solenoid assembly 2400 includes a solenoid 2402, a solenoid plunger or shaft 2404, a solenoid lever 2406, a pin 2408, and a solenoid spring 2410. The solenoid 2402 has a first end 2412, a second end 2414, and an opening 2416 at the second end 2414 for receiving the solenoid shaft 2404. The solenoid shaft 2404 has an inwardly sloping first end 2418, a second end 2420, and openings 2422 about the second end 2420 for receiving the pin 2408. It is preferred that the solenoid shaft 2404 is made of metal. The solenoid lever 2406 has a bulbous first end 2424 having an opening 2425, a second end 2426, an opening 2428 at the bulbous first end 2424 for receiving the pin 2408, and a catch beam engaging structure 2430 projecting from the second end 2426 such that the catch beam engaging structure 2430 points toward the rear of the vehicle when the latch housing 2200, with the assembled solenoid assembly 2400, is installed to the door 2102 of the vehicle's glove compartment and the door 2102 of the glove compartment is closed. The bulbous first end 2424 of the solenoid lever 2406 is adapted for receiving the second end 2420 of the solenoid shaft 2404. The catch beam engaging structure 2430 is adapted for engaging with the attachment opening 2314 of the catch beam 2300. It is preferred that the solenoid lever 2406 is made of a plastic material. The solenoid assembly 2400 can be assembled by first securing the solenoid spring 2410 onto the solenoid shaft 2404, and then sliding the bulbous first end 2424 of the solenoid lever 2406 over the second end 2420 of the solenoid shaft 2404. The solenoid lever 2406 can then be secured over the second end 2420 of the solenoid shaft 2404 with the pin 2408. Lastly, the solenoid shaft 2404 that is secured to the solenoid lever 2406 can be slid a predetermined distance into the opening 2416 of the solenoid 2402.

As best shown in FIGS. 90–93, each of the pair of pawls 2500, 2600 is shown pivotally connected to the latch housing 2200 with suitable attachment means such as the pawl pivot members 2502, 2602 which are provided extending outwardly from the corresponding pawl 2500, 2600 at opposite sides thereof. Each pawl 2500, 2600 is installed onto the latch housing 2200 by snap-fit placement of the corresponding pawl pivot members 2502, 2602 into the corresponding pawl pivot recesses 2272, 2274 disposed in the latch housing 2200. A pair of guide slots 2276, 2278 is provided on the latch housing 2200 leading from the edge of the latch housing 2200 to the corresponding pawl pivot recesses 2272, 2274 for guiding the corresponding pawl pivot members 2502, 2602, in the direction of the corresponding pawl pivot recesses 2272, 2274.

Each pawl 2500, 2600 has a locking lug 2504, 2604, and is provided with a pawl slot 2506, 2606 to retain a keeper rod (not shown). Preferably the keeper rod is attached to a stationary panel, doorframe or compartment (not shown) at a position such that as the swinging panel or door 2102, to which the latch assembly 2100 is attached, is rotated to the closed position, the keeper rod will pass below the forward pointing portion of each of the hook-shaped structures 2208, 2210 and come into engagement with each of the pawls 2500, 2600.

As best shown in FIGS. 86–93, a pawl torsional spring 2700, 2800 is installed on a corresponding pawl 2500, 2600 with the coiled portions surrounding the corresponding pawl pivot members 2502, 2602. A loop of each pawl torsional spring 2700, 2800 engages the notch 2508, 2608 near the top of the corresponding pawl 2500, 2600. Each pawl torsional spring 2700, 2800 biases the corresponding pawl 2500, 2600 toward the open position shown in FIGS. 91 and 93. Each pawl lug 2504, 2604 has a sloping surface 2510, 2610 and a flat radially extending side 2512, 2612. Once each pawl 2500, 2600 is in the closed position, the corresponding catch portion 2316, 2318 of the catch beam 2300 snaps up behind the corresponding lug 2504, 2604, under the bias of the solenoid spring 2410, and catches the flat side of the corresponding lug 2504, 2604 to retain the corresponding pawl 2500, 2600 in the closed configuration. Each catch portion 2316, 2318 is dimensioned such that the catch portion 2316, 2318 can maintain engagement with the corresponding lug 2504, 2604 over a substantial range of the linear translational movement of the catch beam 2300 until the corresponding pawl 2500, 2600 rotates from the closed position to the open position of FIGS. 84–85.

Figure 110:
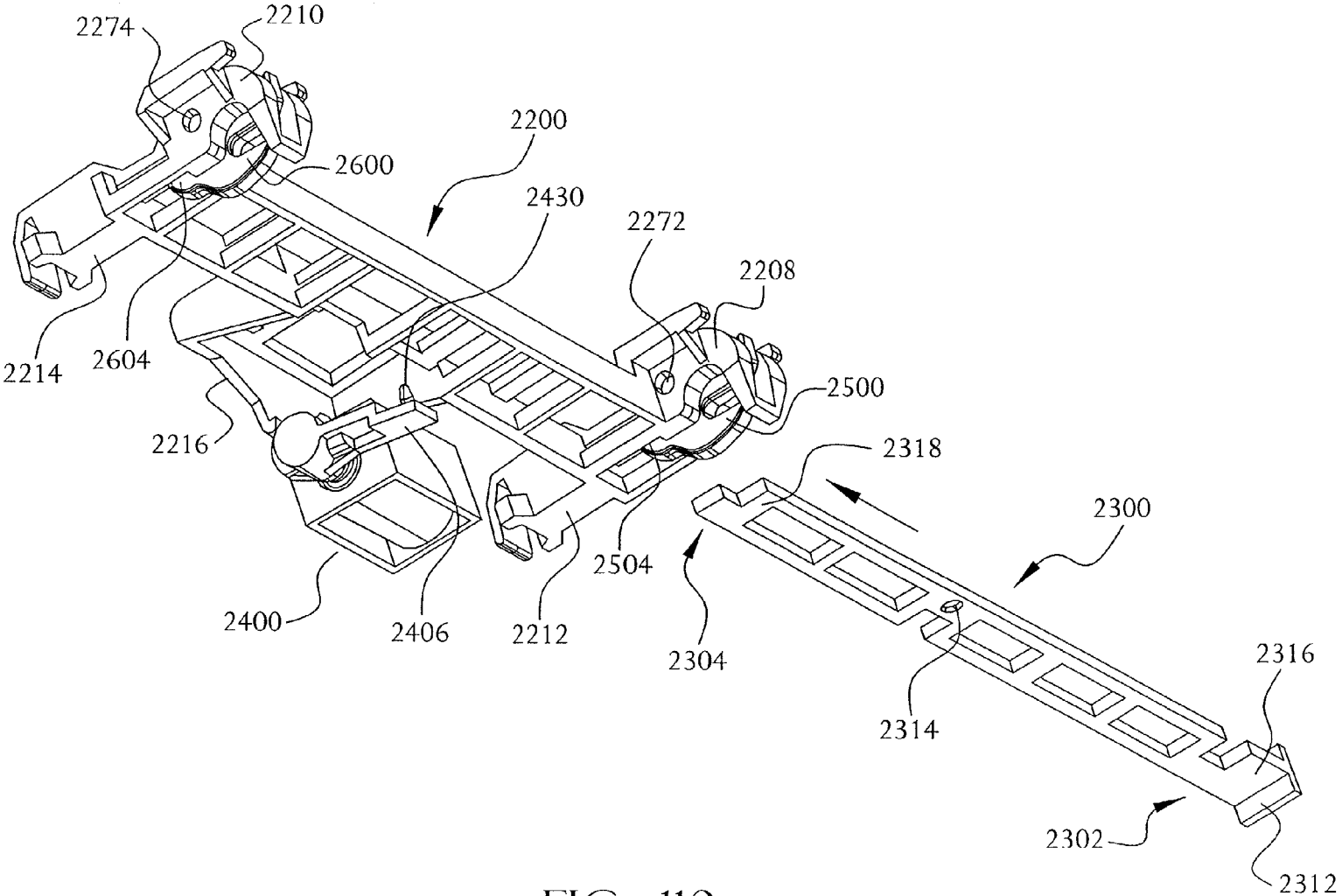
FIG. 110 is a front perspective view of the latch assembly according to the present invention, showing the assembly of the catch beam with the latch housing.
Figure 111:
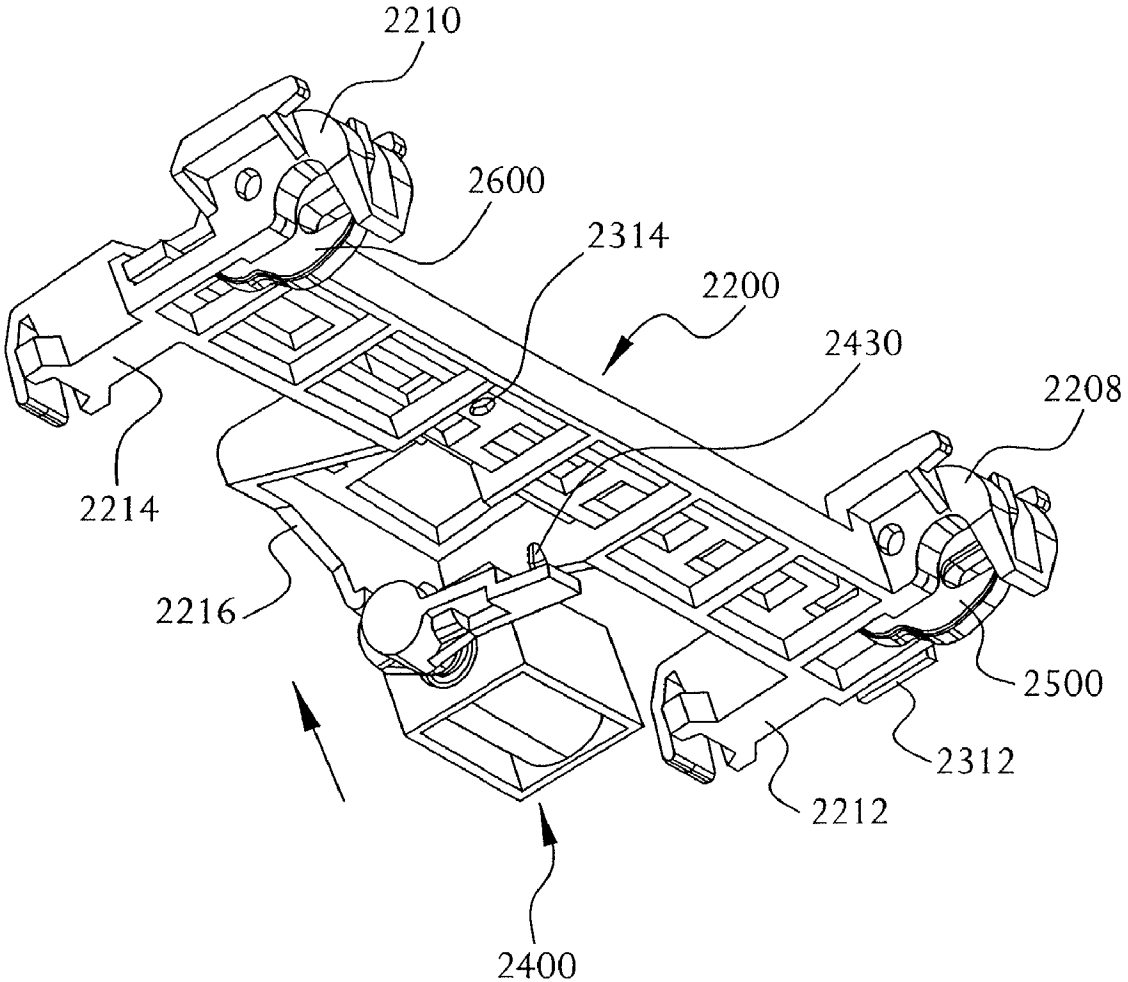
FIG. 111 is a front perspective view of the latch assembly according to the present invention, showing the assembly of the solenoid assembly with the latch housing.
Figure 112:
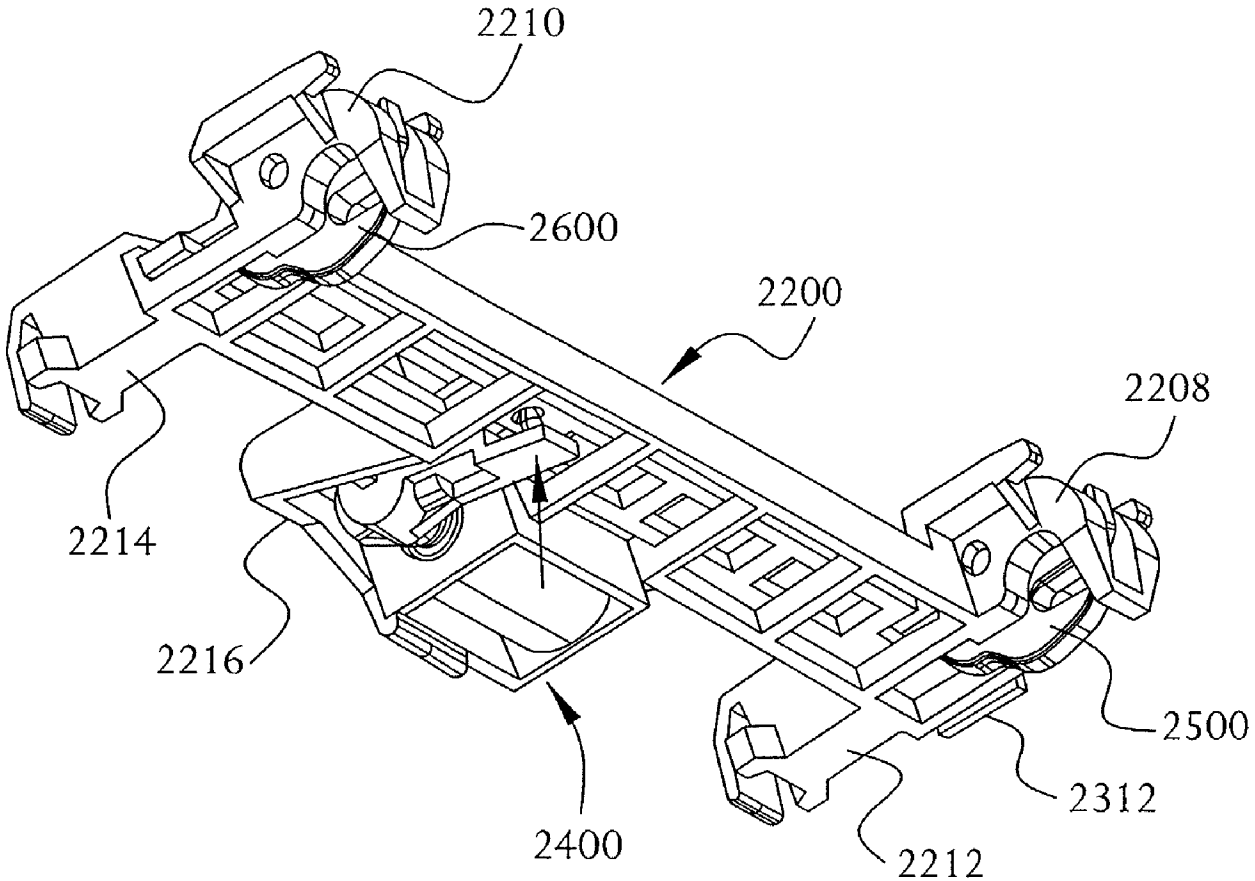
FIG. 112 is a front perspective view of the latch assembly according to the present invention, showing the assembly of the solenoid lever with the latch housing.
Figure 113:
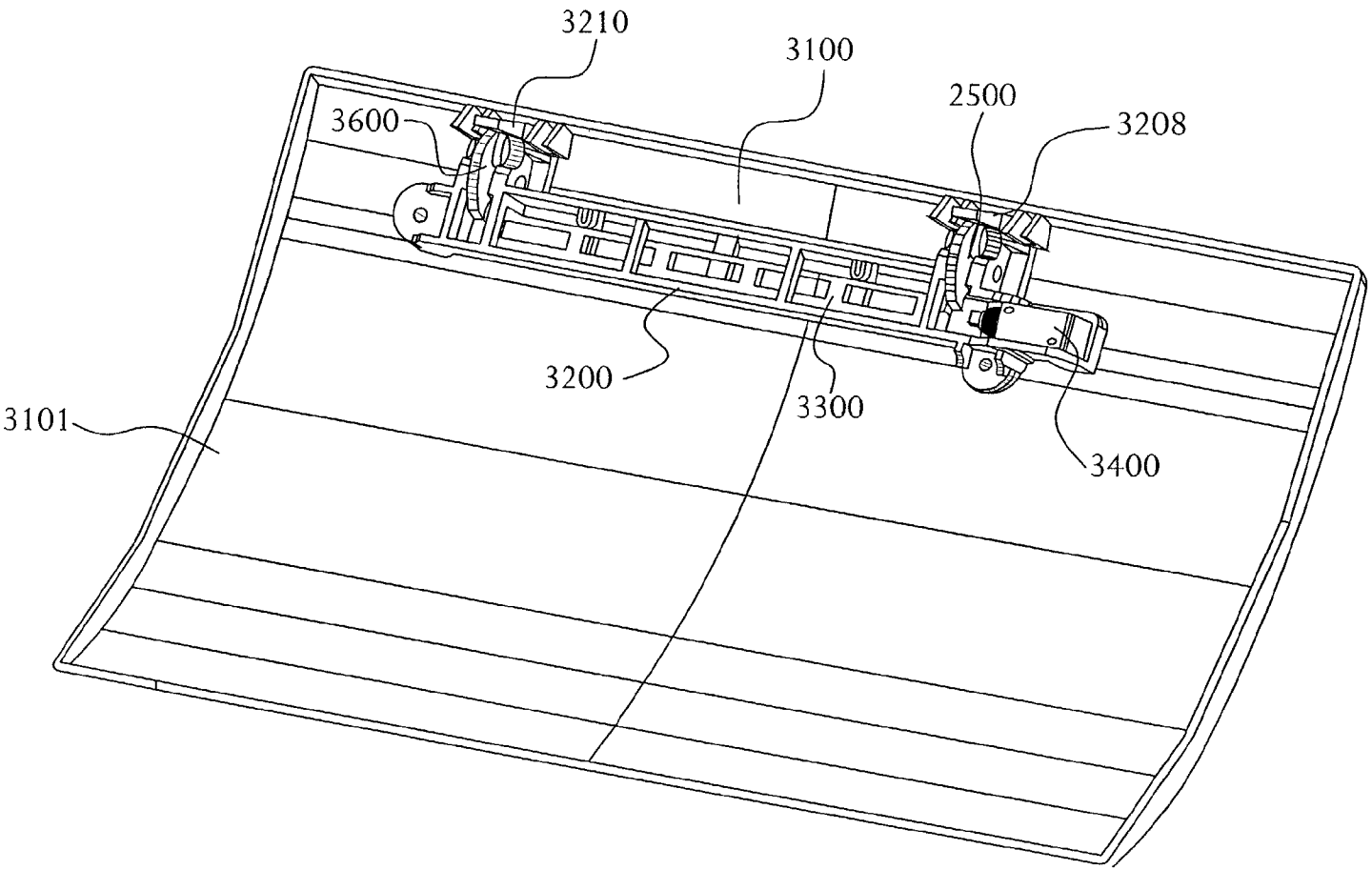
FIG. 113 is a front perspective view of the outer shell of a glove compartment lid or door showing the latch assembly according to the present invention installed to the outer shell of the door with the latch pawls shown in the closed position.
Figure 114:
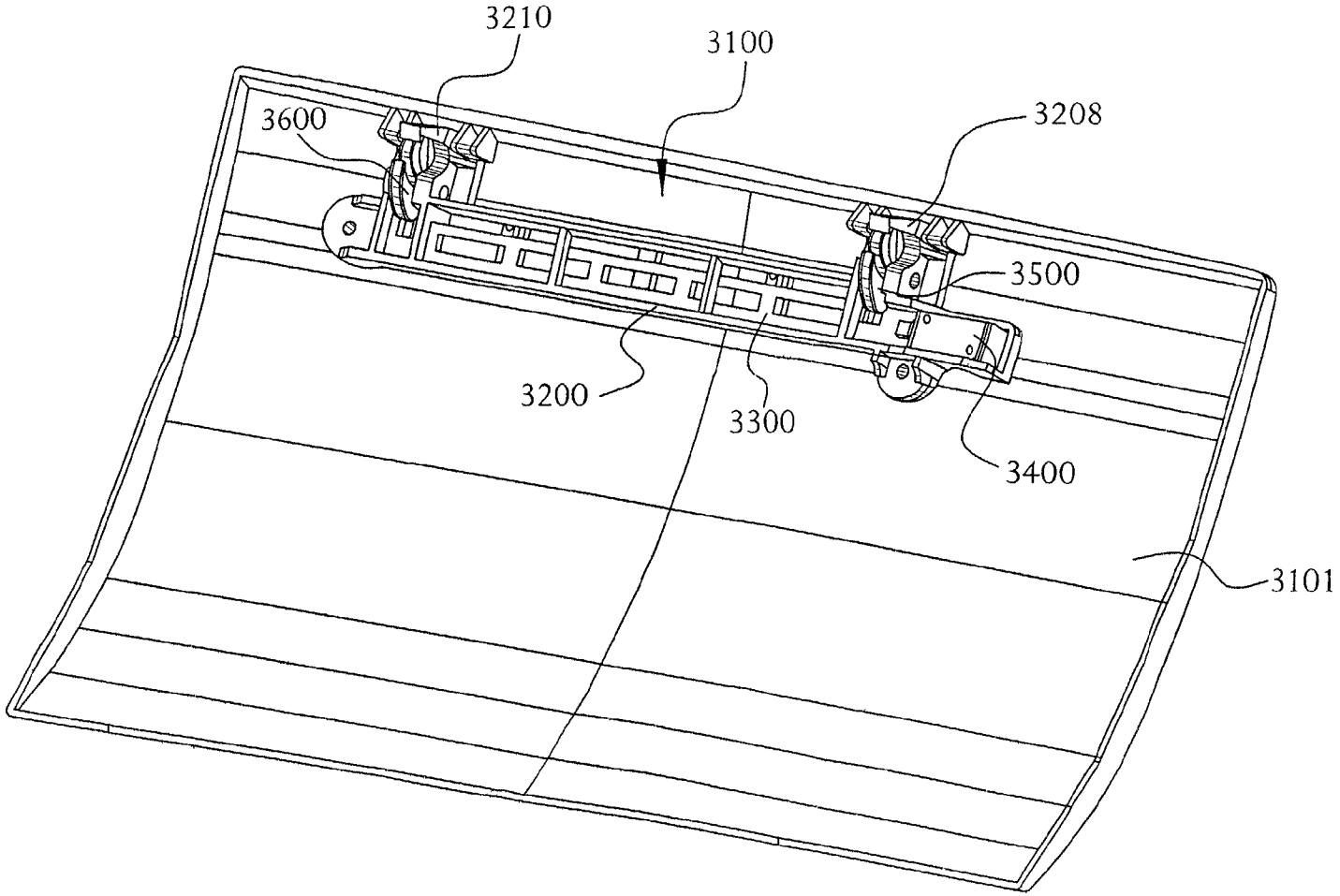
FIG. 114 is a front perspective view of the outer shell of a glove compartment lid or door showing the latch assembly according to the present invention installed to the outer shell of the door with the latch pawls shown in the open position.
Figure 115:
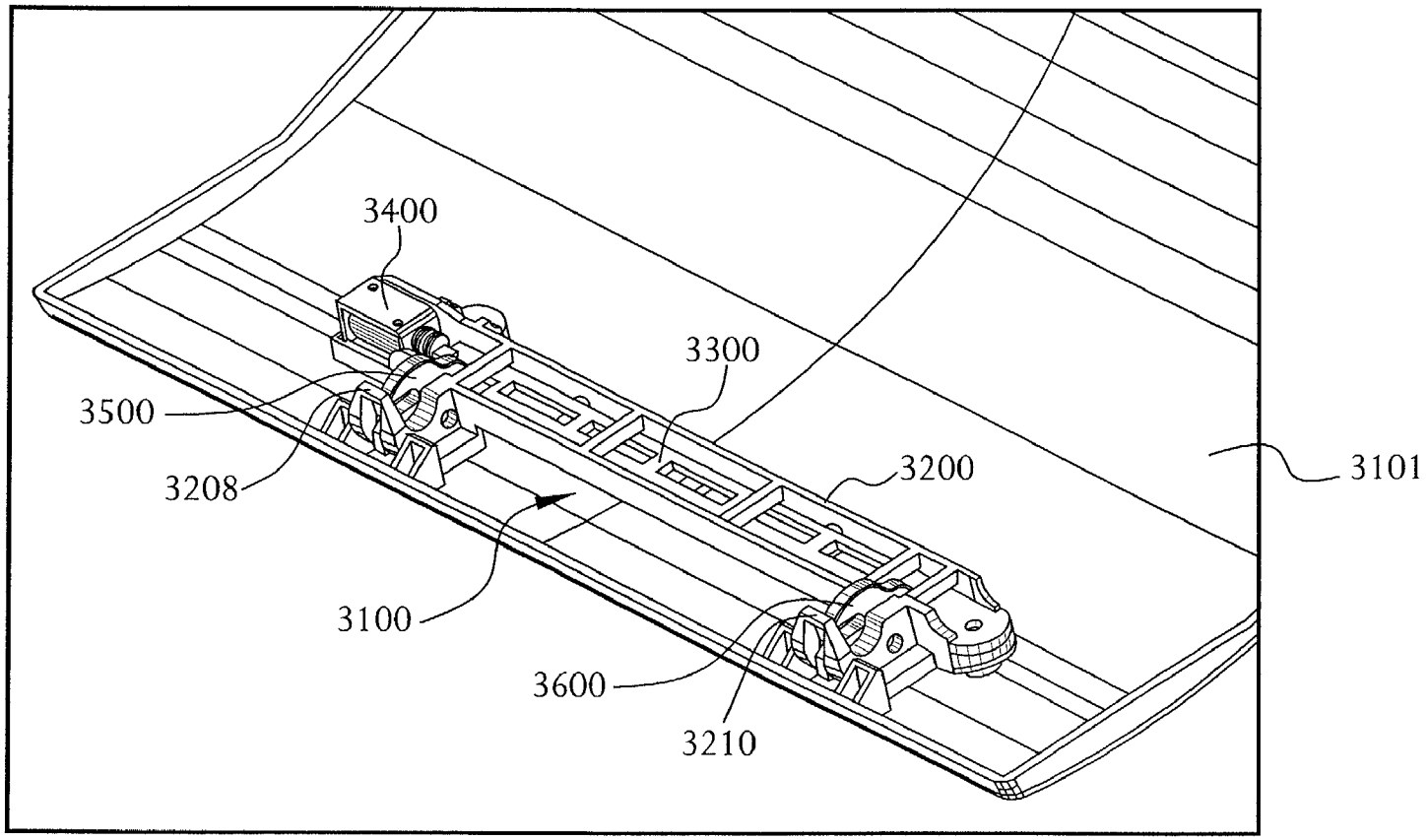
FIG. 115 is a top perspective view of the front side of the outer shell of a glove compartment lid or door showing the latch assembly according to the present invention installed to the outer shell of the door with the latch pawls shown in the closed position.
Figure 116:
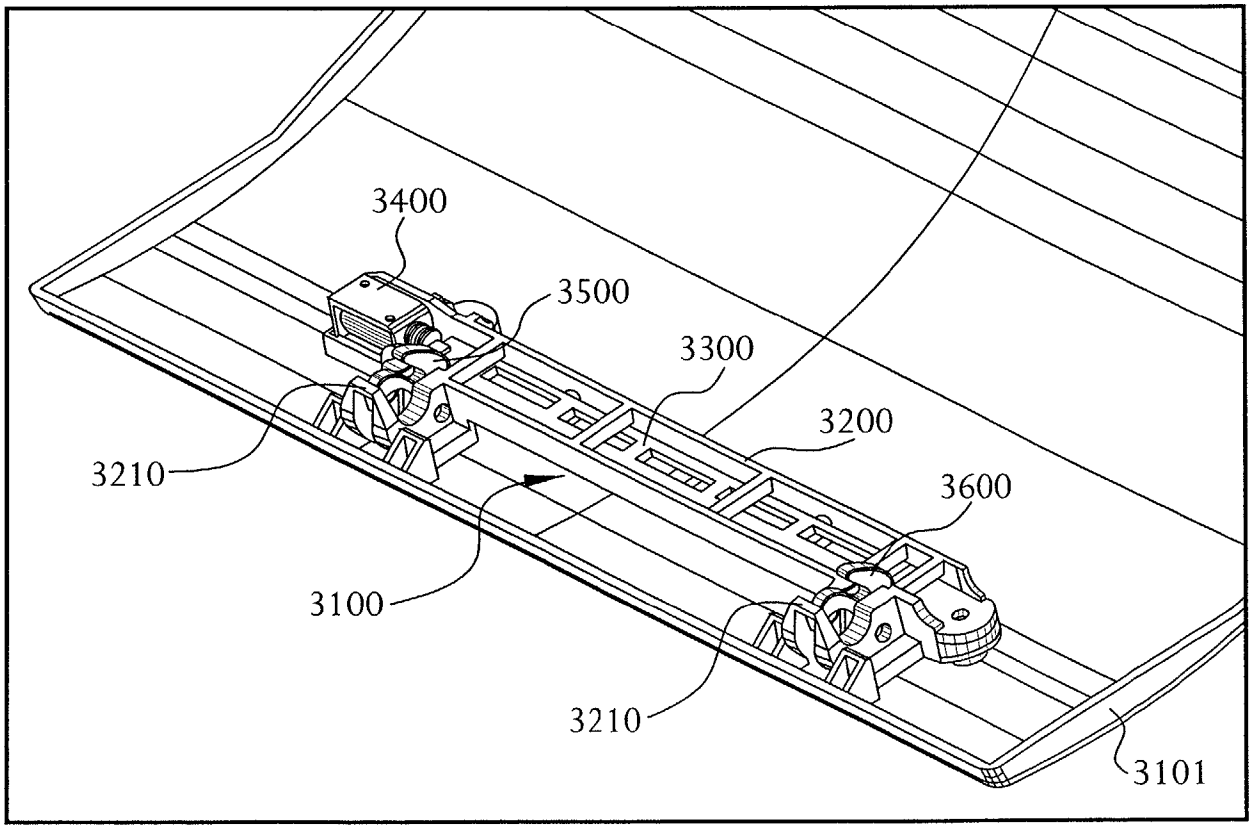
FIG. 116 is a top perspective view of the front side of the outer shell of a glove compartment lid or door showing the latch assembly according to the present invention installed to the outer shell of the door with the latch pawls shown in the open position.
Figure 117B:
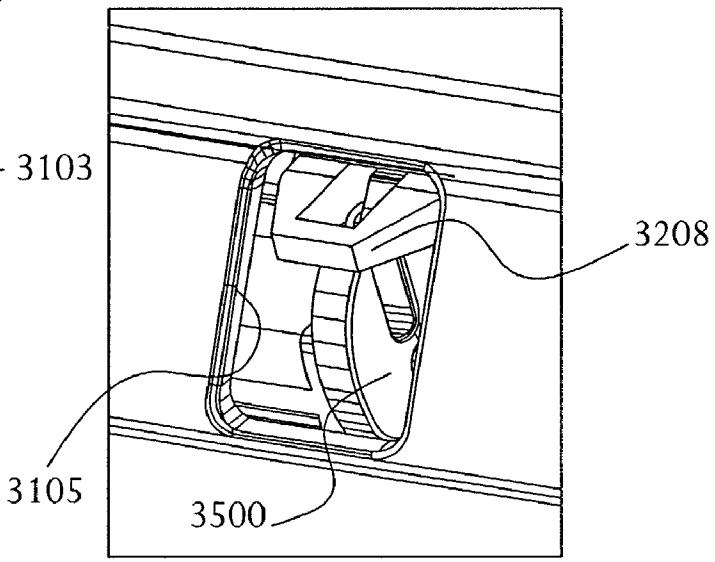
FIG. 117B is a close-up view of the latch pawl shown in FIG. 117A.
Figure 117A:
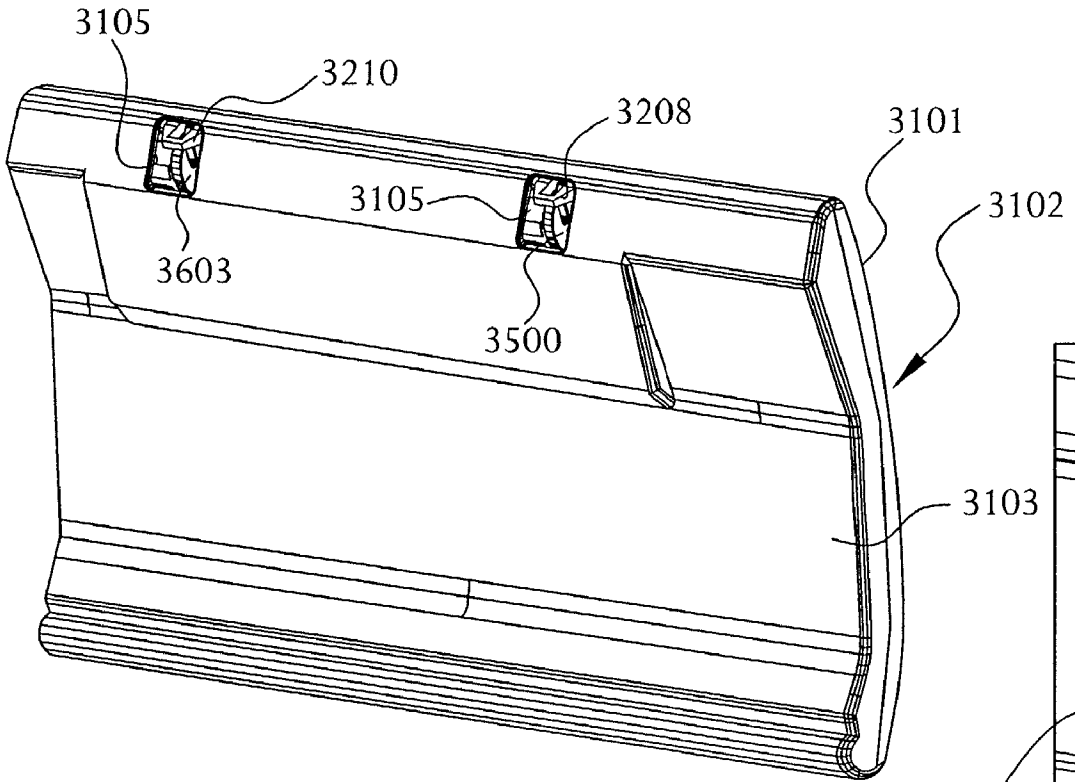
FIG. 117A is a front perspective view of the fully-assembled glove box door with the latch assembly according to the present invention installed, showing the showing the latch pawls in the closed position.
Figure 118B:
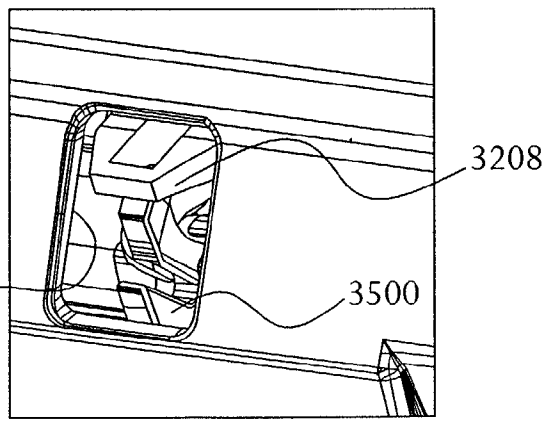
FIG. 118A is a front perspective view of the fully-assembled glove box door with the latch assembly according to the present invention installed, showing the showing the latch pawls in the open position.
Figure 118A:
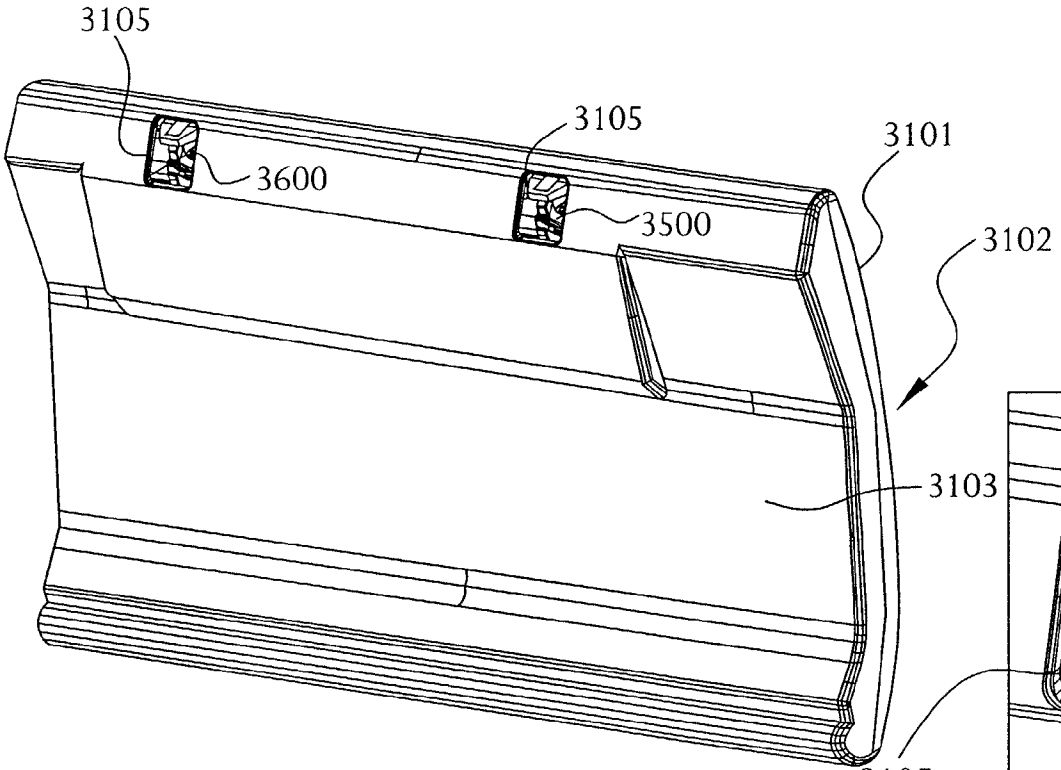
Figure 119:
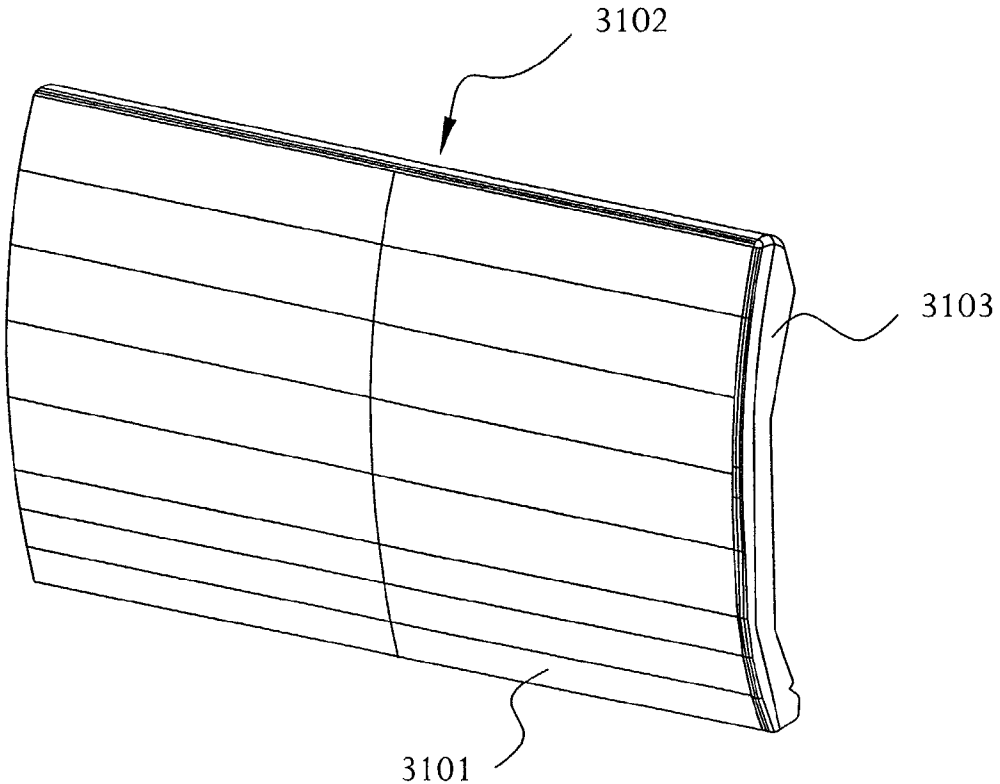
Figure 120:
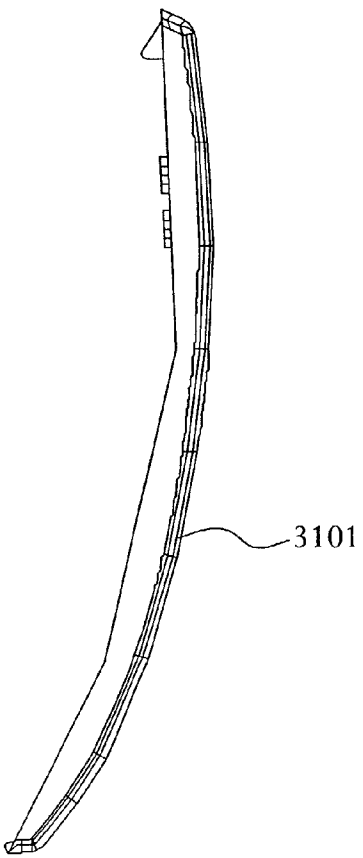
Figure 121:
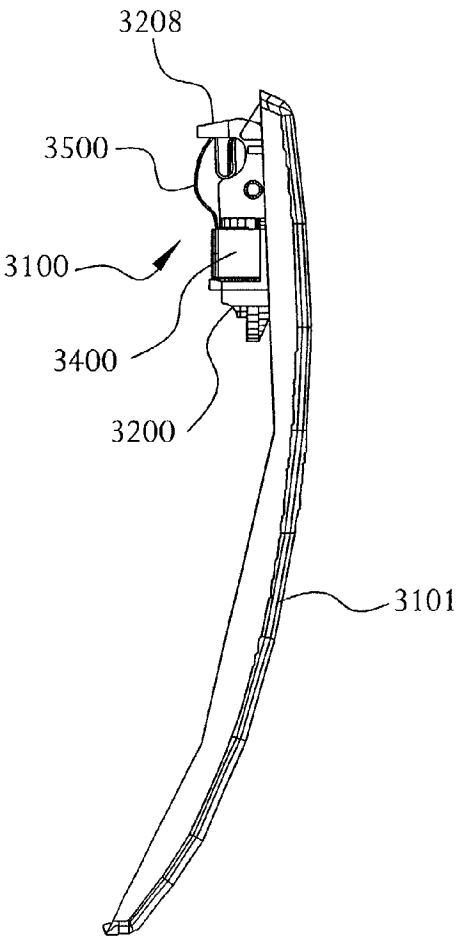
Figure 122:
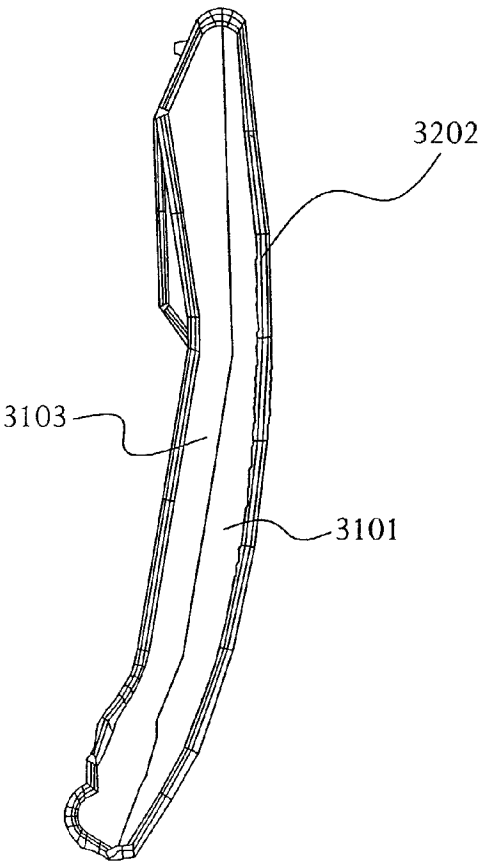
Figure 123:
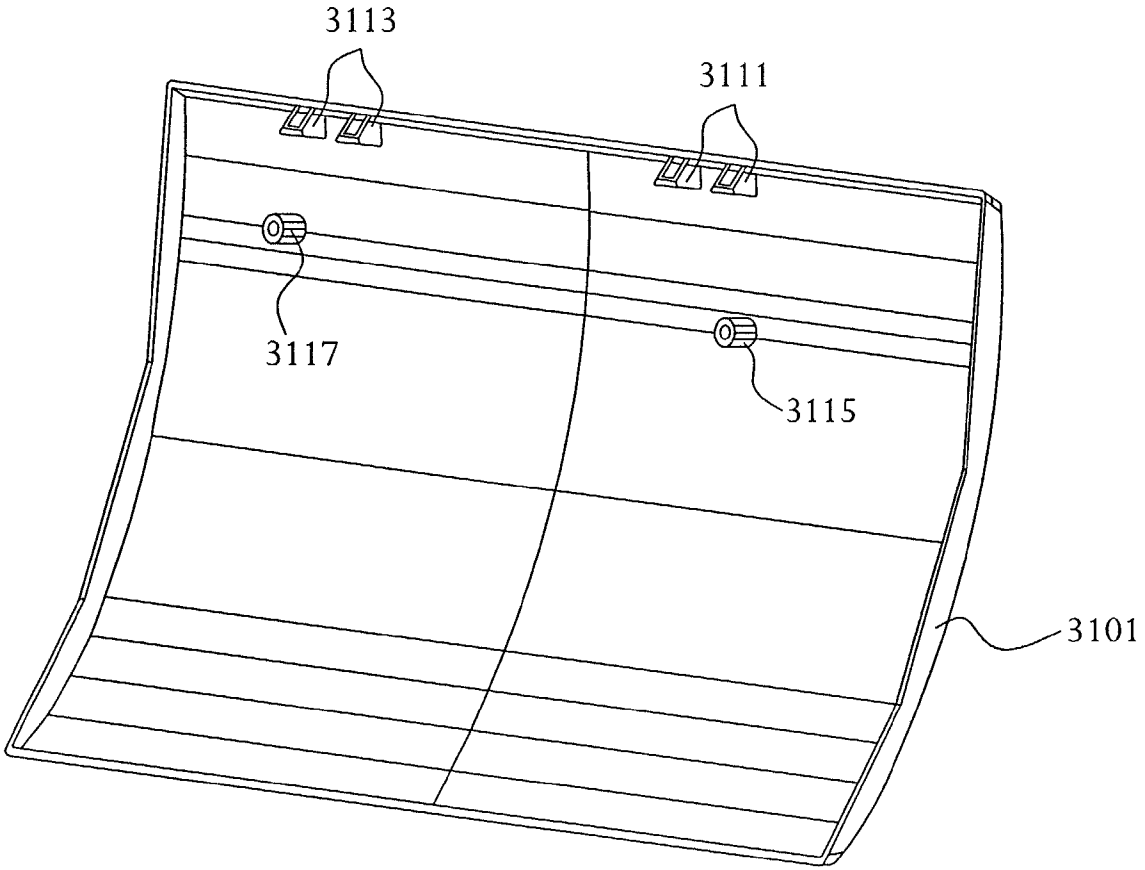
Figure 124:
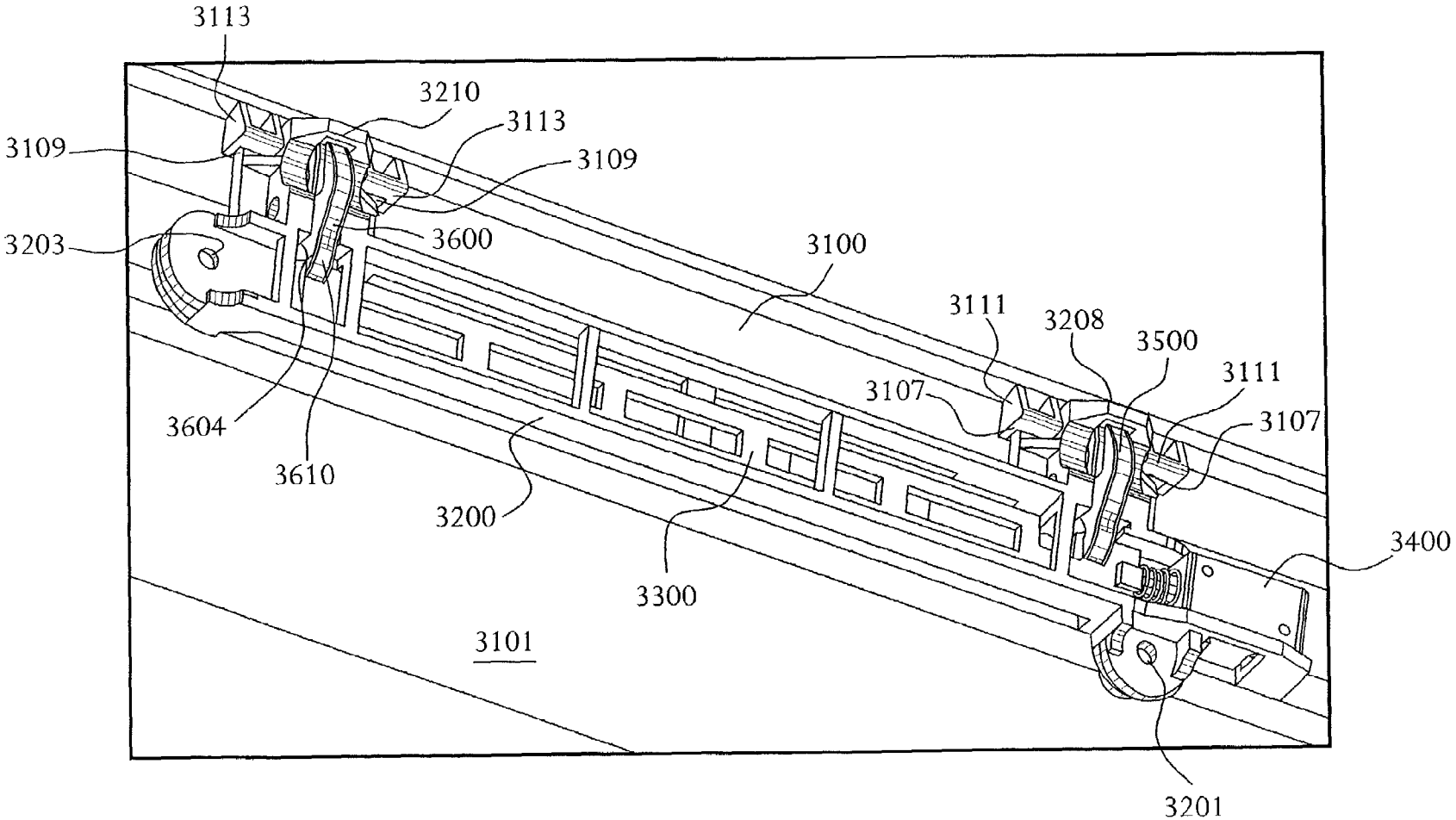
Figure 125:
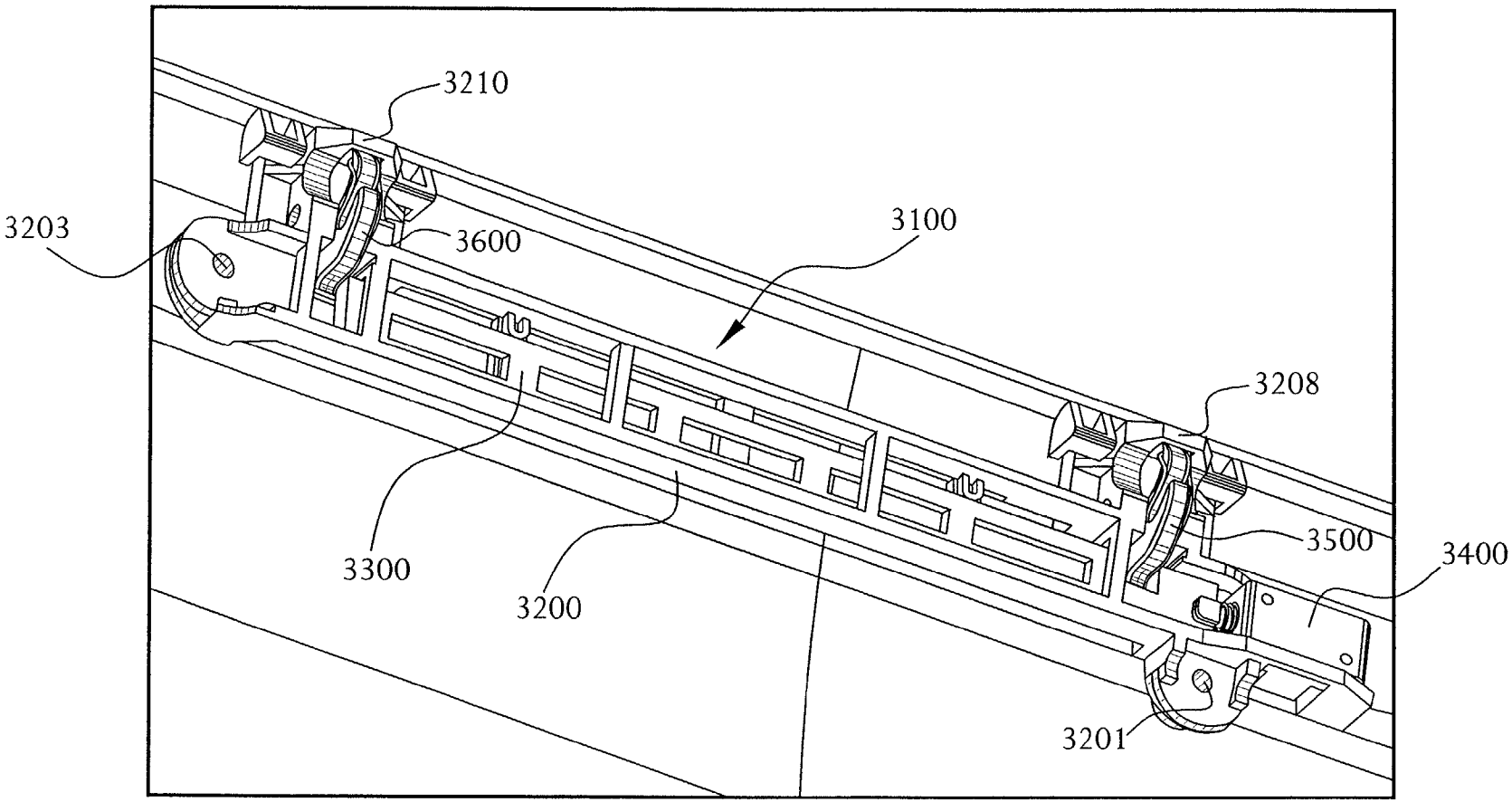
Figure 126:
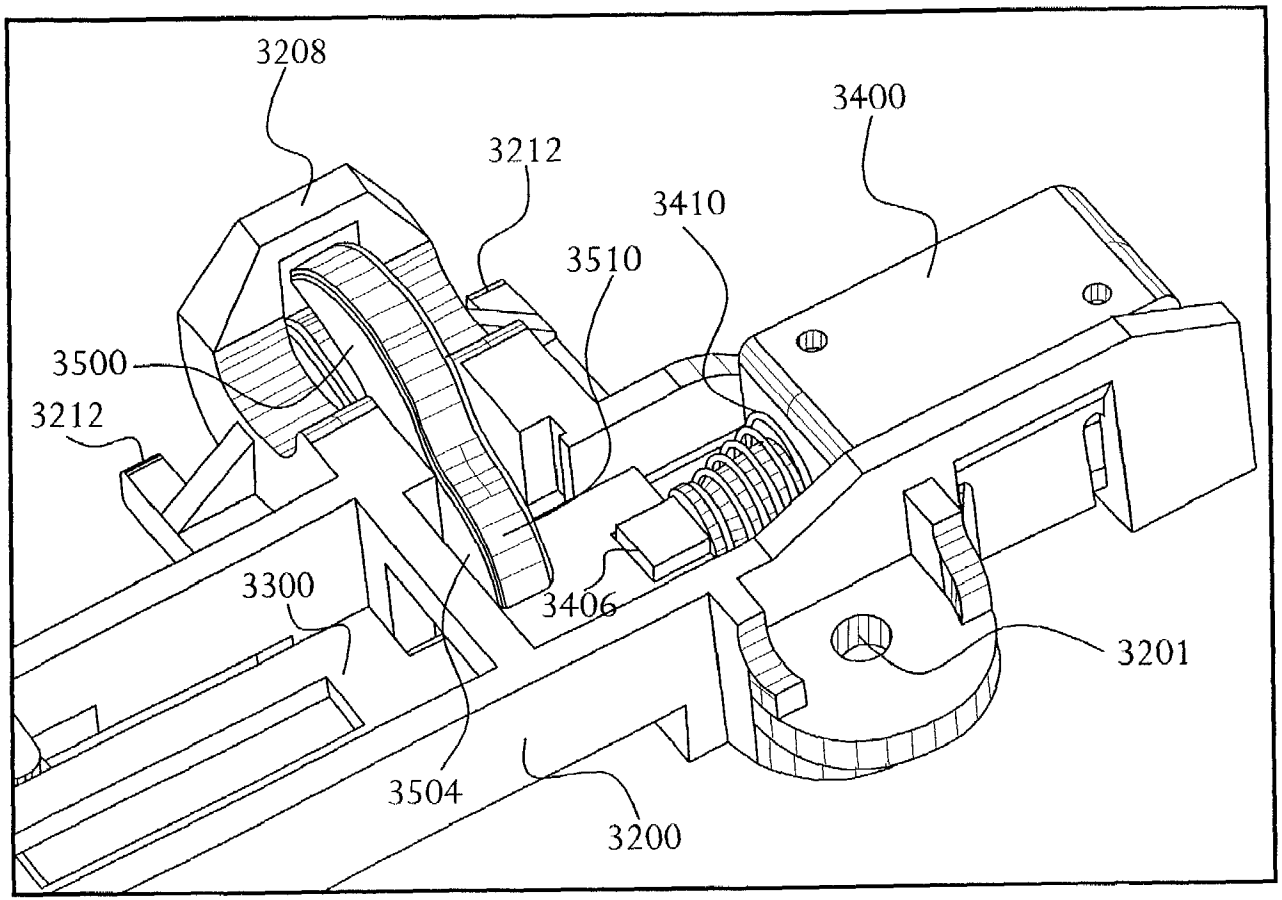
Figure 127:
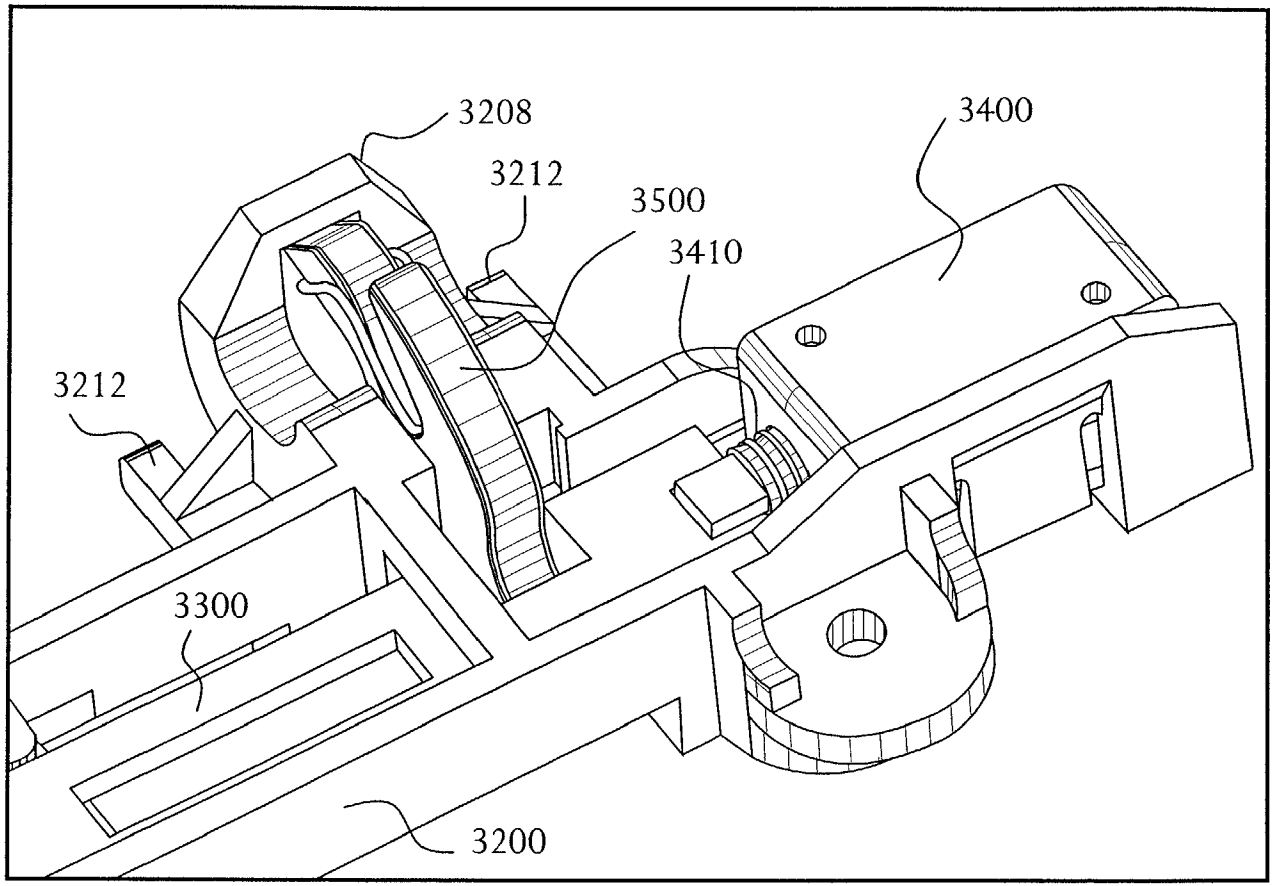
Figure 128:
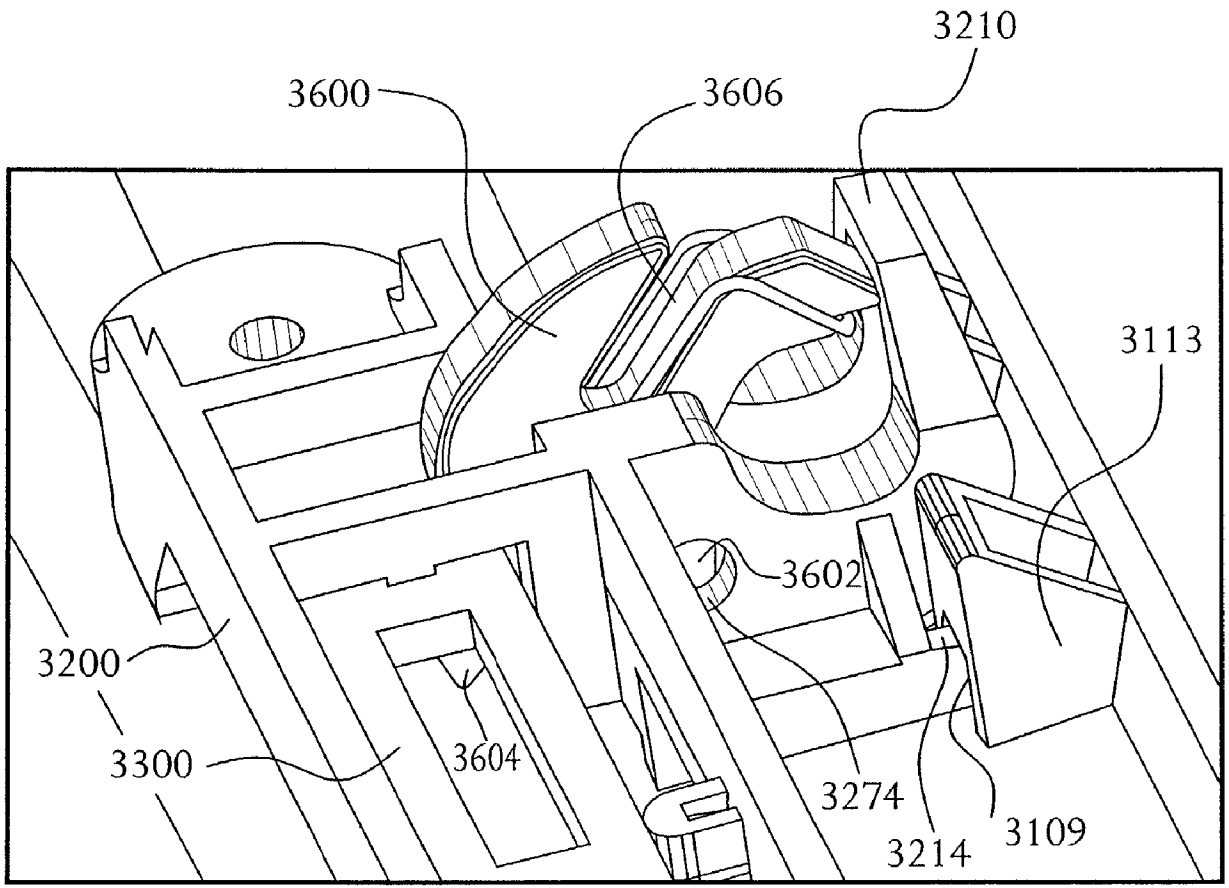
Figure 129:
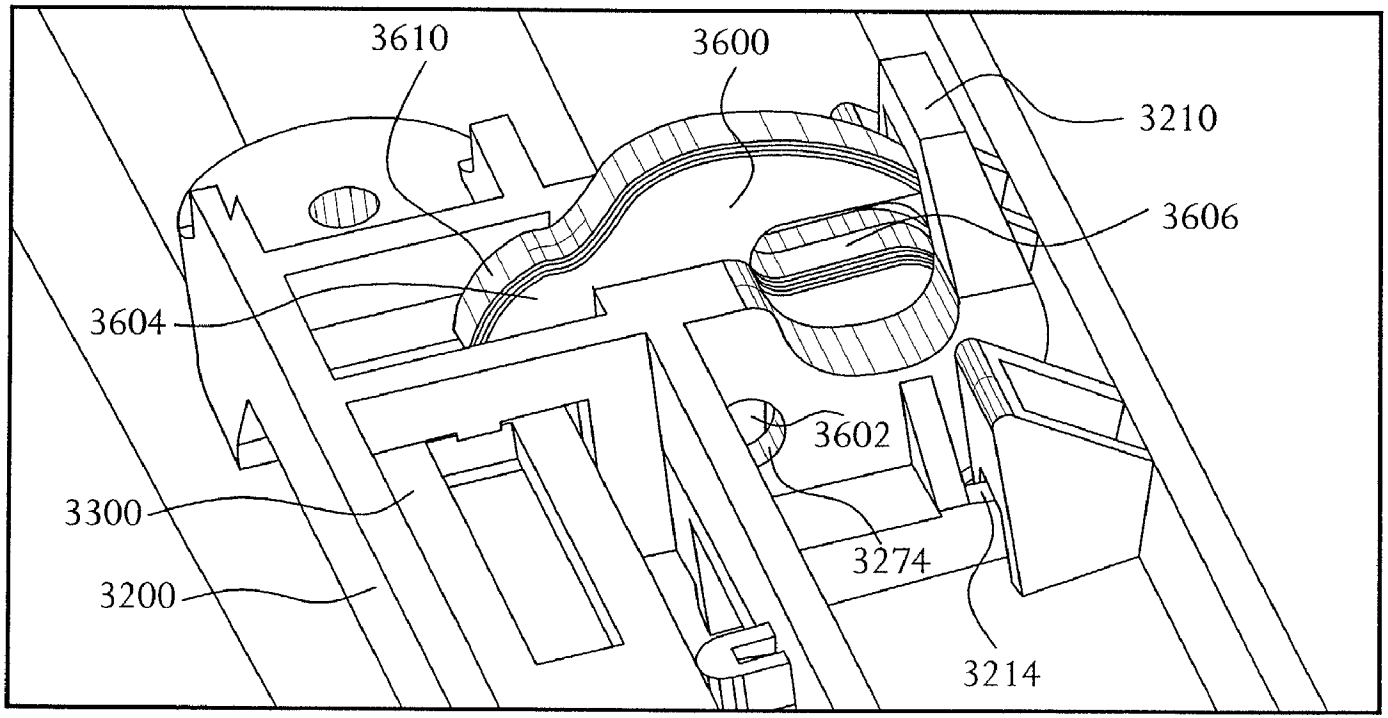

As shown in FIGS. 110–112, the latch assembly 2100 can be assembled by first snap-fit placing the pawls 2500, 2600 and pawl torsional springs 2700, 2800 into the corresponding pawl pivot recesses 2272, 2274 of the latch housing 2200. The catch beam 2300 can then be slid into the channel 2222 of the housing body 2206 of the latch housing 2200, via the second end 2304 of the catch beam 2300, such that the first end stop projection 2312 is proximate the first end 2202 of the latch housing 2200 when the catch beam 2300 is positioned within the channel 2222. The assembled solenoid assembly 2400 can then be snap-fit placed into the solenoid housing 2216, with the catch beam engaging structure 2430 of the solenoid lever 2406 snap-fit placed into the attachment opening 2314 of the catch beam 2300.

The latch assembly 2100 is actuated by a user pressing on a press or push button (not shown) that is in communication with the solenoid 2402. The button can be positioned on the vehicle's instrument panel (not shown), outside the door 2102 of the vehicle's glove compartment (not shown), or in any other location within the vehicle. It is obvious to one in the art that the latch assembly 2100 can also be actuated by a user pressing on a button or switch of a remote device that is in communication with the solenoid 2402. After the user presses the button, the solenoid 2402 is activated and the electromagnetic force created by the solenoid coil pulls the shaft 2404 into the solenoid 2402. The electromagnetic force also pulls the solenoid lever 2406, which is attached to the shaft 2404 via the pin 2408, toward the solenoid 2402, thereby compressing the solenoid spring 2410. Since the solenoid lever 2406 is engaged with the catch beam 2300 when the latch 2100 is assembled, the pull of the electromagnetic force causes the linear translational motion of the catch beam 2300 such that the second end 2304 of the catch beam 2300 moves toward the first end 2202 of the latch housing 2200. When the catch beam 2300 has moved past a predetermined distance such that the catch portions 2316, 2318 are out of engagement with the pawl lugs 2508, 2608, the pawls 2500, 2600 are freed for pivoting. The bias provided by each pawl torsional spring 2700, 2800 rotates the corresponding pawl 2500, 2600 from its closed position, where the keeper rod is cooperatively captured by the pawl slots 2506, 2606 and the hook-shaped structures 2208, 2210, to its open position. The rotation of each pawl 2500, 2600 brings the opening of the corresponding pawl slot 2506, 2606 out from under the corresponding hook-shaped structure 2208, 2210 and allows the keeper rod to be disengaged from the pawls 2500, 2600. The compartment or panel to which the latch assembly 2100 is attached can then be opened.

The compartment or panel (not shown) to which the latch assembly 2100 is attached can be closed by slamming the compartment or panel shut, or towards the front of the vehicle. When the compartment or panel is slammed shut, the keeper rod (not shown) that is attached to the compartment or panel will make contact with the pawls 2500, 2600 and rotate the pawls 2500, 2600 toward the closed position. After a predetermined distance, the keeper rod will pass below the forward pointing portion of each of the hook-shaped structures 2208, 2210 and come into engagement with each of the pawls 2500, 2600 in the pawl slots 2506, 2606. As the pawls 2500, 2600 are rotated toward the closed position such that the pawl lugs 2504, 2604 move upwardly and out of the first and third cutouts 2306, 2310 of the catch beam 2300, the solenoid spring 2410 biases the shaft 2404 and solenoid lever 2406, along with the engaged catch beam 2300, back toward the second end 2204 of the latch housing 2200.

Figure 98:
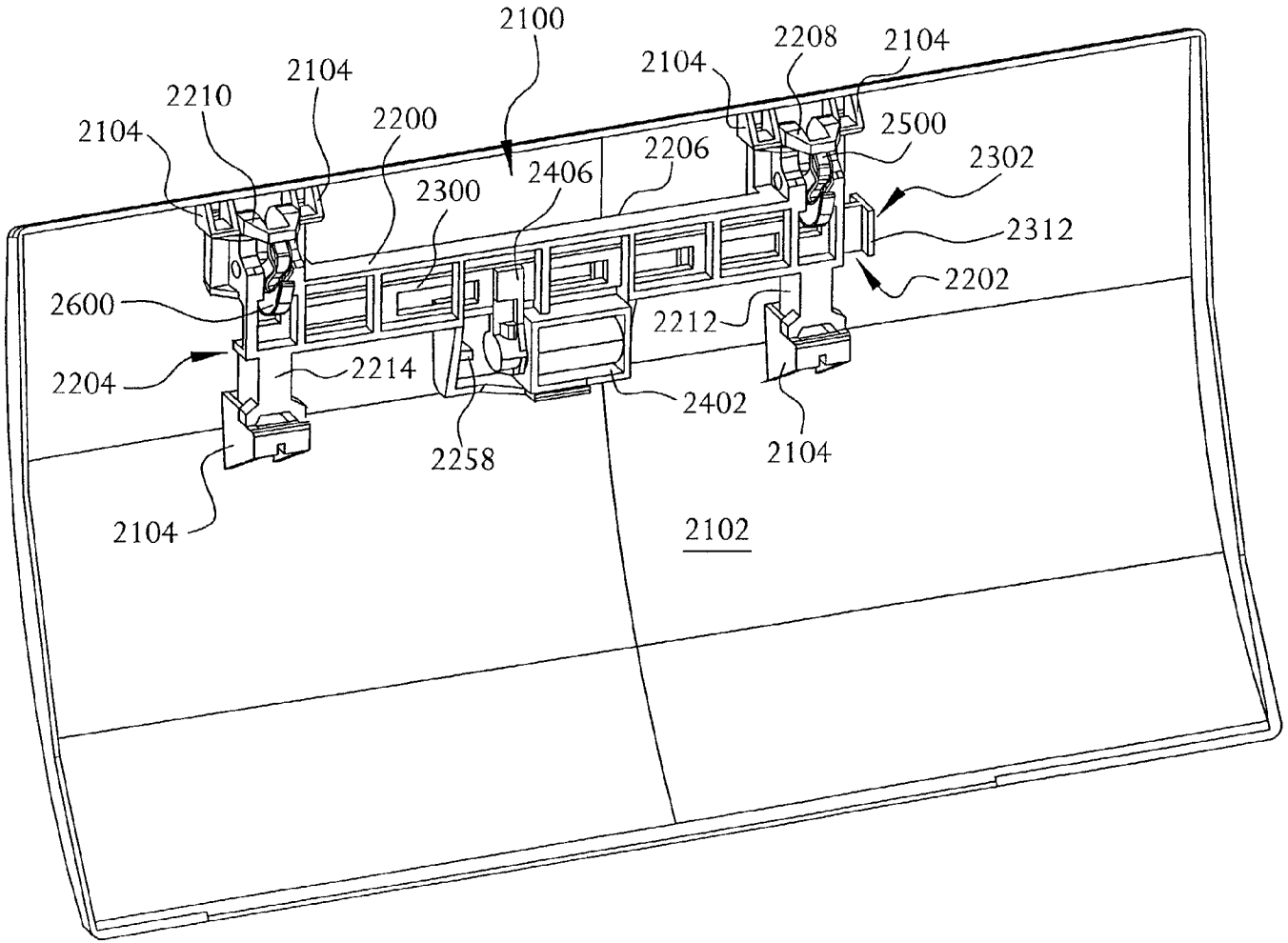
FIG. 98 is a perspective view of the back side of the outer shell of the glove compartment door shown with the latch assembly of the present invention installed thereto.
Figure 99:
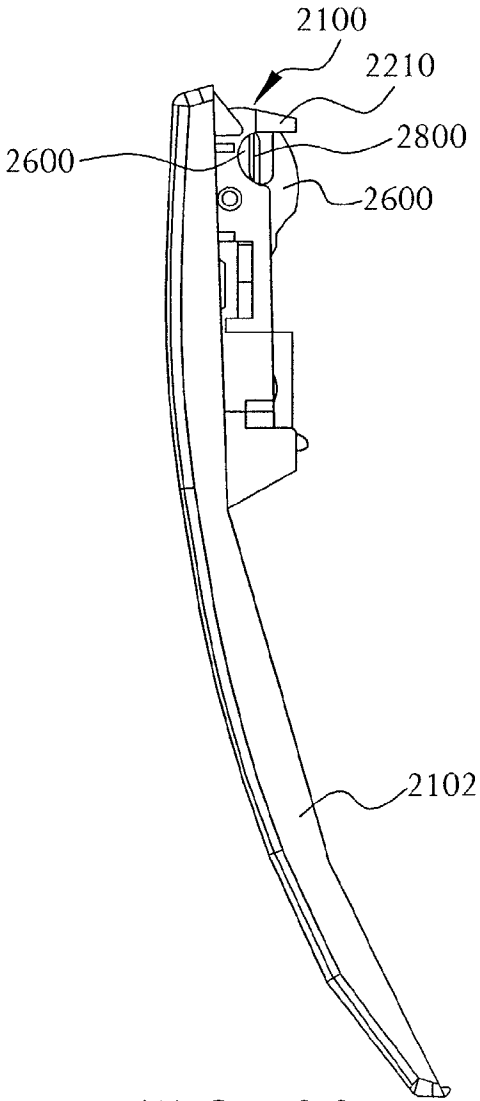
FIG. 99 is an elevational view of the right side of the outer shell of a glove compartment door shown with a latch assembly according to the present invention installed thereto, with the second pawl shown in the closed configuration.
Figure 100:
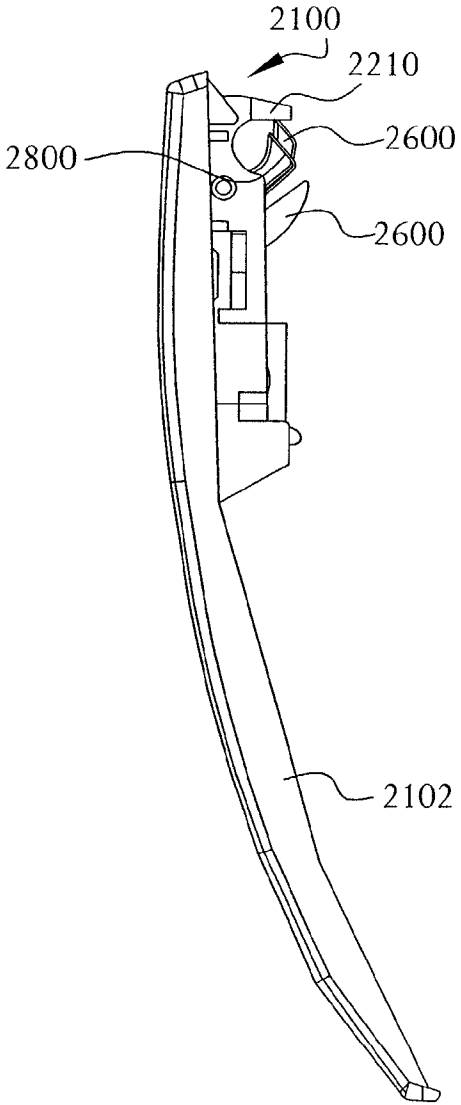
FIG. 100 is an elevational view of the right side of the outer shell of a glove compartment door shown with a latch assembly according to the present invention installed thereto, with the second pawl shown in the open configuration.
Figure 101:
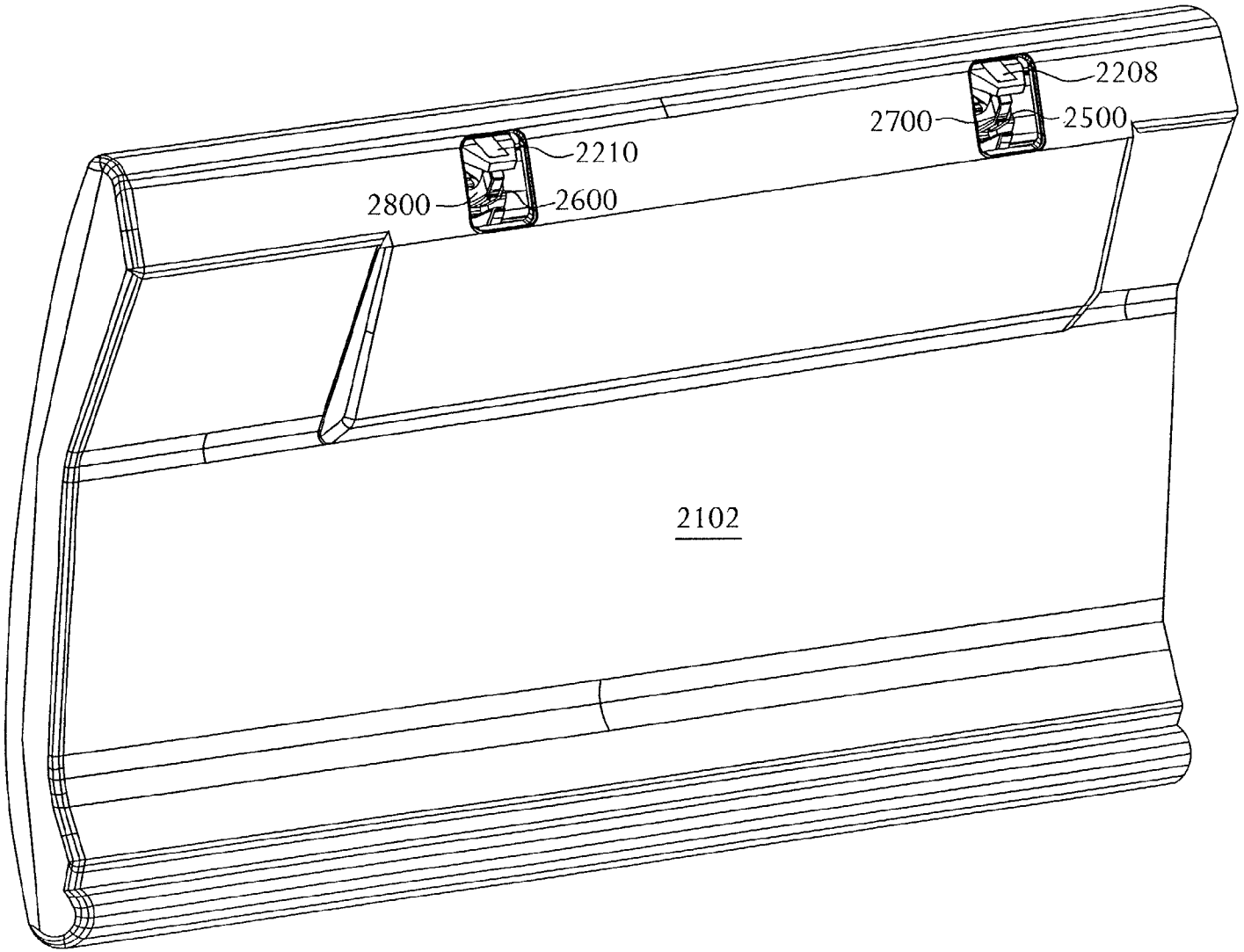
FIG. 101 is a perspective view of the interior side of a glove compartment door shown with a latch assembly according to the present invention installed therein, with the first and second pawls shown in the open configuration.

Suitable mounting means are provided to retain the latch assembly 2100 on a panel or mounting surface (not shown). For example, as shown in FIG. 98, installation of the latch assembly 2100 to a panel may be accomplished by snap-fit placement of the latch assembly 2100 into hooks 2104 and the like that are positioned on the panel, such as for example, a glove box door 2102 of an automobile. Alternatively, installation of the latch assembly 2100 to a panel may be accomplished with fasteners, such as screws or pins, which pass through holes for fastening of the latch assembly 2100 to the panel.

The latch assembly 2100 also has some additional features which enhance its resistance to tampering. Since the latch assembly 2100 is designed without access holes or openings, opportunity for unauthorized access to the latch assembly 2100 is reduced. Also, the pair of pawls 2500, 2600 provide additional strength to the latch assembly 2100 such that opportunity for unauthorized access to the latch assembly 2100 is reduced.

Another embodiment of the latch in accordance with the present invention is illustrated in FIGS. 113 through 161. The latch 3100 in the present embodiment is similar in both structure and function to many of the features already described in detail with respect to the previous embodiments.

Referring to FIGS. 113–161, the latch 3100 of the present invention includes a latch housing 3200, a catch beam 3300, a solenoid assembly 3400, a pair of pawls 3500, 3600, and a pair of pawl torsion springs 3700, 3800.

As shown in FIGS. 113–125 and 128–137, an illustrative example of the application of the latch 3100 is for latching the door 3102 of a vehicle's glove compartment (not shown). References to top, bottom, front, rear, left side and right side as used herein are applied by reference to the vehicle (not shown) in which the latch 3100 is installed. For example, the front of the latch housing 3200 faces toward the front of the vehicle when the latch housing 3200 is installed to the door 3102 of the vehicle's glove compartment and the door 3102 of the glove compartment is closed. The rear of the latch housing 3200 faces toward the rear of the vehicle when the latch housing 3200 is installed to the door 3102 of the vehicle's glove compartment and the door 3102 of the glove compartment is closed. The bottom of the latch housing 3200 faces toward the floor of the vehicle's passenger compartment when the latch housing 3200 is installed to the door 3102 of the vehicle's glove compartment and the door 3102 of the glove compartment is closed. The top of the latch housing 3200 faces toward the roof of the vehicle's passenger compartment when the latch housing 3200 is installed to the door 3102 of the vehicle's glove compartment and the door 3102 of the glove compartment is closed and so forth.

As best shown in FIGS. 154–157, the latch housing 3200 has a first end 3202, a second end 3204, a housing body 3206, a pair of hook-shaped structures 3208, 3210, two pairs of tabs 3212, 3214, and a solenoid housing 3216. The housing body 3206 extends longitudinally between the first and second ends 3202, 3204. The housing body 3206 has an opening 3218, 3220 at each of the corresponding first and second ends 3202, 3204, and a channel 3222 therebetween for receiving the catch beam 3300. The housing body 3206 forms a cage or frame for slidably supporting the catch beam 3300.

Each hook-shaped structure 3208, 3210 projects from the top of the latch housing body 3206 proximate one of the corresponding ends 3202, 33204. Hook-shaped as used herein refers to any member that has a crook, curve, or bend to thereby catch on another member. The hook shape of the structures 3208 and 3210 is most readily apparent from FIGS. 146–149. Each hook-shaped structure 3208, 3210 extends upwardly and then forwardly from the top of the latch housing 3200 such that the tip 3232, 3234 of that hook-shaped structure 3208, 3210 points toward the front of the vehicle when the latch housing 3200 is installed to the door 3102 of the vehicle's glove compartment and the door 3102 of the glove compartment is closed. A slot 3236, 3238 is provided within each corresponding hook-shaped structure 3208, 3210 and extends through a portion of the housing body 3206 (as shown in FIGS. 154–157).

The tabs 3212, 3214 are for mounting the latch 3100 to the outer shell 3101 of the door 3102 of the vehicle's glove compartment. Each tab 3212, 3214 projects upward from either side of a respective one of the hook-shaped structures 3208, 3210. The tabs 3212, 3214 are inserted into holes 3107, 3109 provided in the bottom of brackets 3111, 3113 that project from the inner surface of the outer shell 3101 of the door 3102. Thus the tabs 3212, 3214 in cooperation with brackets 3111, 3113 hold the hook-shaped structures 3208, 3210 securely relative to the inner surface of the outer shell 3101 of the door 3102 when the latch 3100 is mounted to the door 3102. The door 3102 also has an inner shell 3103 that mates with the outer shell 3101 to form the door 3102. The inner shell 3103 has openings 3105 that allow a respective keeper rod to be engaged by the pawls 3500, 3600 and the hook-shaped structures 3208, 3210.

Also projecting from the inner surface of the outer shell 3101 are cylindrical sleeves 3115 and 3117. The sleeves 3115 and 3117 register with the holes 3201 and 3203 of the housing 3200 when the latch 3100 is mounted to the outer shell 3101 of the door 3102. Self-tapping screws passing through holes 3201, 3203 are engaged to the sleeves 3115, 3117 to secure the latch housing 3200 to the outer shell 3101 of the door 3102. This arrangement results in a stronger attachment between the latch 3100 and the door 3102, which in turn results in increased pull and impact strength of the latch 3100.

As best shown in FIGS. 160–161, the solenoid assembly 3400 includes a solenoid 3402, a solenoid plunger or shaft 3404, a tip projection 3406, and a solenoid spring 3410. When the solenoid 3402 is energized the solenoid shaft 3404 is retracted into the solenoid. The tip projection 3406 has a perpendicular portion that projects from a position near the tip of the solenoid shaft 3404 at about a right angle relative to the longitudinal axis of the solenoid shaft 3404. The perpendicular portion of the tip projection 3406 is adapted to engage the catch beam 3300 as will be described below.

The solenoid housing 3216 has a generally rectangular frame for receiving the solenoid assembly 3400. The solenoid housing 3216 supports the solenoid assembly 3400 such that the solenoid shaft 3404 is directly in line with the catch beam 3300 and the tip projection 3406 can engage the catch beam 3300 directly. This arrangement has the advantage that the number of parts required for the latch assembly 3100 is reduced, and consequently the material cost and the material requirements of the latch assembly 3100 are also reduced. The solenoid 3402 being in line with the catch beam 3300 has the further advantage that the catch beam can be moved with less pull/push force, thus requiring a smaller solenoid unit. This also brings the cost of the latch 3100 down.

The solenoid 3402 is selectively energized by a user using a switch (not shown) remotely located somewhere on the vehicle's instrument panel or console. The wiring to the control switch for the latch 3100 is arranged such that the vehicle's ignition key must be in the ignition switch before the solenoid 3402 can be energized using the control switch. The control switch for the latch 3100 can be of any well-known type.

As best shown in FIGS. 158–159B, the catch beam 3300 is elongated, and has a first end 3302, a second end 3304, a slot 3306, and a cutout 3308. The slot 3306 is located near the first end 3302 and is adapted to receive at least the perpendicular portion of the tip projection 3406 such that the solenoid shaft 3404 can push and pull the catch beam 3300. The cutout 3308 registers with the pawl 3500 when the catch beam 3300 is pulled to the unlocked position by the solenoid assembly 3400. The cutout 3308 allows the pawl 3500 to rotate to the open position under the bias of torsion spring 3700 when the catch beam 3300 is in the unlocked position. The length of the catch beam 3300 is selected such that the end 3304 of the catch beam clears the pawl 3600, thus allowing the pawl 3600 to rotate to the open position under the bias of torsion spring 3800, when the catch beam 3300 is in the unlocked position. When the solenoid 3402 is energized, the solenoid shaft 3404 is retracted toward the solenoid body causing the tip projection 3406 to pull the catch beam 3300 to the unlocked position. In the unlocked position, the end 3304 of the catch beam clears the pawl 3600 and the cutout 3308 is positioned below the pawl 3500.

Thus, when the solenoid 3402 is energized, the pawls 3500, 3600 can rotate to the open positions. When the solenoid 3402 is deactivated, the spring 3410 biases the catch beam 3300 toward the locked position. However, movement of the catch beam 3300 to the locked position is prevented as long as the pawls 3500, 3600 are in the open position and block the movement of the catch beam 3300. When the door 3102 is slammed shut and the impact of the keeper rods with the pawls 3500, 3600 rotates the pawls 3500, 3600 to the closed position, the pawls 3500, 3600 clear the catch beam 3300 allowing it to move to the locked position under the bias of spring 3410.

Each of the pair of pawls 3500, 3600 is shown pivotally connected to the latch housing 3200 with suitable attachment means such as the pawl pivot members 3502, 3602 which are provided extending outwardly from the corresponding pawl 3500, 3600 at opposite sides thereof. Each pawl 3500, 3600 is installed onto the latch housing 3200 by snap-fit placement of the corresponding pawl pivot members 3502, 3602 into the corresponding pawl pivot recesses or holes 3272, 3274 disposed in the latch housing 3200. A pair of guide slots 3276, 3278 is provided on the latch housing 3200 leading from the edge of the latch housing 3200 to the corresponding pawl pivot recesses 3272, 3274 for guiding the corresponding pawl pivot members 3502, 3602, in the direction of the corresponding pawl pivot recesses 3272, 3274 during the snap-fitting operation.

Each pawl 3500, 3600 has a locking lug 3504, 3604, and is provided with a pawl slot 3506, 3606 to retain a respective one of two keeper rods (not shown). For the illustrated embodiment, the keeper rods are attached to the vehicle's instrument panel near the opening of the glove box. The keeper rods should be located at positions such that, as the swinging panel or door 3102 is rotated to the closed position, the keeper rods will pass below the forward pointing portion of respective hook-shaped structures 3208, 3210 and come into engagement with respective pawls 3500, 3600.

A pawl torsional spring 3700, 3800 is installed on a corresponding pawl 3500, 3600 with the coiled portions surrounding the corresponding pawl pivot members 3502, 3602. A loop of each pawl torsional spring 3700, 3800 engages the notch 3508, 3608 near the top of the corresponding pawl 3500, 3600. Each pawl torsional spring 3700, 3800 biases the corresponding pawl 3500, 3600 toward the open position shown in FIGS. 147 and 149. Each pawl lug 3504, 3604 has a sloping surface 3510, 3610 and a flat radially extending side 3512, 3612. Once each pawl 3500, 3600 is in the closed position, portions of the catch beam 3300 move behind the lugs 3504, 3604, under the bias of the solenoid spring 3410, and catch the flat side of the lugs 3504, 3604 to retain the pawls 3500, 3600 in their closed positions.

The latch assembly 3100 is actuated by a user operating a switch (not shown) that controls current supply to the solenoid 3402 when the vehicle's key is in the ignition. The switch can be positioned on the vehicle's instrument panel (not shown), outside the door 3102 of the vehicle's glove compartment (not shown), or in any other location within the vehicle. In addition, a wireless remote may be used to energize the solenoid 3402. After the user energizes the solenoid 3402, the electromagnetic force created by the solenoid coil pulls the shaft 3404 into the solenoid 3402. Thus the tip projection 3406 is pulled toward the solenoid housing 3216 and the catch beam 3300 is pulled toward the unlocked position. In addition, the solenoid spring 3410 is compressed during this process. When the catch beam 3300 has moved out of engagement with the pawl lugs 3508, 3608, the pawls 3500, 3600 are freed for pivoting. The bias provided by each pawl torsional spring 3700, 3800 rotates the corresponding pawl 3500, 3600 from its closed position, where the keeper rod is cooperatively captured by the pawl slots 3506, 3606 and the hook-shaped structures 3208, 3210, to its open position. The rotation of the pawls 3500, 3600 to the open position brings the opening of the corresponding pawl slots 3506, 3606 out from under the hook-shaped structures 3208, 3210 and allows the keeper rods to be disengaged from the pawls 3500, 3600 The compartment or panel to which the latch assembly 3100 is attached can then be opened.

The compartment or panel (not shown) to which the latch assembly 3100 is attached can be closed by slamming the door 3102 shut. When the compartment or panel is slammed shut, the keeper rods (not shown) that are located near the opening of the compartment will make contact with the pawls 3500, 3600 and rotate the pawls 3500, 3600 toward the closed position. As the door 3102 rotates to its closed position, the keeper rods will pass below the forward pointing portion of the hook-shaped structures 3208, 3210 and come into engagement with the pawls 3500, 3600 in the pawl slots 3506, 3606. As the pawls 3500, 3600 are rotated toward their closed positions, the pawl lug 3504 moves out of the cutout 3308 and the pawl lug 3604 moves out of the way of the end 3304 of the catch beam 3300 to thus allow the catch beam 3300 to move to the locked position as urged by the solenoid spring 3410.

One problem encountered with other two-point latching systems is that when the glove box door is closed with a push on one side of the centerline of the door, rather than a push on the middle of the door, the flexibility of the door will tend to bring one keeper in the latch position before the other one. There is then a possibility to have the glove box door closed but only maintained by one keeper. This presents a clear danger to the passenger as the door might open in the event of an impact. In addition, the door is not flush with the adjacent interior trim moldings or instrument panel and will not meet the required style and appearance criteria. The chamfers (ramped or sloping surfaces) 3303 and 3301 have been provided on the catch beam at the end 3304 and on one side of the cutout 3308, respectively, to address this problem. If only one pawl reaches the closed position, the catch beam 3300 cannot move fully to the locked position and the respective pawl lug 3504 or 3604 will engage the catch beam in the area of the respective chamfer 3301 or 3303. When the user releases the door, the force of the respective torsion spring 3700 or 3800, through the interaction of the pawl lug with the respective chamfer, will overcome the force of the solenoid spring 3410 and will rotate the one pawl engaged by a keeper rod back to it's open position. Thus, the door 3102 will not remain closed unless both pawls 3500 and 3600 properly engage their respective keeper rods. Consequently, the door 3102 will drop back to the open position prompting the user attempt to close the door 3102 again until the door 3102 is properly secured in the closed position by the latch 3100.

A mechanical override can be provided to allow the opening of the door 3102 even when the power supply to the solenoid 3402 fails due for example to a dead battery. The mechanical override may include a cable attached at one end to the end 3302 of the catch beam 3300. The other end of the cable can be positioned at some location on the instrument panel access to which is controlled by a key. The fuse box for instance may be suitable for such a purpose. By pulling on the remote end of the cable the catch beam can then be moved to the unlocked position to thereby allow the door 3102 to be opened when power to the solenoid 3402 fails.

Furthermore, it should be born in mind that the latch 3100 can also be used to secure a door in the closed position when the keeper rods are carried by the moving door and the latch 3100 is supported by the stationary panel surrounding the opening of the compartment closed by the door.

The latch assembly 3100 also has some additional features which enhance its resistance to tampering. Since the latch assembly 3100 is designed without access holes or openings, opportunity for unauthorized access to the latch assembly 3100 is reduced. Also, the pair of pawls 3500, 3600 provide additional strength to the latch assembly 3100 such that opportunity for unauthorized access to the latch assembly 3100 is reduced.

It will be apparent to those skilled in the art that various modifications can be made to the present invention without departing from the scope and spirit of the invention, and it is intended that the present invention include all embodiments within the scope of the appended claims and their equivalents.

What is claimed is:

1. A latch assembly, the latch assembly comprising:

an elongate housing having walls thereto and a hook-like shaped member extending outwardly transversely thereto from an outside of a said wall thereof;

a pawl pivotally attached to the housing and being movable between a closed and an open position, the pawl being provided with a torsion spring member that biases the pawl toward the open position;

a solenoid within the housing and operating parallel to a longitudinal axis thereof;

a locking member extending from said solenoid parallel to the longitudinal axis of the housing and actuated by said solenoid, the locking member being movable to selectively intercept the pivotal path of the pawl; and a spring positioned inboard of the locking member and operating against the solenoid from which the looking member extends to bias the locking member to extend outwardly from the solenoid;

wherein the pawl extends outwardly from said housing transversely to the longitudinal axis Thereof and in adjacent proximity to said housing hook-like shaped member.

2. The latch assembly of claim 1, wherein said pawl member is arranged parallel with said housing.

3. The latch assembly of claim 1, wherein the housing includes an opening in a sidewall thereof, the pawl operating though this opening and being mounted for the pivoting movement at a point outside of the sidewall of the housing.

4. The latch assembly of claim 3, wherein the pawl is mounted to the hook-like shaped member for pivoting, the mounting location being outside of the sidewall from which the hook-like shaped member extends.

5. The latch assembly of claim 4, wherein the hook-like shaped member is bifurcated having a pair of spaced apart hook-shaped flanges.

6. The latch assembly of claim 5, wherein each of the hook-shaped flanges carries a recession, these recessions being juxtaposed, and wherein the pawl has a pair of pivot spindles extending from opposite sides of the pawl, the pawl being snapably mountable into the hook-shaped flange recessions.

7. The latch assembly of claim 1, wherein the locking member carries a collar at a point along the extension thereof.

8. The latch assembly of claim 6, wherein the locking member carries a collar at a point along the extension thereof.

9. The latch assembly of claim 8, wherein said spring positioned inboard of the locking member and operating against the solenoid from which the locking member extends is position inboard of said locking member collar.

10. The latch assembly of claim 9, also including lateral tabs, one each extending from each of the hook-shaped flanges.

11. The latch assembly of claim 10, wherein each of the lateral tabs is positioned on the outboard face of the respective hook-shaped flange.

12. A latch assembly for releasably securing a first member to a second member, said second member having a keeper in a fixed positional relationship therewith, the latch assembly comprising:

an elongate housing having two opposing walls thereto and a hook-like shaped member extending outwardly from an outside of a said wall thereof, said hook-like shaped member being bifurcated having a pair of spaced apart hook-shaped flanges;

a pair of lateral tabs, one each extending from each of the hook-shaped flanges, on an outboard face thereof;

a pawl pivotally attached to said housing and pivotably movable between a closed position and an open position, said pawl engaging said keeper in said closed position;

a spring member biasing said pawl to said open position; and means positioned within said housing and operating parallel to a longitudinal axis thereof for intercepting the pivotal movement of said pawl for holding said pawl in said closed position;

a spring positioned inboard of said intercepting means and operating to bias the intercepting means to extend outwardly toward said pawl;

wherein said pawl extends outwardly from said housing transversely to said longitudinal axis thereof and in adjacent proximity to said housing hook-like shaped member.

13. The latch assembly of claim 12, wherein the housing includes an opening in a sidewall thereof, the pawl operating though this opening and being mounted for the pivoting movement at a point outside of the sidewall of the housing.

14. The latch assembly of claim 13, wherein the pawl is mounted to the hook-like shaped member for pivoting, the mounting location being outside of the sidewall from which the hook-like shaped member extends.

15. The latch assembly of claim 14, wherein the hook-like shaped member is bifurcated having a pair of spaced apart hook-shaped flanges.

16. The latch assembly of claim 15, wherein each of the hook-shaped flanges carries recession, these recessions being juxtaposed, and wherein the pawl has a pair of pivot spindles extending from opposite sides of the pawl, the pawl being snapably mountable into the hook-shaped flange recessions.

17. The latch assembly of claim 16, wherein said intercepting and holding means includes:

a solenoid supported within said housing and operating parallel to said longitudinal axis thereof; and a locking member extending from said solenoid parallel to said longitudinal axis of said housing and actuated by said solenoid, said locking member being movable to selectively intercept said pivotably movable pawl.

18. A latch assembly for engaging a keeper, comprising:

an elongate housing having walls and a longitudinal axis and sidewalls thereto and a hook-like shaped member, said hook-like shaped member being connected to one of said walls of said housing, and being bifurcated having a pair of spaced apart hook-shaped flanges;

a pair of lateral tabs, one each extending from each of the hook shaped flanges, on an outboard face thereof;

at least one pawl pivotally attached to said housing and pivotably movable between a first position and a second position, said pawl engaging said keeper in said second position; and means positioned within said housing and operating parallel to said longitudinal axis thereof for intercepting the pivotal movement of said pawl thereby prohibiting said pawl from pivoting;

wherein said pawl extends outwardly from said housing transversely to said longitudinal axis thereof and in adjacent proximity to said housing hook-like shaped member wherein said intercepting means includes a solenoid and a locking member; and a spring positioned to bais said locking member towards said pawl and away from said solenoid.

19. The latch of claim 18, also including a catch bar supported by said housing for translational and pivotal movement, said catch bar being movable between locked and unlocked positions; wherein said pawl is supported by said housing proximate said hook-like structure, said pawl being movable between a closed keeper engaging position and an open position, said pawl being biased toward said open position, and said pawl having a bottom lug; and also including a catch bar biasing means for biasing said catch bar toward engagement with said bottom lug; and a handle pivotally attached to said housing, said handle having an actuating arm which is engageble with said catch bar when said catch bar is in said unlocked position.

20. The latch of claim 18, wherein said housing has at least a pair of said hook-shaped members; and also including a catch beam supported by said housing for translational movement, said catch beam being movable between locked and unlocked positions; wherein said at least one pawl includes at least a pair of pawls pivotally supported by said housing wherein each of said pawls is proximate a corresponding hook-shaped structure, each of said pawls being movable between a closed keeper engaging position and an open position, each of said pawls being biased toward said open position, and each of said pawls having a bottom lug; a catch beam biasing means for biasing said catch beam toward engagement with said bottom lug; and wherein said solenoid includes a solenoid assembly being in communication with said catch beam and said catch beam biasing means wherein activation of said solenoid assembly causing linear translational movement of said catch beam from a locked position to an unlocked position.

21. The latch of claim 18, wherein said housing has at least one pair of said hook-shaped members; and wherein said at least one pawl including at least one pair of pawls pivotally supported by said housing wherein each of said pawls is positioned proximate a respective one of said hook-shaped structures, each of said at least one pair of pawls being movable between a closed keeper engaging position and an open position, each of said at least one pair of pawls being biased toward said open position; a catch beam supported by said housing for movement between locked and unlocked positions, said catch beam being engageable with said at least one pair of pawls to thereby essentially maintain each of said at least one pair of pawls in said closed position when said at least one pair of pawls are each in said closed position and said catch beam is in said locked position; and wherein said solenoid includes a solenoid assembly operating to move said catch beam to said unlocked position when said solenoid is energized.

* * * * *

UNITED STATES PATENT AND TRADEMARK OFFICE

CERTIFICATE OF CORRECTION

PATENT NO. : 7,004,517 B2 
APPLICATION NO. : 10/001479
DATED : February 28, 2006
INVENTOR(S) : Fabrice Vitry et al.

It is certified that error appears in the above-identified patent and that said Letters Patent is hereby corrected as shown below:

In the Drawings: (as shown in attached)
Sheet 115 of 149, Fig. 122, replace reference numeral "3202" with --3102-- and add arrow (see Fig. 119),
Sheet 137 of 149, Fig. 148, replace reference numeral "212" with --3212--.

Column 2, line 37, insert --a-- between "is" and "fragmentary";
Column 2, line 40, insert --a-- between "is" and "fragmentary";
Column 3, line 52, replace "FIGS." with --FIG.--;
Column 3, line 55, replace "FIGS." with --FIG.--;
Column 3, line 58, replace "FIGS." with --FIG.--;
Column 3, line 61, replace "FIGS." with --FIG.--;
Column 4, line 57, replace "catch bar" with --catch beam--;
Column 4, line 60, replace "catch bar" with --catch beam--;
Column 4, line 62 replace "catch bar" with --catch beam--;
Column 4, line 64, replace "catch bar" with --catch beam--;
Column 5, line 1, replace "catch bar" with --catch beam--;
Column 5, line 5, replace "catch bar" with --catch beam--;
Column 5, line 9, replace "catch bar" with --catch beam--;
Column 7, line 9, delete the redundant "showing the";
Column 8, line 67, insert --present-- before "invention";
Column 9, line 2, insert --present-- before "invention";
Column 9, line 4, insert --present-- before "invention";
Column 9, line 6, insert --present-- before "invention";
Column 9, line 8, insert --present-- before "invention";
Column 9, line 10, insert --present-- before "invention";
Column 12, line 31, replace "1110" with --110--;
Column 13, line 39, delete "is" between "104" and "has";
Column 16, line 9, insert a period --.-- after "closed" and replace "the" with --The--;
Column 17, line 59, insert a period --.-- after "53" and replace "the" with --The--;
Column 18, line 65, replace "300." with --2300.--;
Column 18, line 66, replace "side wall" with --sidewall--;
Column 18, line 67, replace "206" with --2206--;
Column 19, line 1, replace "side wall" with --sidewall--;
Column 19, line 37, replace "side wall" with --sidewall--;
Column 19, line 38, replace "side wall" with --sidewall--;
Column 19, line 40, replace "rearwall" with --rear wall--;
Column 19, line 45, replace "side walls" with --sidewalls--;
Column 19, line 55, replace "side wall" with --sidewall--;
Column 19, line 57, replace "side wall" with --sidewall--;
Column 19, line 64, replace "side wall" with --sidewall--;
Column 23, line 41, replace "33204" with --3204--;

UNITED STATES PATENT AND TRADEMARK OFFICE

CERTIFICATE OF CORRECTION

PATENT NO. : 7,004,517 B2
APPLICATION NO. : 10/001479
DATED : February 28, 2006
INVENTOR(S) : Fabrice Vitry et al.

It is certified that error appears in the above-identified patent and that said Letters Patent is hereby corrected as shown below:

In the Claims:
In column 27, line 36, replace “looking” with --locking--.
In column 27, line 40, replace “Thereof” with --thereof--.
In column 27, line 47, replace “though” with --through--.
In column 28, line 41, replace “though” with --through--.
In column 29, line 21, replace “catch bar” with --catch beam--.
In column 29, line 29, replace “catch bar” with --catch beam--.
In column 29, lines 29-30, replace “catch bar” with --catch beam--.
In column 29, line 32, replace “catch bar” with --catch beam--.
In column 29, line 33, replace “catch bar” with --catch beam--.
In column 30, line 29, replace “including” with --includes--.

Signed and Sealed this

Sixteenth Day of January, 2007

JON W. DUDAS
*Director of the United States Patent and Trademark Office*